US012158291B1

(12) United States Patent
Slaughter-Zrostlik et al.

(10) Patent No.: US 12,158,291 B1
(45) Date of Patent: Dec. 3, 2024

(54) LOW-FORCE COMPRESSIVE AND TENSILE ACTUATION FOR ELASTOCALORIC HEAT PUMPS

(71) Applicant: Iowa State University Research Foundation, Inc., Ames, IA (US)

(72) Inventors: Julie Slaughter-Zrostlik, Ames, IA (US); Vitalij K. Pecharsky, Ames, IA (US); Lucas Griffith, Ames, IA (US); Agata Czernuszewicz, Ames, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 495 days.

(21) Appl. No.: 16/949,744

(22) Filed: Nov. 12, 2020

Related U.S. Application Data

(60) Provisional application No. 62/934,363, filed on Nov. 12, 2019.

(51) Int. Cl.
*F25B 21/00* (2006.01)

(52) U.S. Cl.
CPC ..... *F25B 21/00* (2013.01)

(58) Field of Classification Search
CPC ..... F25B 21/00
See application file for complete search history.

(56) References Cited

U.S. PATENT DOCUMENTS 9,612,040 B2 * 4/2017 Casset ..... F03G 7/06
2009/0281768 A1 * 11/2009 Fitzgerald ..... G06F 30/23 702/42

(Continued)

FOREIGN PATENT DOCUMENTS

DE 102018202953 A1 * 8/2019 ..... B32B 15/01
KR 20150032776 A * 9/2014 ..... F25B 21/00
WO WO-2013079596 A1 * 6/2013 ..... B81B 3/0024

OTHER PUBLICATIONS

Bruederlin et al., "SMA foil-based elastocaloric cooling: from material behavior to device engineering", J. Phys. D: Appl. Phys., vol. 50, 11 pages, Sep. 22, 2017.

(Continued)

*Primary Examiner* — Ana M Vazquez
(74) *Attorney, Agent, or Firm* — McKee, Voorhees & Sease, PLC

(57) ABSTRACT

The elastocaloric effect underpins a promising solid-state heat pumping technology that, when adopted for commercial and residential applications, can revolutionize the cooling and heating industry due to low environmental impact and substantial energy savings. Known operational demonstration devices based on the elastocaloric effect suffer from low endurance of materials and, in most experimental systems, from large footprints due to bulky actuators required to provide sufficient forces and displacements. We demonstrate a new approach which has the potential to enable a more effective exploitation of the elastocaloric effect by reducing the forces required for actuation. Thin strips of NiTi were incorporated into composite structures with base polymer, such that bending the structures results in either exclusively compression or exclusively tension applied to the elastocaloric strips. The structures allow compression of thin elastocaloric strips without buckling, realize more than 50% reduction in required forces for a given strain compared with axial loading, and open up a wide range of possibilities for compact, efficient elastocaloric devices.

26 Claims, 92 Drawing Sheets
(64 of 92 Drawing Sheet(s) Filed in Color)

(INVENTION – BENDING BEAM CANTILEVER TENSON AND COMPRESSION MODE)

(56) References Cited

U.S. PATENT DOCUMENTS

| | | | | |
|---|---|---|---|---|
| 2015/0082809 | A1* | 3/2015 | Schwartz | F25B 21/00 62/3.1 |
| 2016/0084544 | A1 | 3/2016 | Radermacher et al. | |

OTHER PUBLICATIONS

Cui et al., "Demonstration of high efficiency elastocaloric cooling with large ΔT using NiTi wires", Applied Physics Letters, vol. 101, 4 pages, 2012.
Czernuszewicz et al., "Low-force compressive and tensile actuation for elastocaloric heat pumps", Applied Materials Today, vol. 19, 8 pages, Jan. 4, 2020.
Jou et al., "Fatigue-resistant high-performance elastocaloric materials made by additive manufacturing", Science, vol. 366, pp. 1116-1121, Nov. 29, 2019.
Kaneko et al., "Development of Reciprocating Heat Engine Using Shape Memory Alloy", Journal of Environment and Engineering, vol. 6, No. 1, pp. 131-139, 2011.
Kumar et al., "Vibration induced refrigeration using ferroelectric materials", Scientific Reports, vol. 9, 9 pages, 2019.
Kumar et al., "Vibration induced refrigeration and energy harvesting using piezoelectric materials: a finite element study", RSC Adv., vol. 9, pp. 3918-3926, Jan. 3, 2019.
Manosa et al., "The Use of Shape-Memory Alloys for Mechanical Refrigeration", Functional Materials Letters, vol. 2, No. 2, pp. 73-78, Feb. 2, 2009.
Ossmer et al., "Elastocaloric cooling using shape memory alloy films", Journal of Physics: Conference Series 476, 5 pages, 2013.
Ossmer et al., "Evolution of temperature profiles in TiNi films for elastocaloric cooling", Acta Materialia, vol. 81, pp. 9-20, Aug. 2, 2014.
Ossmer et al., "Elastocaloric Heat Pumping Using a Shape Memory Alloy Foil Device", Transducers, pp. 726-729, 2015.
Ossmer et al., "Energy-efficient miniature-scale heat pumping based on shape memory alloys", Smart Mater. Struct., vol. 25, 13 pages, Jul. 19, 2016.
Qian et al., "Study on high efficient heat recovery cycle for solid-state cooling", International Journal of Refrigeration, vol. 55, pp. 102-119, Mar. 22, 2015.
Qian et al., "Performance enhancement of a compressive thermoelastic cooling system using multi-objective optimization and novel designs", International Journal of Refrigeration, vol. 57, pp. 62-76, Apr. 13, 2015.
Qian et al., "Design of a hydraulically driven compressive elastocaloric cooling system", Science and Technology for the Built Environment, vol. 22, pp. 500-506, 2016.
Qian et al., "A review of elastocaloric cooling: Materials, cycles and system integrations", International Journal of Refrigeration, vol. 64, pp. 1-19, 2016.
Sharar et al., "First Demonstration of a Bending-Mode Elastocaloric Cooling 'Loop", 17th IEEE Itherm Conference, 9 pages, 2018.
Slaughter et al., "Compact and efficient elastocaloric heat pumps—Is there a path forward?", Journal of Applied Physics, vol. 127, 8 pages, Apr. 16, 2020.

* cited by examiner

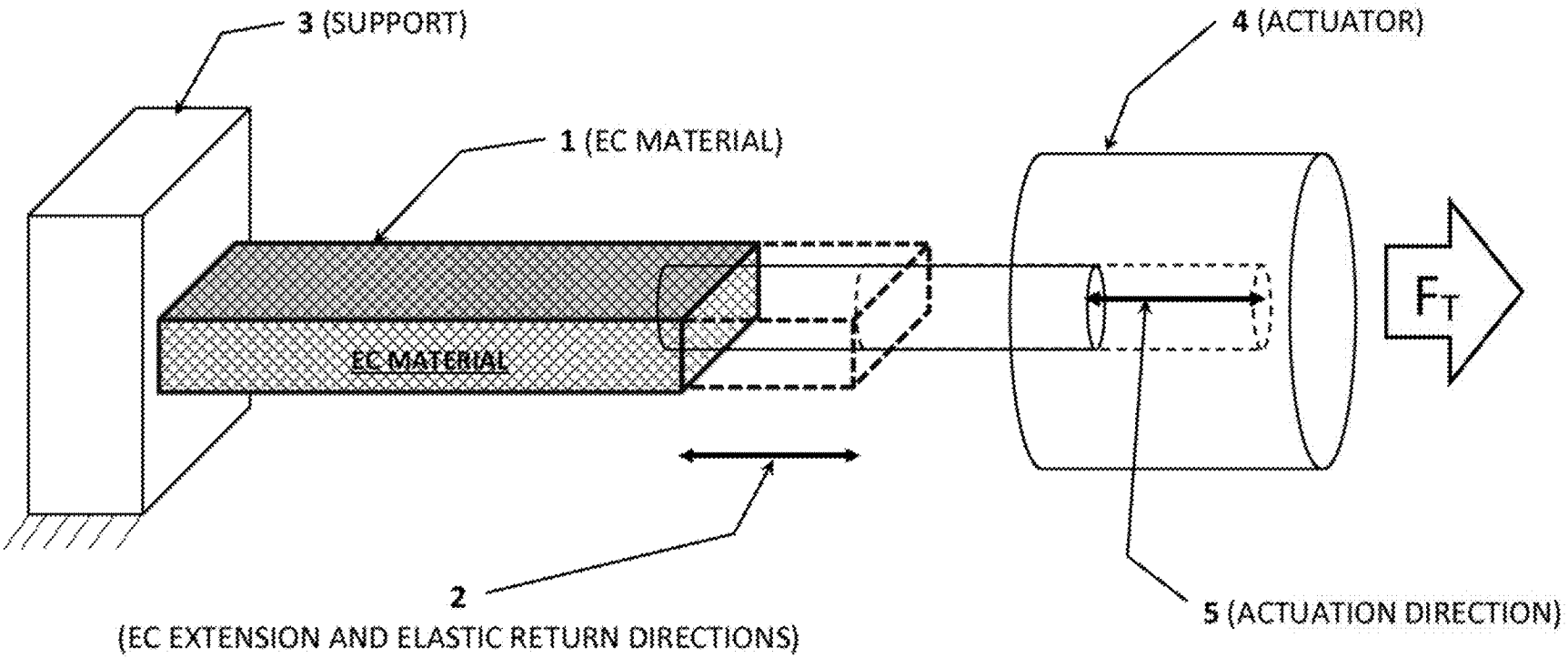
FIG. 1 (PRIOR ART – DIRECT TENSION)

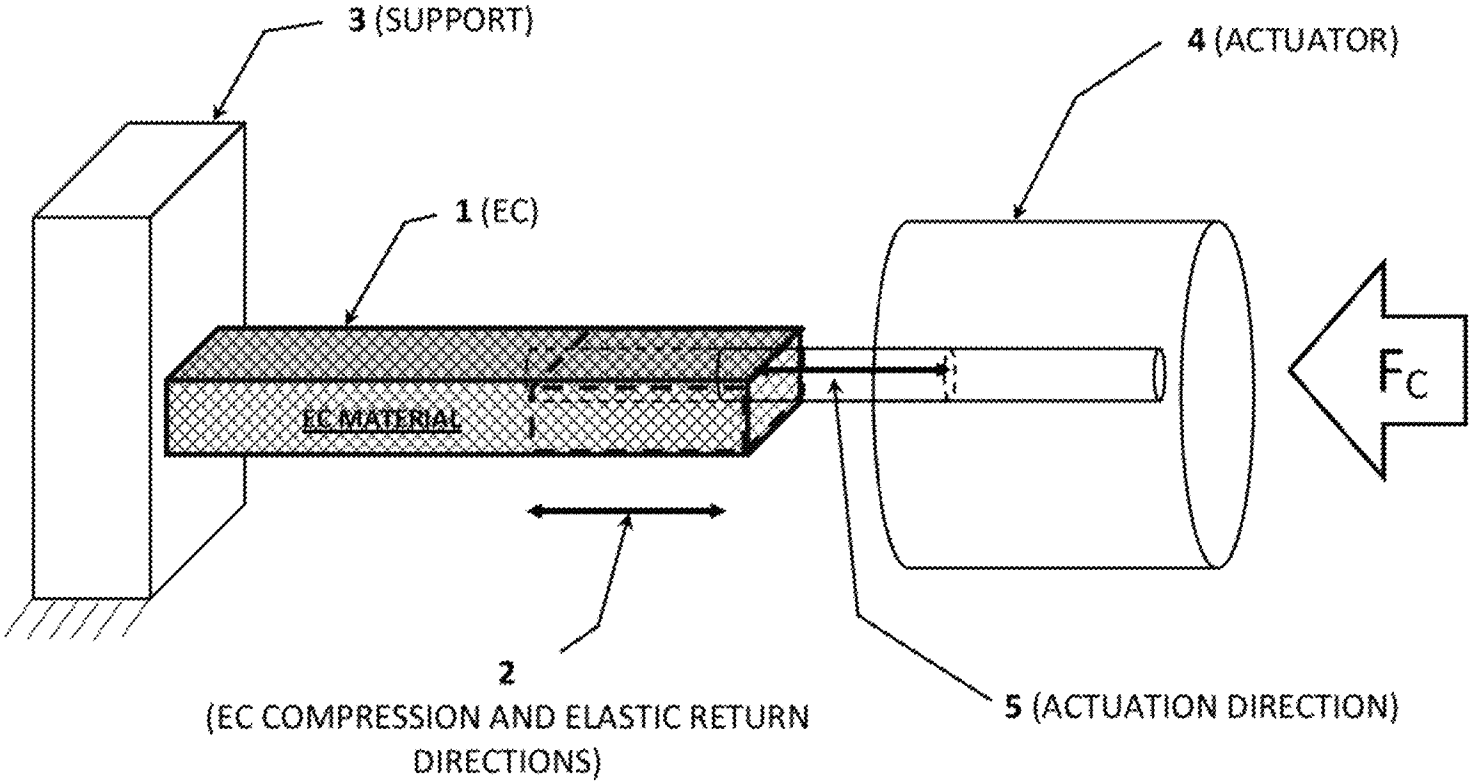
FIG. 2 (PRIOR ART – DIRECT COMPRESSION)

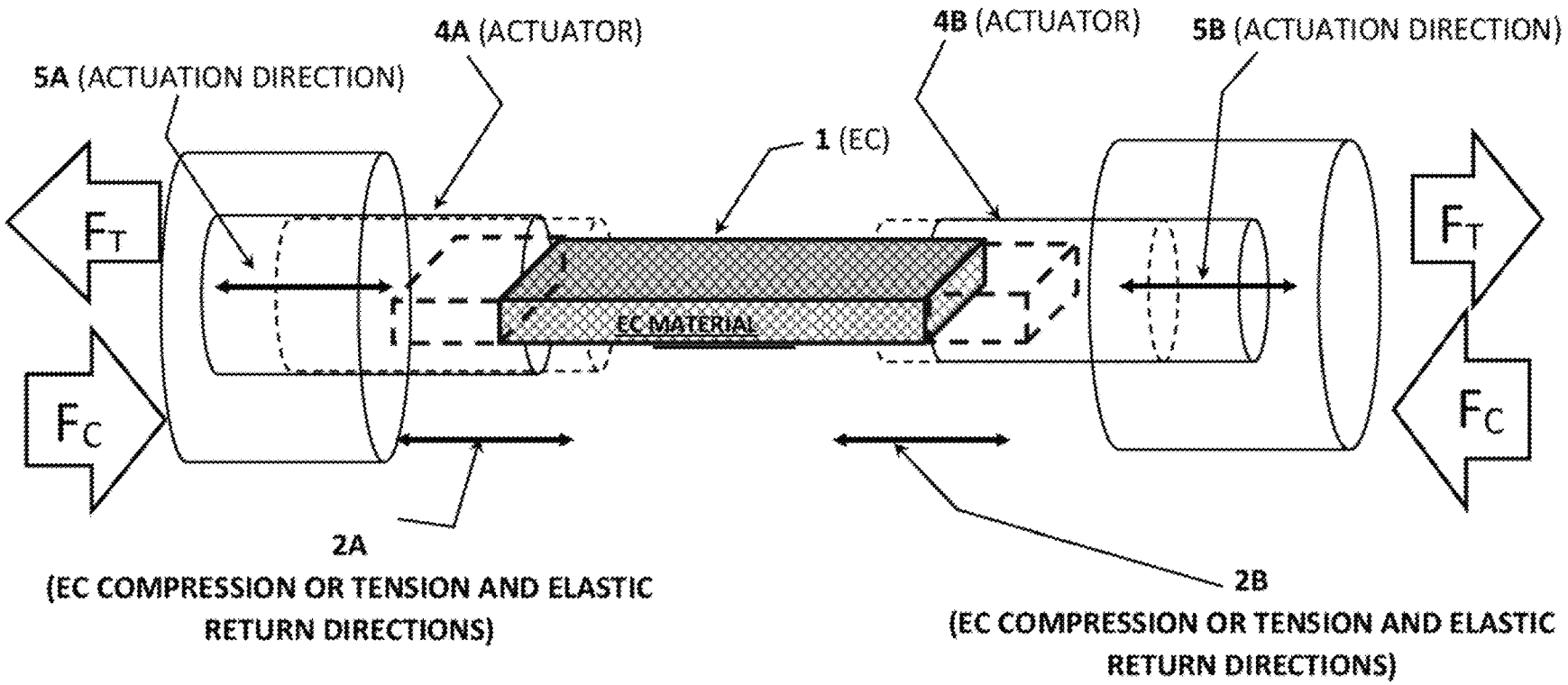
FIG. 3 (PRIOR ART – DIRECT TENSION AND COMPRESSION)

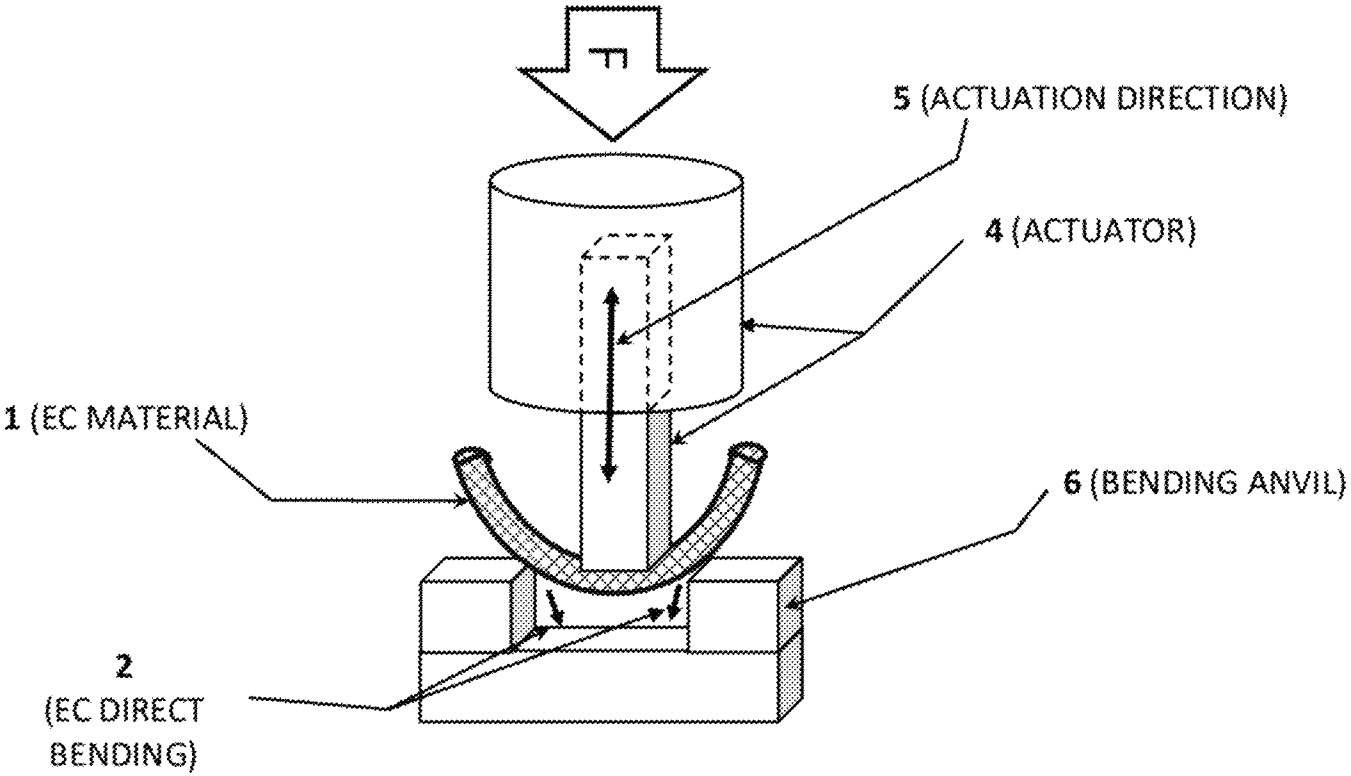
FIG. 4A (PRIOR ART – DIRECT BEND)

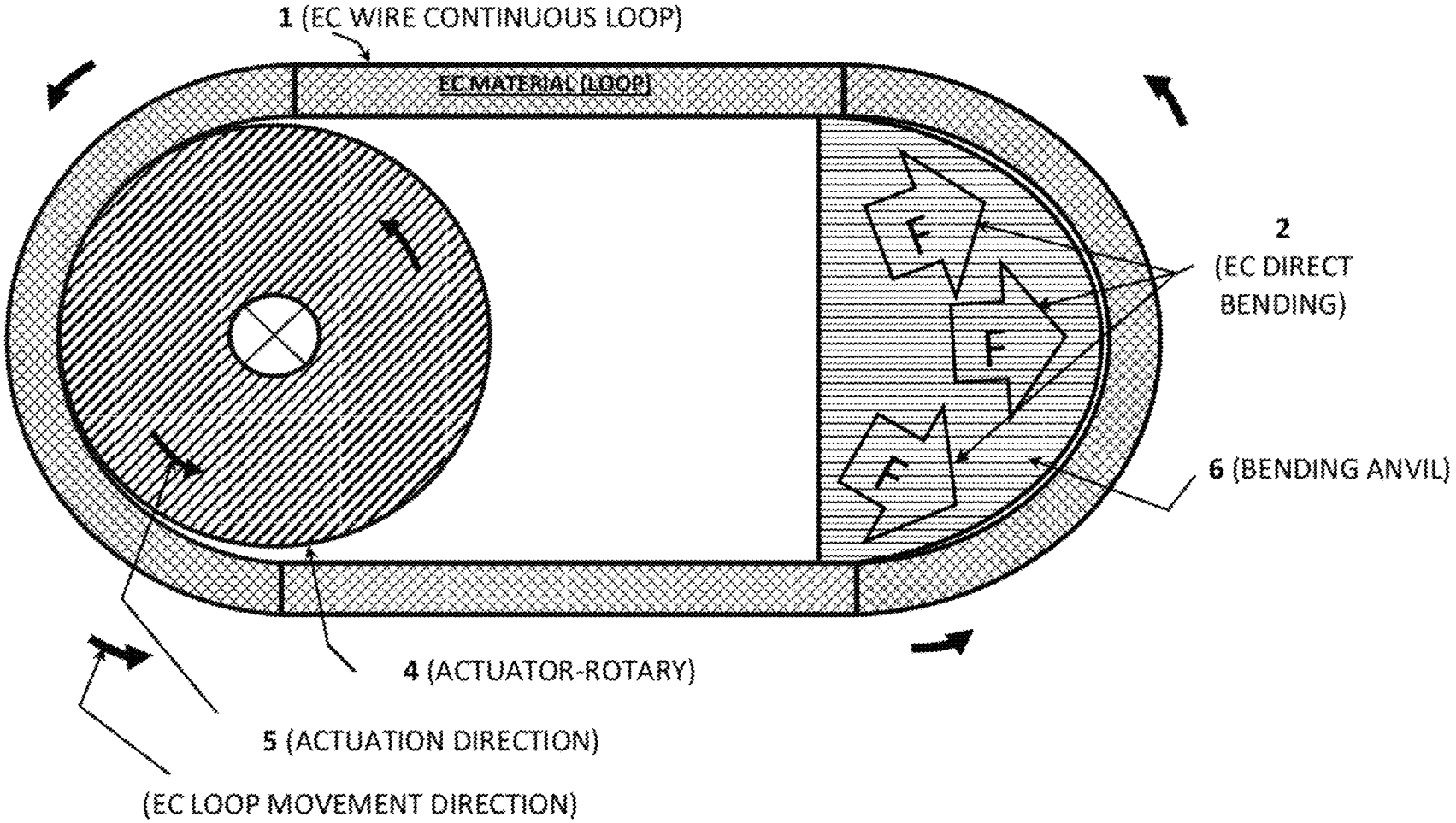
FIG. 4B (PRIOR ART – DIRECT BEND)

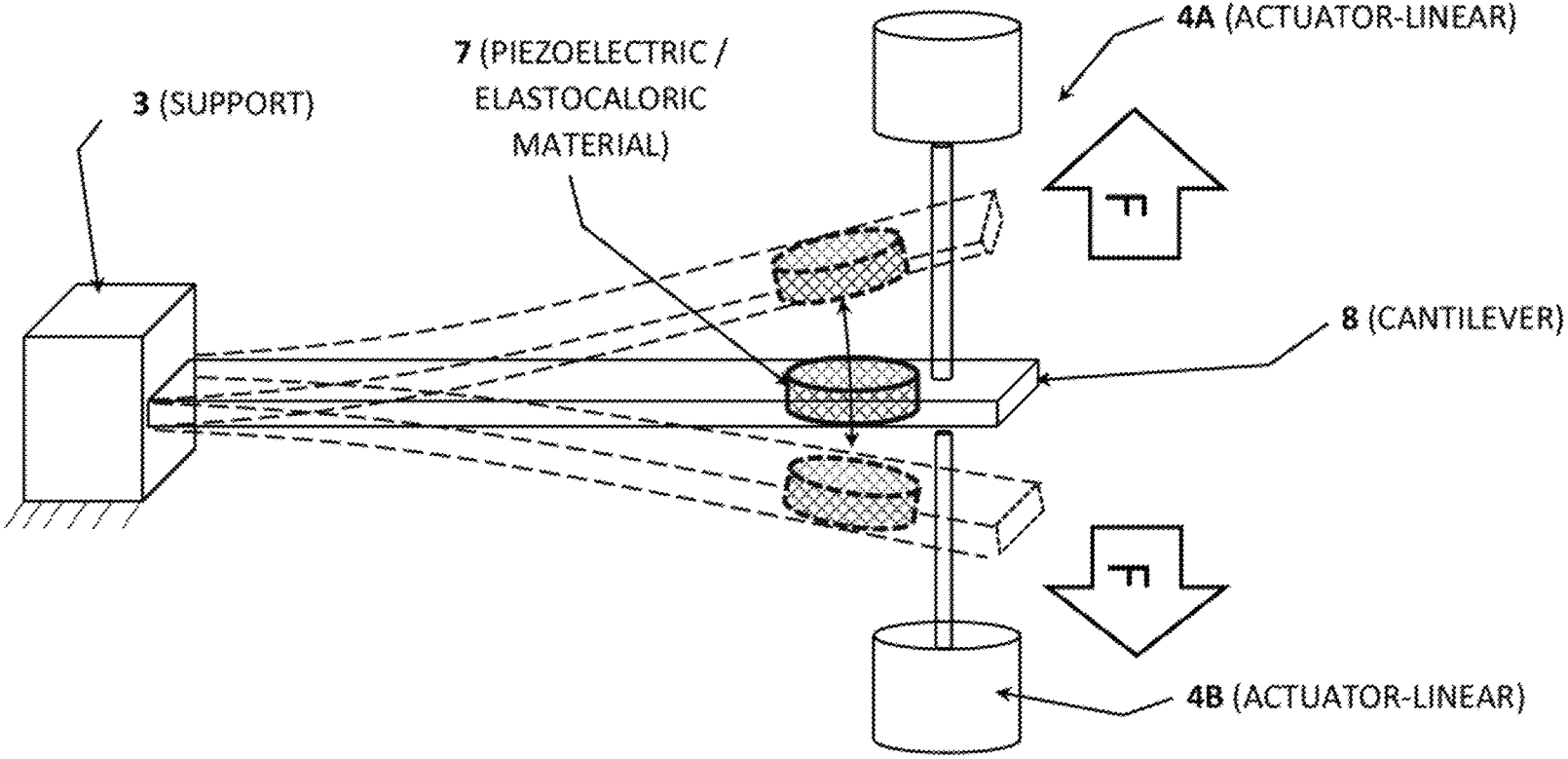
FIG. 5 (PRIOR ART – PIEZOELECTRIC STRESS/STRAIN WITH CANTILEVER)

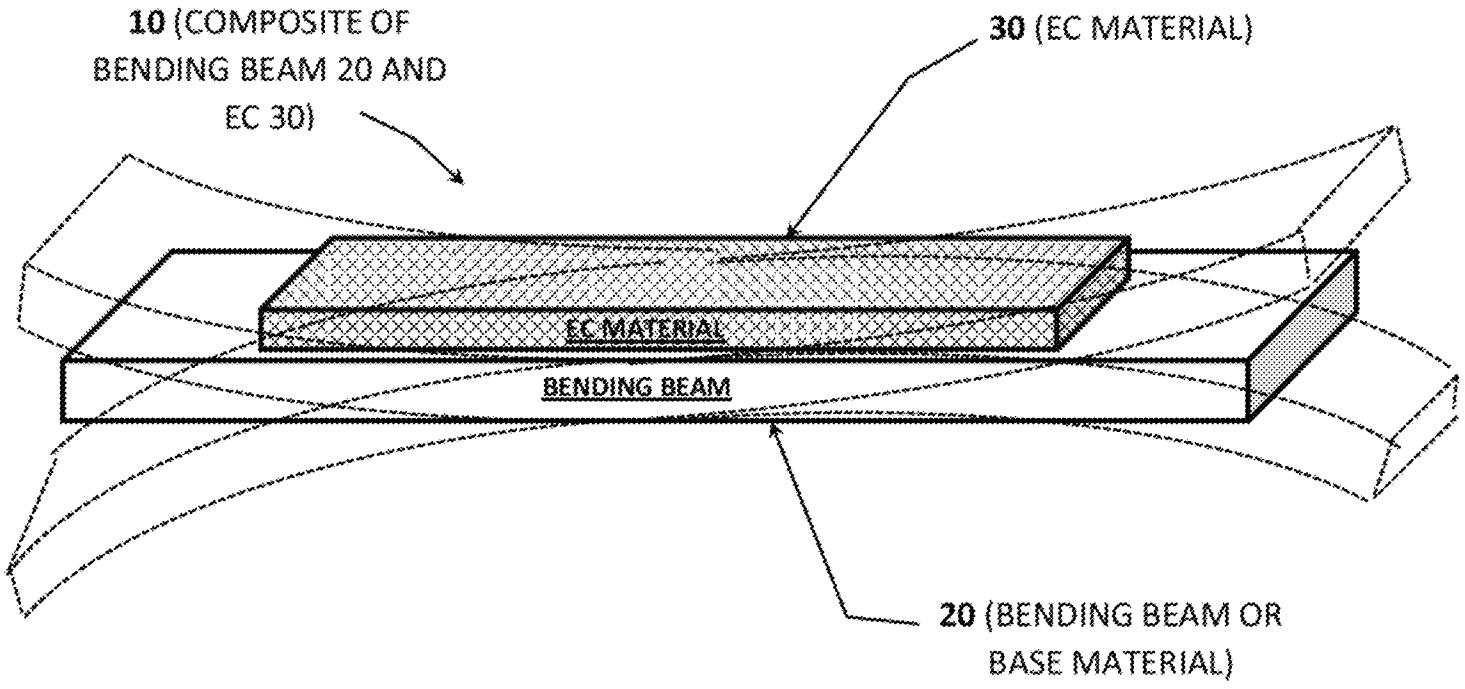
FIG. 6A (INVENTION – COMBINATION OF BENDING BEAM BASE AND EC MATERIAL)

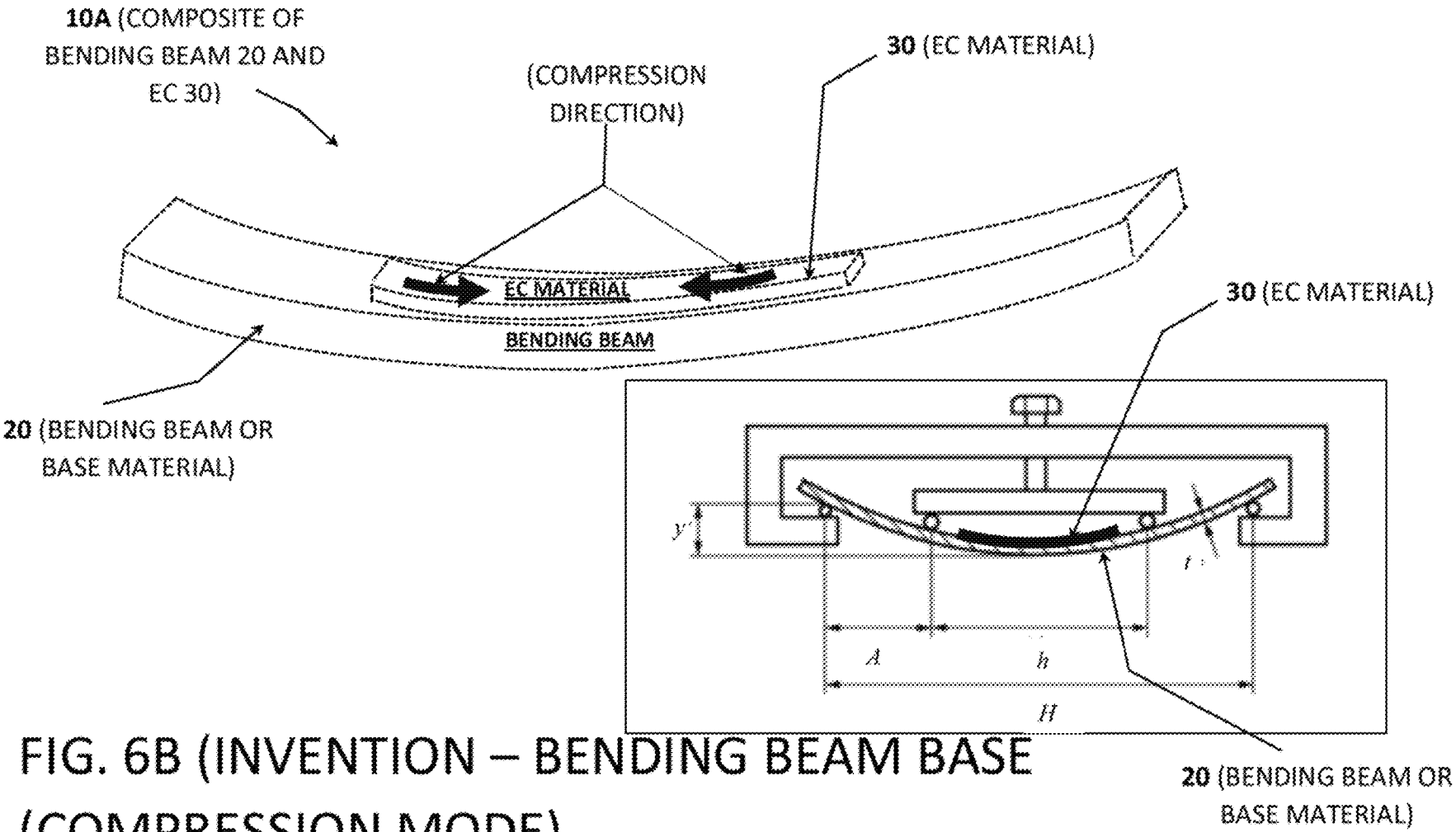
FIG. 6B (INVENTION – BENDING BEAM (COMPRESSION MODE)

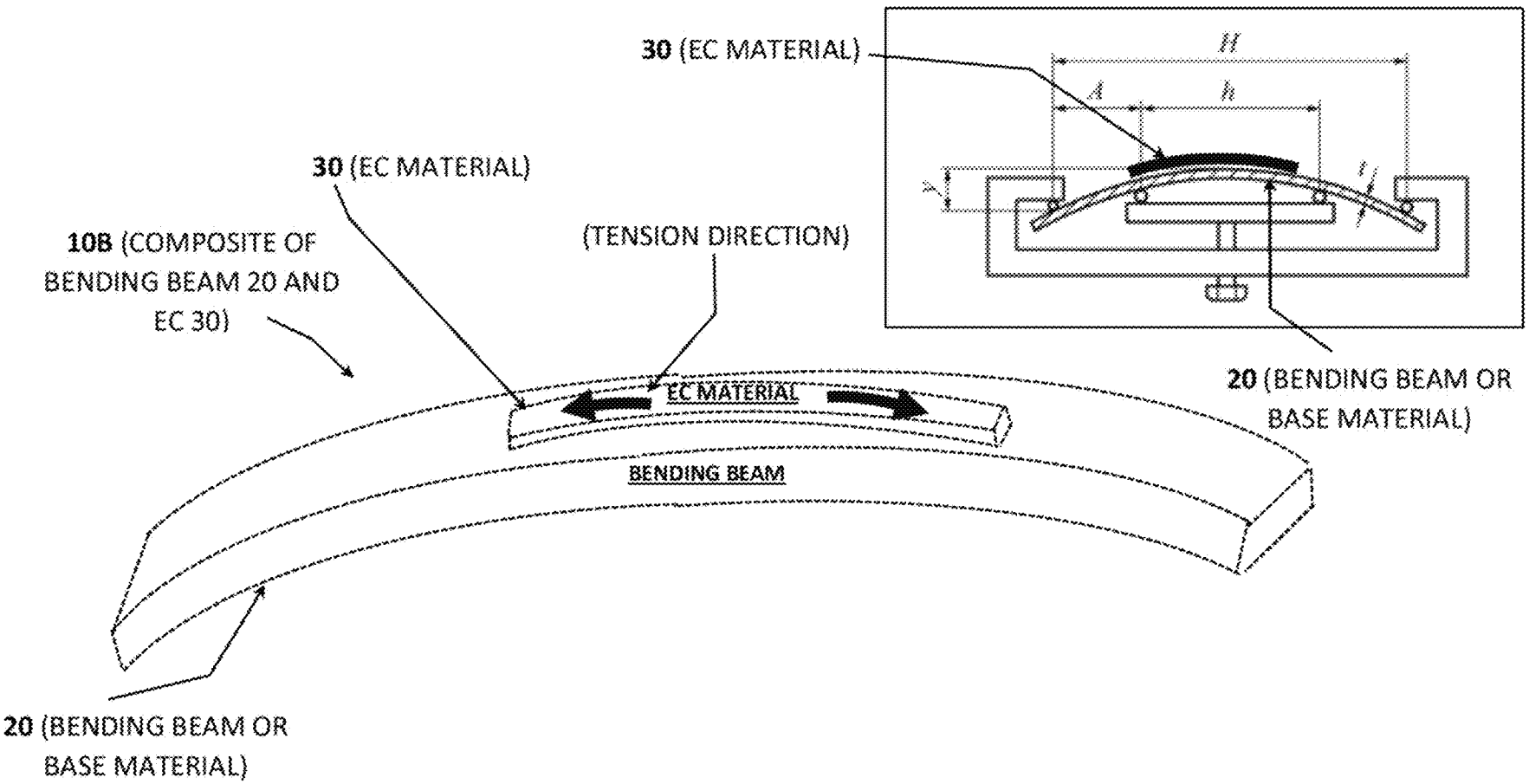
FIG. 6C (INVENTION – BENDING BEAM BASE—TENSION MODE)

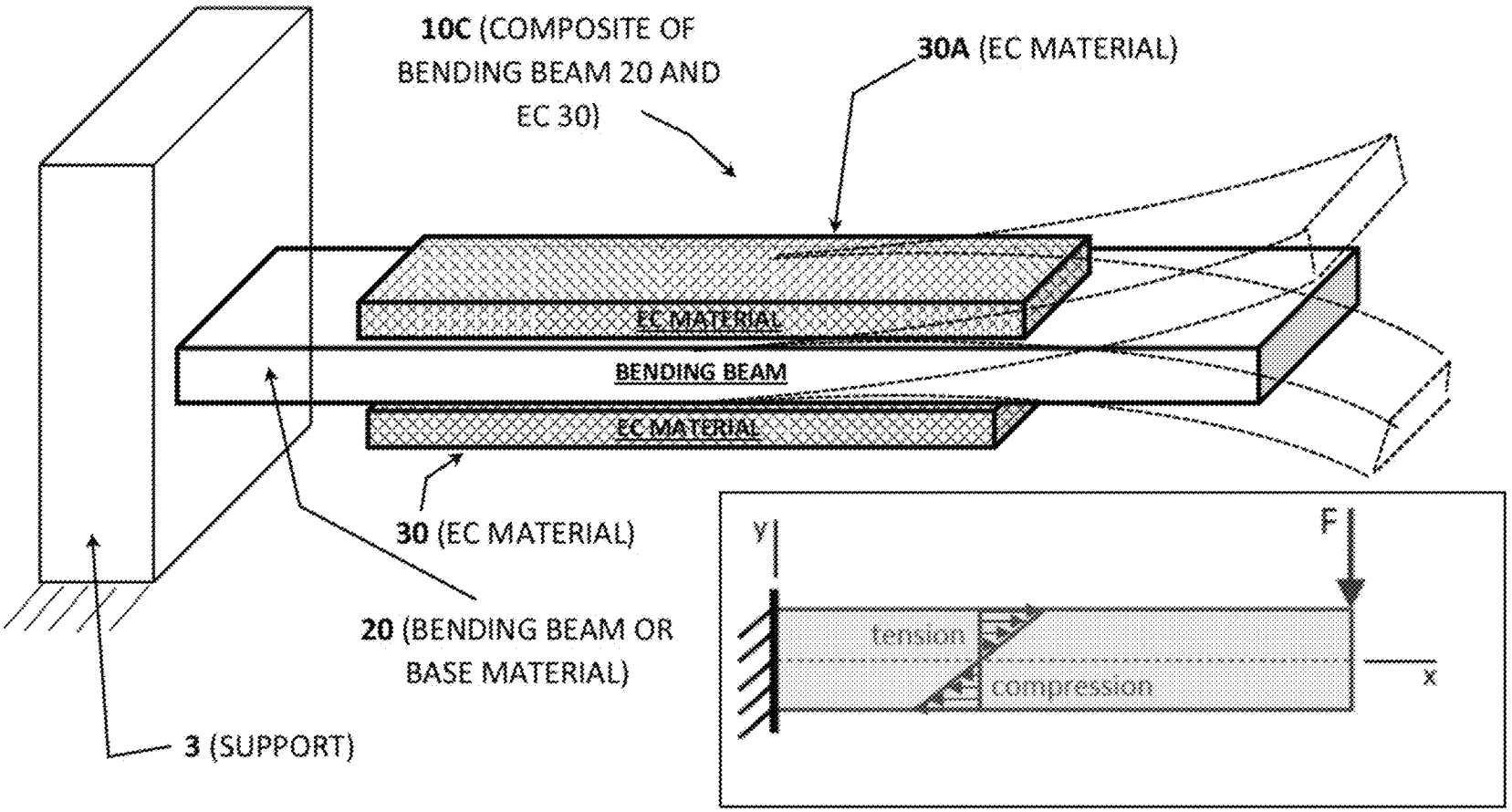
FIG. 6D (INVENTION – BENDING BEAM CANTILEVER TENSON AND COMPRESSION MODE)

DIMENSIONS (IN MM) ARE EXEMPLARY ONLY

DIMENSIONS (IN MM) ARE EXEMPLARY ONLY

Location of green plot indicated by green line and location of blue plot indicated by line in FIGURE 33A (same axes values as in FIGURE 32C)

FIGURE 45A
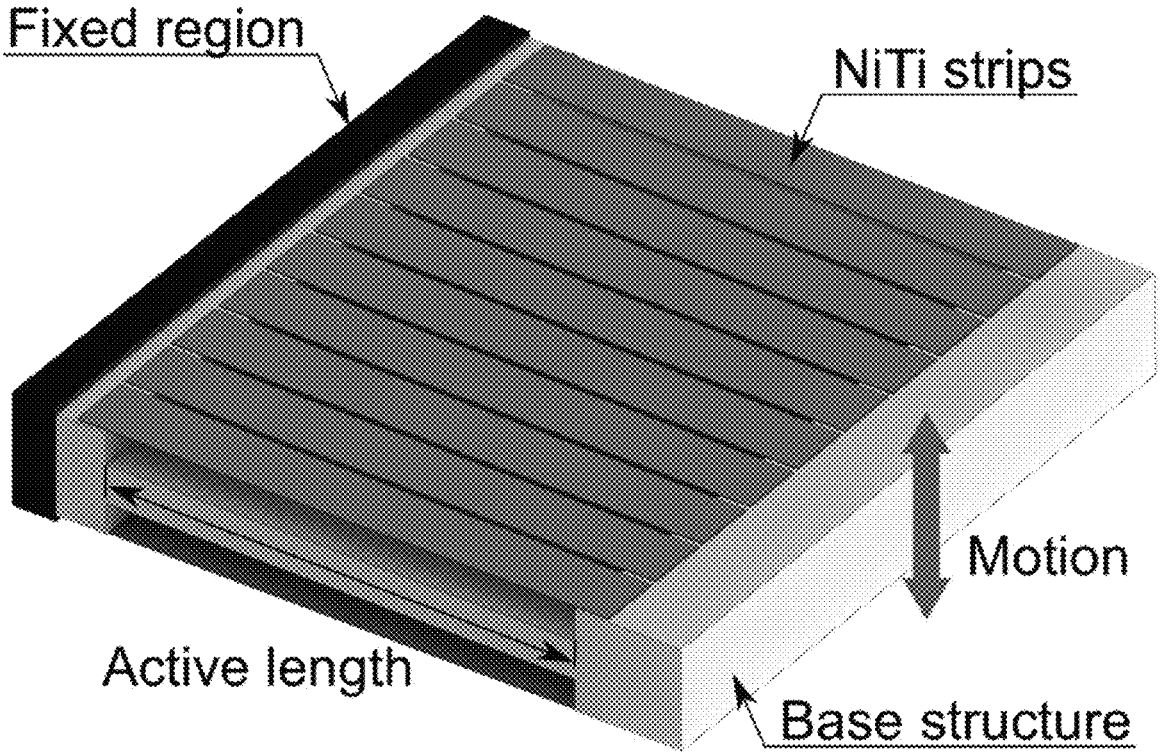
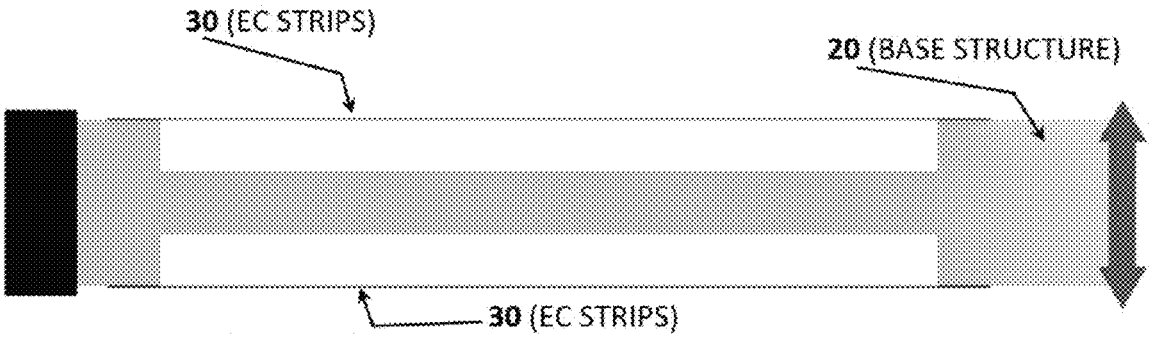
FIGURE 45B

TABLE I. Representative list of elastocaloric materials for near room temperature heat pumping and key properties.

| Material | Stress (MPa) | Strain (%) | Strain Energy Density required ($MJ/m^3$) | Adiabatic temperature change (K) | Reference |
|---|---|---|---|---|---|
| Ni–Ti (tension) | 570 | 6 | 17.1 | 23 | 14 |
| Ni–Ti (compression) | 750 | 6 | 6.6 | 10 | 18 |
| Ni–Ti with pre-strain (tension) | 190 | 1.5–2.5 | 0.95 | 5 | 15 |
| Ni–Ti with pre-strain (tension) | 185 | 1.5–2.5 | 0.93 | Not measured | This work |
| Ni–Ti–Cu | 350 | 1.7 | 3 | 6.2 | 19 |
| Ni–Ti–Mn–B | 700 | 7 | 24.5 | 31.5 | 20 |
| Ni–Mn–In | 300 | 1.4 | 2.1 | 4 | 21 |
| Ni–Mn–In–Co | 150 | 5 | 3.8 | 4 | 22 |
| Ni–Mn–Sb–Co | 100 | 2.3 | 1.2 | – | 23 |
| Ni–Mn–Sn–Cu | 280 | 2.6 | 3.6 | 8 | 24 |
| Ni–Fe–Ga | 130 | 3.5 | 2.3 | 7 | 25 |
| Ni–Fe–Ga–Co | 300 | 13 | 19.5 | 10 | 26 |
| Ni–Co–Al | 170 | 7 | 6 | 3.1 | 25 |
| Ni–Co–Ga | 140 | 5 | 3.5 | 4.5 | 27 |
| Cu–Al–Mn | 450 | 3.5 | 7.9 | 3.8 | 28 |
| Cu–Al–Zn | 250 | 3.8 | 4.8 | 6 | 29 |
| Fe–Pd | 100 | 3.7 | 1.85 | 3 | 30 |
| Ba–Ti–O | 6500 | 3 | 97.5 | 5.5 | 31 |
| Ba–Ca–Zr–Ti–O | 200 | 0.3 | 0.3 | 1.4 | 32 |
| PMN–32PT | 28 | 0.2 | 0.03 | 0.6 | 33 |
| Natural rubber | 1.6 | 6 | 0.05 | 9 | 34 |

FIGURE 49A

TABLE II. Actuator technologies and relevant characteristics

| Actuation technology | Stress capability (MPa) | Strain capability (%) | Average energy density ($MJ/m^3$) | Typ. Freq (Hz) | Typ. power density ($MW/m^3$) | Efficiency (%) | Reference |
|---|---|---|---|---|---|---|---|
| Piezoelectric[a] | 10–30 | 0.01–0.02 | 0.000 75 | 10 000 | 7.5 | >90 | 13 and 36 |
| Magnetostrictive[a] | 50–100 | 0.06–0.15 | 0.020 | 1000 | 19.7 | 80–90 | 13 and 36 |
| SMA[a] | 100–700 | 1.0–7.0 | 4.0 | 1 | 4.0 | <10 | 13 |
| Magnetic SMA[a] | 2–30 | 1.0–5.0 | 0.12 | 10 | 1.2 | 80–90[b] | 36 |
| Solenoid | 0.004–0.10 | 10.0–40.0 | 0.000 44 | 10 | 0.004 | 50–80 | 13 |
| Moving coil | 0.04–0.1 | 1.0–10.0 | 0.000 96 | 100 | 0.10 | 50–80 | 13 |
| Linear motor | 0.035 | 50 | 0.0044 | 1 | 0.004 | >85[c] | 37 |
| Rotary motor[d] | — | — | — | 1 000 | 1.0 | >85 | 38 and 39 |
| Pneumatic | 0.69 | 50 | 0.086 | 10 | 0.86 | 15 | 13 |
| Hydraulic | 20.8 | 70 | 3.64 | 10 | 36.4 | 50 | 13 |

[a]Based only on active material {Eq. (1)}.
[b]Assume efficiency is similar to magnetostrictives.
[c]Assume efficiency is similar to rotary motors.
[d]With rotary to linear conversion.

FIGURE 49B

TABLE III. Dimensions used in calculating the ratio of actuator volume to active material volume for different designs.

| | Motor diameter (mm) | Motor + gearbox × length (mm) | Motor volume ($mm^3$) | Active material volume ($mm^3$) | Motor volume to active material |
|---|---|---|---|---|---|
| Case 1 | 22 | 123.9 | 47 098 | 3 000 | 15.7:1 |
| Case 2 | 22 | 76.9 | 29 232 | 3 000 | 9.7:1 |
| Qian *et al.*[11,a] | — | — | 5 621 528 | 124 899 | 45:1[b] |
| Hou *et al.*[46,b] | 6 | 115 | 3 252 | 4 | 812.9:1 |

[a]System includes energy recovery and pre-strain.
[b]Numbers are based only on active material (Terfenol-D).

FIGURE 49C

Table S1. Material properties used for Case 1 finite element analysis.

| | Modulus (GPa) | Density (kg/m$^3$) | Poisson's ratio |
|---|---|---|---|
| PEEK* | 3.6 | 1320 | 0.4 |
| NiTi | 32.5 | 6900 | 0.3 |

*PEEK = Polyether Ether Ketone

FIGURE 50A

Finite element models, Case 2

Comsol Multiphysics, Structural Mechanics, static model, 2D plane strain model, included an initial strain of 2% in the NiTi plates. The modulus for Case 2 is lower than Case 1 because the NiTi material is operating in its superelastic region as shown in Fig. 3 of the main text.

Table S2. Material properties used for Case 1 finite element analysis.

| | Modulus (GPa) | Density (kg/m$^3$) | Poisson's ratio |
|---|---|---|---|
| PEEK | 3.6 | 1320 | 0.4 |
| NiTi | 19.1 | 6900 | 0.3 |

FIGURE 50B

Table S3. Results from FEA of both cases providing the needed peak-to-peak input force and displacement to achieve a given peak-to-peak stress.

| | Force (N) | Displacement (mm) | Stress (MPa) |
|---|---|---|---|
| Case 1 | 2423 | 13 | 325 |
| Case 2 | 584 | 14 | 185 |

FIGURE 50C

LOW-FORCE COMPRESSIVE AND TENSILE ACTUATION FOR ELASTOCALORIC HEAT PUMPS

CROSS-REFERENCE TO RELATED APPLICATIONS

This application claims the benefit of Provisional Application U. S. Ser. No. 62/934,363 filed on Nov. 12, 2019, all of which is herein incorporated by reference in its entirety.

GOVERNMENT RIGHTS CLAUSE

Embodiments of the present disclosure were made with U.S. Government support under Department of Energy Contract No. Contract No. DE-AC02-07CH11358. The Government has certain rights in the invention.

I. BACKGROUND OF THE INVENTION

A. Field of the Invention

The present invention relates to elastocaloric materials and, in particular, to apparatus, devices, uses, systems, and methods of generating, controlling, and using elastocaloric effect from elastocaloric materials. In various embodiments, the elastocaloric effect can be harvested and used in a heat pump.

B. Problems in the Art

Elastocaloric materials are solids that exhibit stress-induced reversible phase transformations during which latent heat is released or absorbed. When stress is applied or removed, a phase transformation is induced. The material heats up or cools down because of entropy difference between the two co-existing phases.

Elastocaloric materials have been investigated for heat pump purposes. However, there are a number of competing, and sometimes antagonistic factors, that create challenges. For example, the elastocaloric effect from the material tends to increase with increase in imposed stresses in the material, but this requires high forces and bulky actuators. Stress can also degrade the material. Another example relates to form factor. Robustness of elastocaloric materials that are stretched or compressed improves with cross-sectional area, yet increasing volume to surface ratio decreases the heat transfer rate. This can be counter-productive to use in heat pumps. Furthermore, it can be advantageous to be able to induce elastocaloric effect either by stretching or compressing, and typical set-ups employ either tension or compression. Most do so axially, which risks failures in tension or buckling in compression of elastocaloric material. As further discussed below, these competing factors make any design choice unpredictable. A solution that solves one concern may make the solution impractical because of another.

Vapor-compression technology consumes ca 6 EJ of the 37 EJ of primary energy used annually in the United States, to dehumidify, cool and heat space, and chill water [1]. Citations in square brackets refer to the References cited at the end of Section IV.C. Fractions of energy consumed for similar uses in the developed countries are comparable to the U.S., and they are rapidly growing in the developing world. Caloric heat pumping promises to become an energy efficient and environmentally benign alternative to vapor-compression methods in common use today. In addition to potential energy savings as high as 25 to 30% [2], a transition to caloric heat pumping technologies also replaces the potent greenhouse gases currently used as refrigerants with zero global-warming-potential caloric solids. The most mature caloric technology is based on the magnetocaloric effect [3], which is a reversible thermal response of a solid magnetic material subjected to adiabatic changes of an external magnetic field. Laboratory-scale refrigeration devices based on the magnetocaloric effect already demonstrate temperature spans and cooling powers sufficient for some applications [2,4-6], however, the high cost of generating magnetic field changes on the order of 1.1-1.5 T impedes the introduction of the technology to the market. Another phenomenon that attracts increasing attention because of its potential for high energy conversion efficiency, is the elastocaloric effect, where reversible adiabatic temperature changes in certain superelastic materials can be generated by stress. The key advantages of elastocaloric cooling over magnetocaloric are that stress-generating components may, in principle, be realized at low cost, and the maximum achievable stresses are much less limited than the maximum magnetic fields available from either permanent or superconducting magnets.

Several laboratory-scale demonstration cooling systems employing the elastocaloric effect have been reported in the literature, demonstrating coefficients of performance as high as 7 [7], which is in line with the material-based coefficient of performance reaching 11.8 (83.7% of Carnot) theoretically predicted for NiTi (Nitinol) [8]. Most of the known systems are bulky because hydraulic load frames are used to generate the high force/displacement required to maximize adiabatic temperature changes [7,9,10]. Moreover, the working elastocaloric material (NiTi), is mainly actuated by tensile stress which, though easy to apply, greatly reduces life-span of materials due to fatigue [11,12]. More recently, methods of harnessing the elastocaloric effect potentially applicable to variable-scale cooling systems have been reported. One such approach uses a magnetostrictive material where stress is generated by a low magnetic field (0.16 T), to cyclically compress a $2\times1\times2$ $mm^3$ $Cu_{72}Al_{17}Mn_{11}$ sample [13]. Though more elegant than a hydraulic load frame, the high cost of advanced magnetostrictive materials and unfavorable length ratios of the magnetostrictive and elastocaloric components (proportional to strain, on the order of $10^{-2}$, required to actuate the latter, but inversely proportional to magnetostriction, on the order of $10^{-3}$, of the former) are major weaknesses of this strategy.

Many state-of-the-art approaches apply loading forces directly to the elastocaloric material(s). Examples are illustrated diagrammatically in FIGS. 1, 2, and 3. A linear actuator can apply linear motion 5 with force F to directly tension (FIG. 1) or directly compress (FIG. 2) elastocaloric ("EC") material by holding at least one of its ends 1 (here a strip or elongated piece) at fixed support 3. Other CE form factors could be a tube or set of tubes, a block, or stacks of pieces. See, e.g., Published Patent Application US 2016/00844544A1 to University of Maryland (2016), incorporated by reference herein. The direction of mechanical loading, and elastic return, is diagrammatically illustrated at 2. FIG. 3 illustrates both tensioning and compressing (see 2A and 2B, here with actuation directions 5A and 5B by actuators 4A and 4B). As noted herein, direct tension or compression presents challenges.

Another method of inducing the elastocaloric effect is bending the material [14-17]. Sharar et al. demonstrate a six-fold reduction of the force required to generate a given strain on the surface when bending 1 mm NiTi wire as compared to direct tensile loading. Bending, however, results in a distribution of stress and strain (from compression on the inside of the bend radius to tension on the outside), which makes parts of the active material under tension 27 susceptible to fatigue and reduces the temperature response; in this case from 16 K in tension to 9 K during bending. Ossmer et al. and Bruederlin et al. report a miniature-scale heat pump that operates by stretching a 30 μm thick $Ti_{49.1}Ni_{50.5}Fe_{0.4}$ foil over cleverly shaped heat exchangers. The system consists of an elastocaloric bridge attached to a movable frame, and solid heat exchangers. The device uses the adiabatic temperature change of the material directly, which generally results in a simpler device, but limits the temperature span between the hot and cold sides to less than the generated adiabatic temperature change. A model of another miniature elastocaloric system to provide temperature span larger than the adiabatic temperature change of the material was described in [17]. A cantilever-based device with patches of piezoelectric $0.50Ba(Zr_{0.2}Ti_{0.8})O_3$-$0.50(Ba_{0.7}Ca_{0.3})TiO_3$ was actuated by vibrations. According to the model, a single cantilever could generate 0.2 K temperature change at 324 K, while 10 cascaded elements could create a temperature difference of about 2 K in 10 s.

Examples of direct bending of EC material are illustrated diagrammatically in FIGS. 4A and 4B. EC material 1 (here a wire form), is forced against (FIG. 4A), or moved around (FIG. 4B), a bending anvil 6. See, e.g., Sharar D J, Radice J, Warzoha R, Hanrahan B, Chang B. First Demonstration of a Bending-Mode Elastocaloric Cooling "Loop." Proc. 17th Intersoc. Conf. Therm. Thermomechanical Phenom. Electron. Syst. ITherm 2018, 2018. doi:10.1109/ITHERM.2018.8419513, incorporated by reference herein. Application and removal of force F allows elastic return to produce an elastocaloric effect cycle. Again, however, this is direct loading of the EC material. FIG. 5 illustrates another reported approach. A piezoelectric (PE) material 7 is mounted at the free end of a cantilever 8. See, e.g., Kumar, et al., Vibration induced refrigeration and energy harvesting using piezoelectric materials: a finite element study, RCS. Adv., 2019, 9, 3918, incorporated by reference herein. The authors describe that flexing of cantilever 8 between opposite positions induces what they call both piezoelectric and elastocaloric effects from a cycle of tensile and compression stresses in the PE material 7. However, as reported at Qian, et al., A review of elastocaloric cooling: Materials, cycles and system integrations, International Journal of Refrigeration 64 (2016) 1-19, incorporated by reference herein, and in Slaughter, Czernuszewicz, Griffith and Pecharsky, Compact and efficient elastocaloric heat pumps—Is there a path forward?, J. Appl. Phys. 127, 194501 (2020), incorporated by reference herein, there are differences between piezoelectric/27 ferroelectric materials and elastocaloric materials in terms of elastocaloric cooling performance and harvesting.

Though elastocaloric cooling remains promising, there are many barriers that must be overcome before this technology can be employed practically. As mentioned before, one of the major hindrances is the high forces necessary to obtain sufficient adiabatic temperature changes, which translates into bulky and expensive actuators. Another hurdle is short fatigue life of materials subjected to tension. Tensile loading allows for use of samples with very high length to thickness ratio (e.g. strips, plates, foils, ribbons) which is highly beneficial for heat transfer; however, cracks open in working elements under the tensile stress, reducing their lifetime much below the $\sim 10^{8\text{-}9}$ cycles required for a typical appliance. Materials subjected to compression loading can endure many more cycles, but their shapes are limited to short lengths with large cross-sectional areas to avoid buckling which strongly limits heat transfer and reduces performance of a compression-based device. While tubes tolerate compression and provide reasonably good heat transfer, they are also much more expensive than wires or thin plates. Compression often also requires higher stresses than tension to obtain the same strain and, therefore, temperature change.

We teach a novel low-force method of activating layers of elastocaloric material in either tension or compression for applications in future efficient solid-state heat pumping systems. In one embodiment, strips of NiTi were incorporated into structures that reduce the actuating forces. Fabricated structures consisted of patches of active material and a plastic base material with low thermal conductivity to reduce parasitic heat losses. In tensile configuration, large strains and stresses were achieved with less than ½ the force of direct tension. In a compression configuration, a NiTi strip was bonded directly to a plastic beam; when this beam was tested in a four-point bend setup, the entire strip was in compression. This configuration also used approximately ½ of the force as with direct actuation, and, more importantly, it allowed the entire sample to be in compression without buckling. The proposed concept paves the way to the new, potentially exciting area of compact and efficient elastocaloric systems.

Therefore, as can be seen, there is room for improvement in this technological art.

II. SUMMARY OF THE INVENTION

A. Objects of the Invention

It is therefore a principal object, features, or advantages of the invention to provide apparatus, systems, and methods which improve over or solve problems and deficiencies in the state of the art.

Further objects, features, or advantages of the invention include apparatus, systems, or methods which:

a. Allow relatively low-force actuation to induce effective elastocaloric effect, at least compared to the magnitude of force applied axially to induce the same magnitude of elastocaloric effect.
b. Allow the use of smaller, less complex, and low-cost components.
c. Provide for greater flexibility and variations regarding form factor, interfacing with other systems, and operation, including ability to induce elastocaloric effect by tensile or compressive stress.
d. Resist or eliminate buckling in thin layers during compressive stress.
e. Are scalable with respect to elastocaloric members and/or use of multiple elastocaloric members concurrently in a system.
f. Allow use of relatively thin elastocaloric members, including in form of strips, patches, films, flakes, powders, or wires which not only is beneficial regarding cost of the member(s) but is beneficial thermodynamically at least in terms of heat transfer.

B. Aspects of the Invention

In one aspect of the invention, a method, apparatus, or system for generating elastocaloric effect from elastocaloric material includes an elongated base or beam member to which is mounted or installed an elastocaloric strip. The strip can be mounted along or at an end of the base member.

Bending forces imposed on the base member induce elastocaloric effect in the elastocaloric strip mounted to it. By controlling placement and mounting of the strip, as well as the bending forces, a variety of benefits are possible. One example is producing exclusively tensile or compressive stress in the strip for increased elastocaloric performance. Another is deterrence or elimination in the elastocaloric material of buckling in compression. Another is reduction in the amount of force needed to generate a similar magnitude of elastocaloric effect as just axial loading of elastocaloric material.

In one example according to the invention, tensile loading is by clamping or otherwise fixing opposite ends of the strip over a cut out along a side of the base member and applying four-point bending to bend the base member with forces applied to its opposite side, which lengthens the distance between the clamped ends of the strip to tension it. In another example, compressive loading is by bonding a strip along a side of the base member and using four-point bending to bend the base member in a way that it shortens the side with the bonded strip relative to the base's center, longitudinal axis to compress it. Another example places a strip along one side of and at or near one end of the base member, fixes that end of the base, and applies linear bending force on the opposite cantilevered free end of the base. Direction of the force determines if the strip is tensioned or compressed. A second strip can be placed on the opposite side of the base member at the fixed end, such that bending of the base will induce tensile stress on one strip and compressive stress in the other at the same time.

Another example is mounting the strip to one side of a composite base member that has at least one electrostrictive or magnetostrictive layer, controlling an electrical or magnetic field around the combination, and using differences in response of the layers to cause bending or curving which imposes stress on the strip. In one example, the electrostrictive or magnetostrictive layer is located on the opposite side of the neutral axis from the elastocaloric layer with other layers made of passive materials (e.g. plastic or metal). If the electrostrictive or magnetostrictive layer is closer to the neutral axis than the elastocaloric layer then, when a field is applied, the layer will strain (grow longer or shorter) in response to the field and this actuation strain will impart a larger strain to the elastocaloric layer.

In another aspect of the invention, a variety of design parameters can be evaluated and selected by the designer for a given application. In one example, amount, direction, length of time of application, and frequency of application of actuating forces can be selected for different outcomes. Also, the scale of the strip and base member can be varied according to desire or need. Selection of materials for the strip and base member can likewise be varied. Additionally, a plurality of strip and base member combinations can be coordinated to produce a composite output.

Another aspect of the invention is how the bending beam/strip combination(s) can be applied. In one example, they can be used to add or subtract heat from another system. Heat sinks or heat exchangers can be interfaced for that purpose. Another example is a regenerative heat exchanger that uses controlled fluid flow correlated to elastocaloric effect. The solid-state nature of the bending beam/strip combination(s) made according to the invention allow reduced forces needed for effective elastocaloric output, economy, reduced complexity, and flexibility of design for a wide variety of potential applications, including but not limited to refrigeration and water cooling.

III. BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIGS. 1, 2, 3, 4A-B, and 5 are diagrammatic depictions of state-of-the-art techniques of generating an elastocaloric effect from elastocaloric materials.

FIGS. 6A-D are diagrammatic depictions of generalized examples of embodiments according to the invention.

Figure 10B:
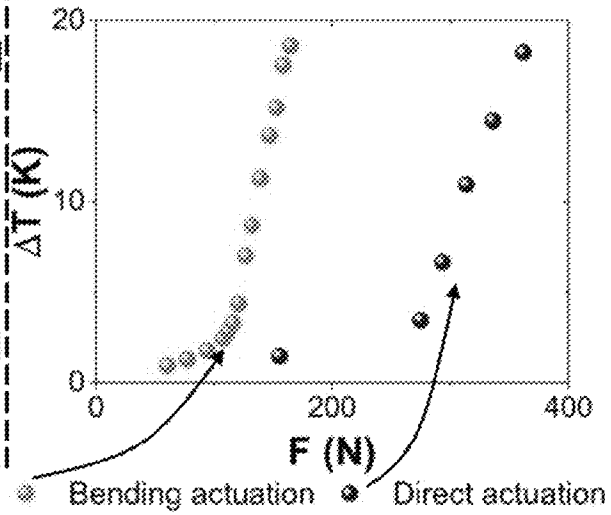
Figure 10A:
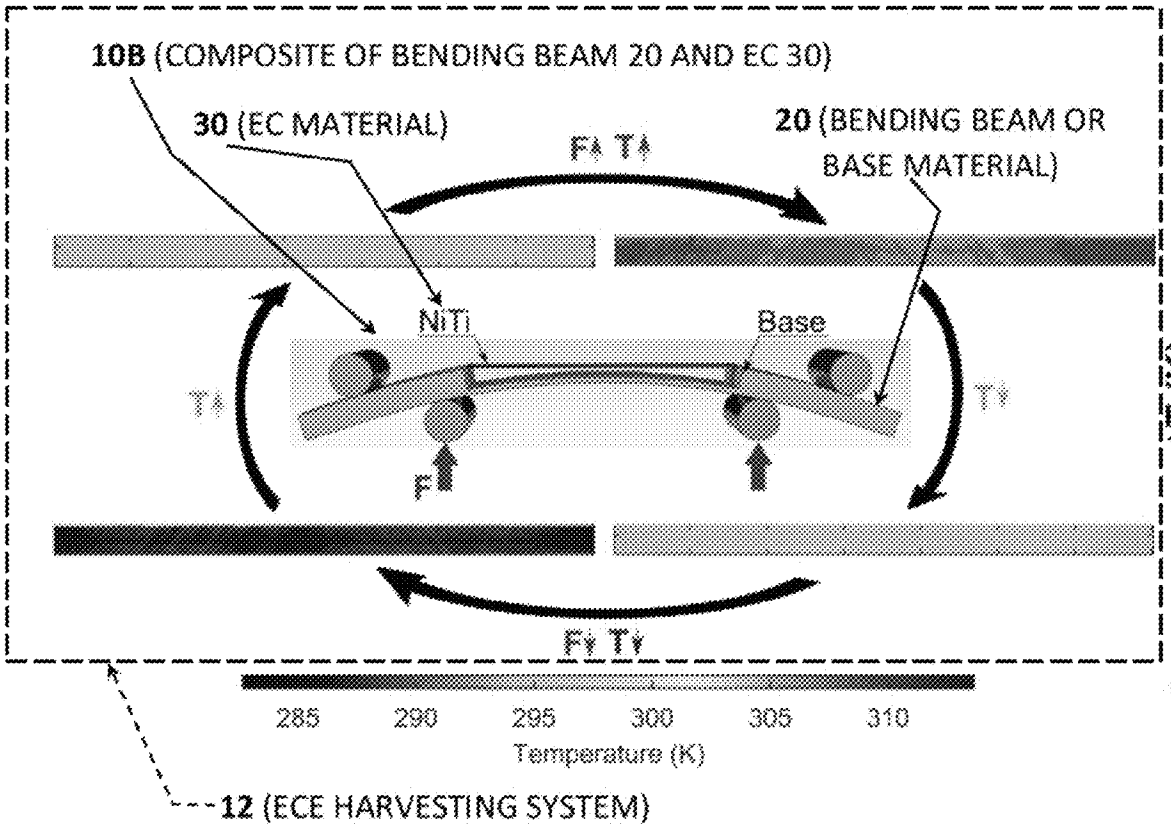

FIGS. 10A-B are diagrammatic depictions of how embodiments of the invention can be implemented in a heat pump.

Figure 11:
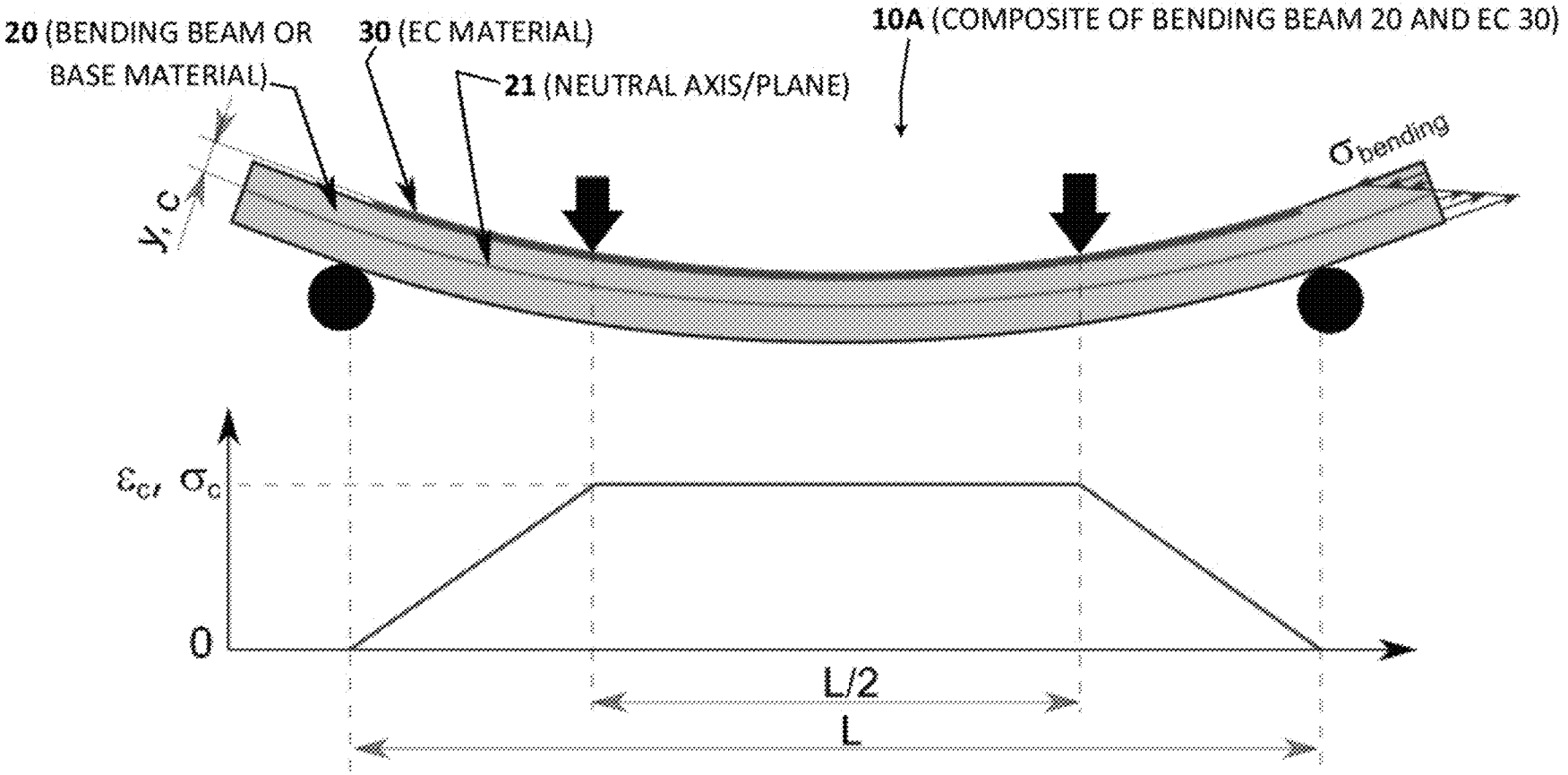

FIG. 11 is a diagrammatical depiction of a specific embodiment according to the invention; a composite of an EC material mounted to a bending beam. FIG. 11 shows a principle schematic of a four-point bending method with elastocaloric material entirely in compression; base beam 20, elastocaloric material 30, and neutral surface (axis/plane) 21. Supporting pins are shown as circles and loading pins—as arrows.

Figure 12A:
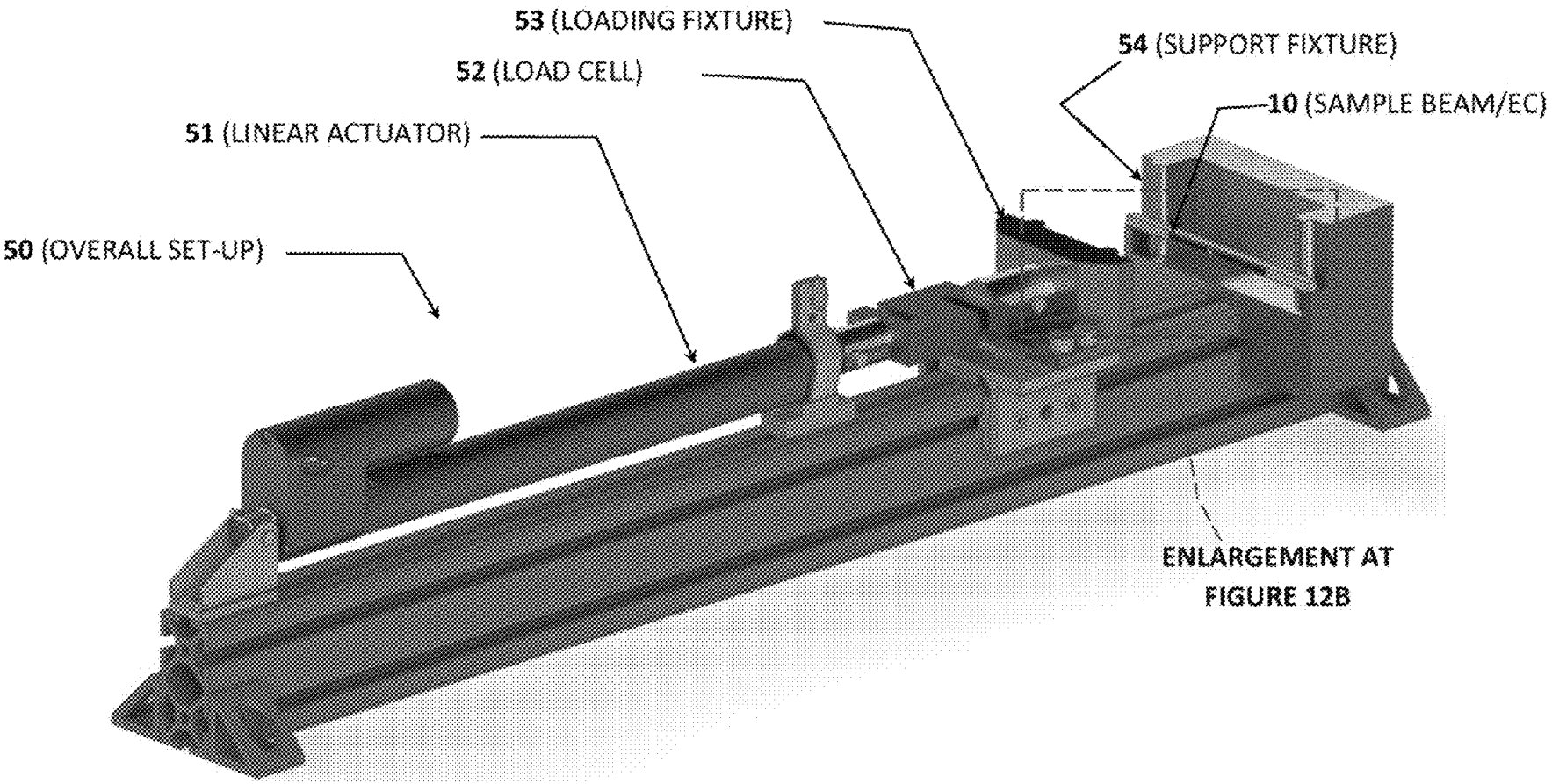

FIGS. 12A and B show a solid model of an experimental system 50 for use with the compression method of FIG. 11: linear actuator 51, load cell 52, loading fixture 53 for 4-point bending tests, supporting fixture 54 for 4-point bending tests, -sample 10 base beam 20, elastocaloric material 30, strain gauge 58, and thermocouple 59.

Figure 13:
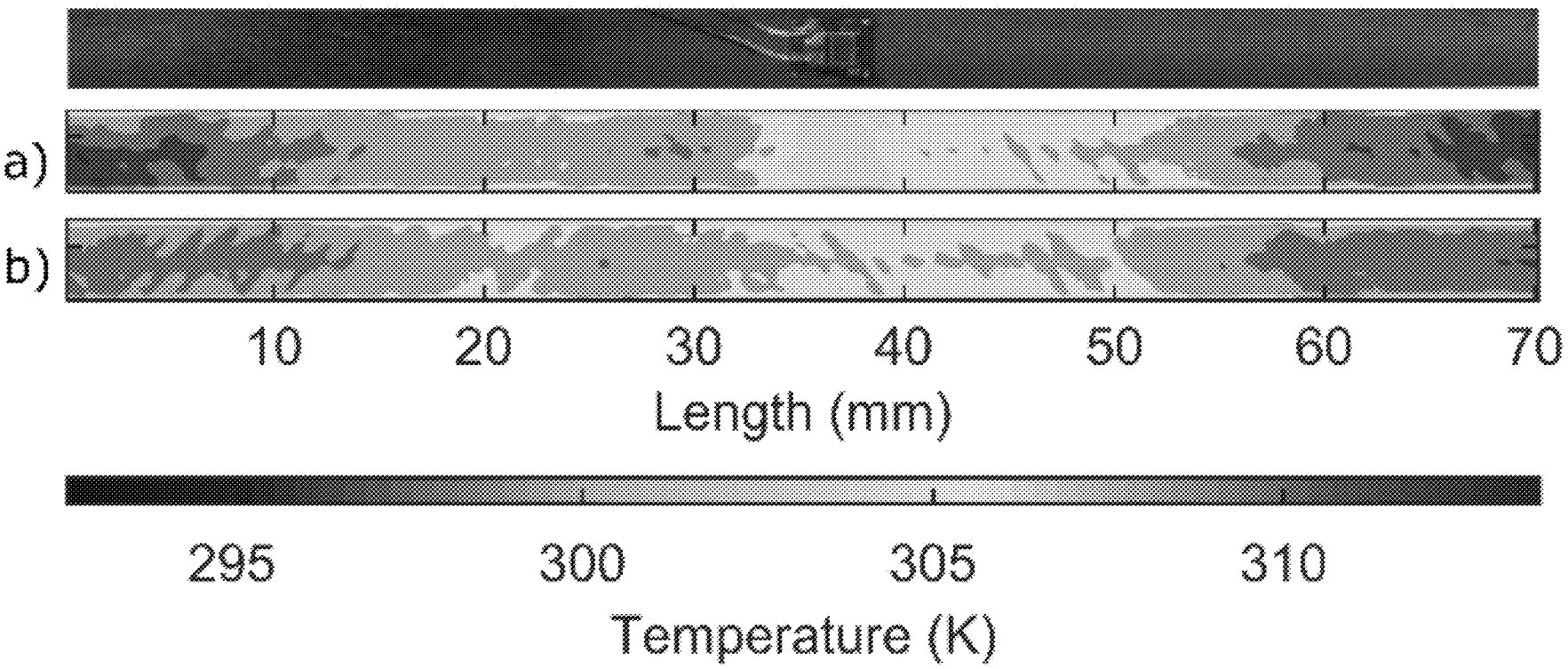

FIG. 13 shows an optical image of the NiTi strip with the strain gauge attached (top) and IR images of the strips under 4% tension strain. The strip with the strain gauge attached to the side opposite to what is shown in the image (a) and without the strain gauge (b).

Figure 14A:
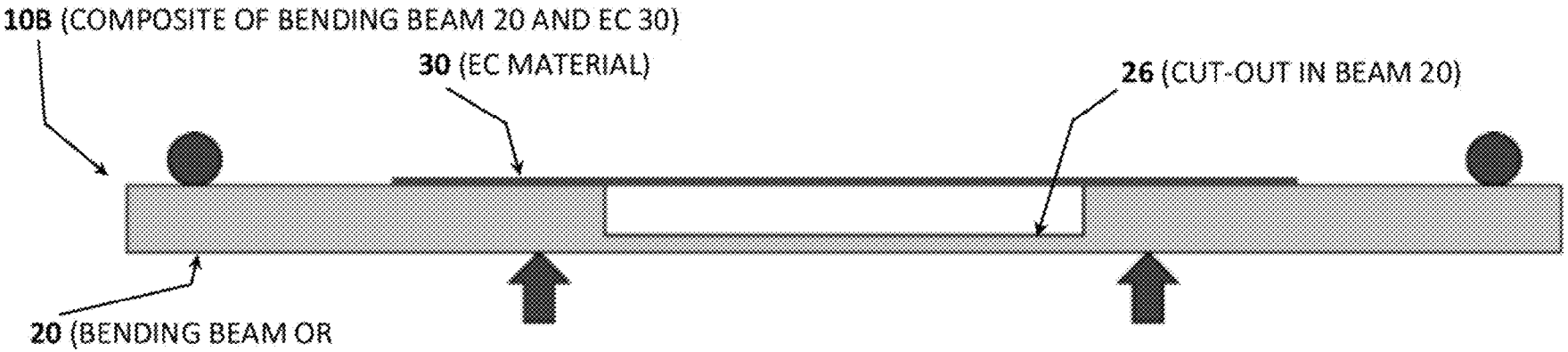
Figure 14B:
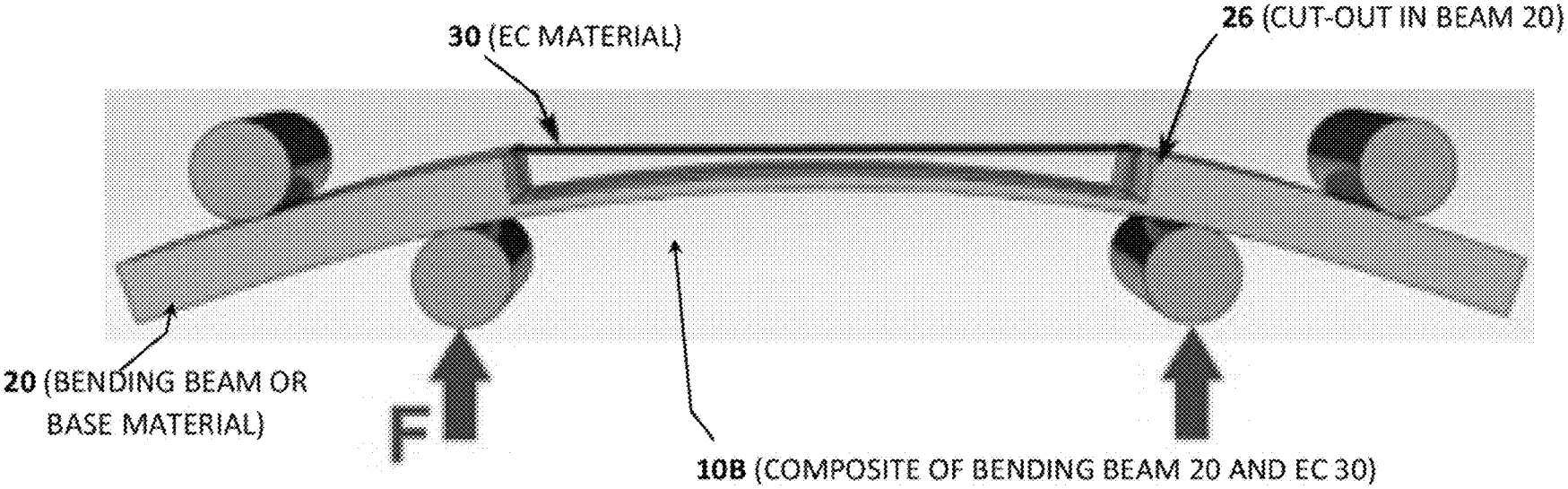
Figure 14C:
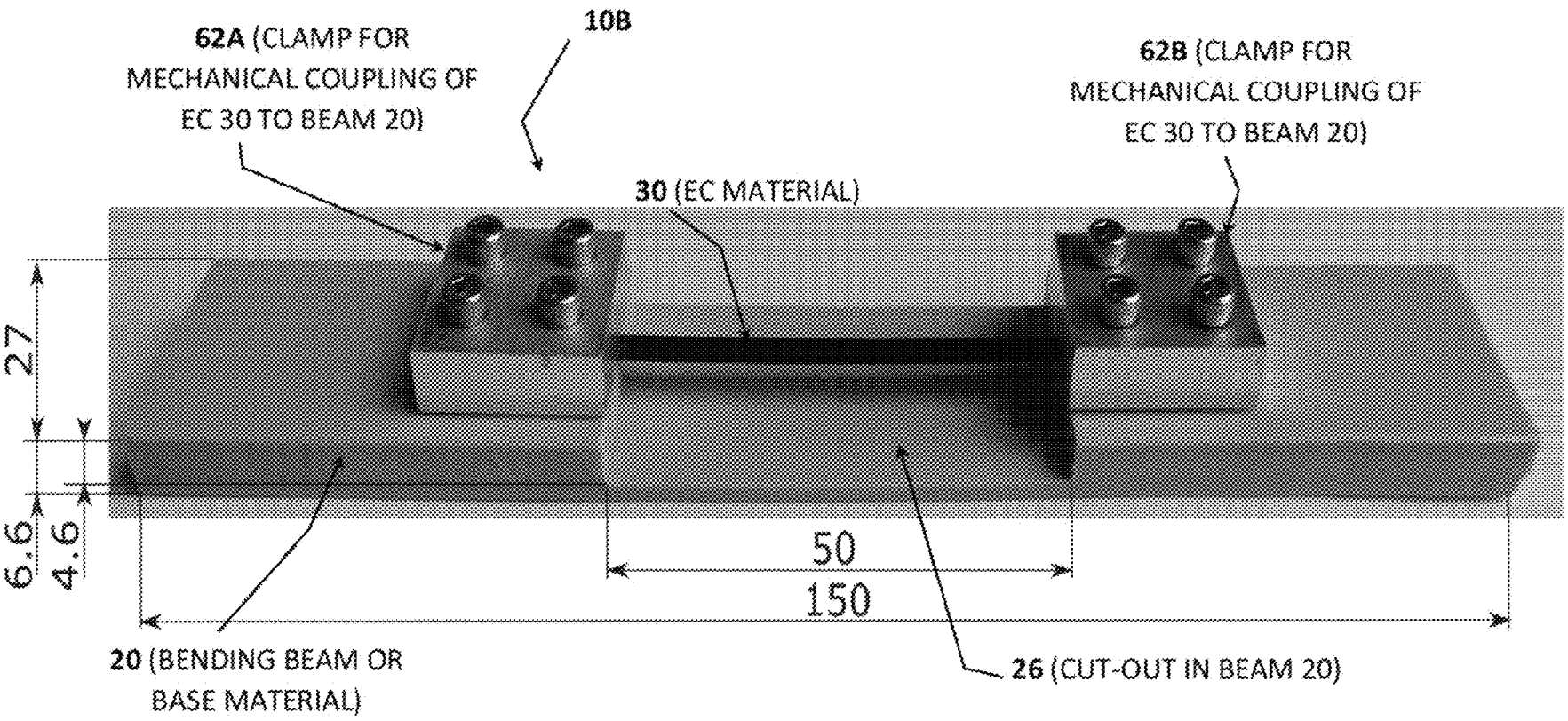

FIGS. 14A-C show, respectively, sketches and a photograph of the tension sample configuration with supporting pins shown by circles and loading pins shown by arrows. FIG. 14A is in neutral position. FIG. 14B in tensioned position.

Figure 15A:
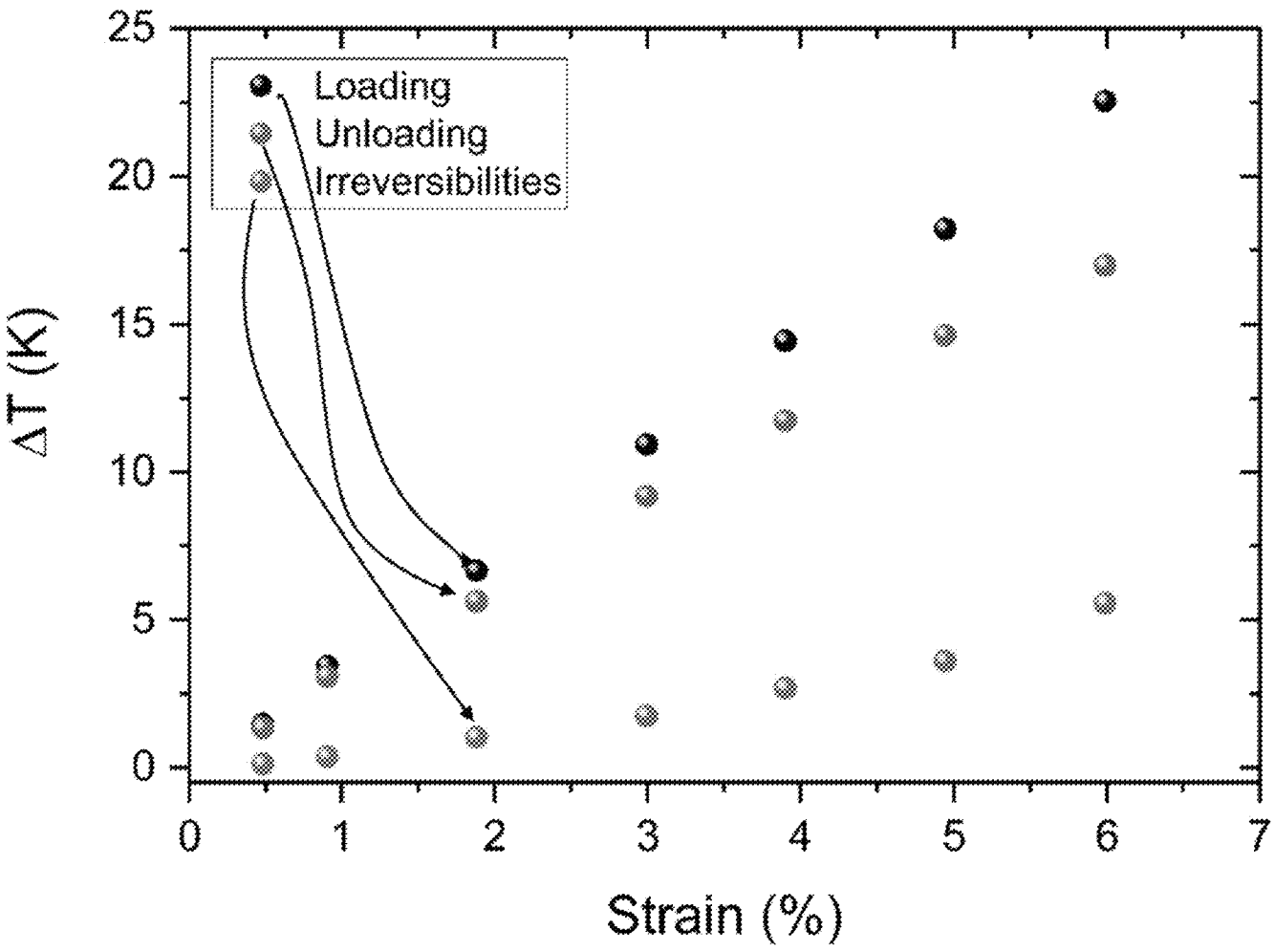
Figure 15B:
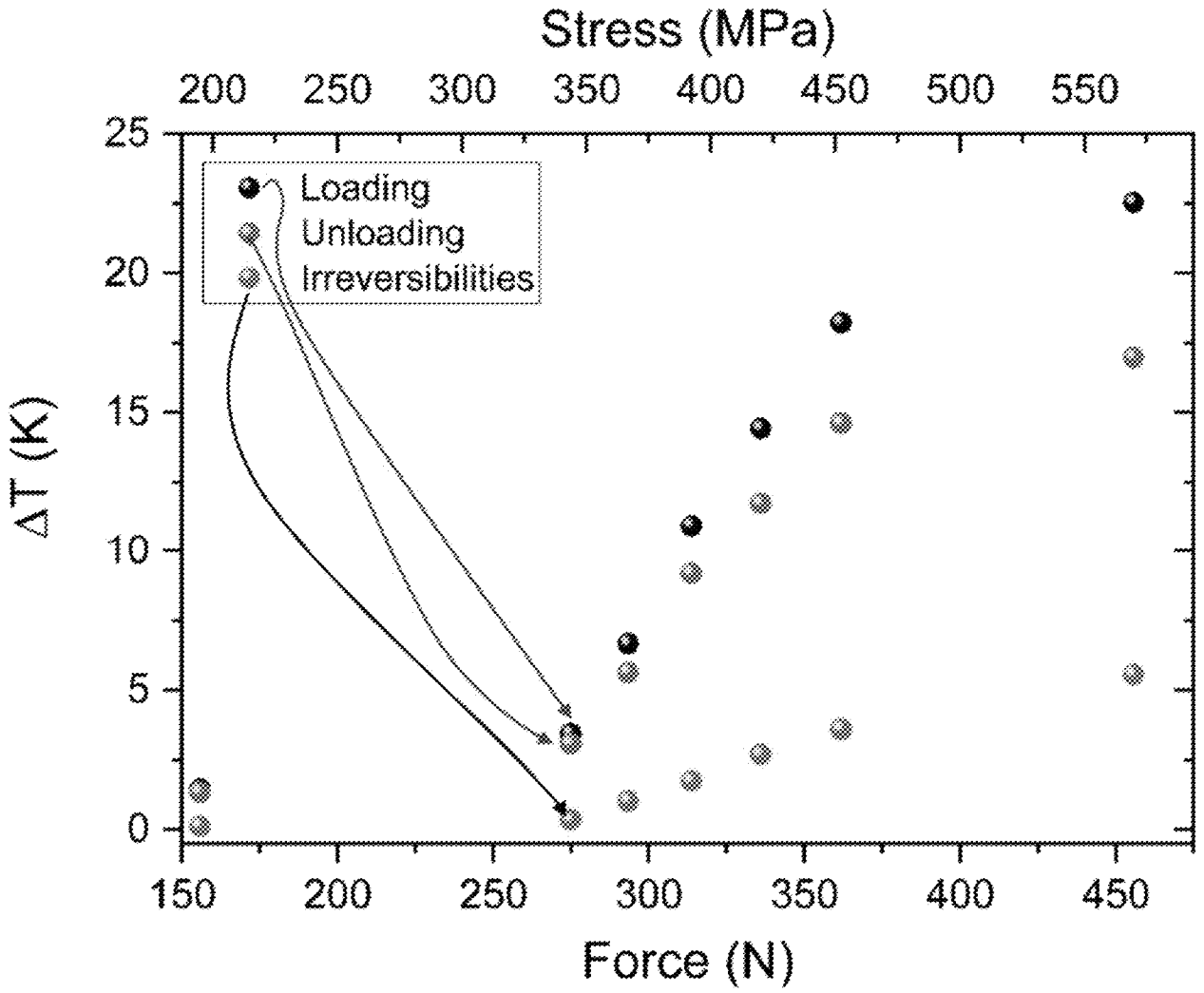
Figure 15C:
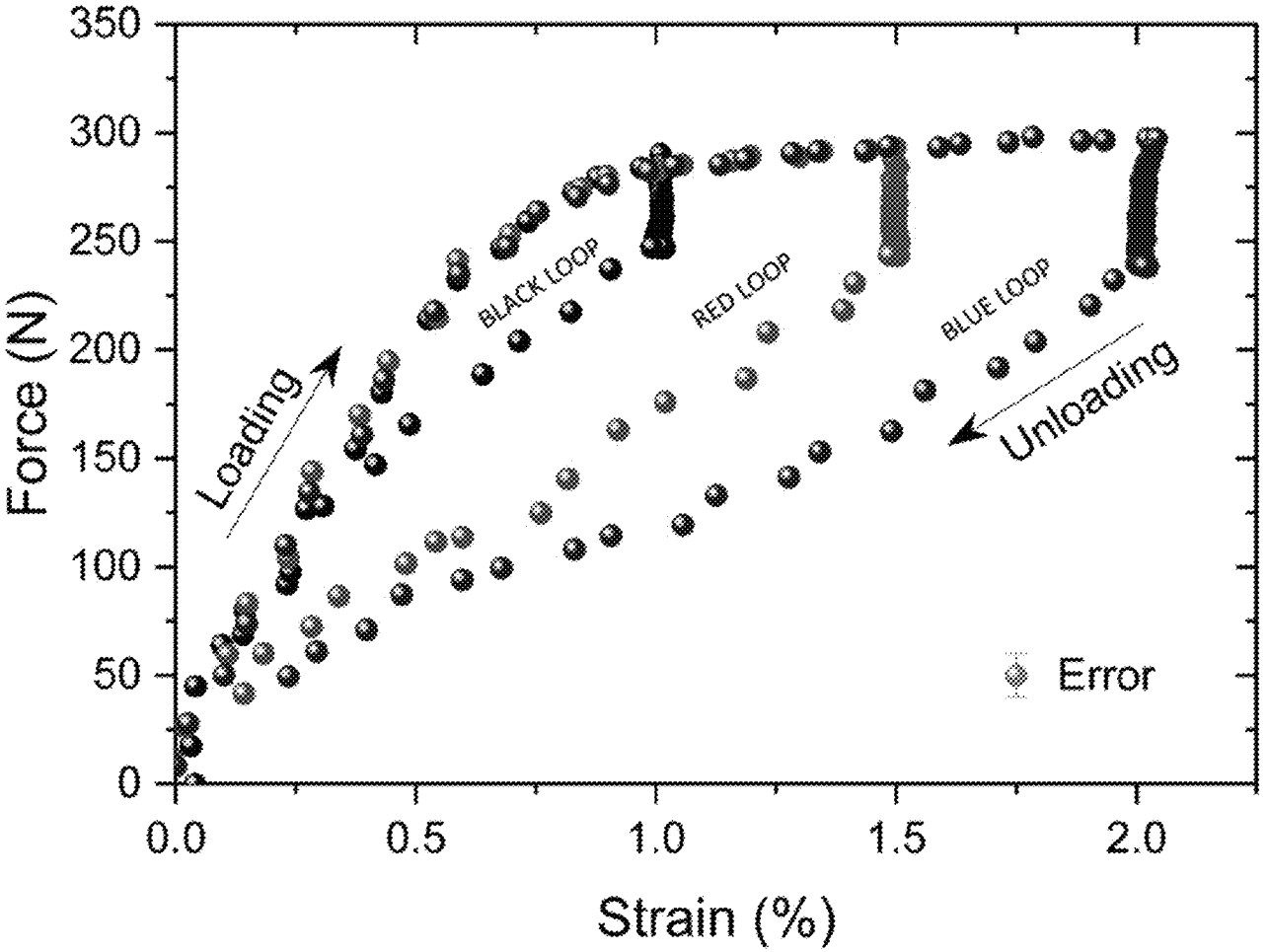

FIGS. 15A-C show, for comparison, data regarding CE material 20 (here NiTi) axially loaded. Temperature changes during axial loading and unloading as a function of strain (FIG. 15A) and force (FIG. 15B). Errors in FIG. 15A and FIG. 15B are smaller than the size of the symbols. FIG. 15C shows force-strain characteristics for 1, 1.5, and 2% strain with a representative error bar shown on the bottom right.

Figure 16A:
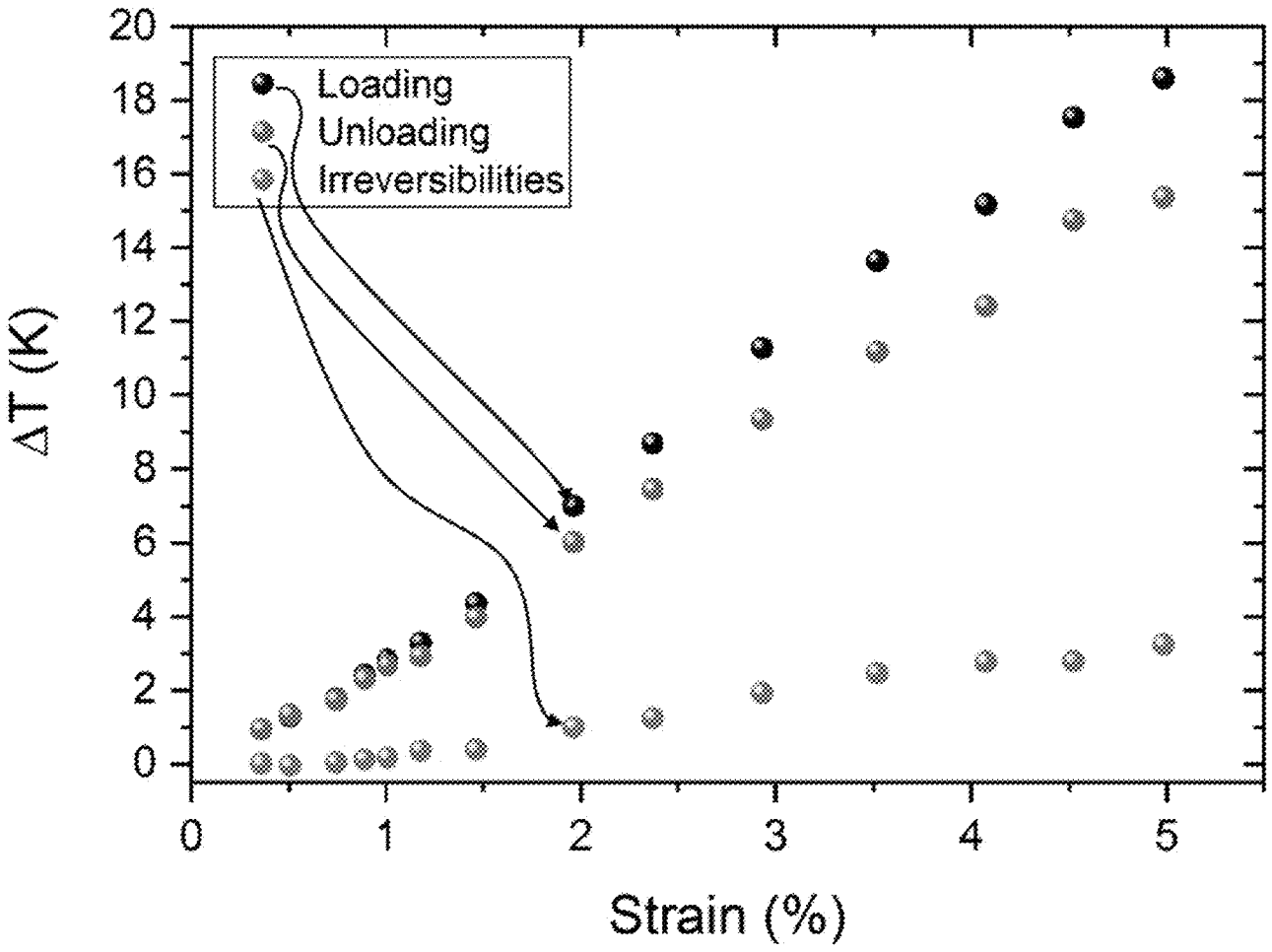
Figure 16B:
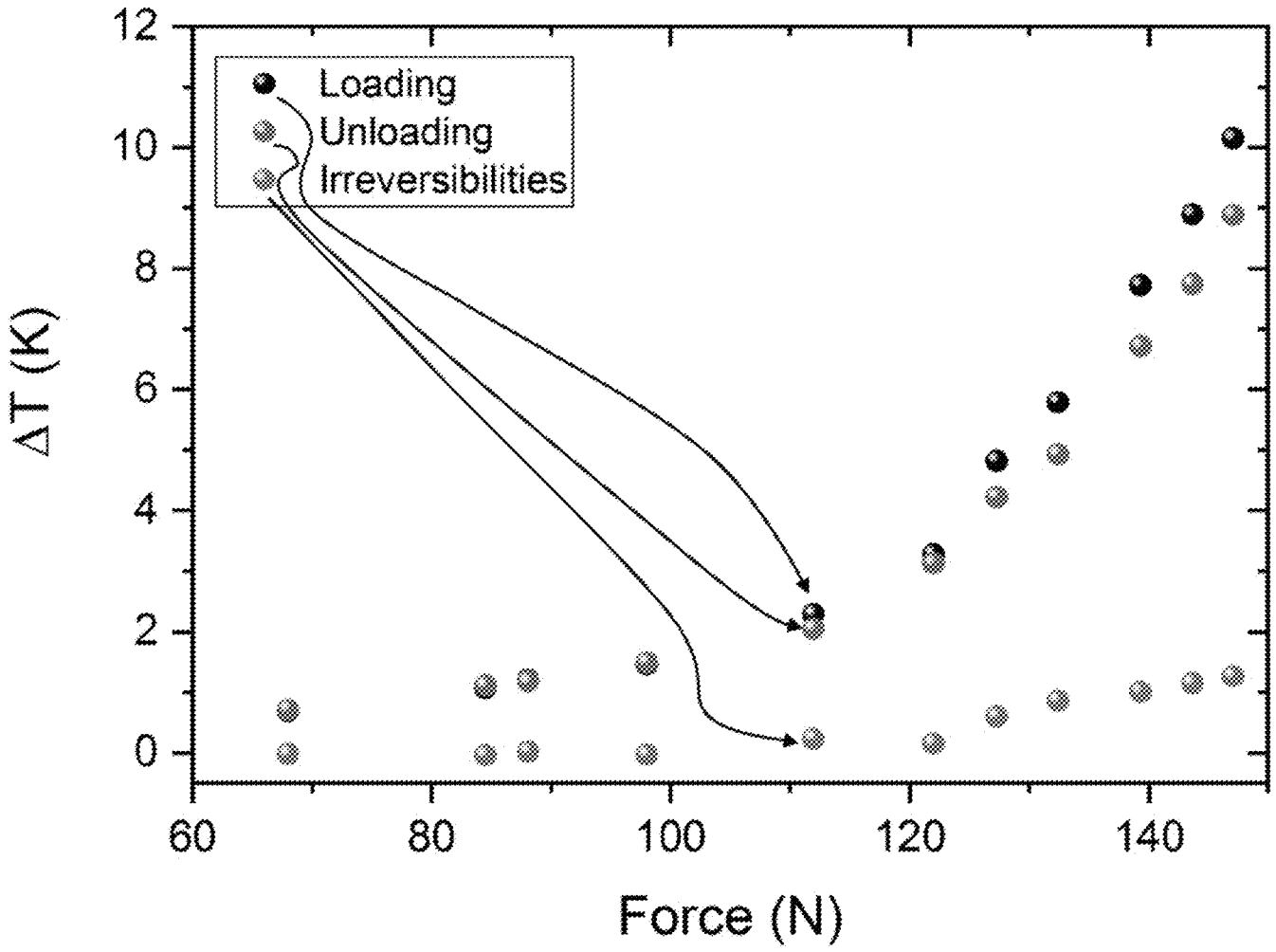
Figure 16C:
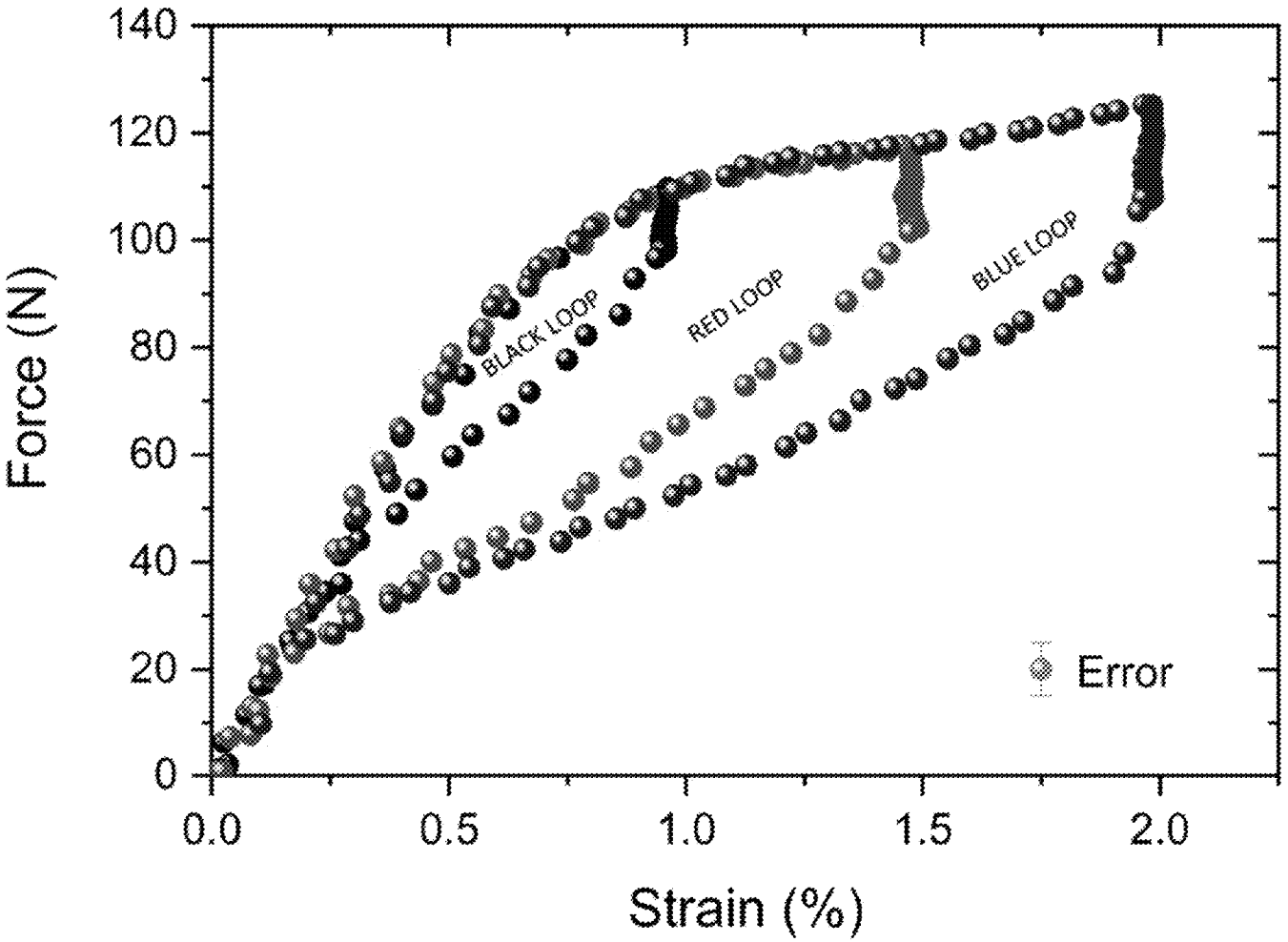
Figure 16D:
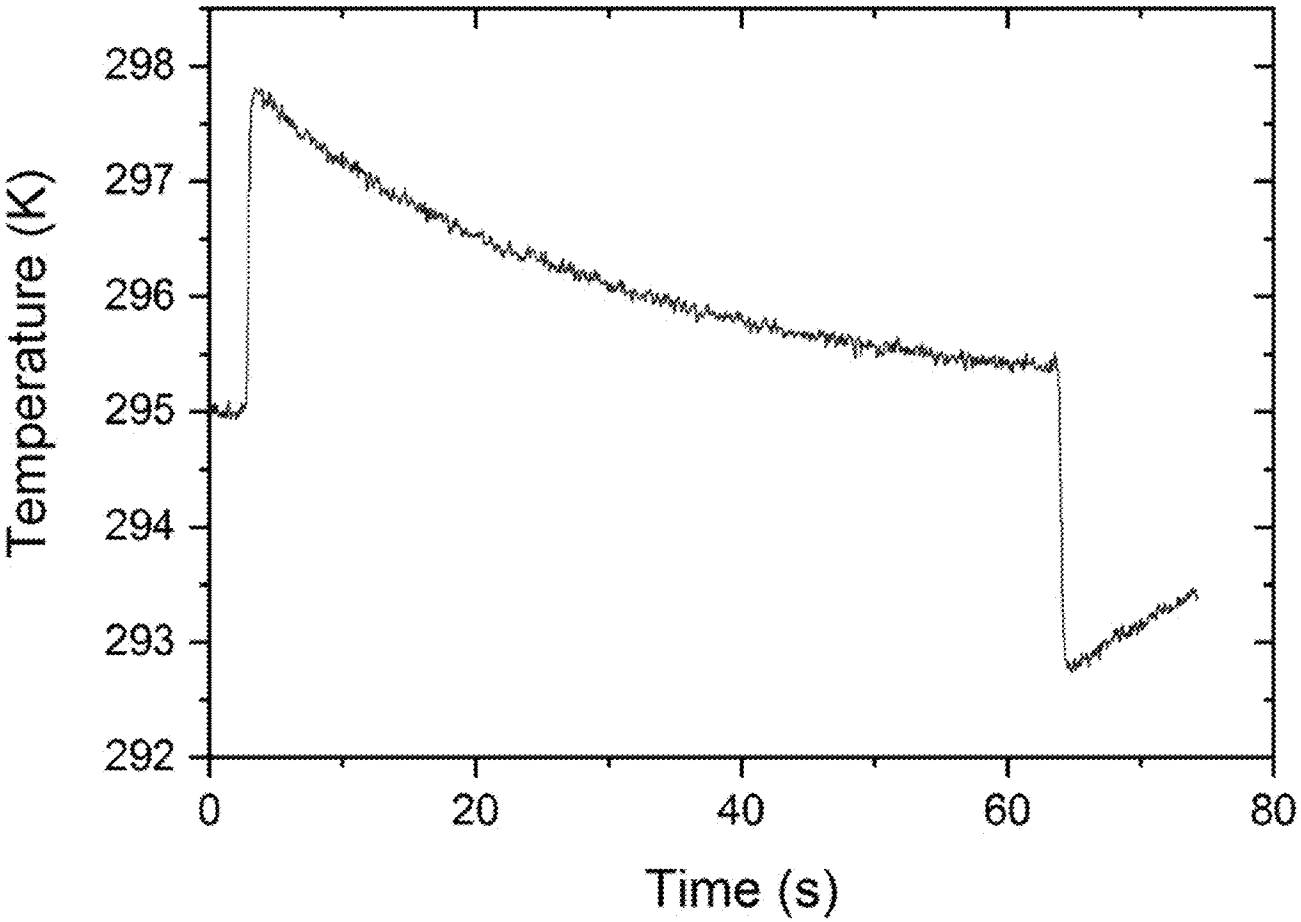

FIGS. 16A-D show data regarding a composite beam according to FIGS. 14A-C subjected to bending with NiTi strip in tension. Temperature changes during loading and unloading as a function of strain (FIG. 16A) and force (FIG. 16B). Errors in FIG. 16A and FIG. 16B are smaller than the size of the symbols. FIG. 16C shows force-strain characteristics for 1, 1.5, and 2% strain with a representative error bar shown on the bottom right. FIG. 16D shows typical record of temperature vs. time behavior of NiTi for 1% strain.

Figure 17A:
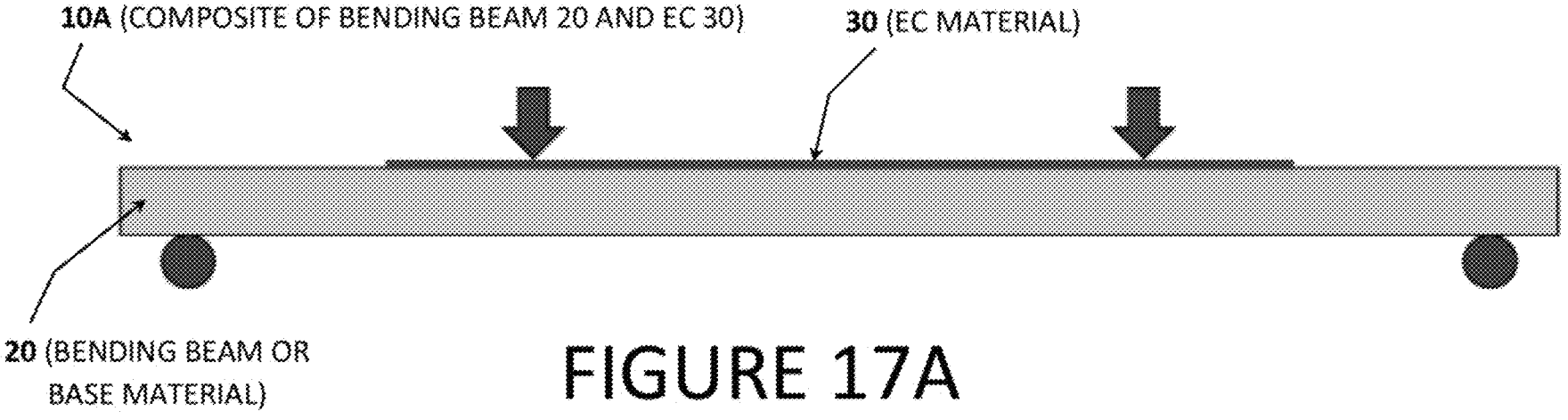

FIGS. 17A-Bare a sketch and photograph, respectively, of the compression sample configuration 10 according to an embodiment of the invention with supporting pins shown by circles and loading pins shown by arrows.

Figure 17B:
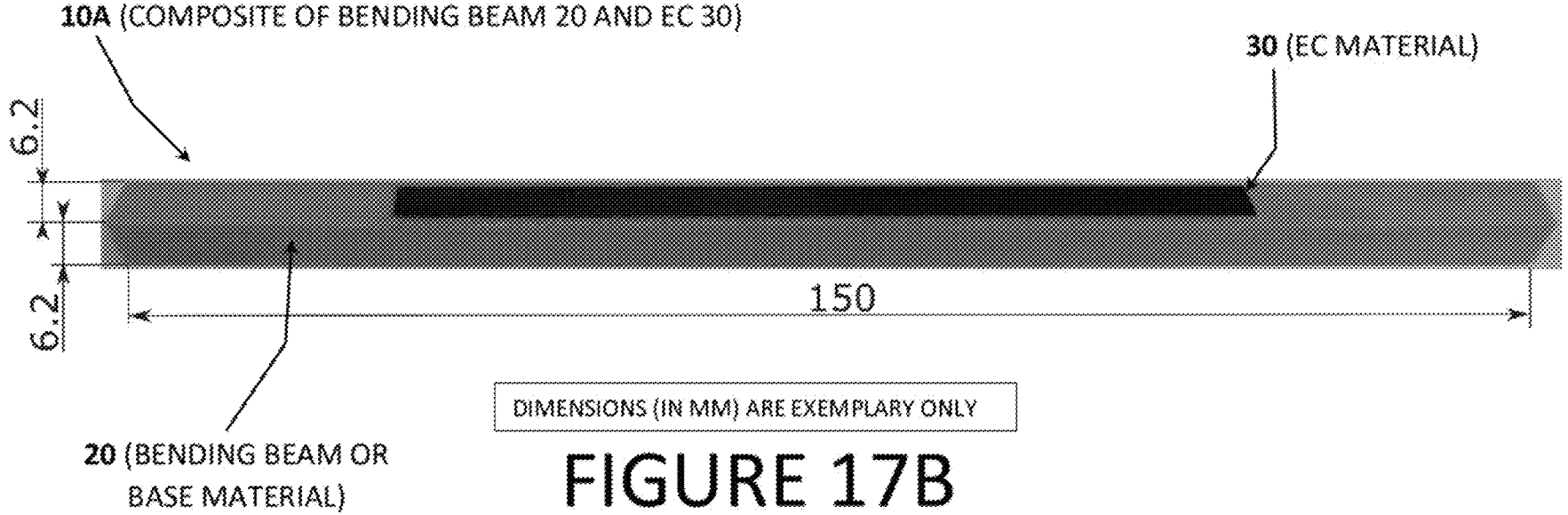
Figure 18A:
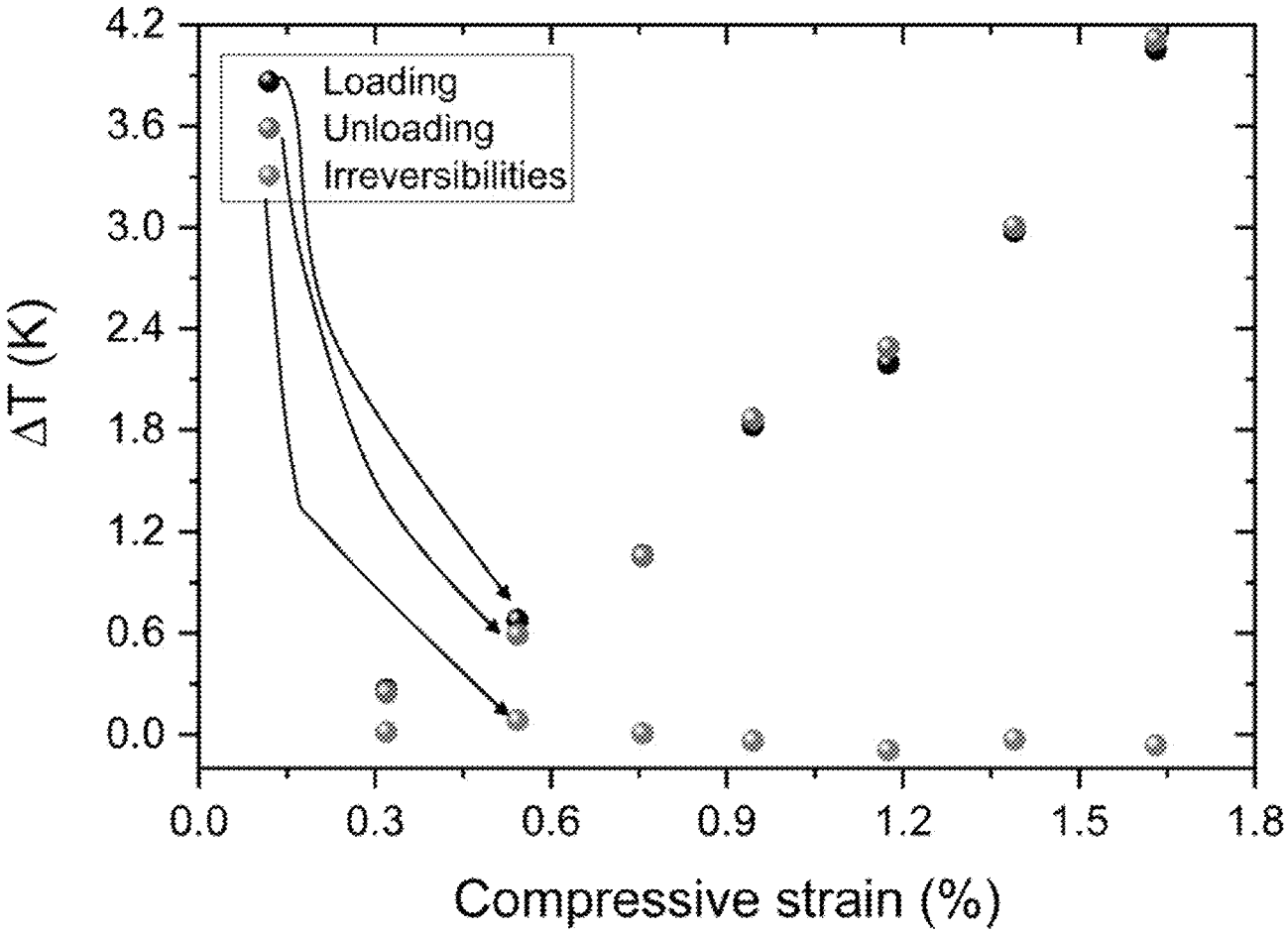
Figure 18B:
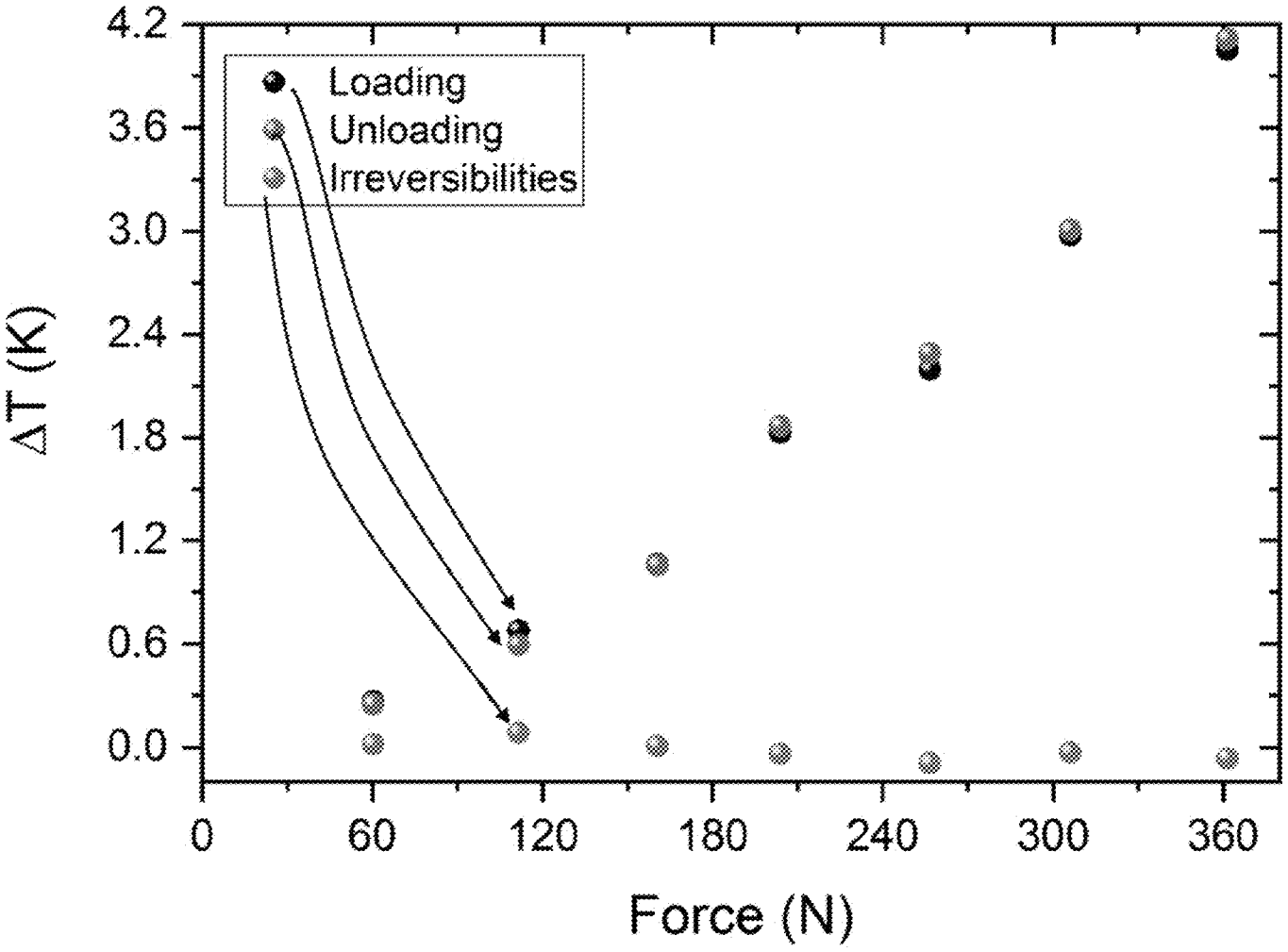
Figure 18C:
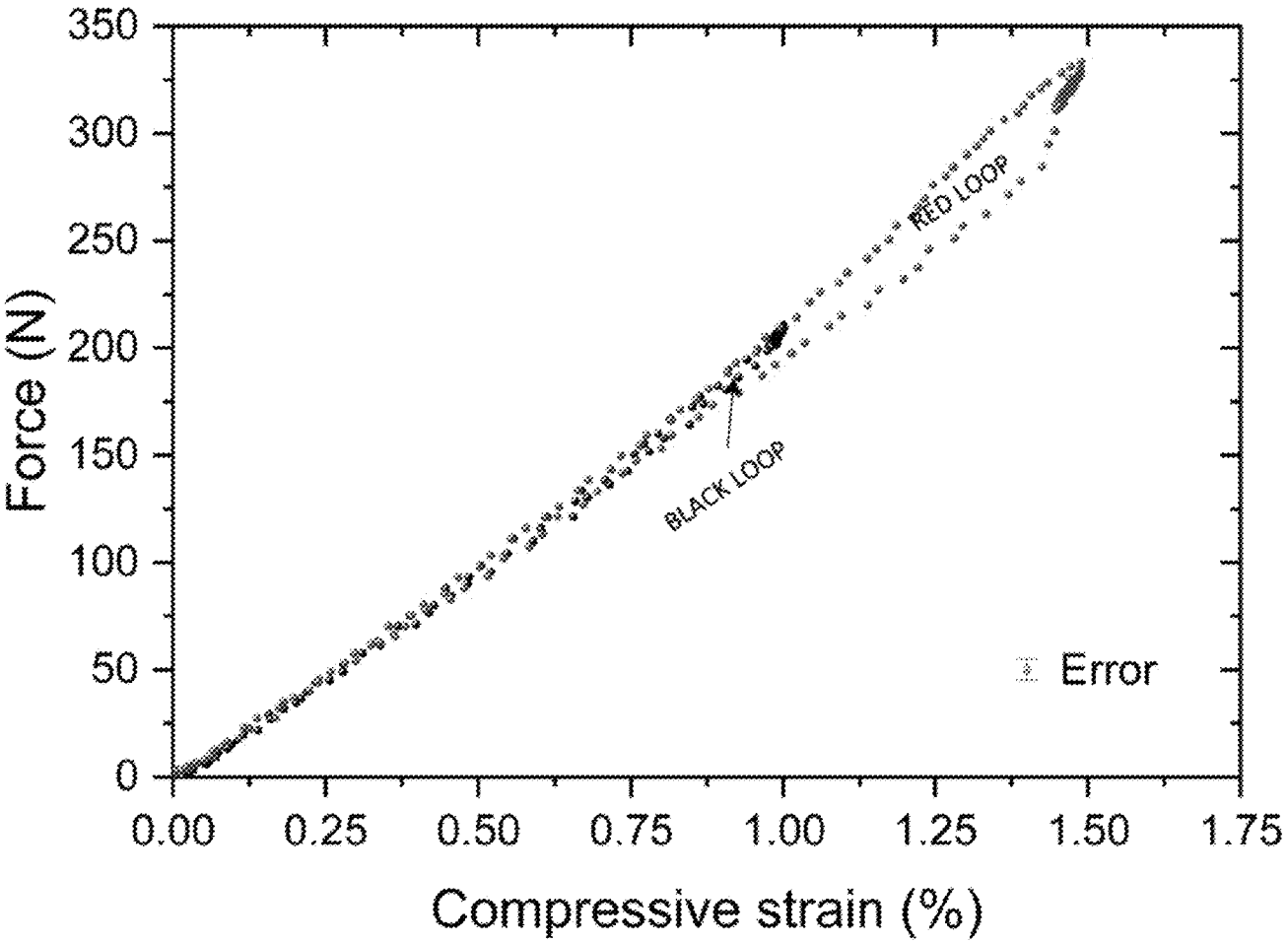
Figure 18D:
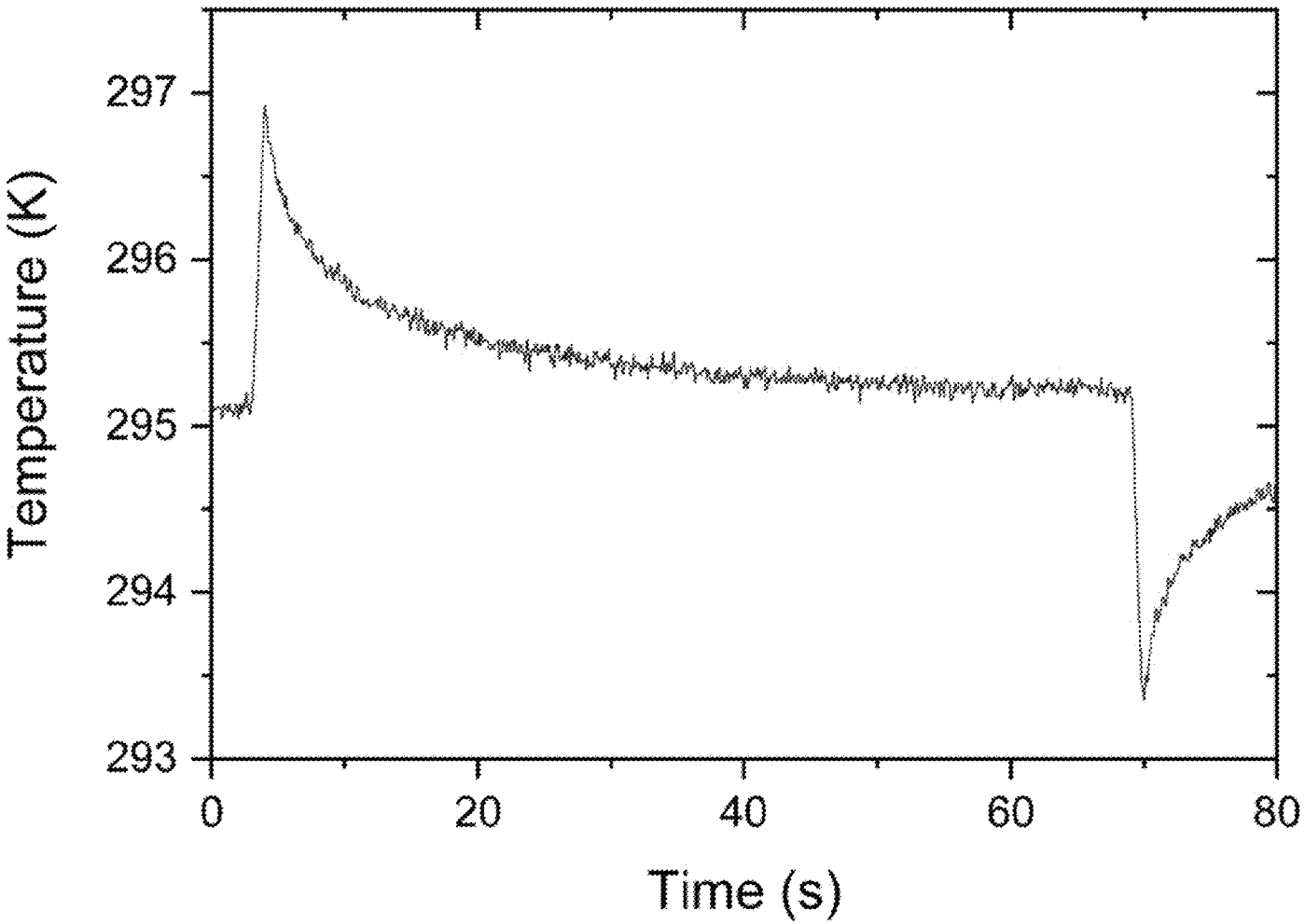

FIGS. 18A-D show data regarding a composite beam such as FIGS. 17A-B subjected to bending with NiTi strip in compression. Temperature changes during loading and unloading as a function of strain (FIG. 18A) and force (FIG. 18B). Errors in FIG. 18A and FIG. 18B are smaller than the size of the symbols. FIG. 18C shows force-strain characteristics for 1 and 1.5% strain with a representative error bar shown on the bottom right. FIG. 18D shows typical record of temperature vs. time behavior of NiTi for 1% strain.

Figure 19:
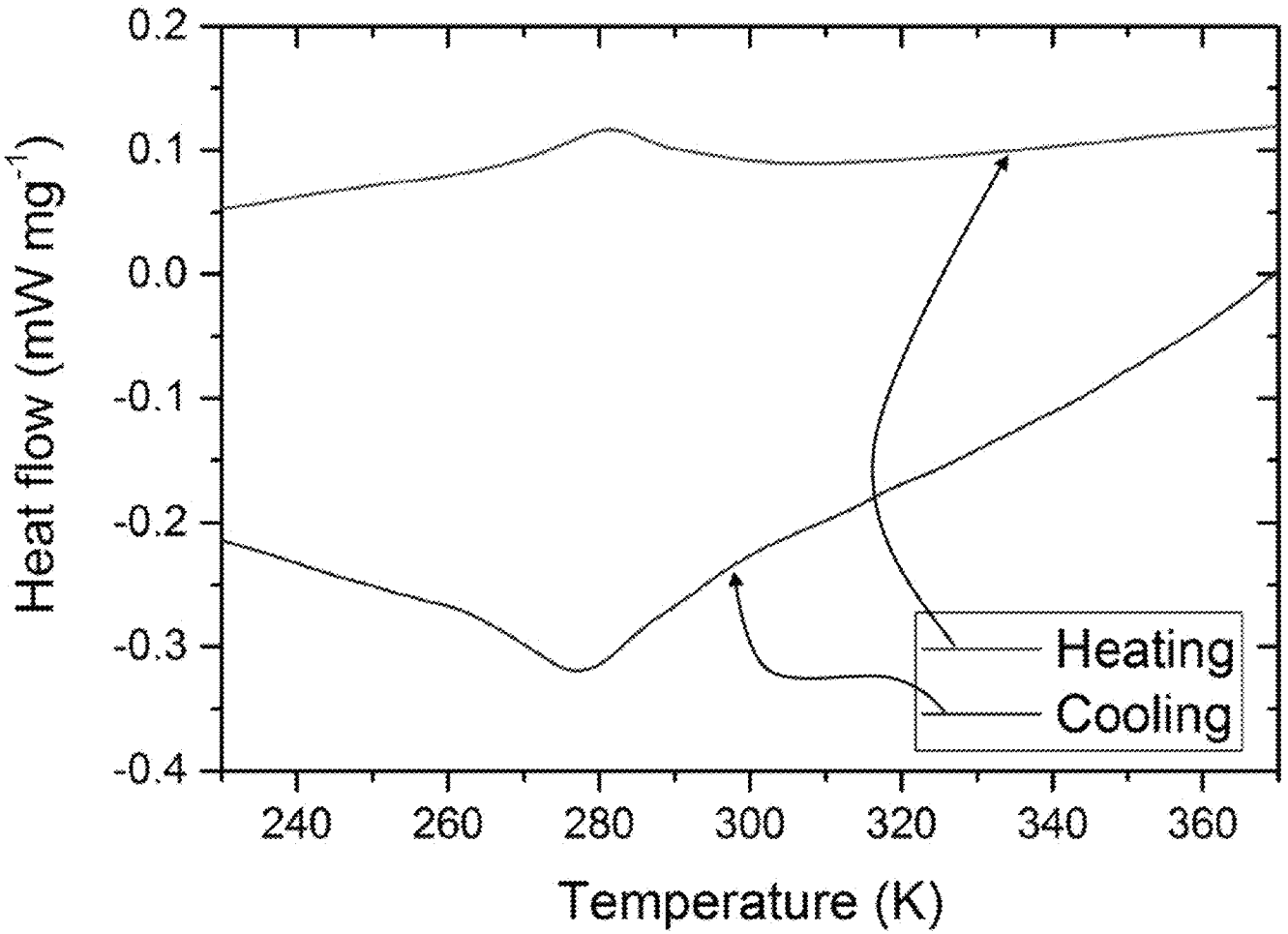

FIG. 19 shows DSC (Differential Scanning calorimetry) traces of a sample extracted from one of the NiTi strips employed in the study of the foregoing embodiments after the strip was trained in tension, showing phase transformations around 277 K on cooling and 281 K on heating. The DSC measurements were performed at 10 K $min^{-1}$.

Figure 20:
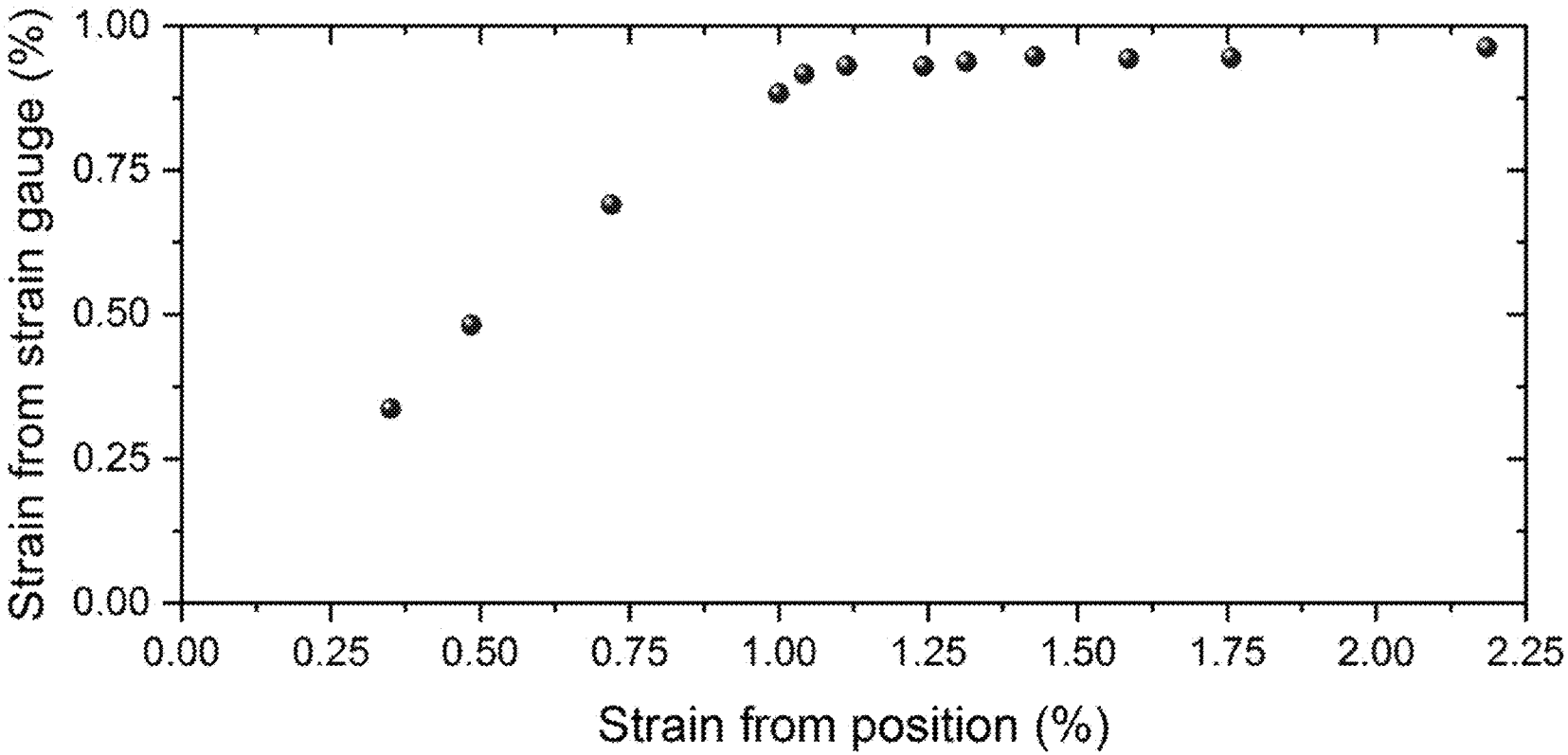

FIG. 20 shows strain measured by strain gauge vs. strain calculated from 10 kΩ potentiometer position sensor for the strip in tension. The strain gauge (SGT-1/350-TY11, Omega) response starts to saturate around 1% where the phase transition initiates, which indicates that the strain gauge restrains the martensitic transition in the area underneath the sensor.

Figure 21A:
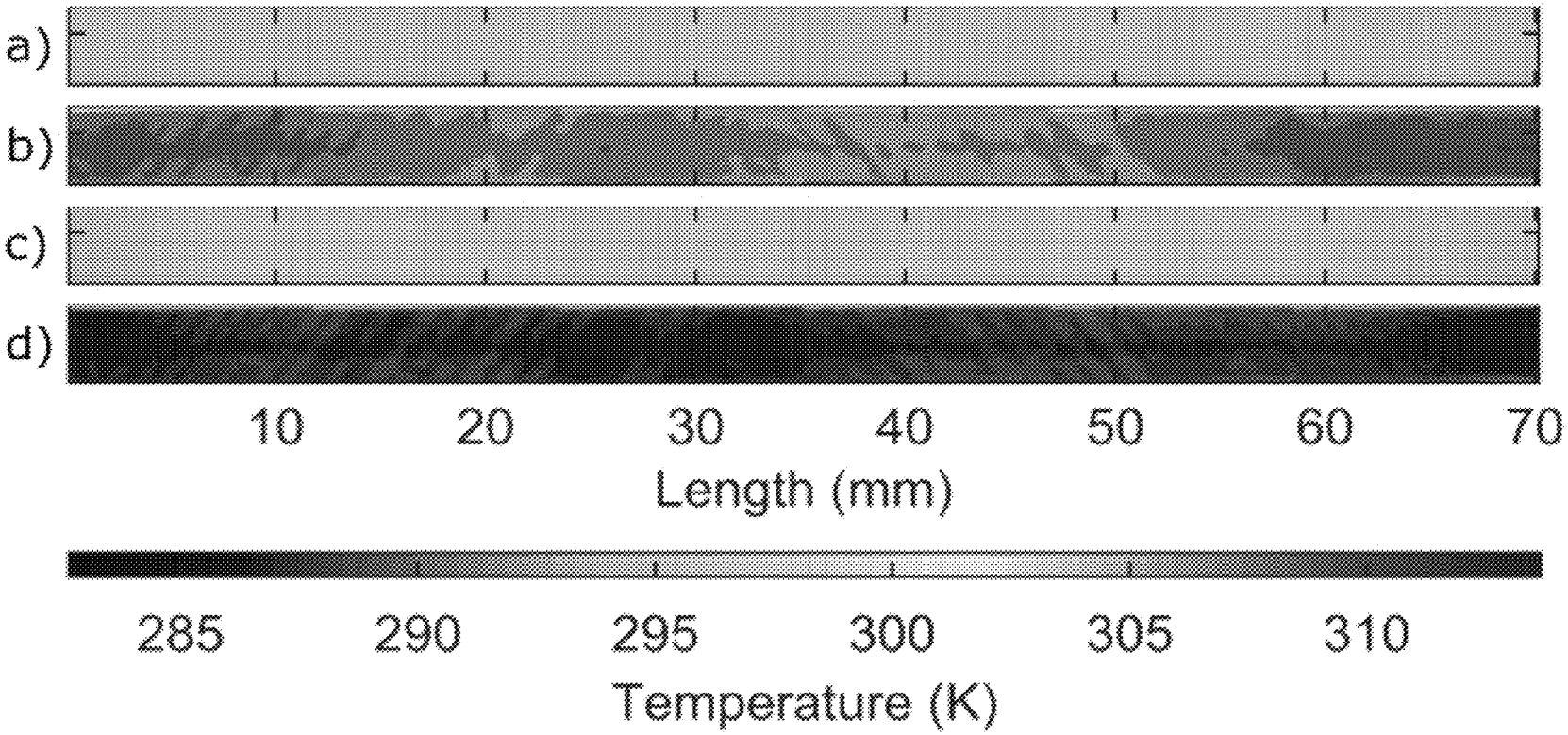
Figure 21B:
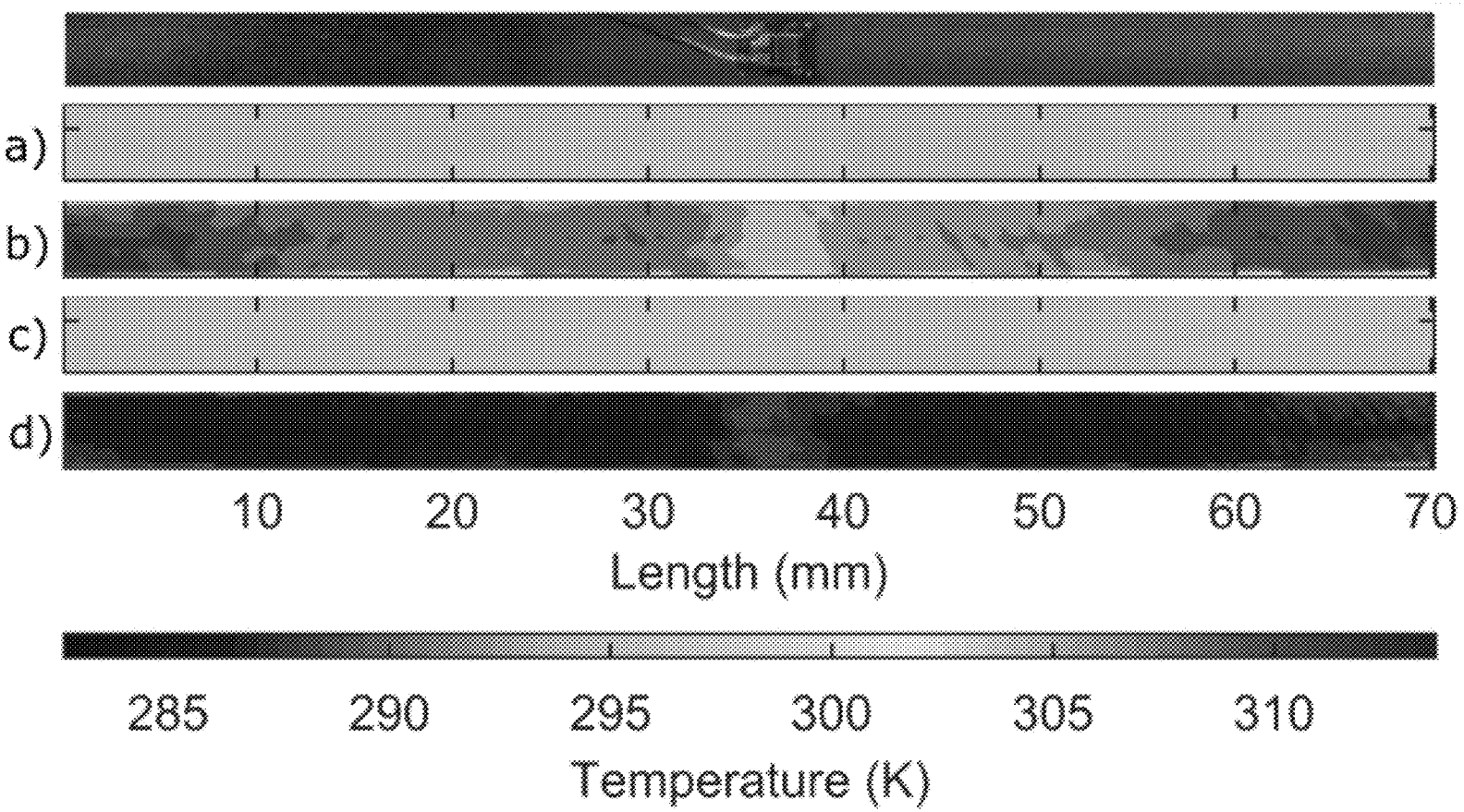

FIGS. 21A and B show IR images of a bare sample (FIG. 21A) and the same sample with strain gauge attached (FIG. 21B) under 4% tension strain. Temperature distribution across the sample (a) before loading, (b) after loading, (c) before unloading and (d) after unloading. The temperature scales are expanded compared with FIG. 13 in the main text to accommodate unloading temperature drops. Before loading and unloading temperature of the samples was always equal to room temperature. Even though the average stress-induced temperature changes are identical, minor differences in hues on the left and on the right reflect uncontrolled variability of room temperature that can be as much as 1 K between the measurements shown on the left and on the right. Minor non-uniformities in local temperature distributions in (b) and (d) on the left arise naturally during the martensitic transition, which starts along the clearly visible Lüders-type bands [Tušek J. et al., Acta Materialia 150 (2018) 295-307]. The distribution of the Lüders-type bands is relatively homogenous, hence temperature distribution across the sample is relatively uniform. On the right, temperature distributions are similar to the left, except for the area directly above the strain gauge. This area shows distinctly lower temperature changes than the rest of the sample, and it lacks Lüders-type bands. These observations support our argument about different strain distribution in NiTi strips caused by stiffness of the sensor that impedes the phase transition.

Figure 22A:
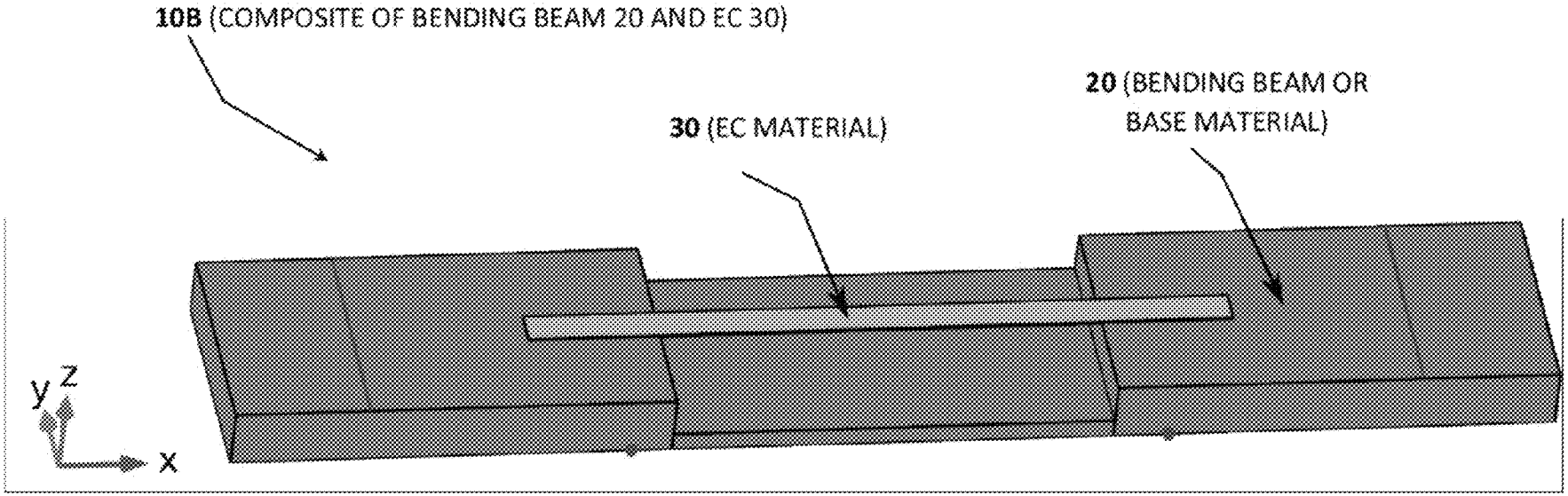
Figure 22B:
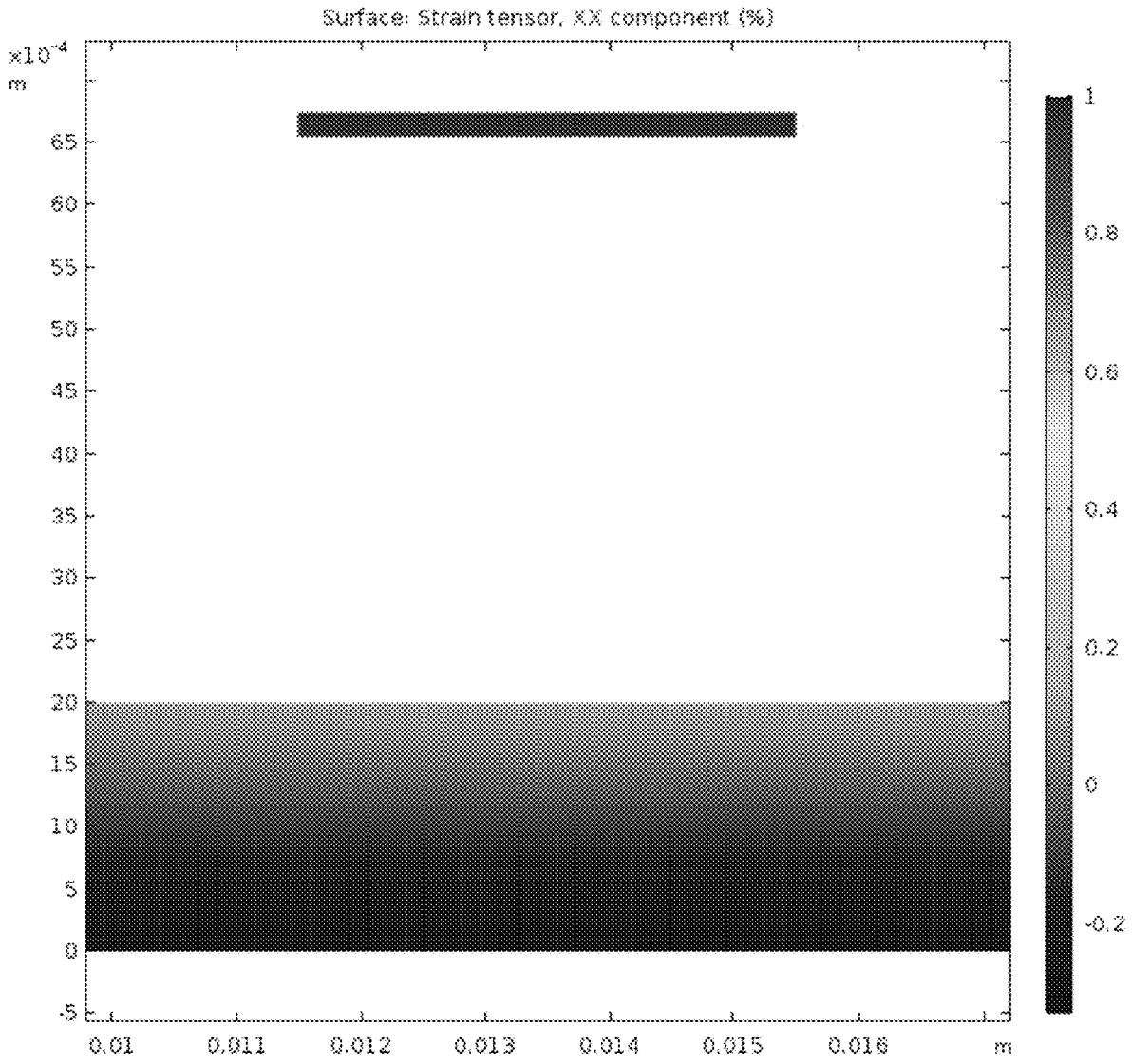
Figure 22C:
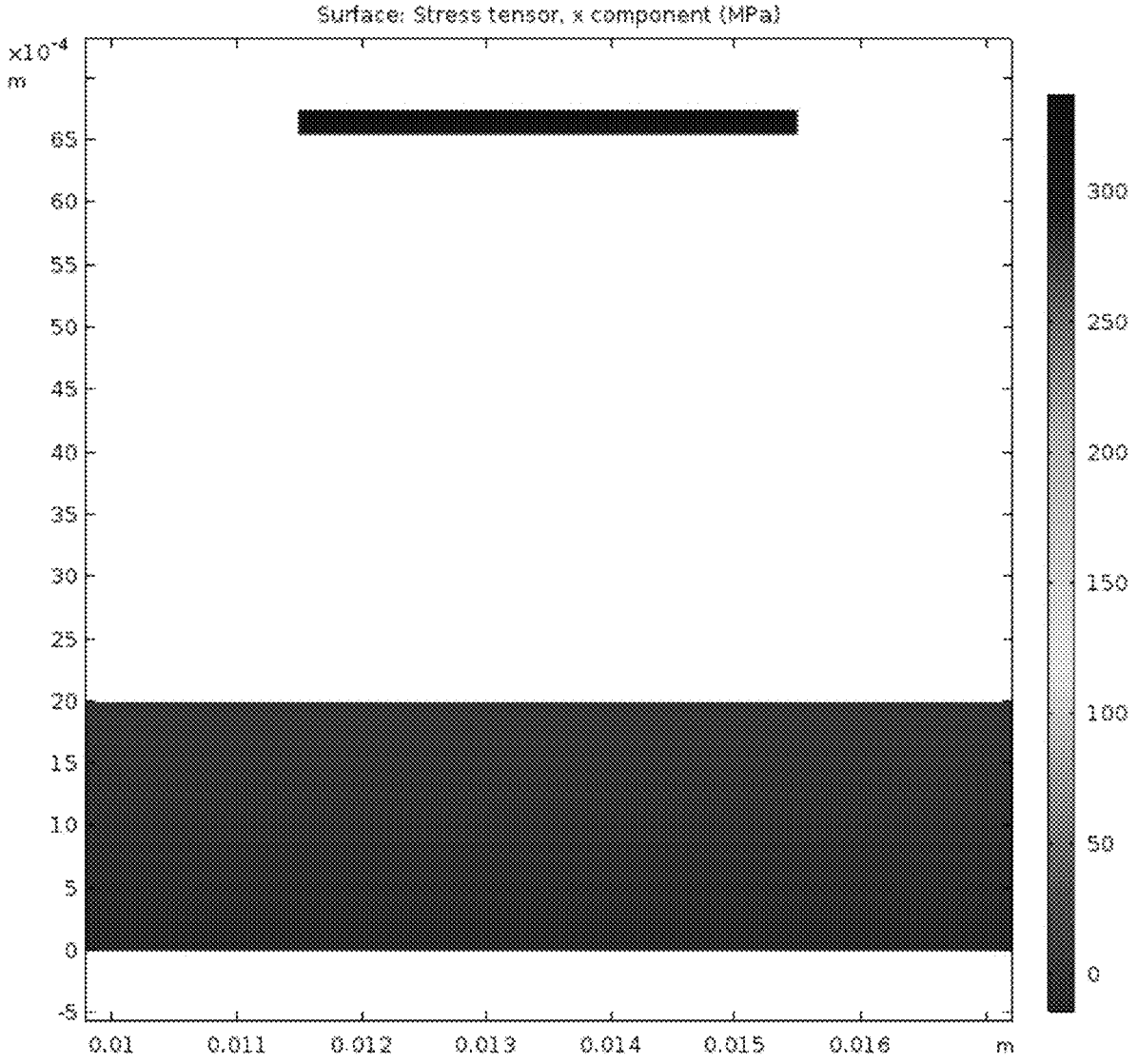
Figure 22D:
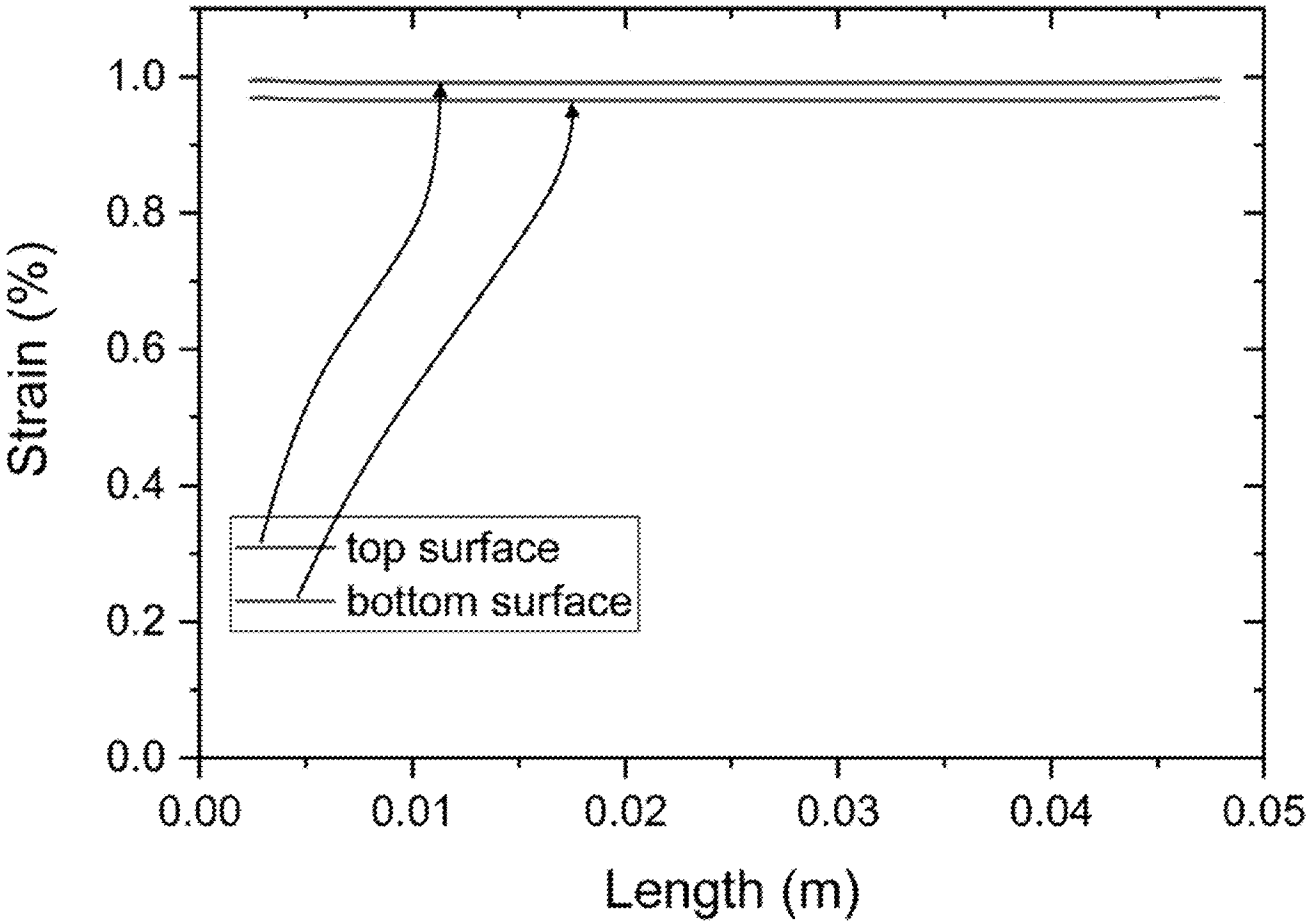
Figure 22E:
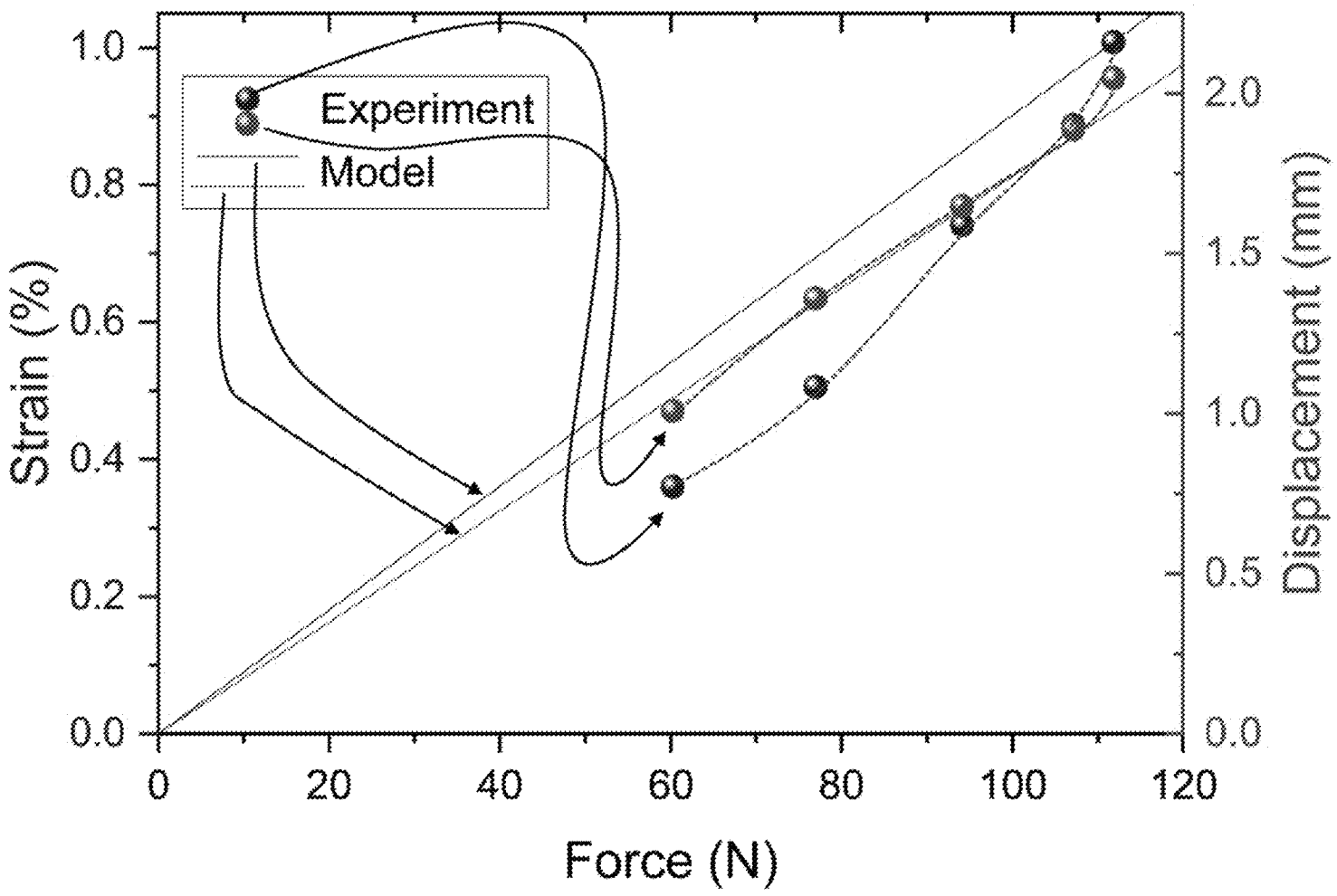

FIGS. 22A-E show COMSOL finite element analysis of the tensile-bending beam geometry subjected to 110 N load and model validation. FIG. 22A shows model geometry: NiTi strip 30, base beam 20, red lines-support locations, red dots-load locations. Axial strain (FIG. 22B) and stress (FIG. 22C) distribution in the cross-section through sample is shown. FIG. 22D shows axial strain vs. length of the NiTi strip. FIG. 22E shows model validation. The purpose of the model was to evaluate stress and strain distribution in the composite structure in elastic region of the NiTi stress-strain curve (up to 1% strain amplitude). Supplementary table 2 lists materials properties used in the analysis. The numerical results for displacement of the loading fixture and strain on the top surface of elastocaloric material were compared with experimental data at given forces. Displacement results are in very good agreement. Discrepancies in strain below 1% are related to the non-linear behavior of NiTi throughout the martensitic transformation that was not included in the model. However, the model is sufficient to approximate strain and stress distribution in the composite structure, especially at 1% strain shown. Results depicted in FIGS. 22B, C, and D show that NiTi is in pure tension with the neutral axis in the base beam. Strain variation across the thickness of the NiTi strip is about 2%. Even though superelasticity was not included in the model, the lower Young's modulus of the martensite would move the neutral surface closer to the middle of the base beam, leaving the NiTi in pure tension.

Figure 23A:
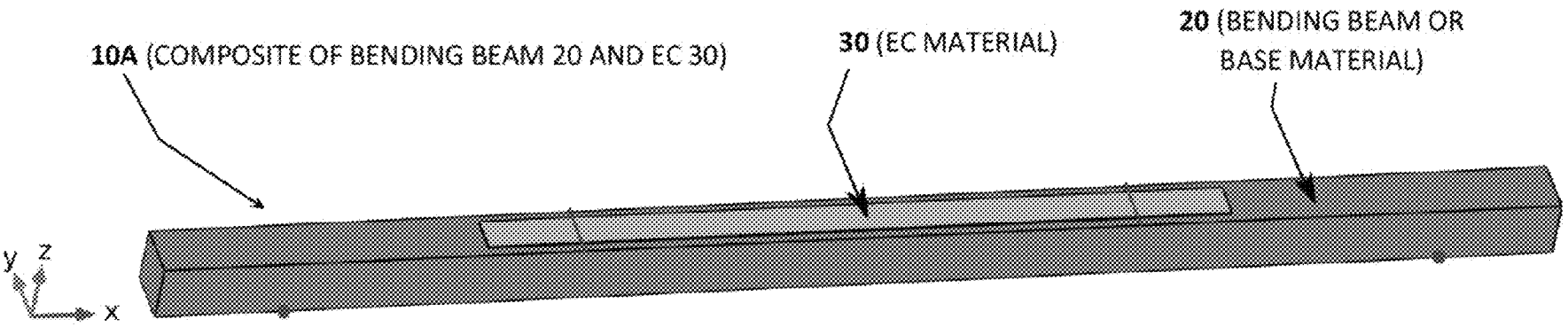
Figure 23B:
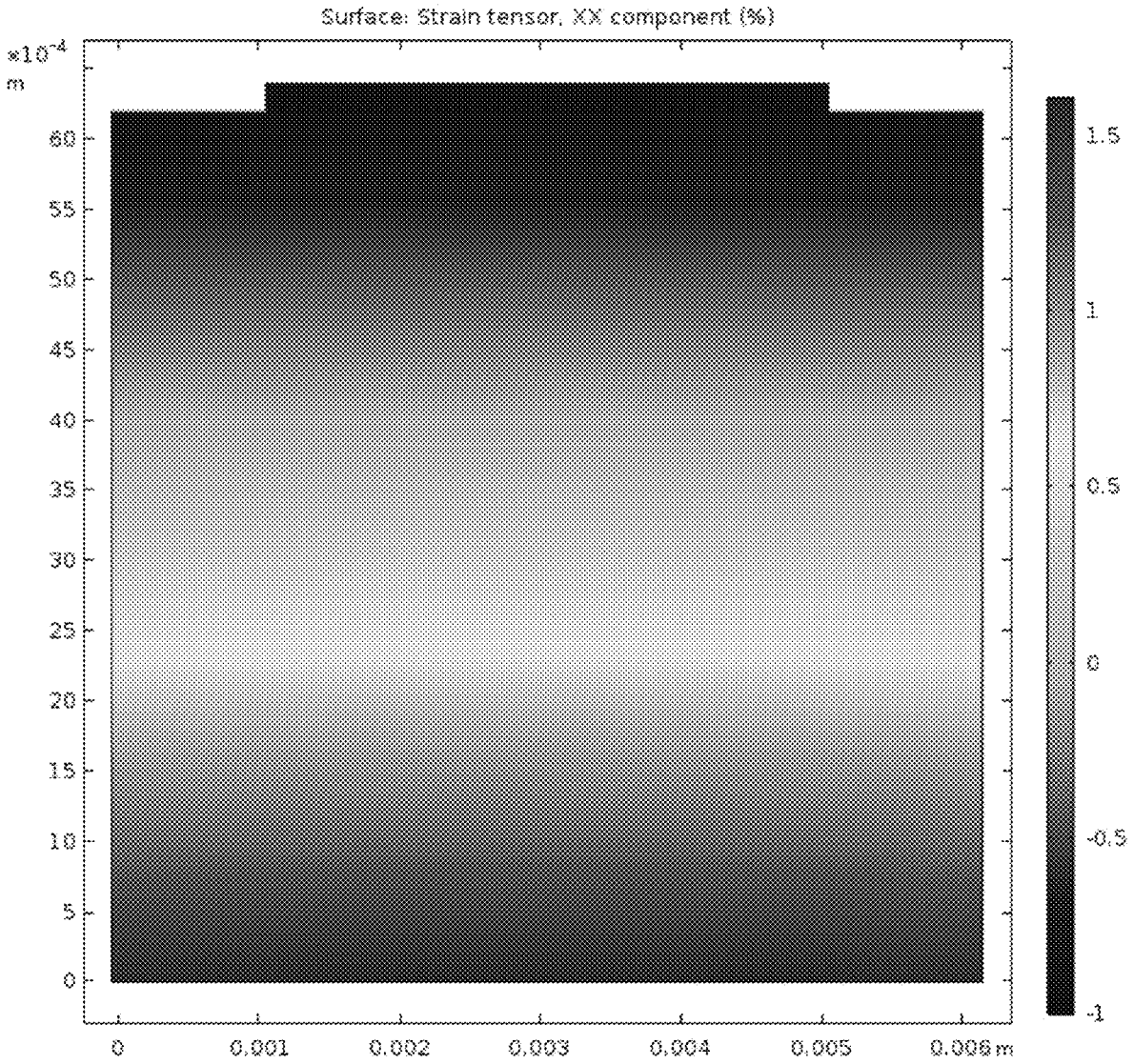
Figure 23C:
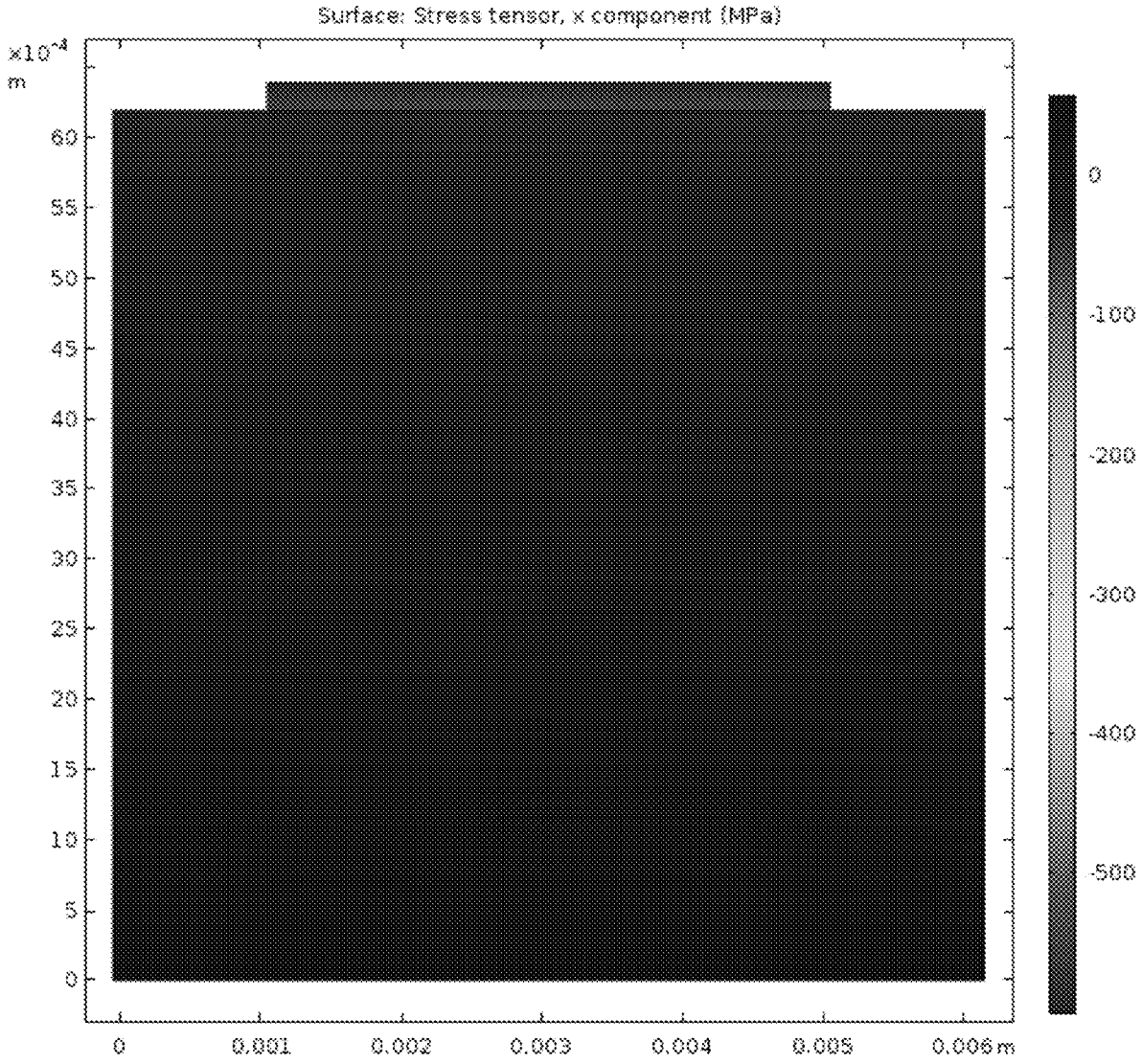
Figure 23D:
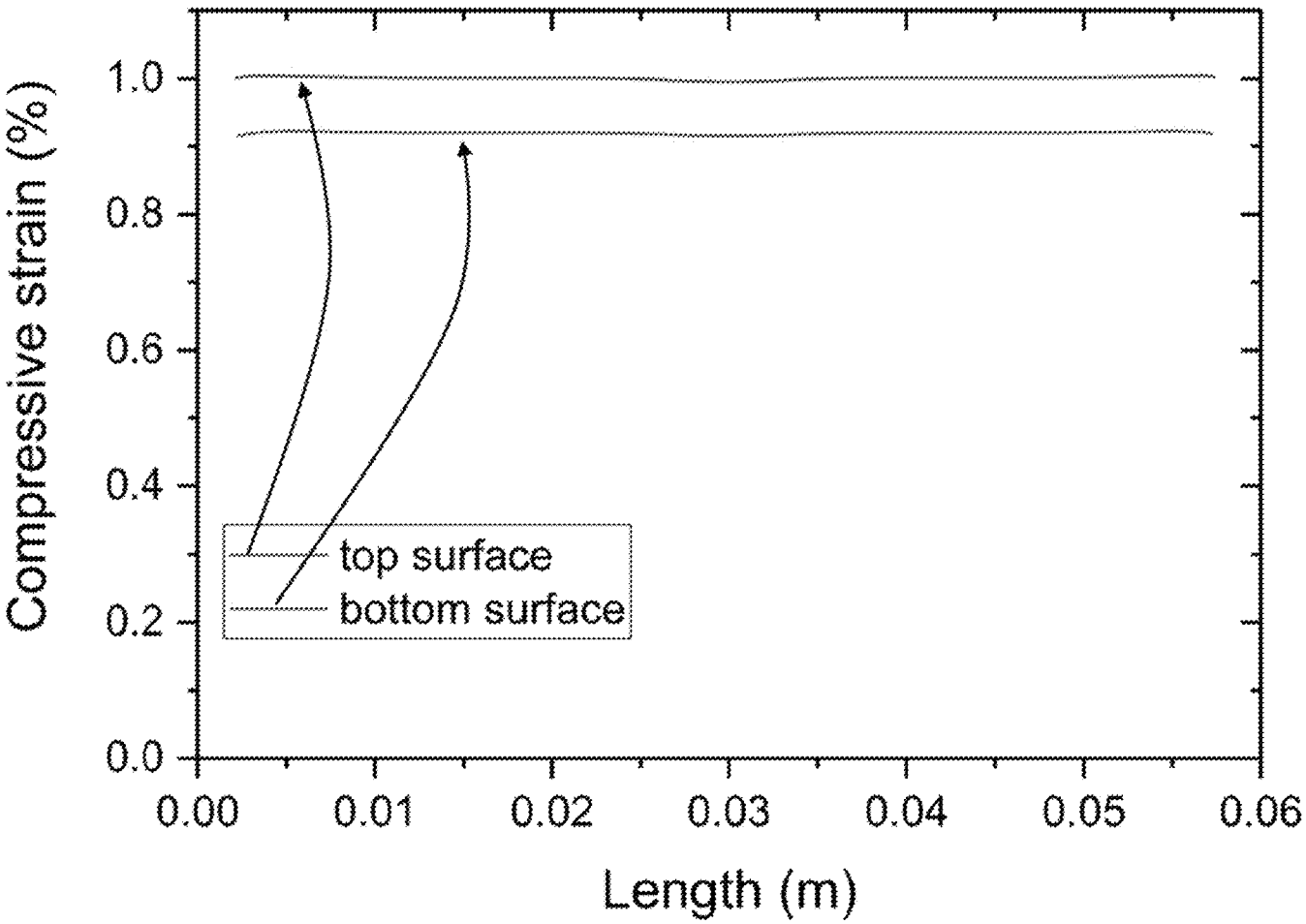
Figure 23E:
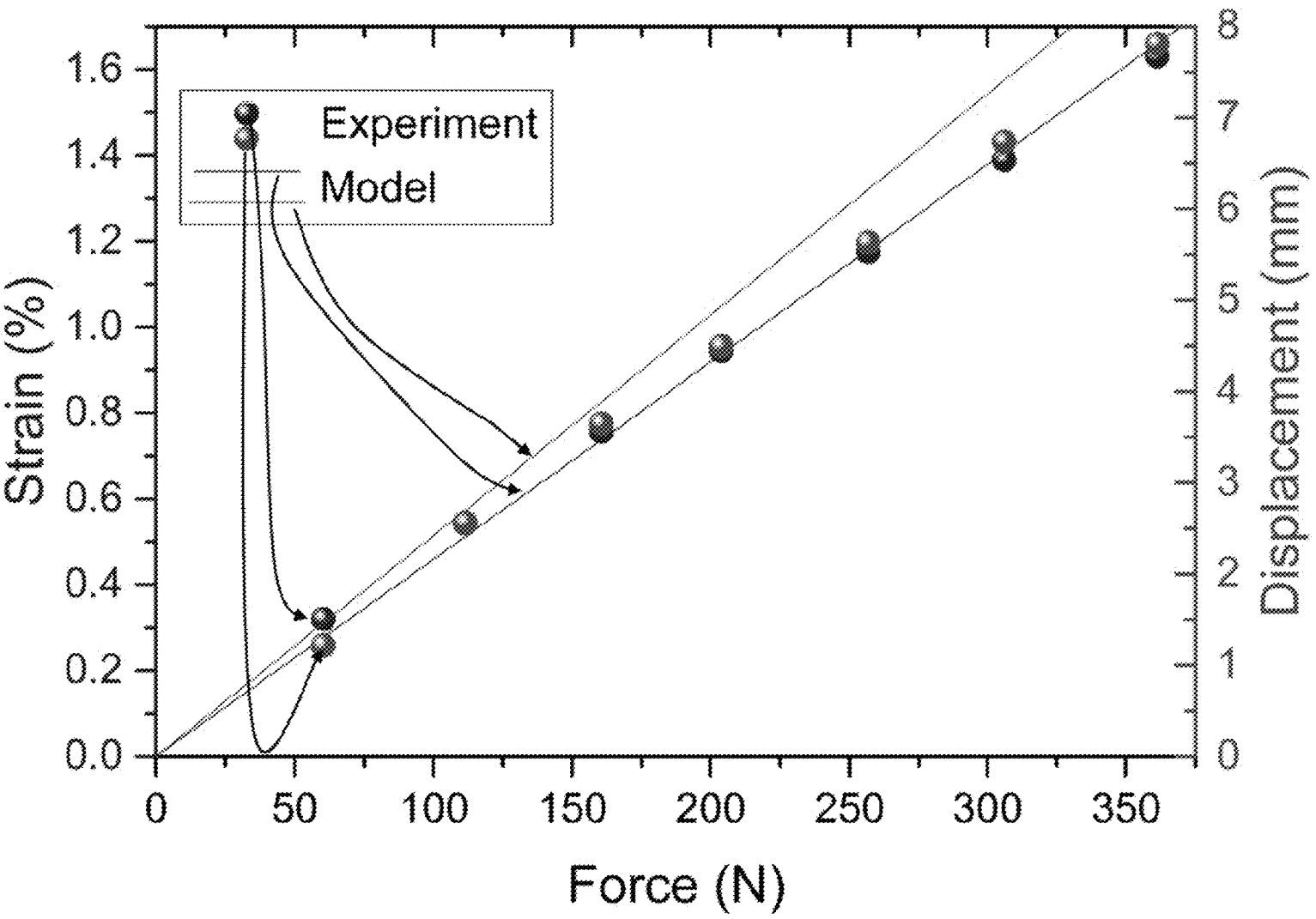

FIGS. 23A-E show COMSOL finite element analysis of the compressive-bending beam geometry subjected to 218 N load. FIG. 23A shows model geometry: NiTi strip 30, base beam 20, red lines-load locations, red dots-support locations. Axial strain (FIG. 23B) and stress (FIG. 23C) distribution in the cross-section through sample is shown. FIG. 23D shows axial strain vs. length of the NiTi strip between loading pins. FIG. 23E shows model validation. The purpose of the model was to evaluate stress and strain distribution in the composite structure in elastic region of the NiTi stress-strain curve. Materials properties used in the analysis are listed in Supplementary table 2 Supplementary Table 2. The numerical results for displacement of the loading fixture and strain on the top surface of elastocaloric material were compared with experimental data. Strain results are in excellent agreement, but a small discrepancy in the displacement is visible. The numerical simulations confirm that the 60 mm of NiTi is entirely in compression and the neutral surface is located in the plastic beam. The strain in NiTi is uniform across its length and it decreases by about 8% from the top surface to the bottom. As in the tensile-bending beam, the Young's modulus of NiTi decreases in the superelastic region, which moves the neutral surface closer to the middle of the base beam, allowing NiTi to remain in pure compression and lowering the force required to increase strain.

Figure 24A:
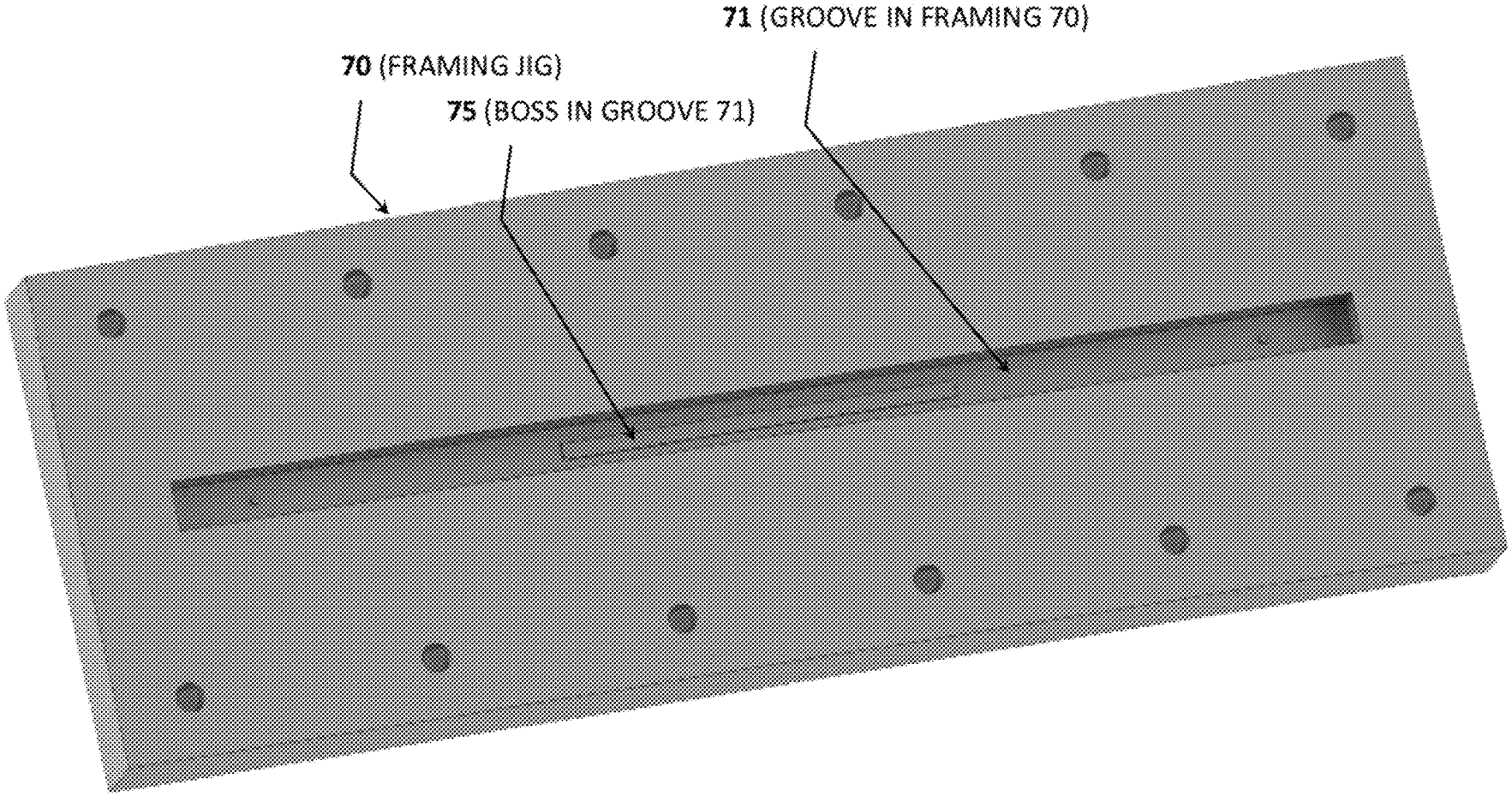
Figure 24B:
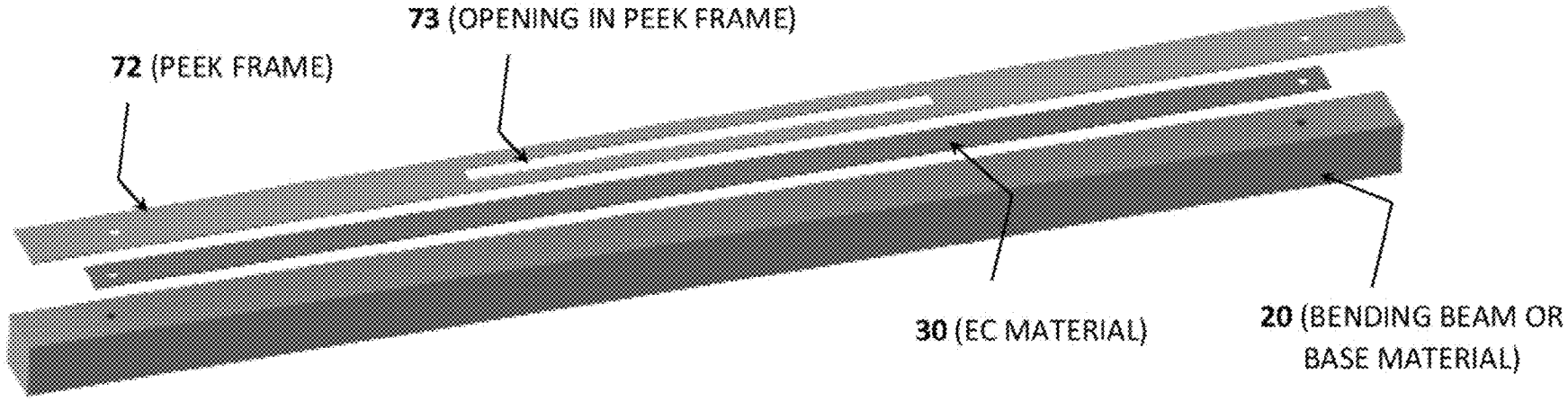
Figure 24C:
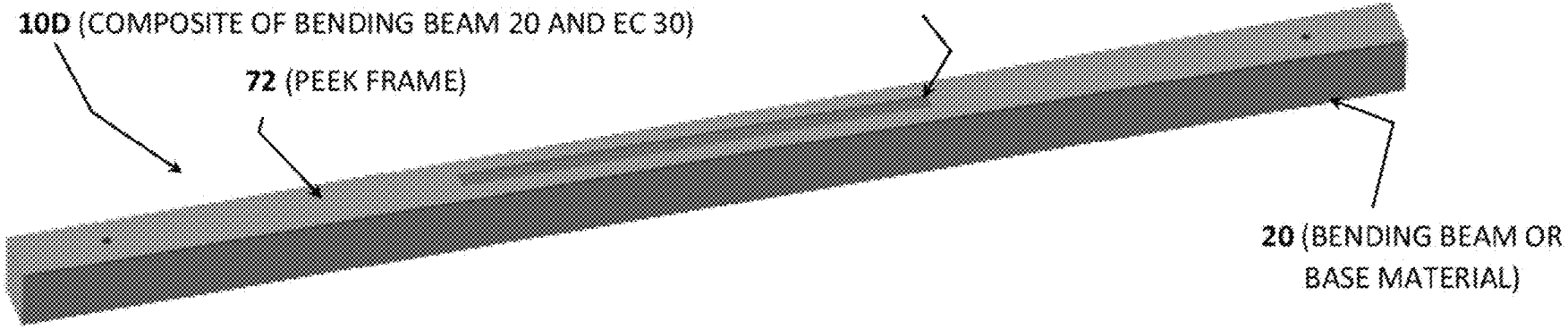
Figure 24D:
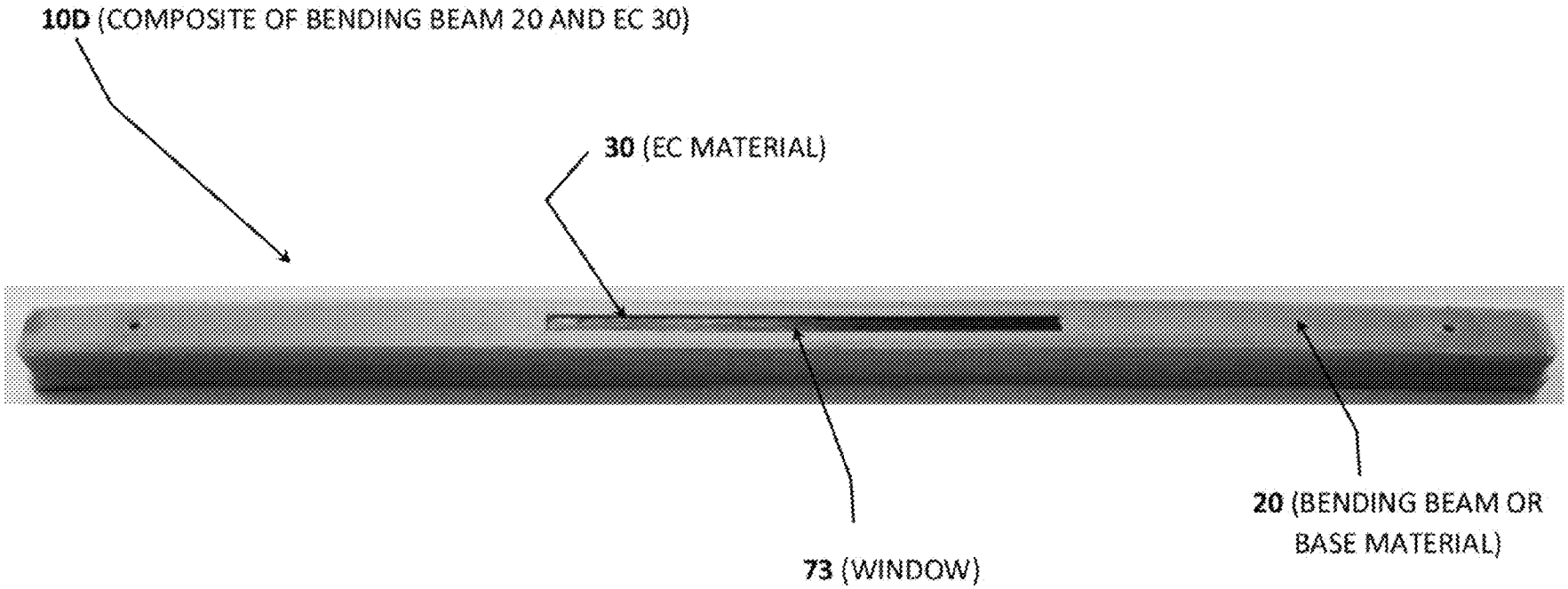

FIGS. 24A-D show a method of framing an elastocaloric strip. FIG. 24A shows jig 70, FIG. 24B is an exploded view of the composite beam: PEEK frame 72 (with opening 73), NiTi strip 30, PEEK beam 20. FIG. 24C shows assembled beam 10. FIG. 24D is a photograph of a finished composite beam.

Figure 25A:
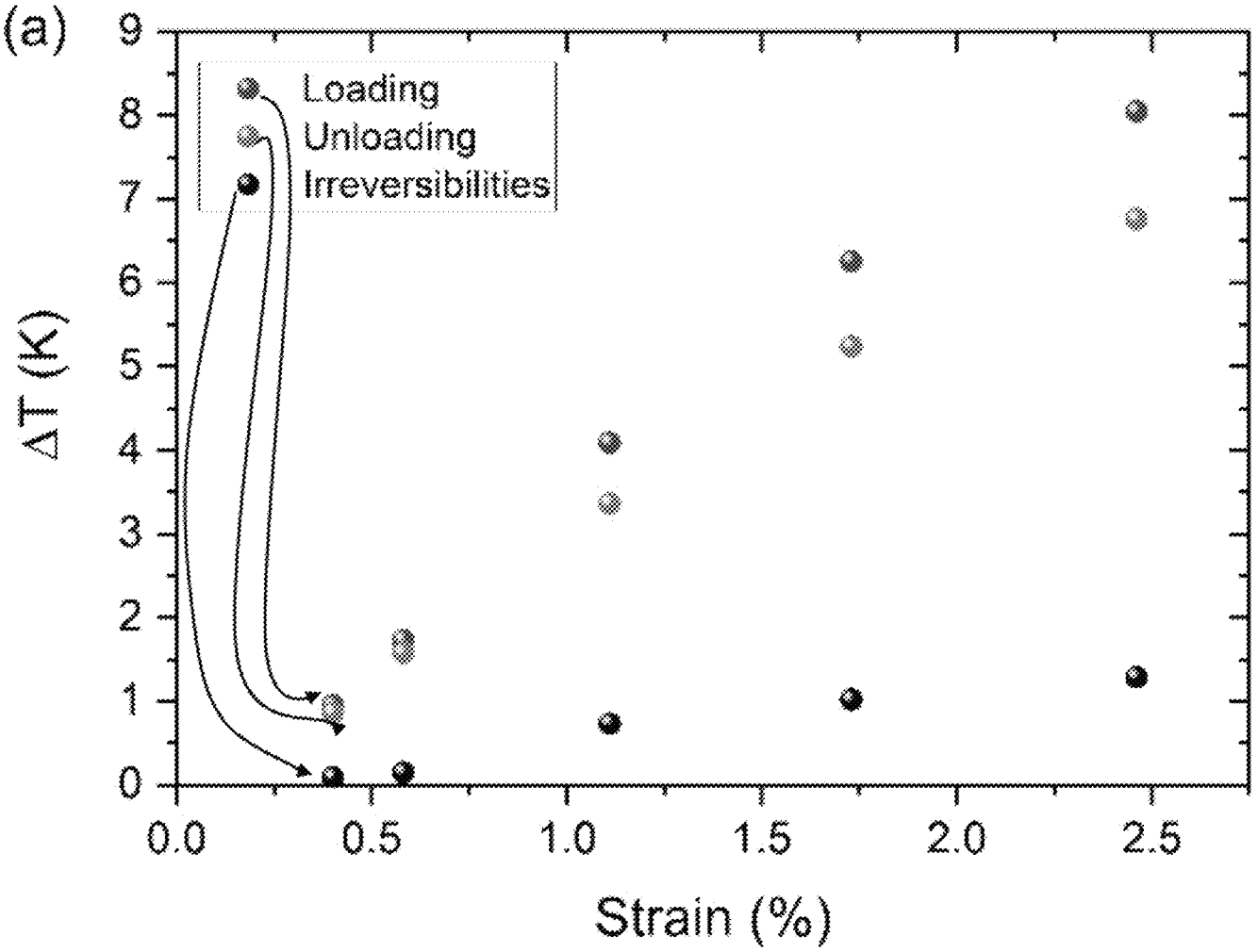
Figure 25B:
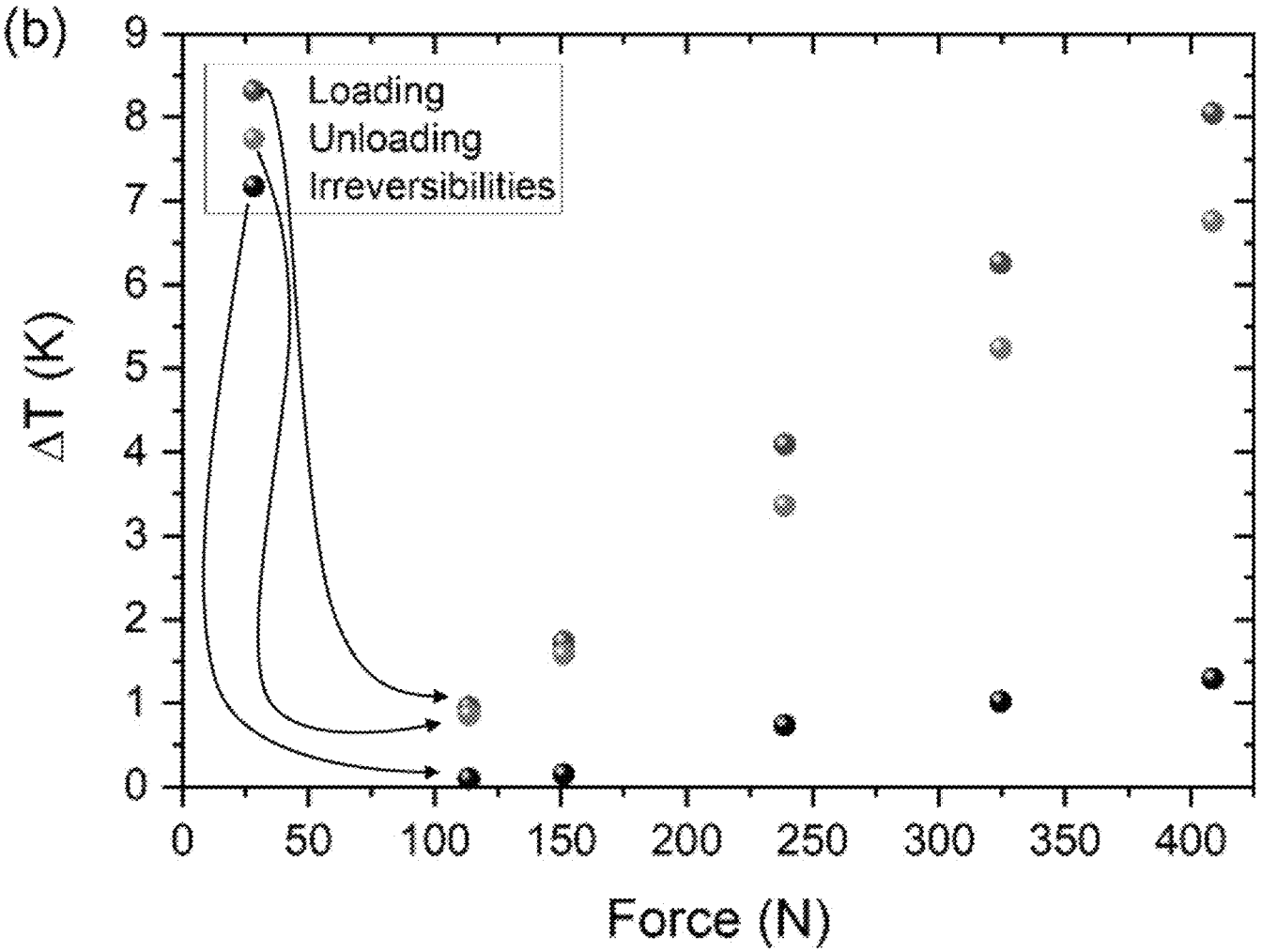
Figure 25C:
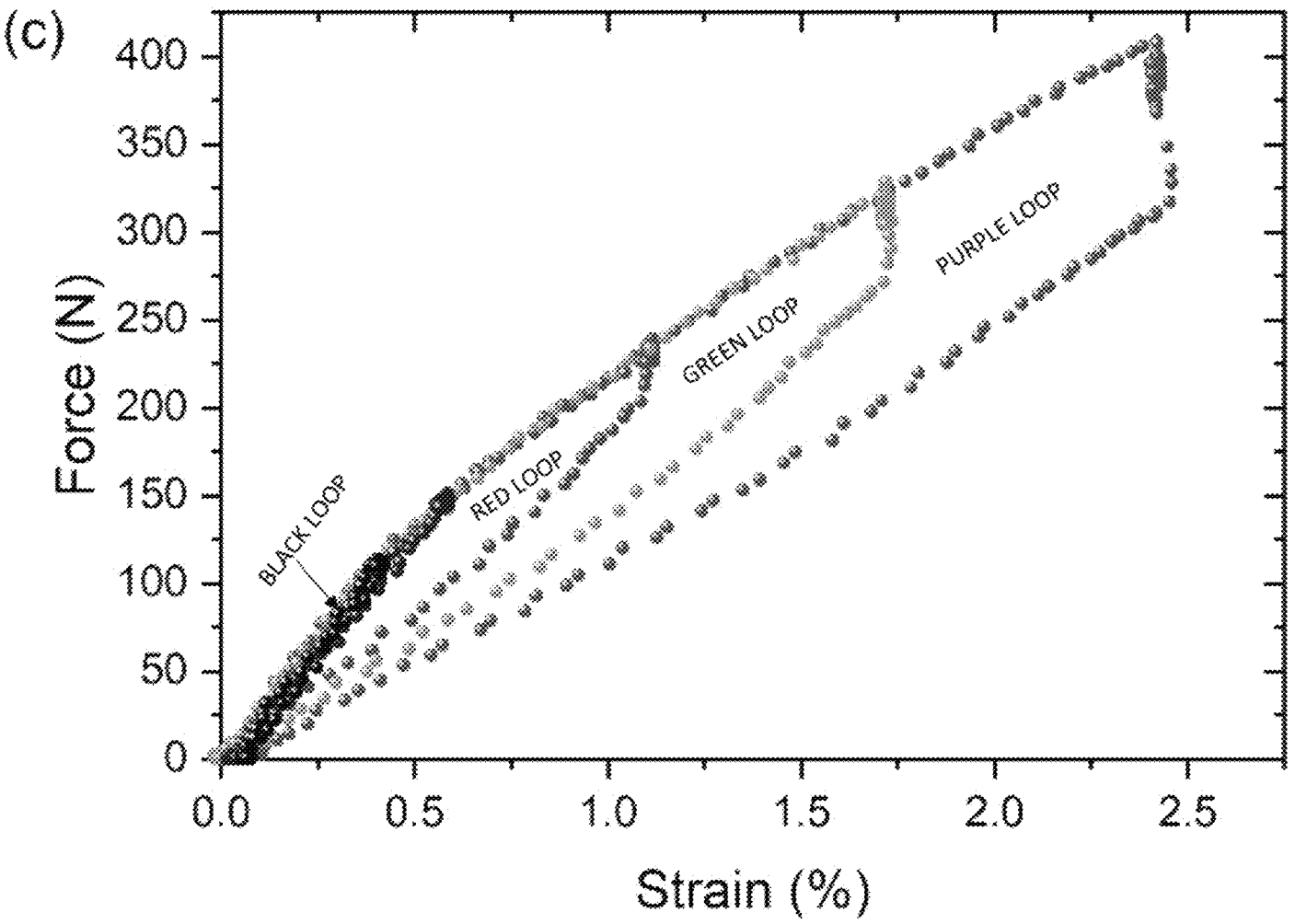

FIGS. 25A-C show data regarding temperature change (positive during loading and negative during unloading) and strain analysis for assembled, untrained composite beams made according to FIGS. 24A-D, namely temperature change vs. strain (FIG. 25A), temperature change vs. force (FIG. 25B), and force-strain loops (FIG. 25C).

Figure 26:
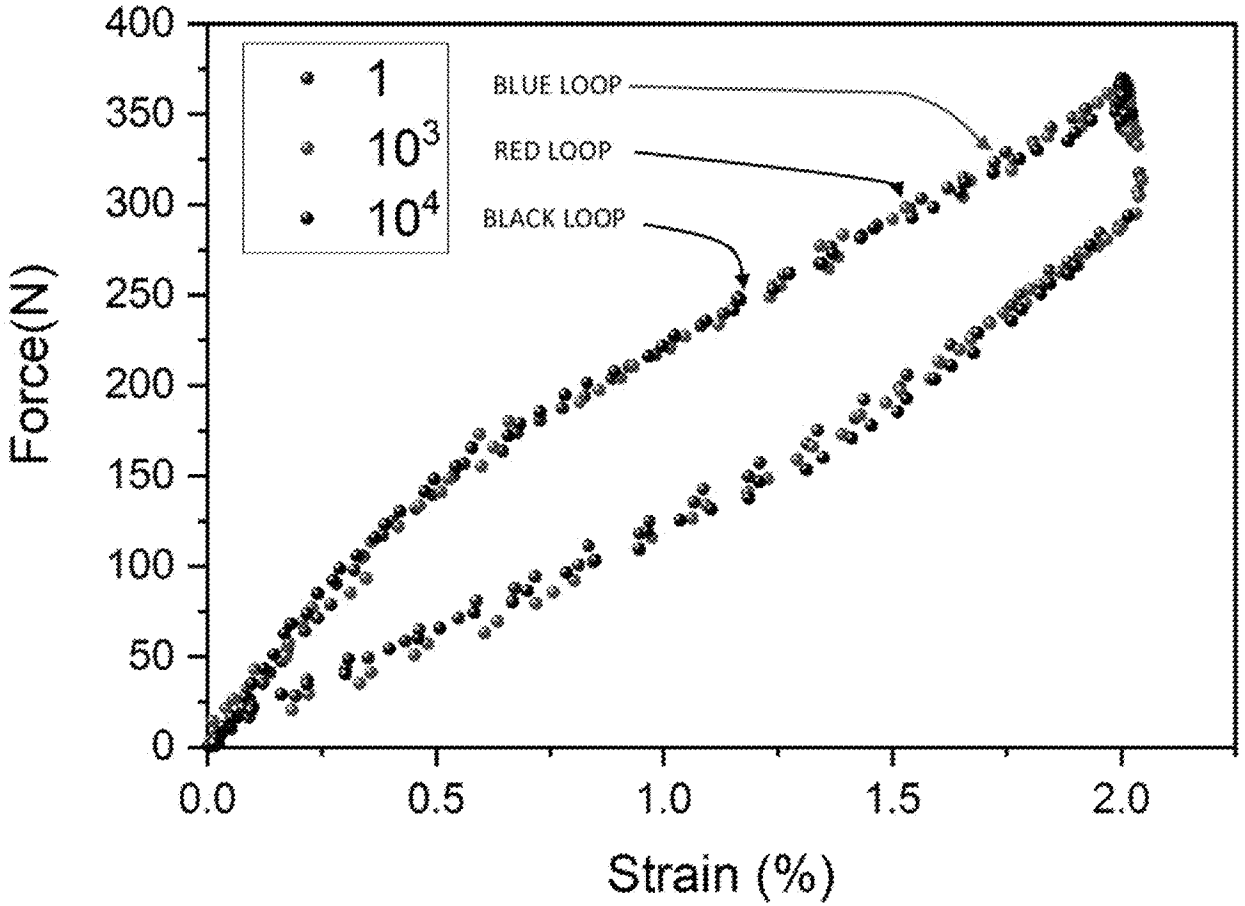

FIG. 26 shows cyclic force-strain analysis for embodiments according to FIGS. 24A-D, namely comparison of $1^{st}$, $1{,}000^{th}$ and $10{,}000^{th}$ cycles.

Figure 27A:
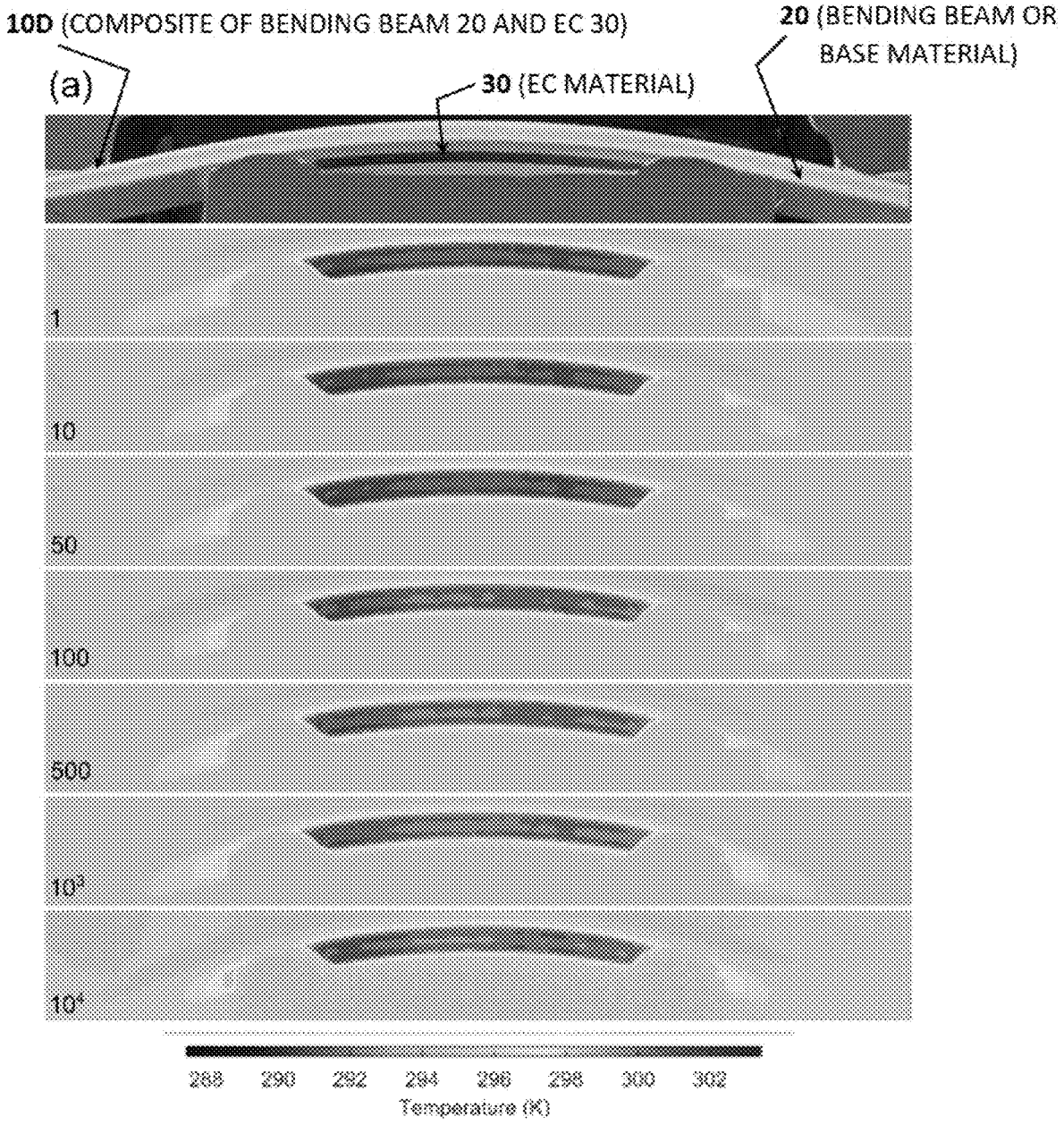
Figure 27B:
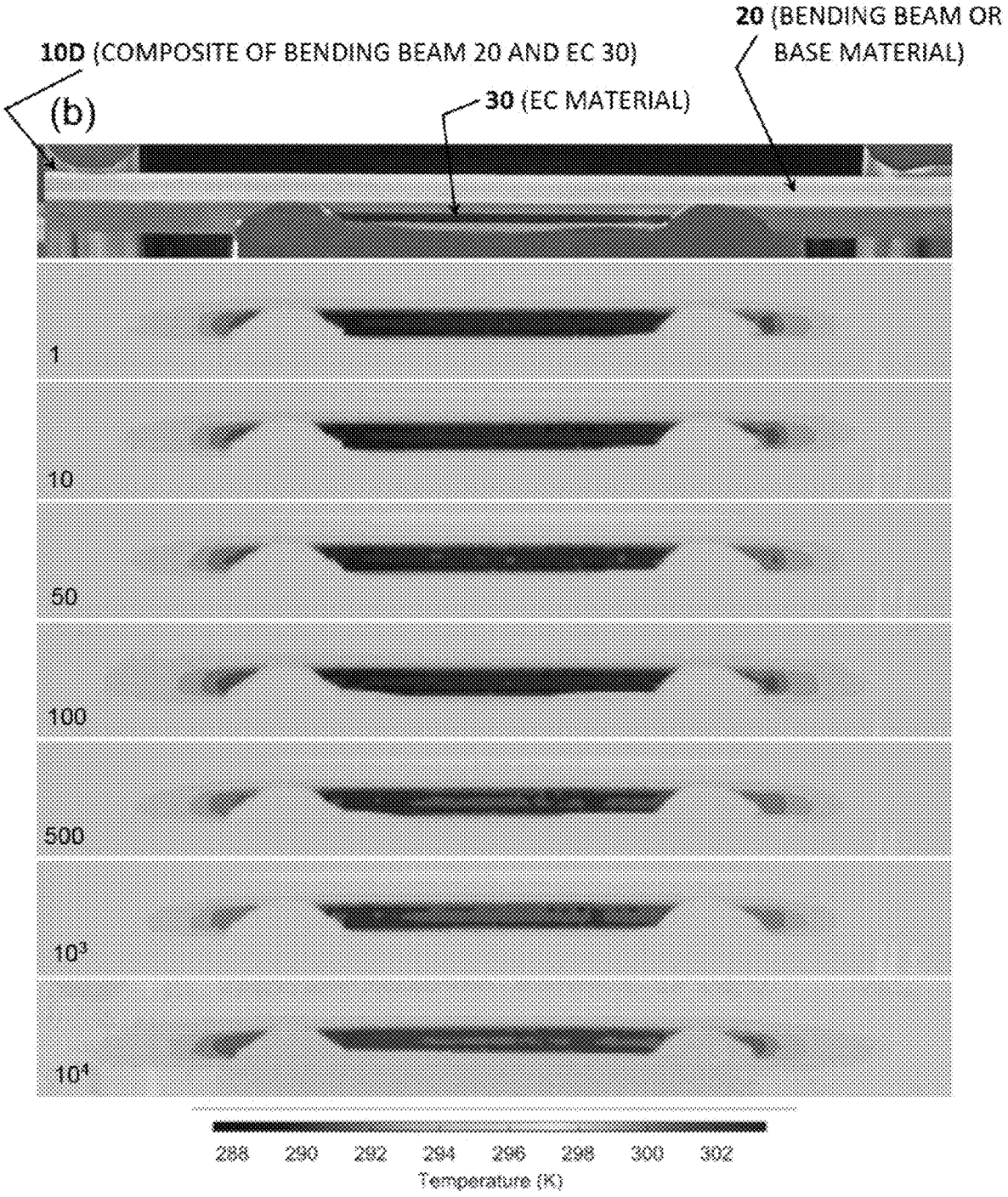
Figure 27C:
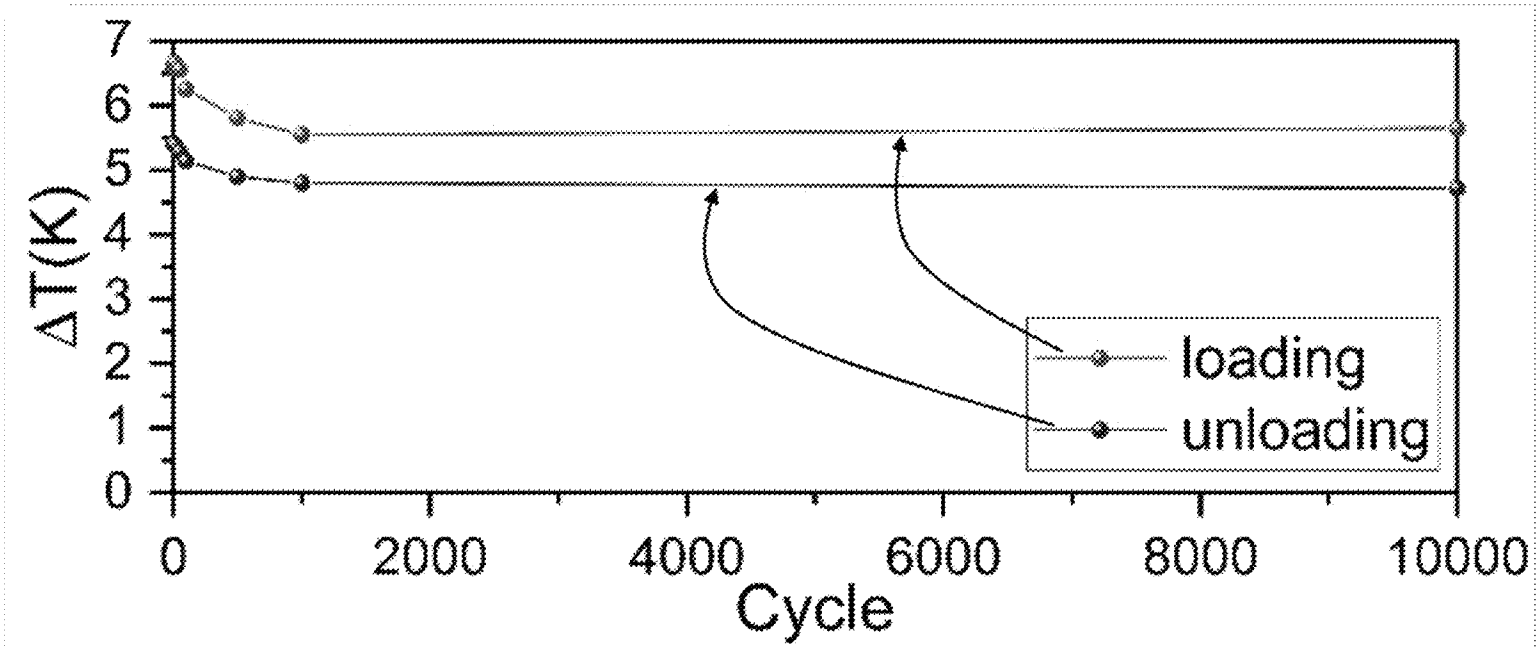

FIGS. 27A-C show impact of cycling on NiTi temperature changes for embodiments according to FIGS. 24-D. Temperature distribution for selected loading (FIG. 27A) and unloading (FIG. 27B) cycles (cycle number is shown in the bottom left corner of each map). FIG. 27C shows temperature changes vs. cycle number.

Figure 28:
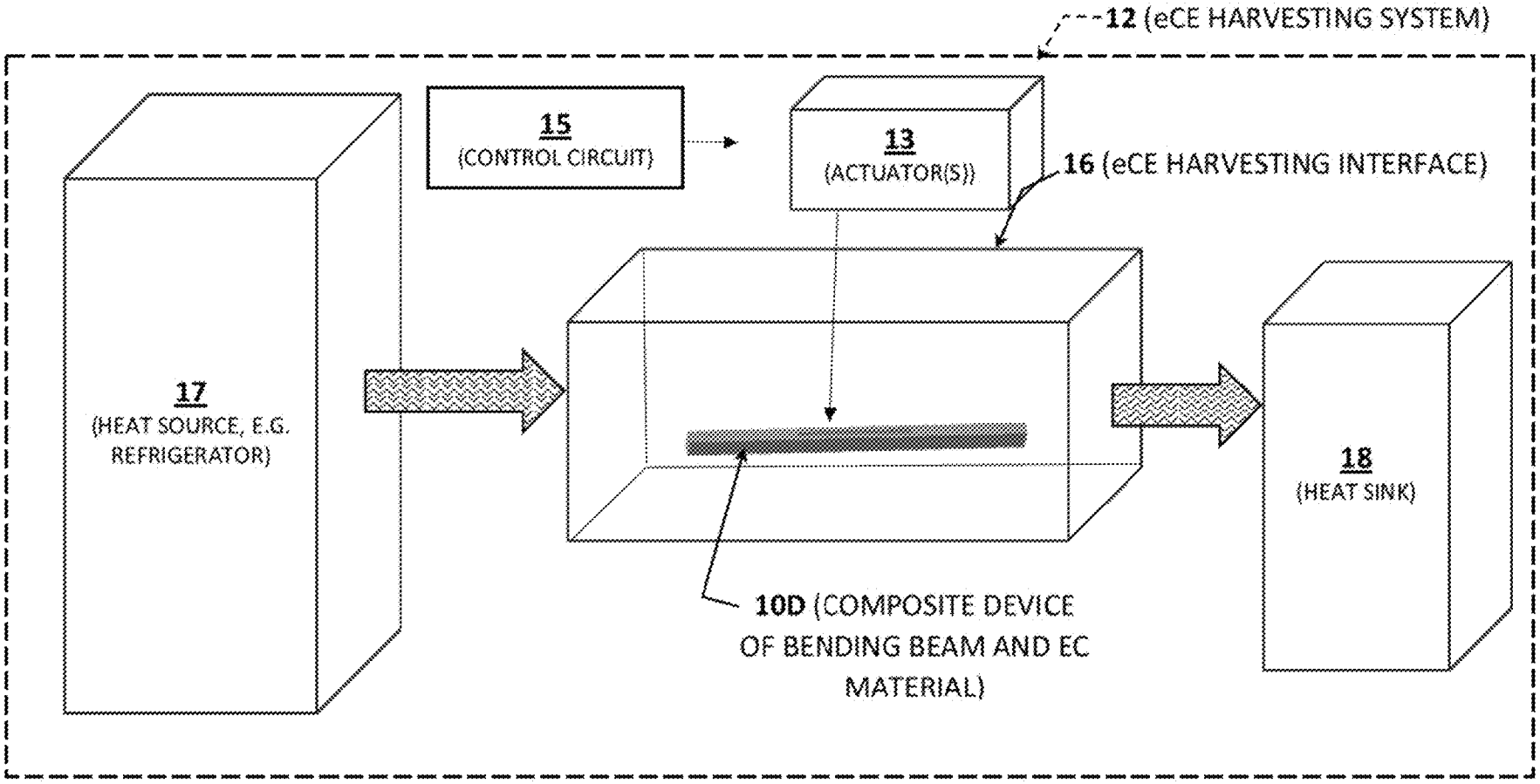

FIG. 28 is a diagram of an overall EC harvesting system with the composite bending beam 10D of FIGS. 24-27.

Figure 29A:
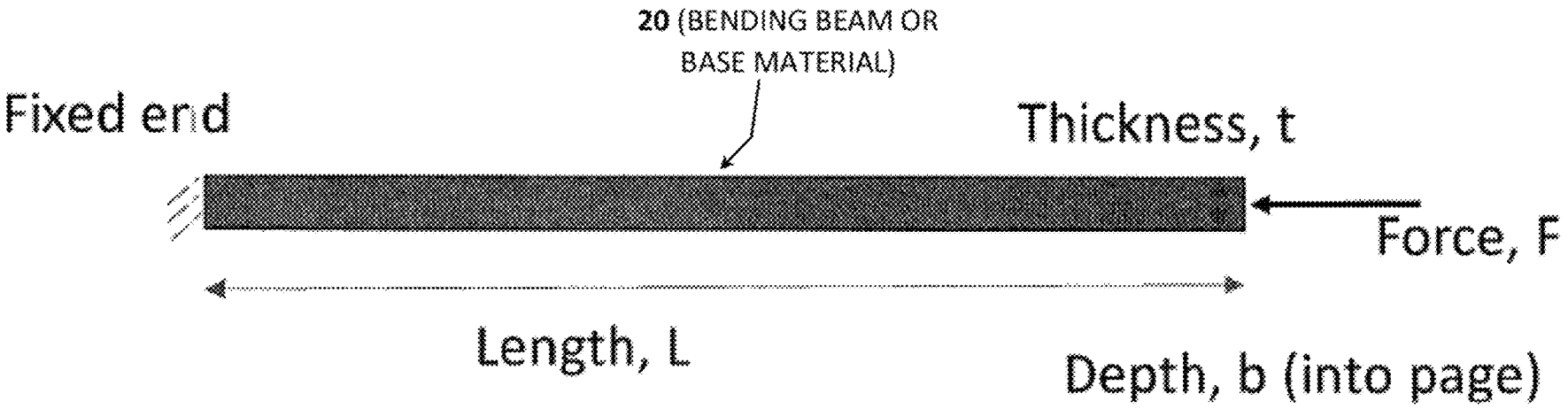
Figure 29B:
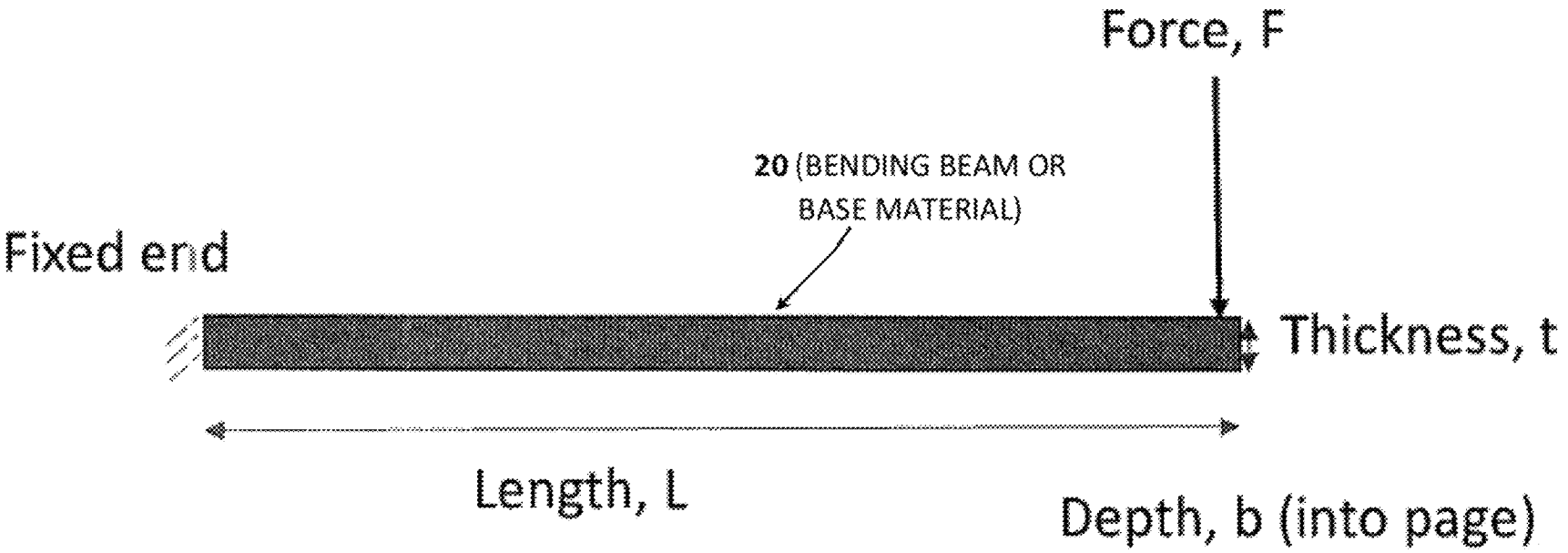
Figure 30:
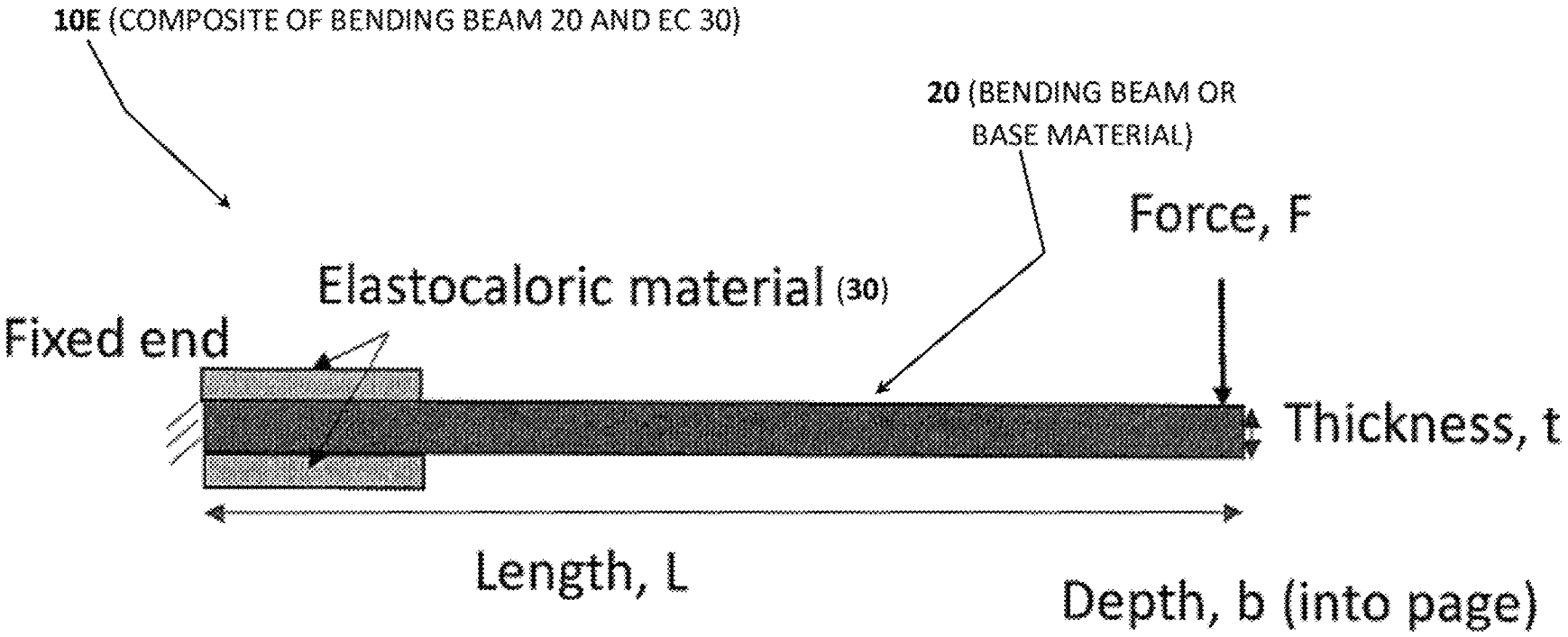

FIGS. 29A-B, and 30 are diagrammatic views illustrating an alternative cantilever beam embodiment according to the invention.

FIGS. 31A-C, 32A-C, and 33A-C are, respectively, diagrammatic depictions of alternative embodiments of a cantilevered bending beam with elastocaloric patches on opposite sides of one end, including data about the elastocaloric output and performance of those patches if the beam is oscillated up and down.

Figure 34A:
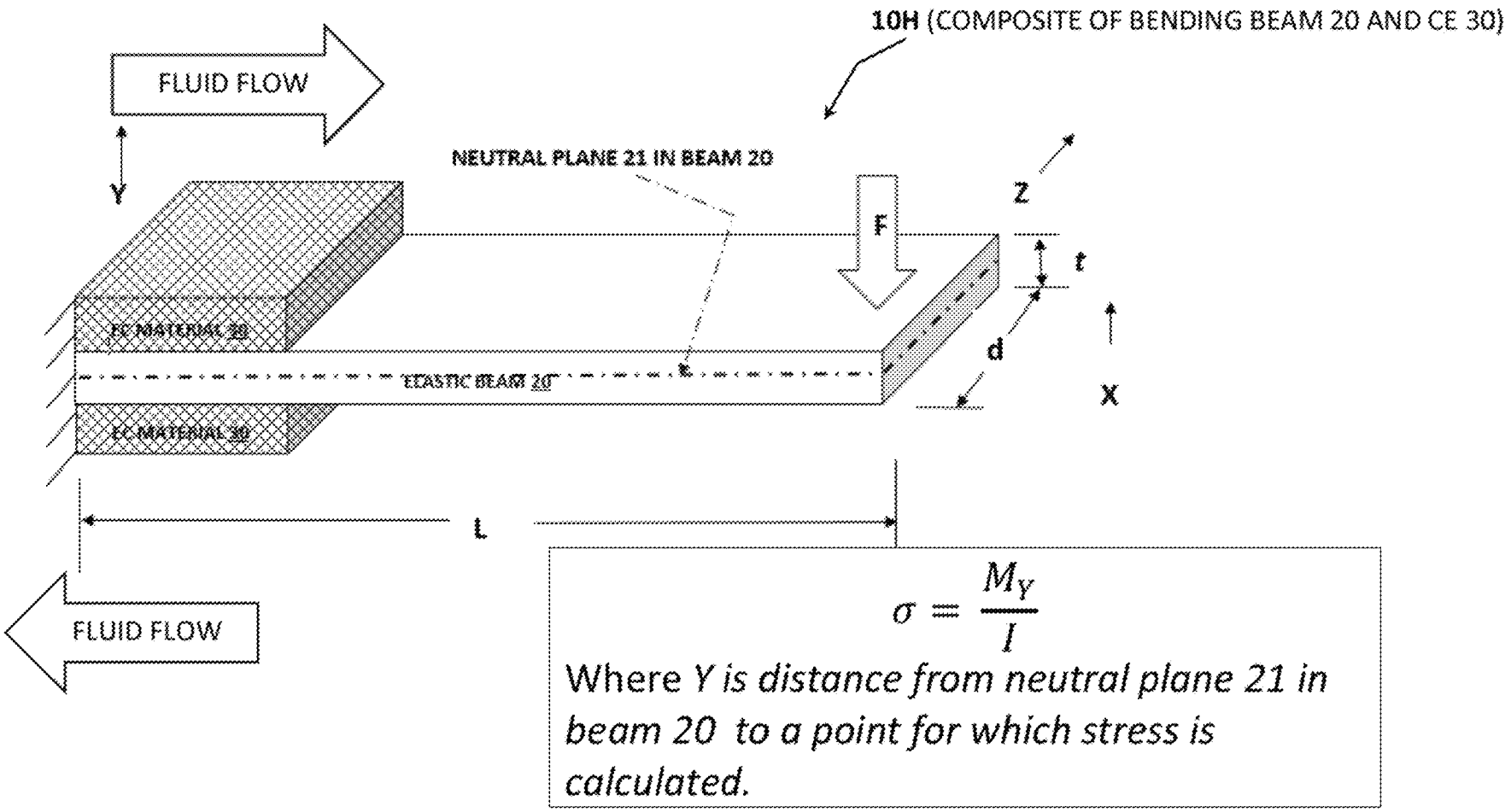

FIGS. 34A and B are further illustrations of a cantilever bending beam and its performance according to aspects of the invention.

Figure 33A:
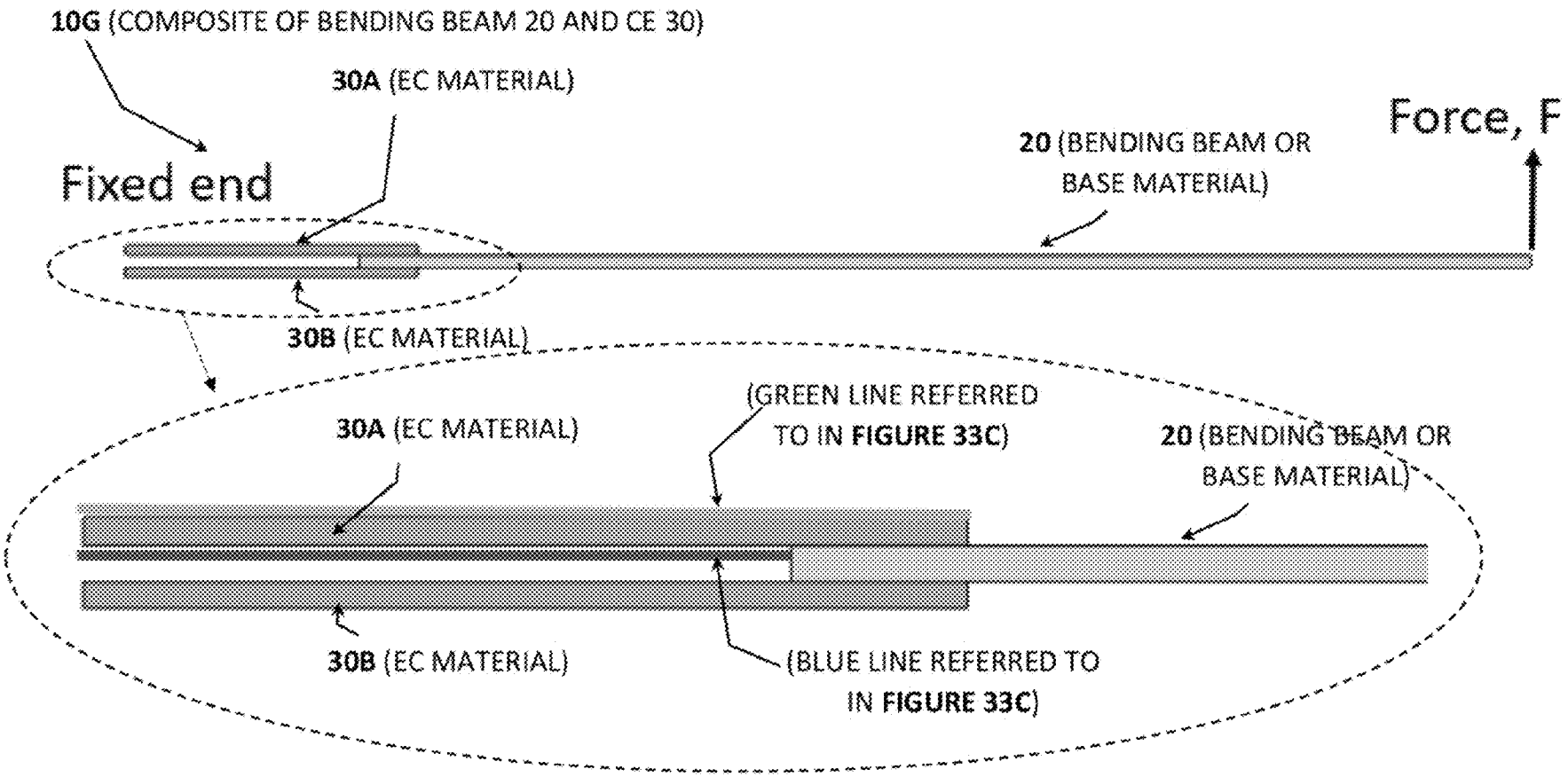
Figure 33B:
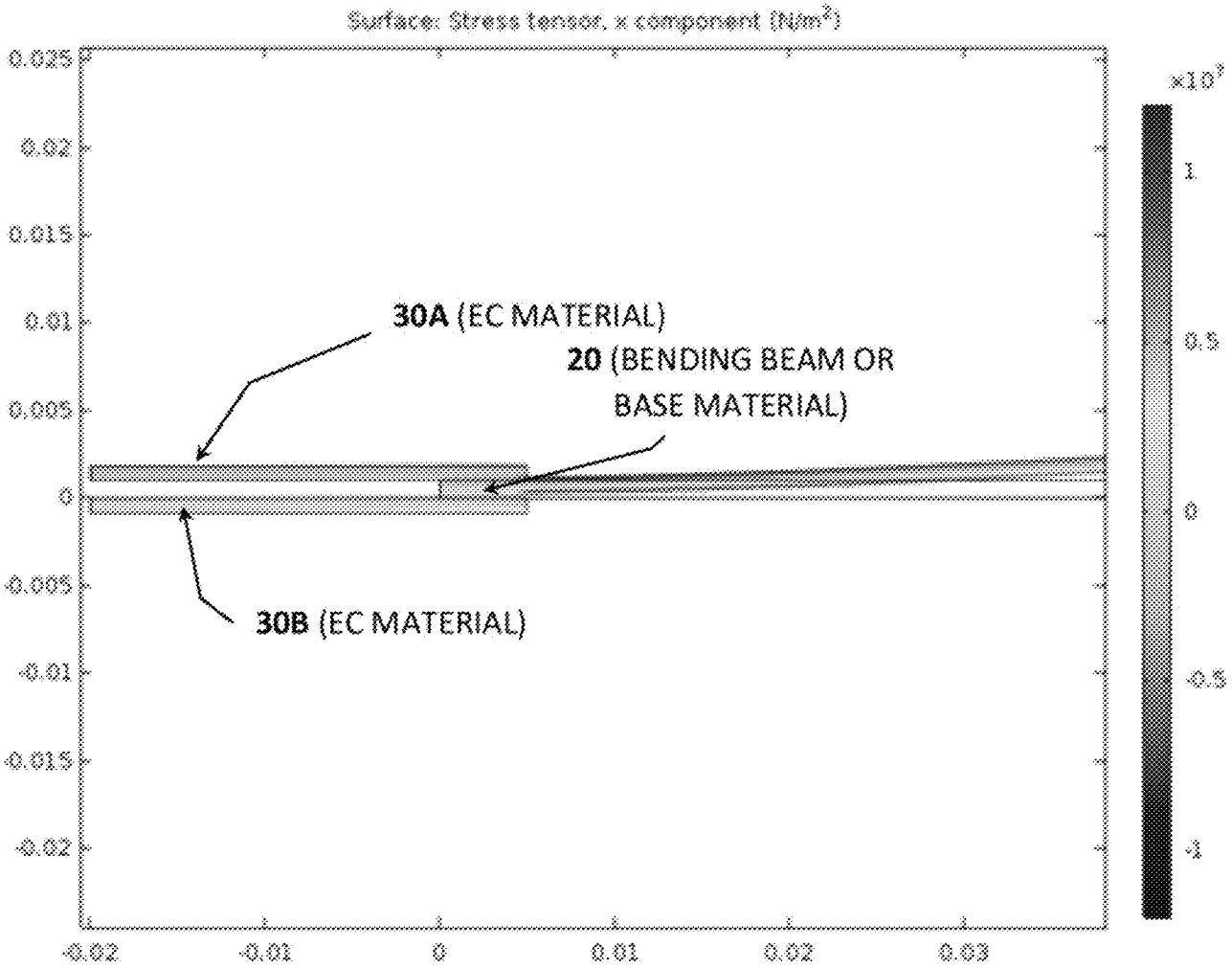
Figure 33C:
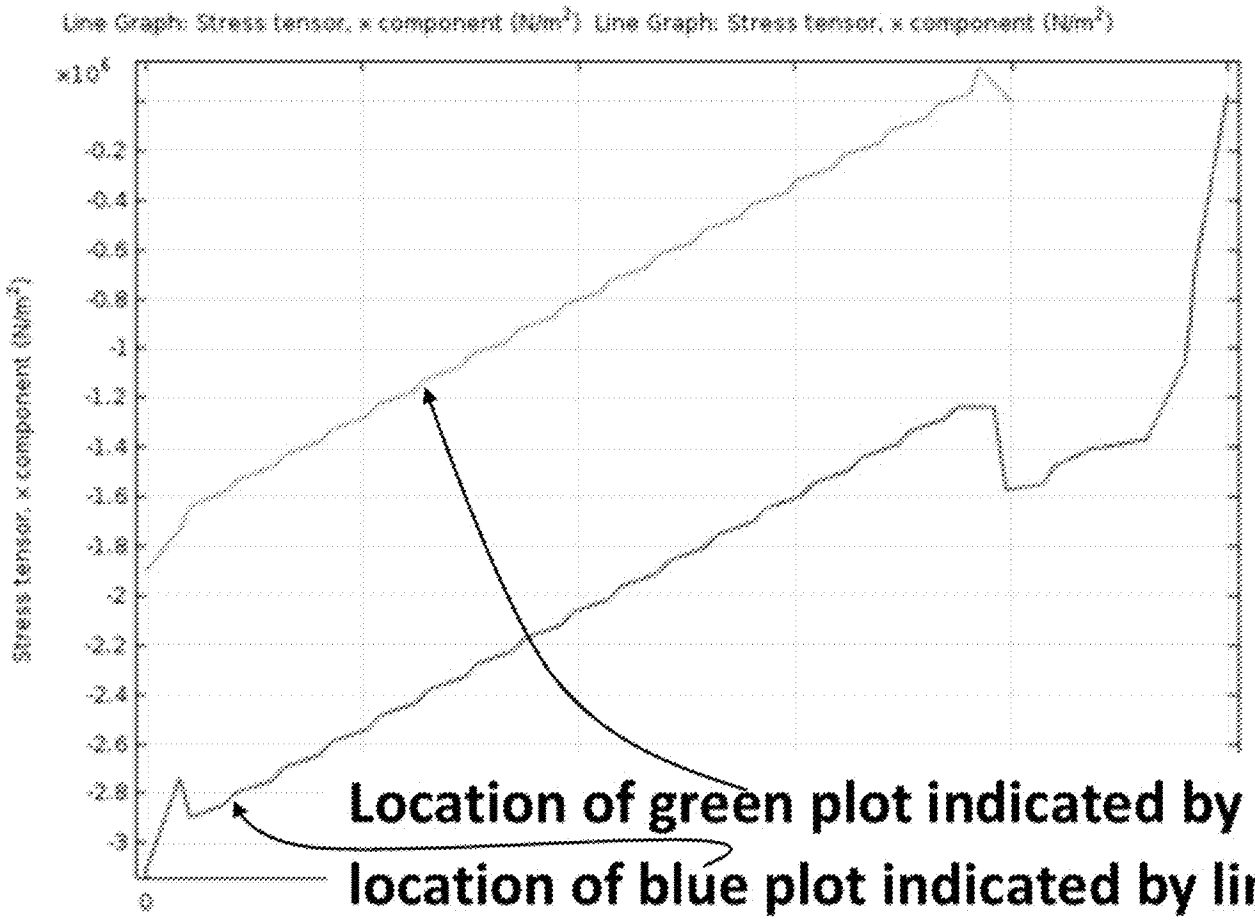
Figure 34B:
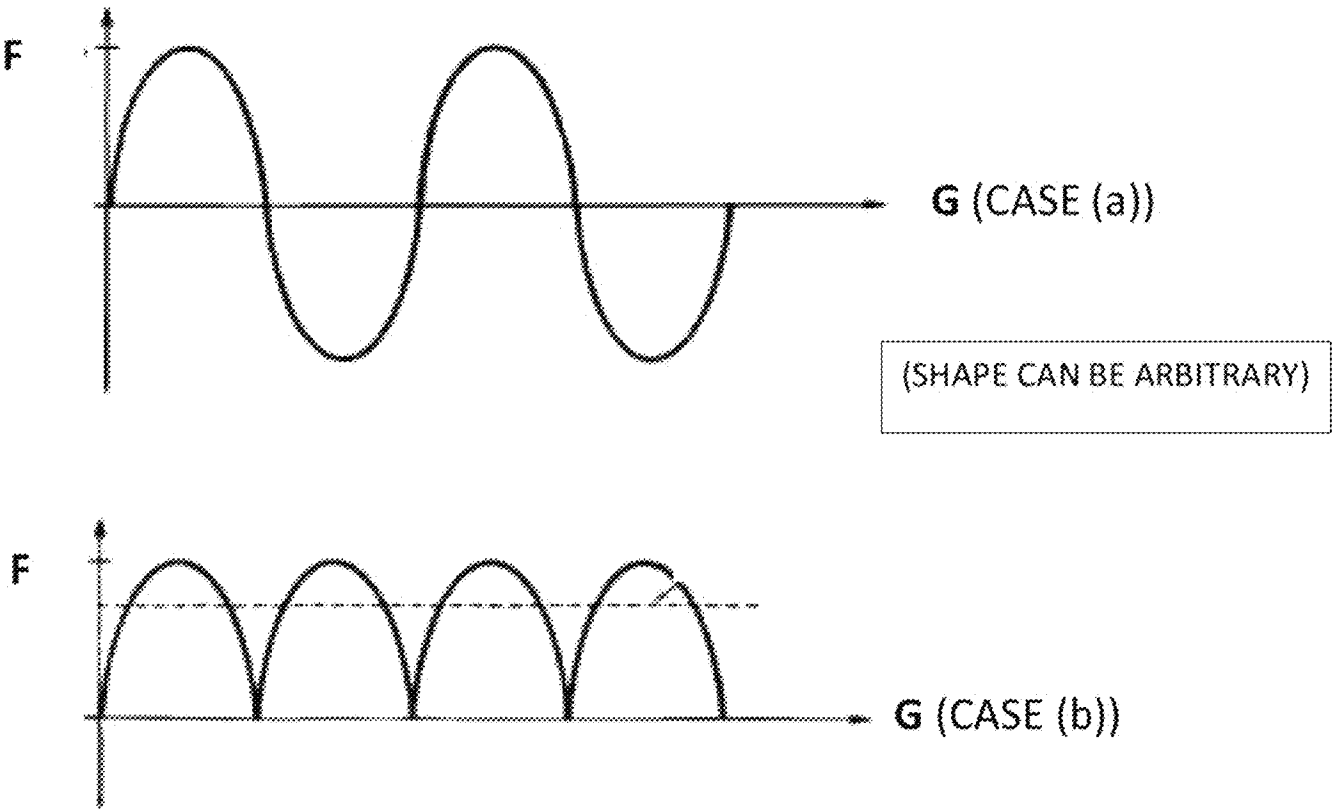
Figure 35:
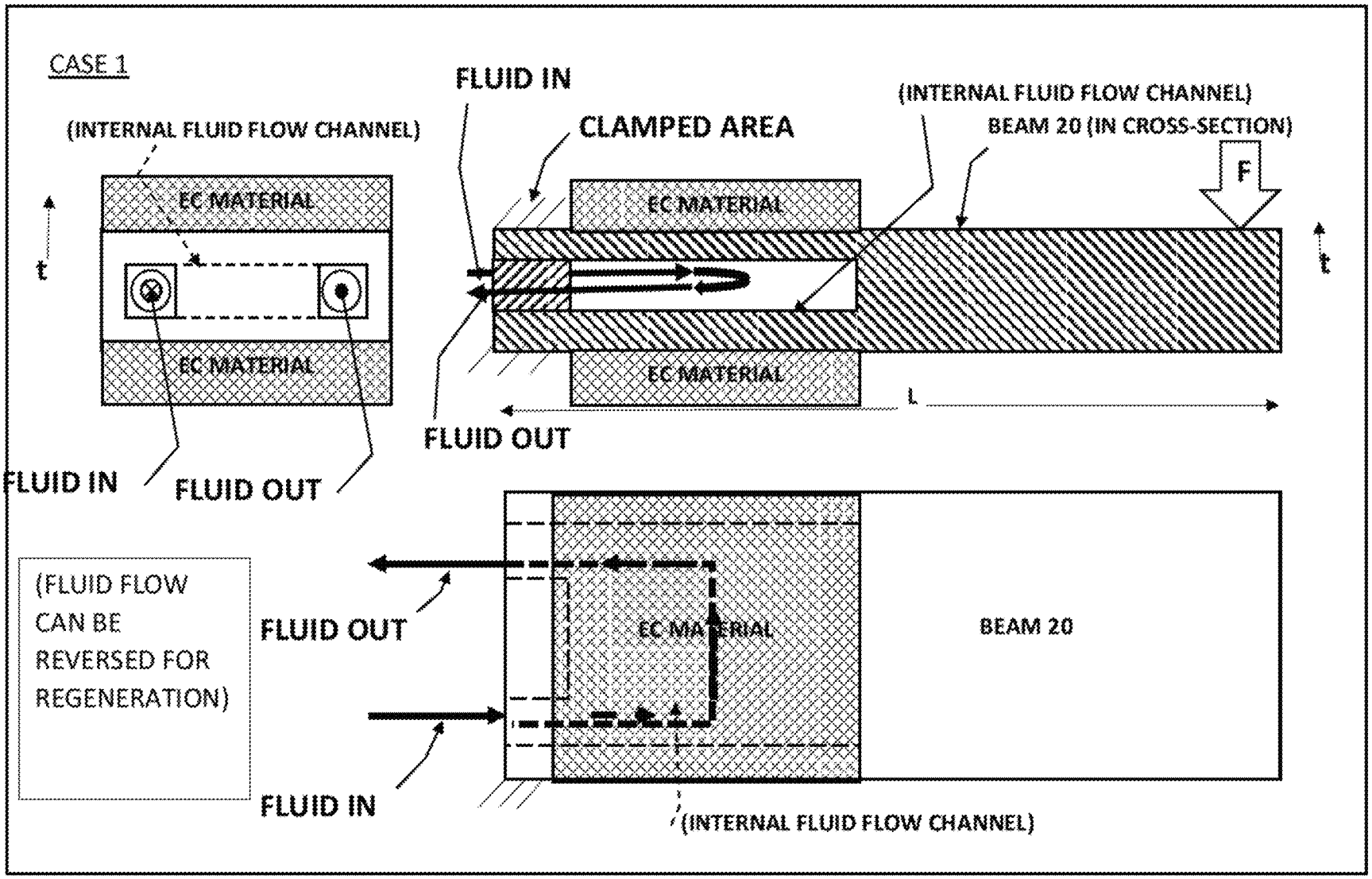
Figure 36:
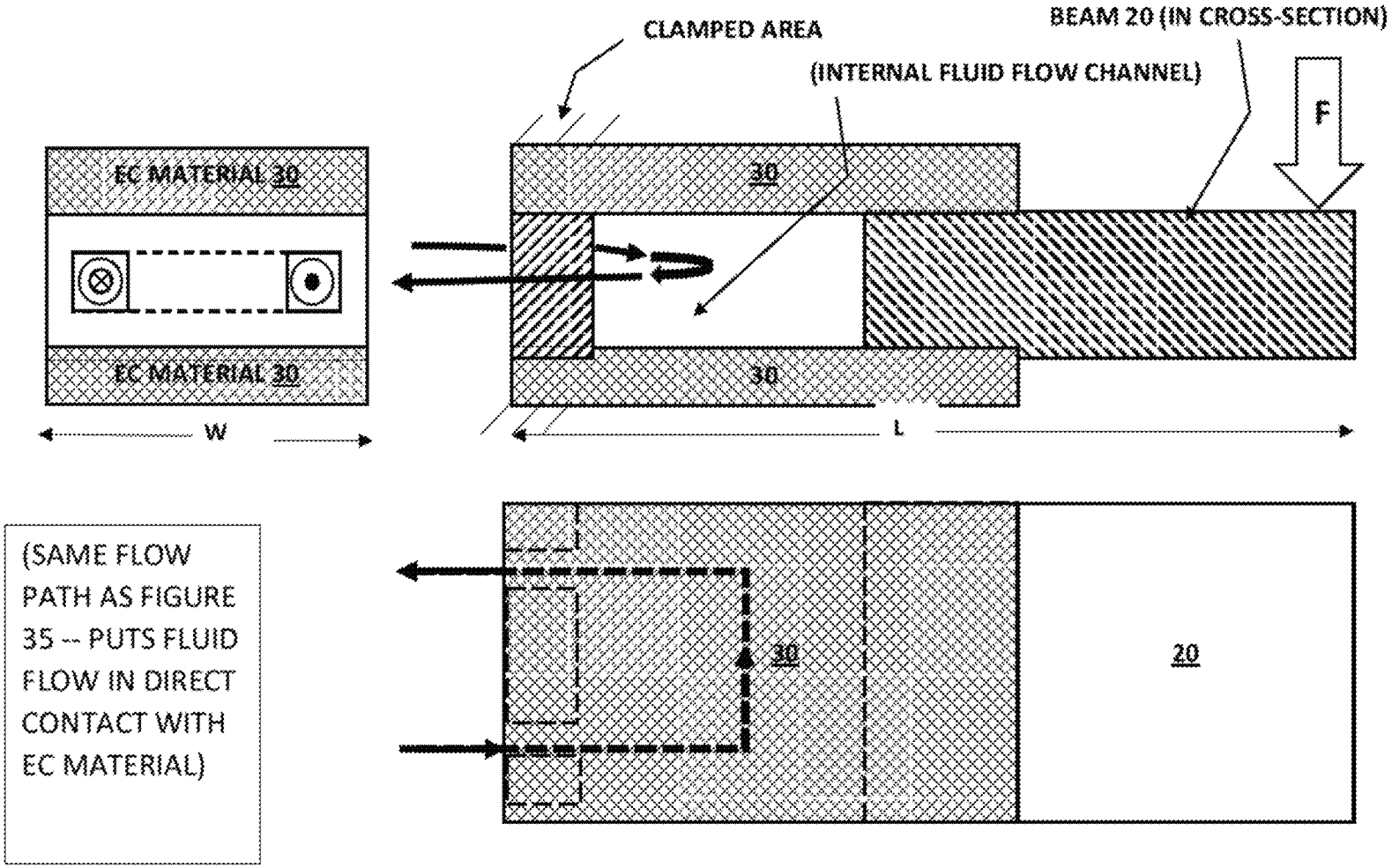

FIGS. 35 and 36 diagrammatically depict several non-limiting examples of heat exchange by fluid flow that can be used with the embodiments of FIGS. 29 to 34.

Figure 37A:
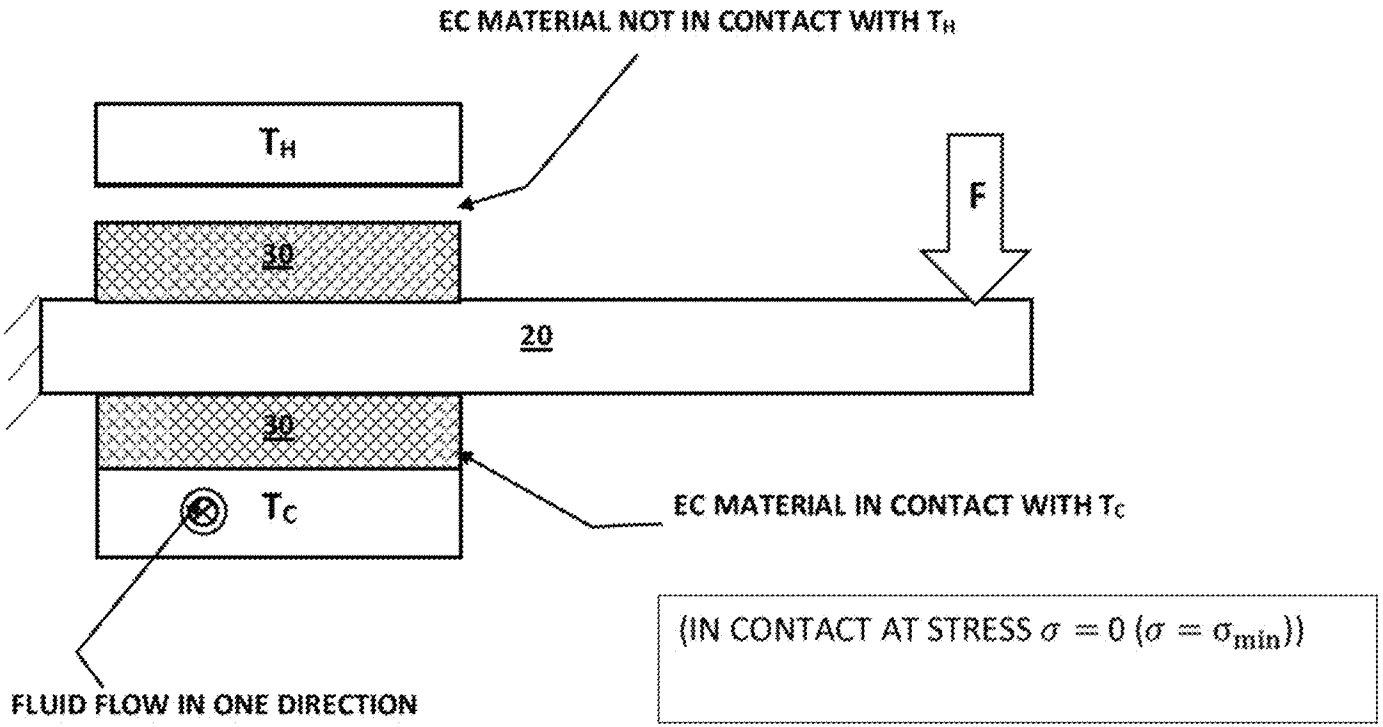
Figure 37B:
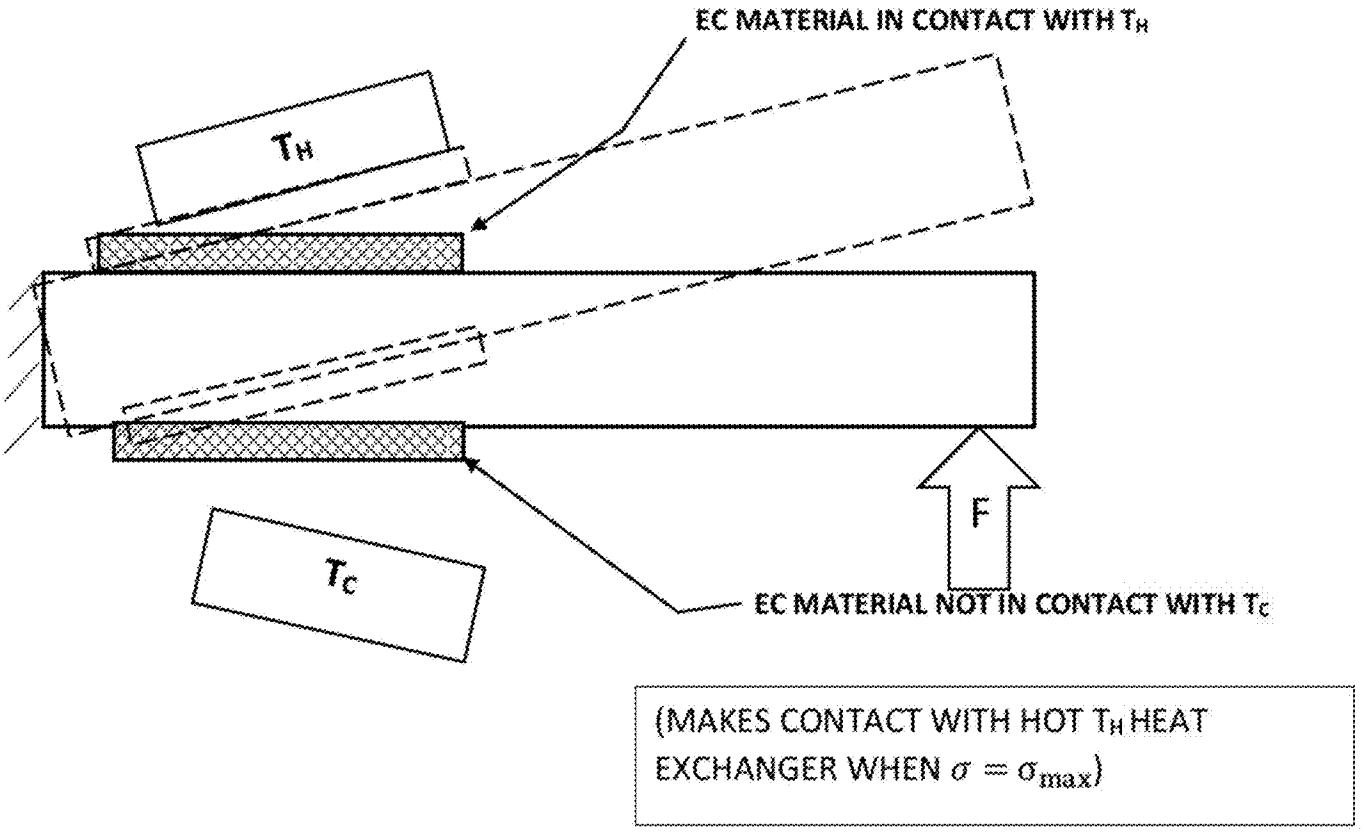

FIGS. 37A-B are diagrammatically views using the cantilevered embodiments of FIGS. 29 to 34 to transfer heat by contact with heat sinks, including operation in a bi-directional mode.

Figure 38A:
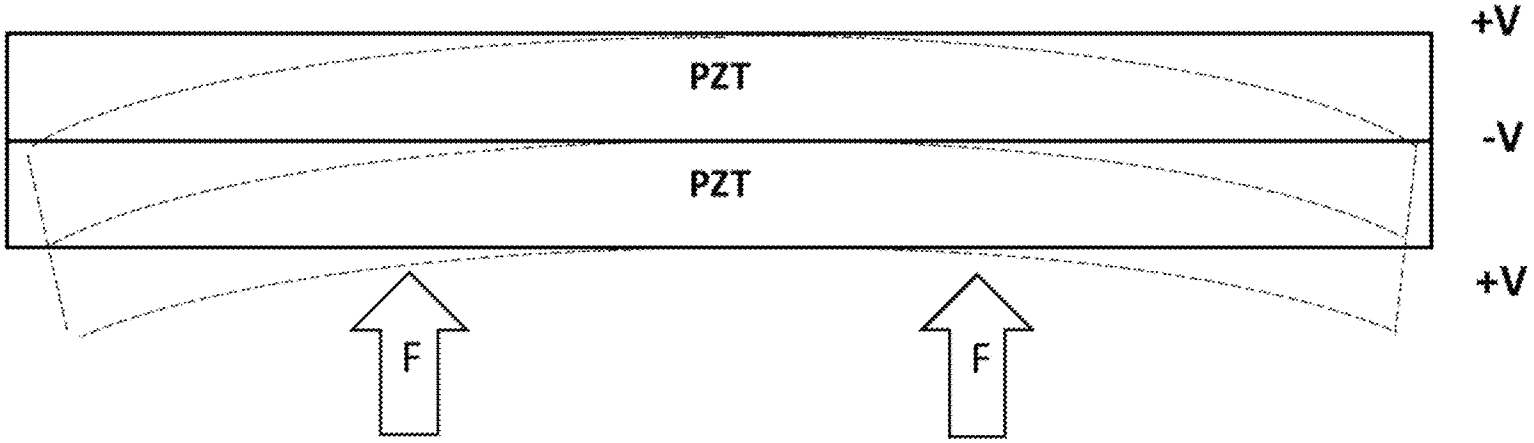
Figure 38B:
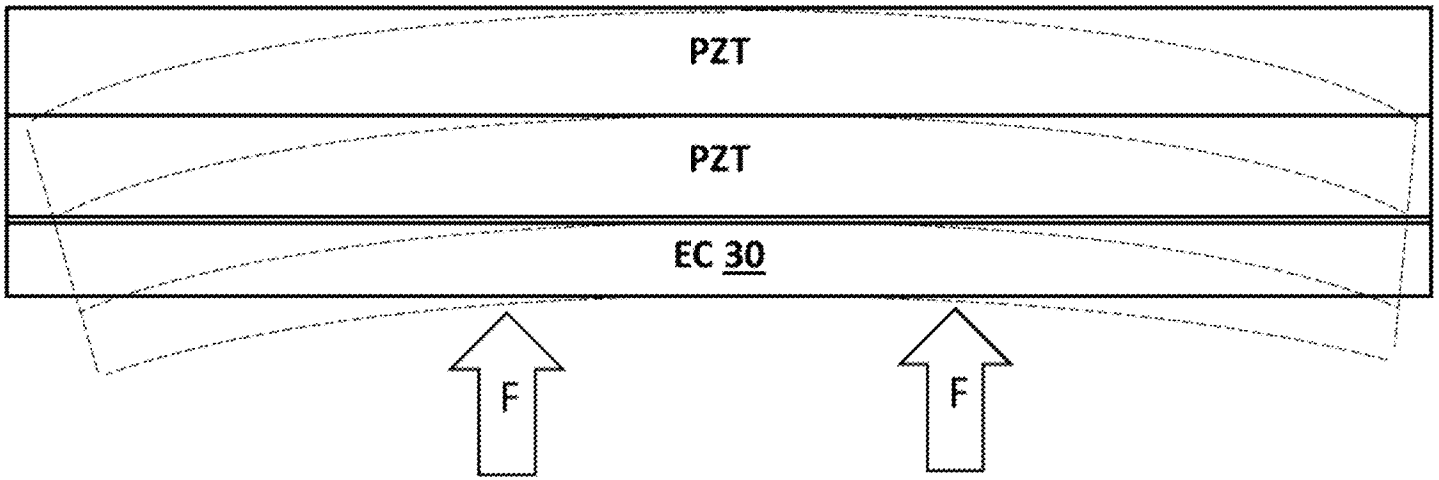
Figure 38C:
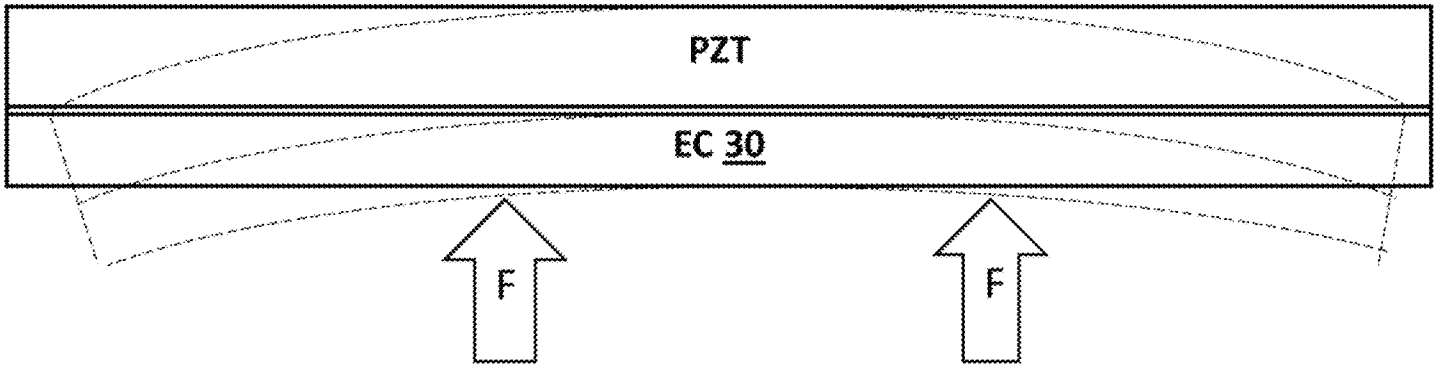

FIGS. 38A-C are diagrams depicting several non-limiting examples of use of piezoelectric material as a bendable base member.

Figure 39:
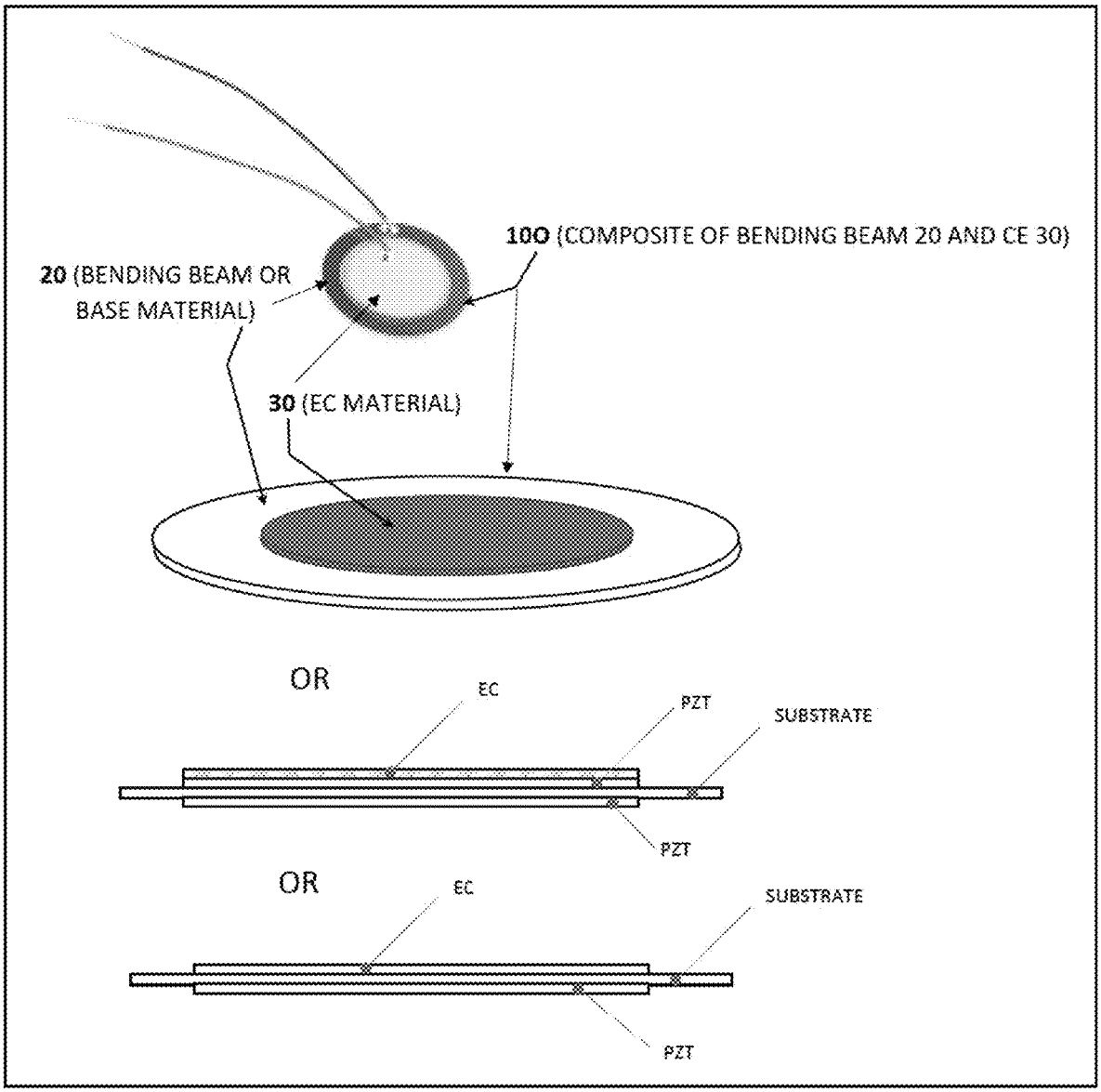

FIG. 39 are diagrams illustrating possible alternative form factors for piezoelectric material as the base member in the form of thin circular plates rather than beams.

Figure 40:
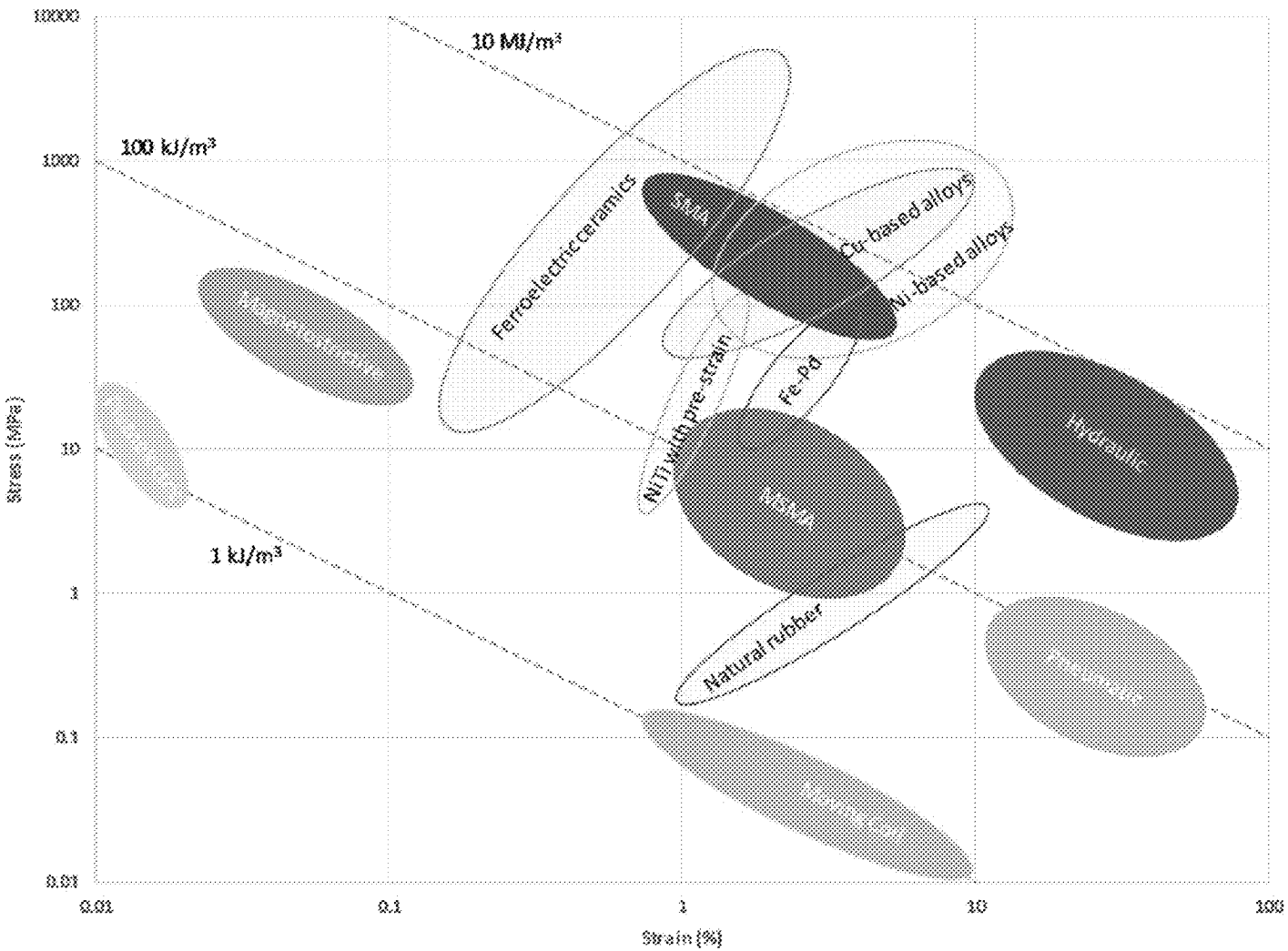

FIG. 40 shows representative actuation stress vs actuation strain for different classes of actuator materials and actuators (solid with white text) and required stress and strain for candidate elastocaloric materials (transparent with black text).

Figure 41:
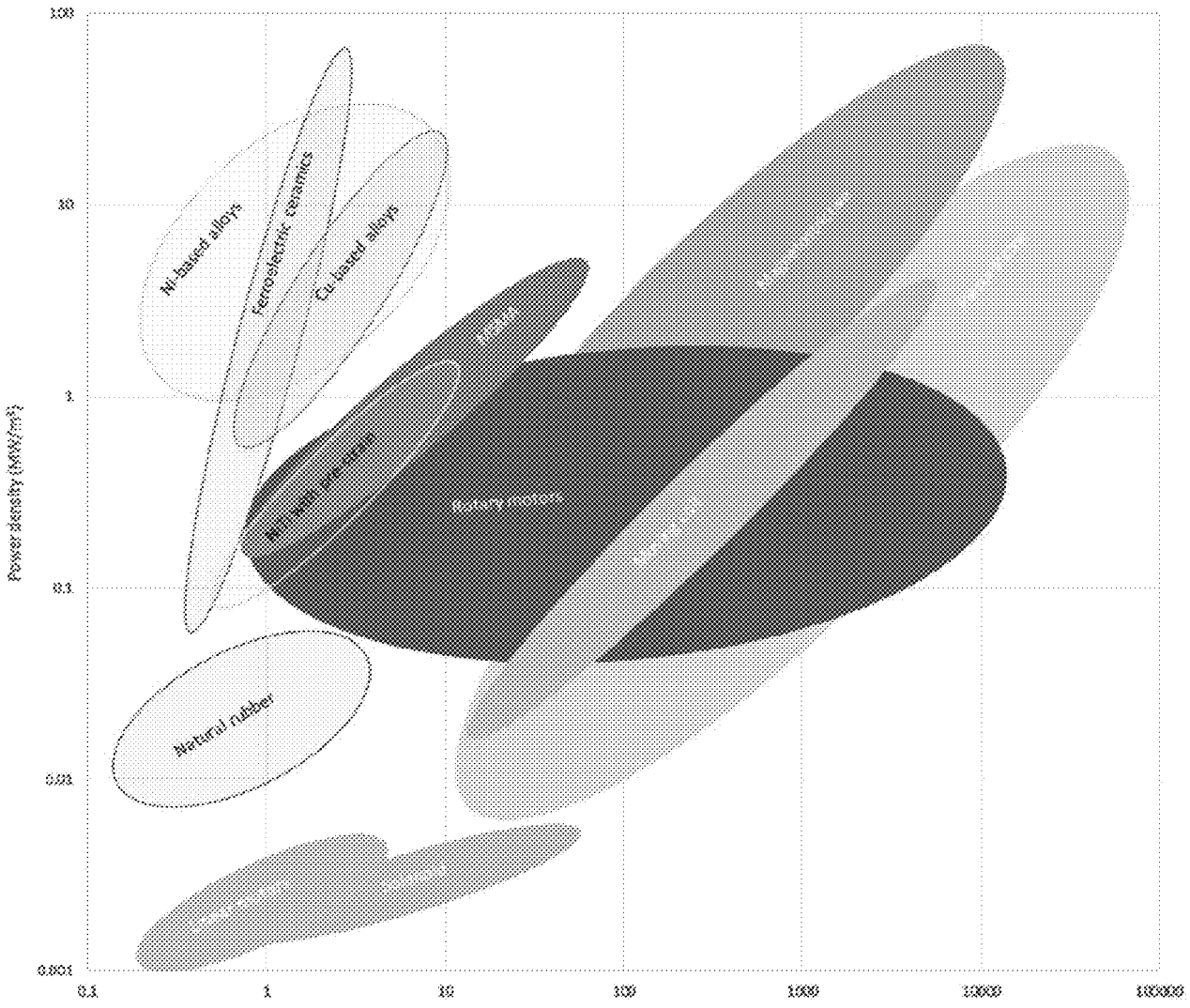

FIG. 41 shows representative power densities and frequency ranges for different classes of actuator materials and actuators (solid with white text) and requirements for candidate elastocaloric materials (transparent with black text).

Figure 42:
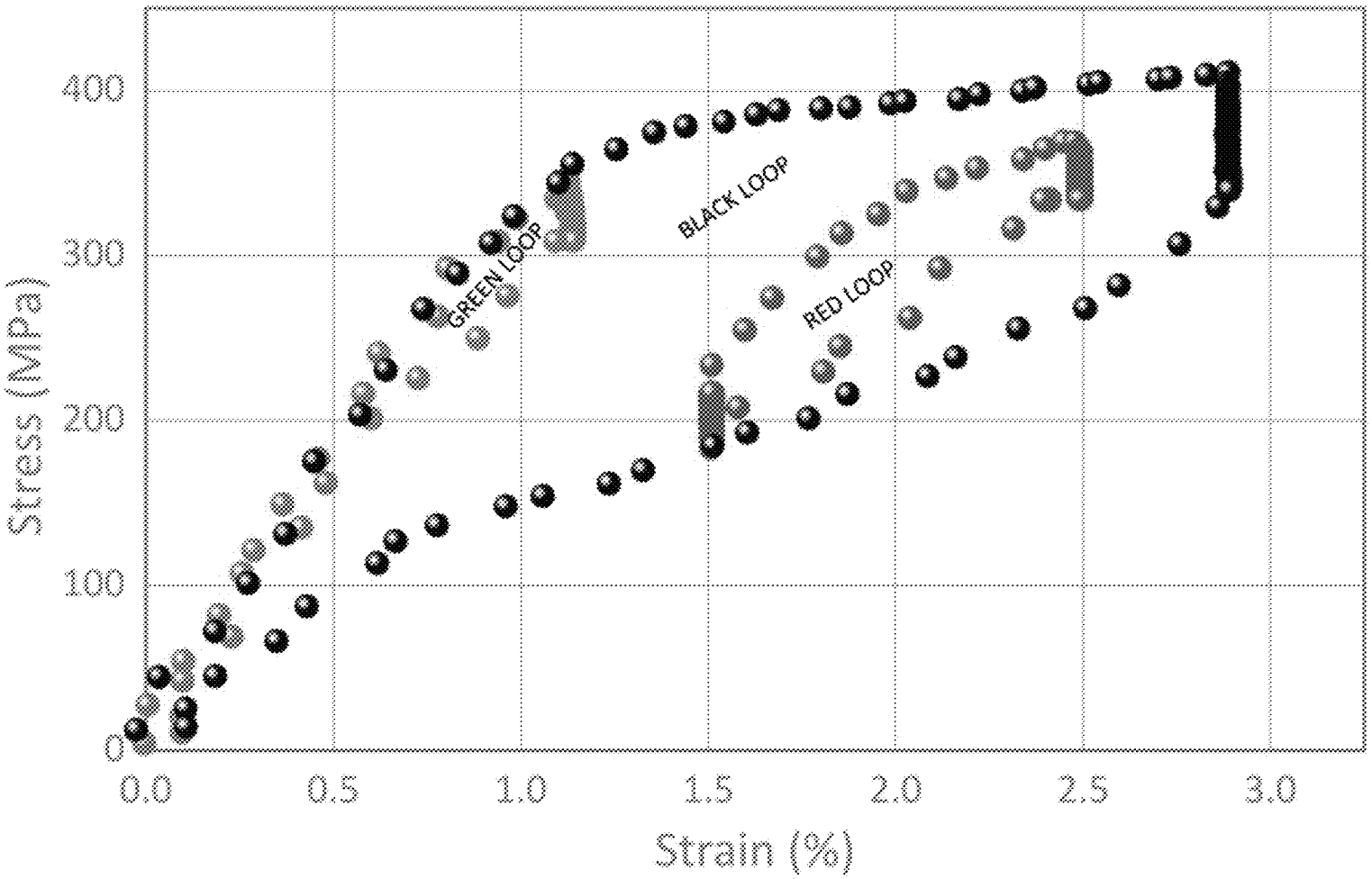

FIG. 42 shows stress-strain curves for a NiTi strip (0.2×4×50 mm3) in tension according to exemplary embodiments of the invention. Vertical data points at the ends of the loops are caused by a waiting period for the strip to return to ambient temperature before the next loading/unloading cycle.

Figure 43A:
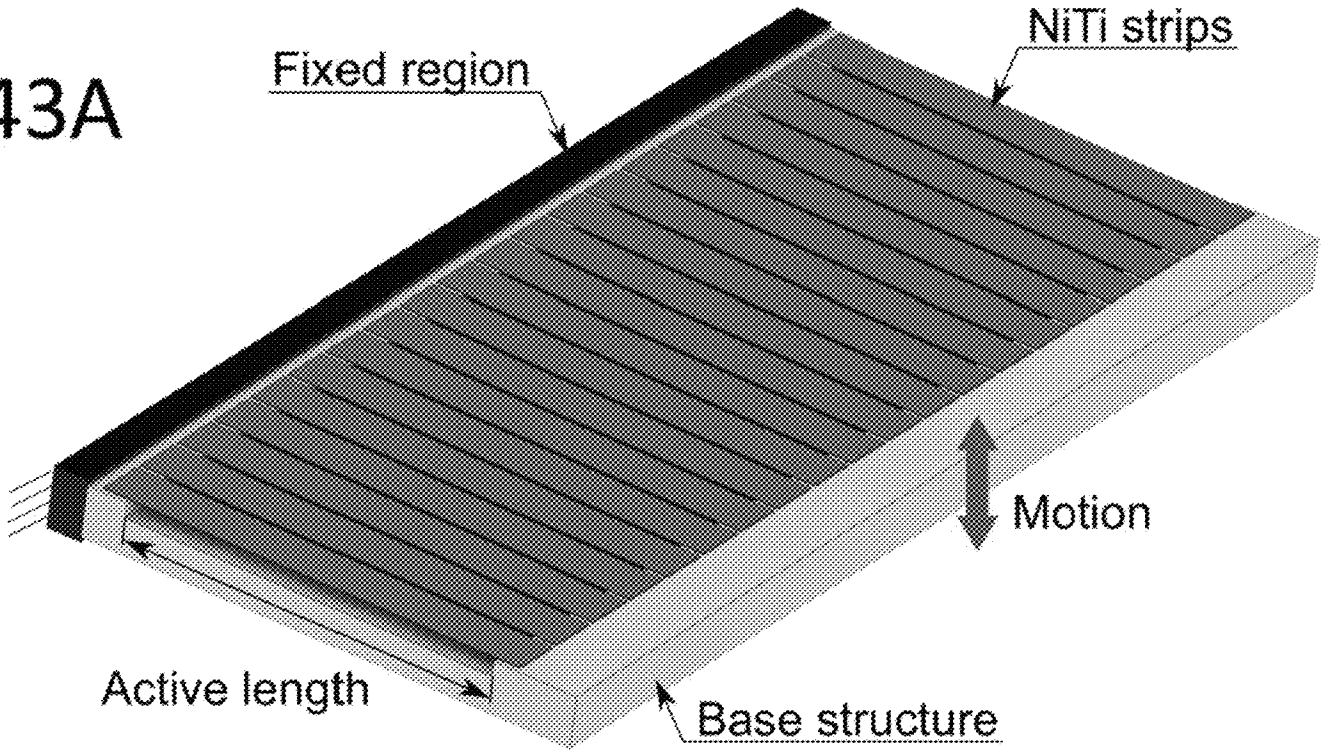
Figure 43B:
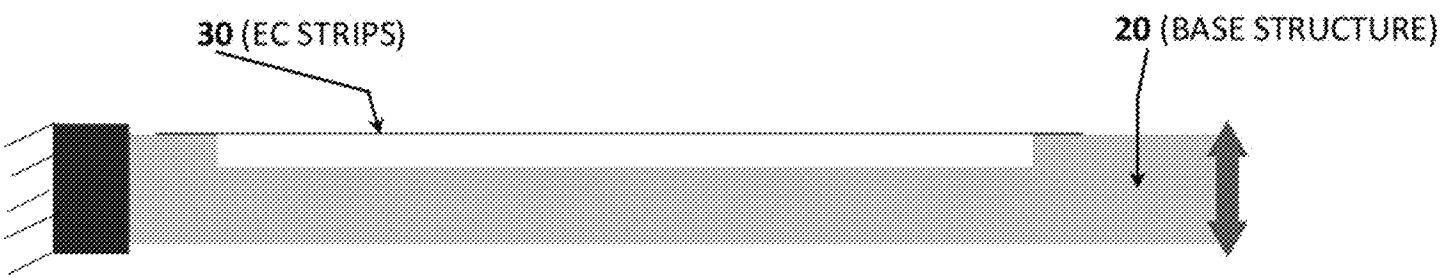

FIGS. 43A and B show sketches of a regenerator geometry used in a case 1 according to exemplary embodiments of the invention. FIG. 43A is in perspective and FIG. 43B in lateral cross-section (in the plane of active length). Nitinol parts are shown in dark gray with the base structure in light gray. The side view shows the fixed boundary on the left with motion from the actuator applied on the right.

Figure 44:
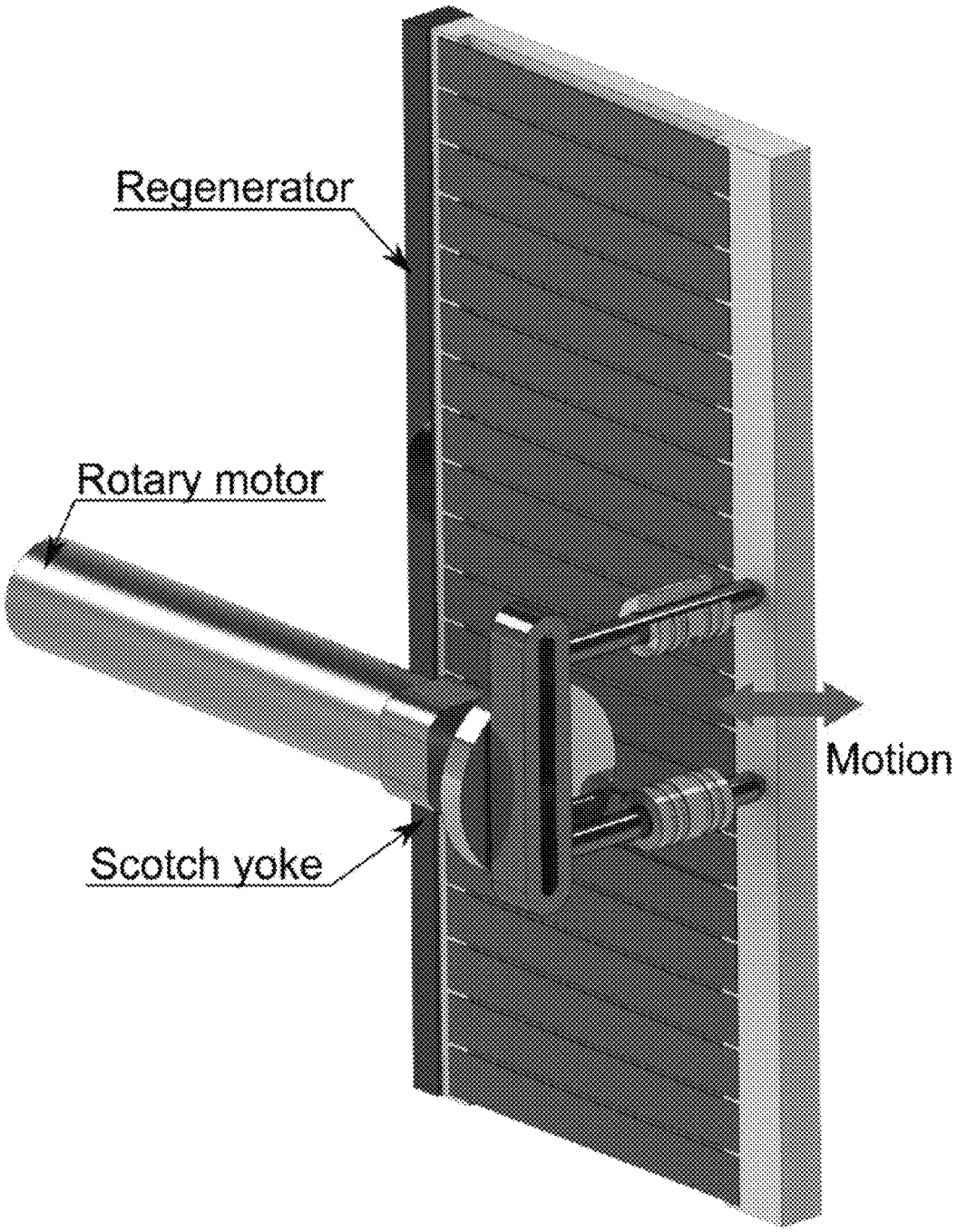

FIG. 44 shows a conceptual sketch of a Scotch yoke driver for a bending regenerator, case 1. Hardware to clamp and hold parts is not shown.

FIGS. 45A and B show a Case 2 regenerator with NiTi plates on both sides of the base structure to enable energy recovery and strain bias according to exemplary embodiments of the invention. FIG. 45A is in perspective and FIG. 45B in lateral cross-section (in the plane of active length).

Figure 46:
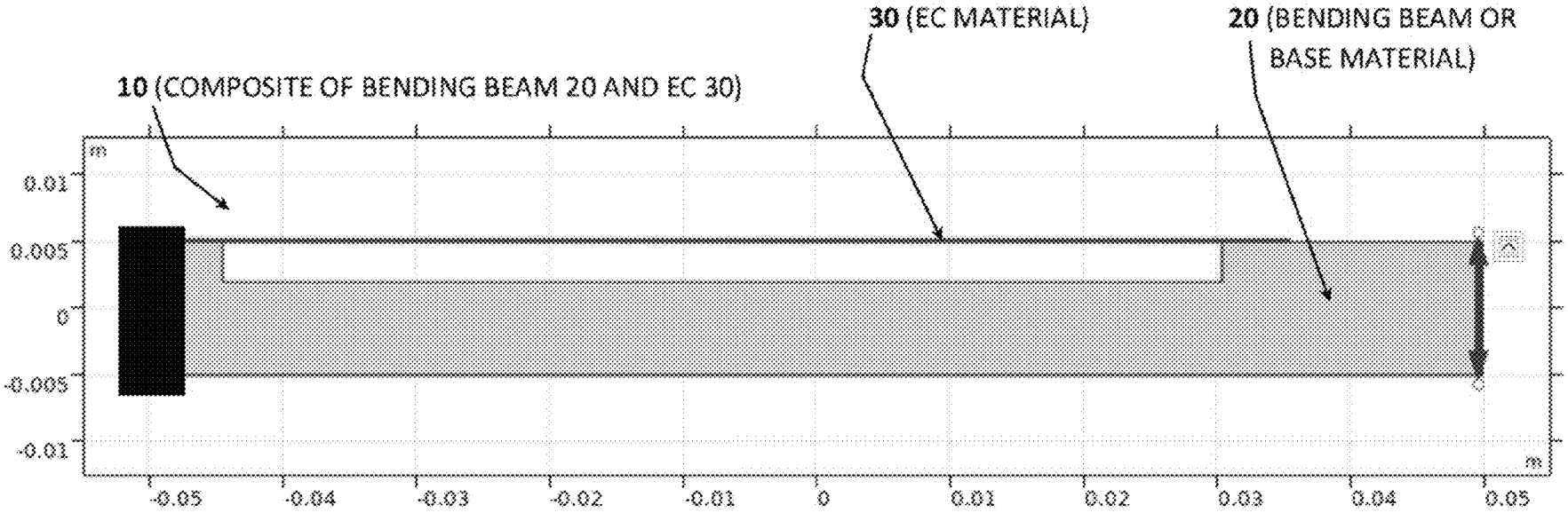

FIG. 46 shows Case 1 geometry for 2D finite element analysis (FEA). Fixed boundary is on the left and load is applied on the right end.

Figure 47:
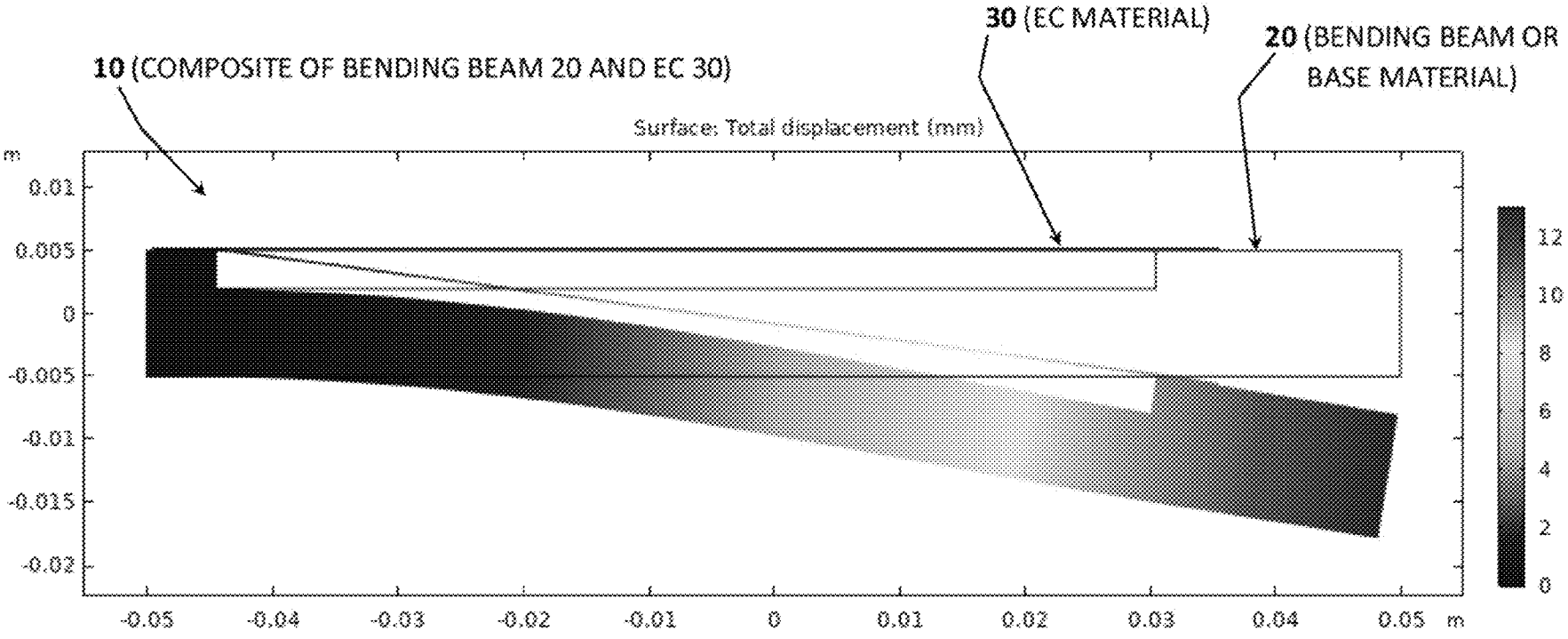

FIG. 47 shows Case 1 peak-to-peak displacement for 2D FEA with force as listed in Table S3. Note that in this case, the beam only moves downward from its neutral location).

Figure 48:
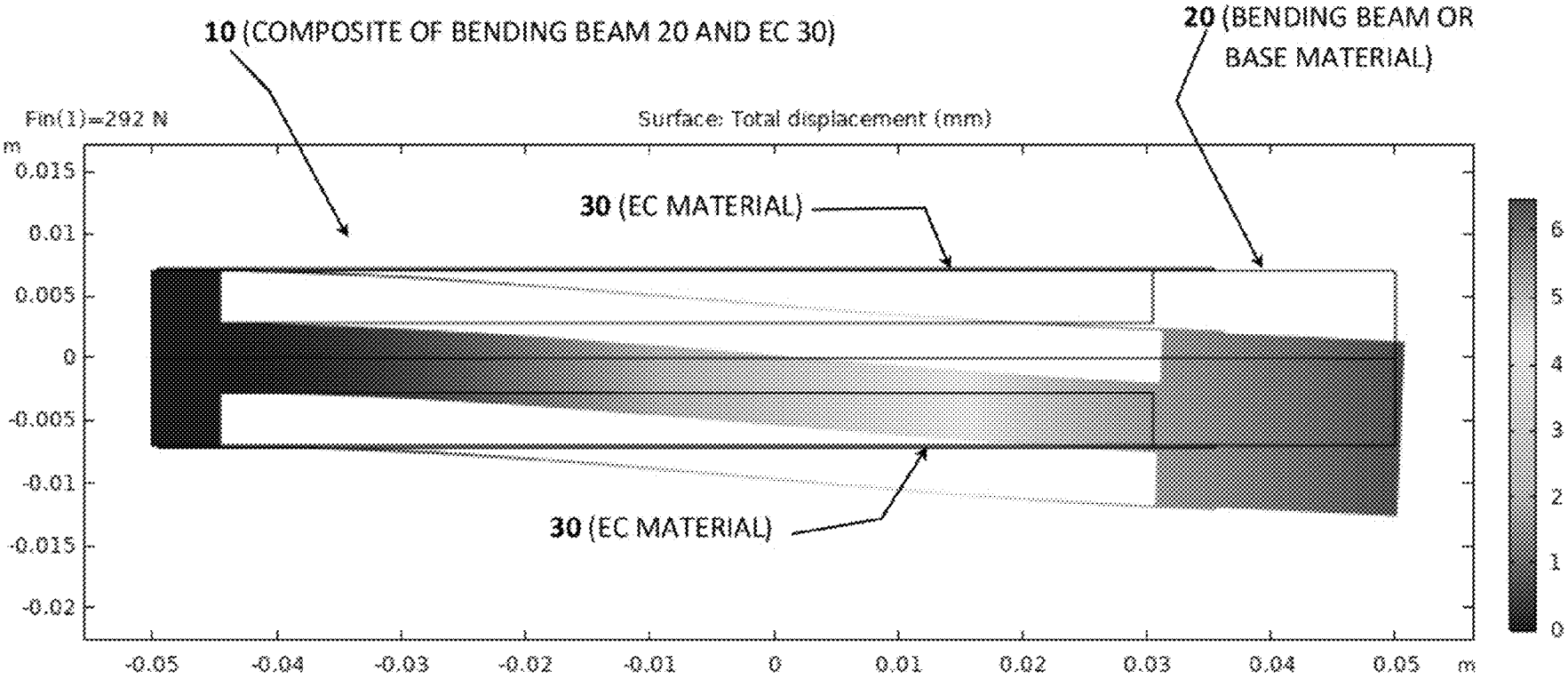

FIG. 48 shows [MDH III] Case 2 zero-to-peak displacement for 2D FEA with one-half the force as listed in Table S2. Note that in this case, the beam moves symmetrically above and below its neutral location with the amplitude shown.

FIGS. 49A-C are tables I, II, and III, respectively, regarding the description of the embodiments of FIGS. 40-45.

FIGS. 50A-C are tables S1, S2, and S3, respectively, regarding the description of the embodiments of FIGS. 46-48.

IV. DETAILED DESCRIPTION OF EXEMPLARY EMBODIMENTS OF THE INVENTION

A. Overview

For a better understanding of the invention, several non-limiting examples of aspects of the invention will now be described in detail. It is to be understood that the invention can take many forms and embodiments. These exemplary embodiments are presented by way of example only, and are neither inclusive nor exclusive of all forms and embodiments the invention can take. Variations obvious to those skilled in this technical art will be included with the invention.

For example, many of the examples describe use of NiTi as the elastocaloric active material. Other shape-memory class materials are possible. US Published Patent Application 2016/00844544A1 to University of Maryland (2016), incorporated by reference herein, describes additional examples. By further example, some examples illustrate aspects of the invention with an elastocaloric member in the form of a strip of a fraction of a millimeter thick, several millimeters wide and tens of millimeters long. The active elastocaloric member can take many form factors and can larger or smaller in dimensions. Furthermore, some examples are in the context of use of the elastocaloric effect from the active member for purposes of heating or cooling applications. US Published Patent Application 2016/00844544A1 to University of Maryland (2016) describes an example. While this is an important application, aspects of the invention are not necessarily limited to such.

As will be further appreciated by those skilled in this technical art, possible variations to materials, active member, base member, set-ups, actuators, and interfaces to take advantage or use the elastocaloric effect of the same are disclosed in the citations in the bibliography at the end of this description. For example, the harvest of heat (or cooling from) the elastocaloric effect of the active member(s) according the invention can utilize thermal conduction by surface-to-surface contact, by heat exchange involving fluid(s), or other heat sink/heat exchange techniques. The invention can also be incorporated into innovative systems that include regenerative heating/cooling techniques that take advantage of aspects of how elastocaloric effect is induced by the present invention.

B. Generalized Example

With particular reference to appended FIGS. 6-10, generalized examples of the invention will be described. They can be compared to the prior art techniques of FIGS. 1-5.

Fatigue from stretching and buckling from compression are challenges when using elastocaloric materials for elastocaloric effect. This is particularly true in applications that benefit from many cycles of subjecting the material to stress. Additionally, performance is best if the material can be uniformly and exclusively stretched or compressed. This is difficult and can require cumbersome, complex, and costly components.

A key aspect of the present invention is to address the foregoing issues by (a) using relatively thin pieces of elastocaloric material, (b) mounting them to or on a much thicker and longer base member, and (c) using controlled actuating forces to bend the base member. The manner of mounting the elastocaloric strip and the manner and direction bending of the base member are coordinated to promote uniform and exclusive tensile or compressive stress across at least a substantial portion of the strip but deterring or eliminating failure by buckling, including over many cycles of loading. As diagrammatically illustrated in FIG. 6A-D, and FIG. 7, bending actuation of the strip(s) 30A and/or 30B via its combination with a thicker, longer base, facilitates the same. As will be appreciated by those skilled in the art, EC material 30A or 30B can take many different forms. One example is a strip or patch of material. Another is a plurality of or stack of strips or patches. Another is flakes or powder physically coupled (e.g. adhered) to beam 20.

Figure 7:
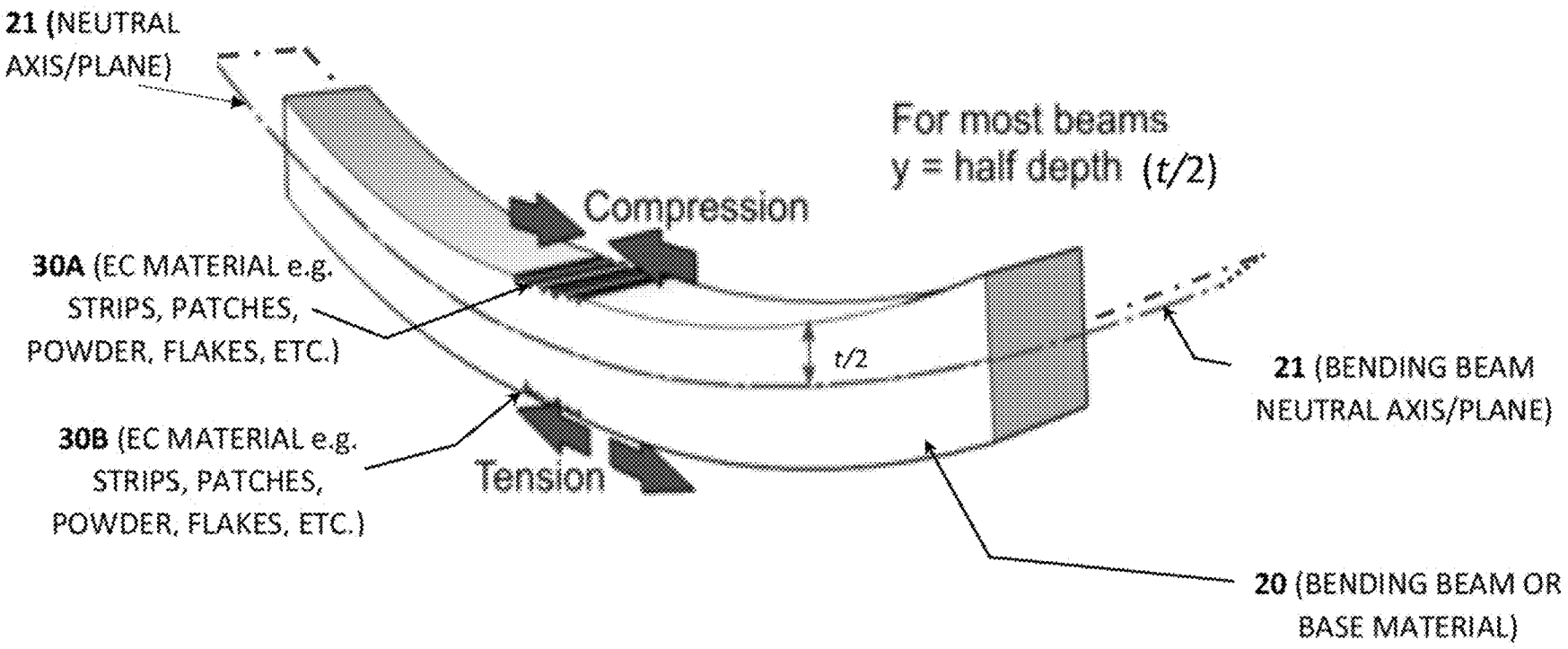
FIG. 7 is a diagrammatic depiction of bending beam principles that can be applied to embodiments of the invention.
Figure 8:
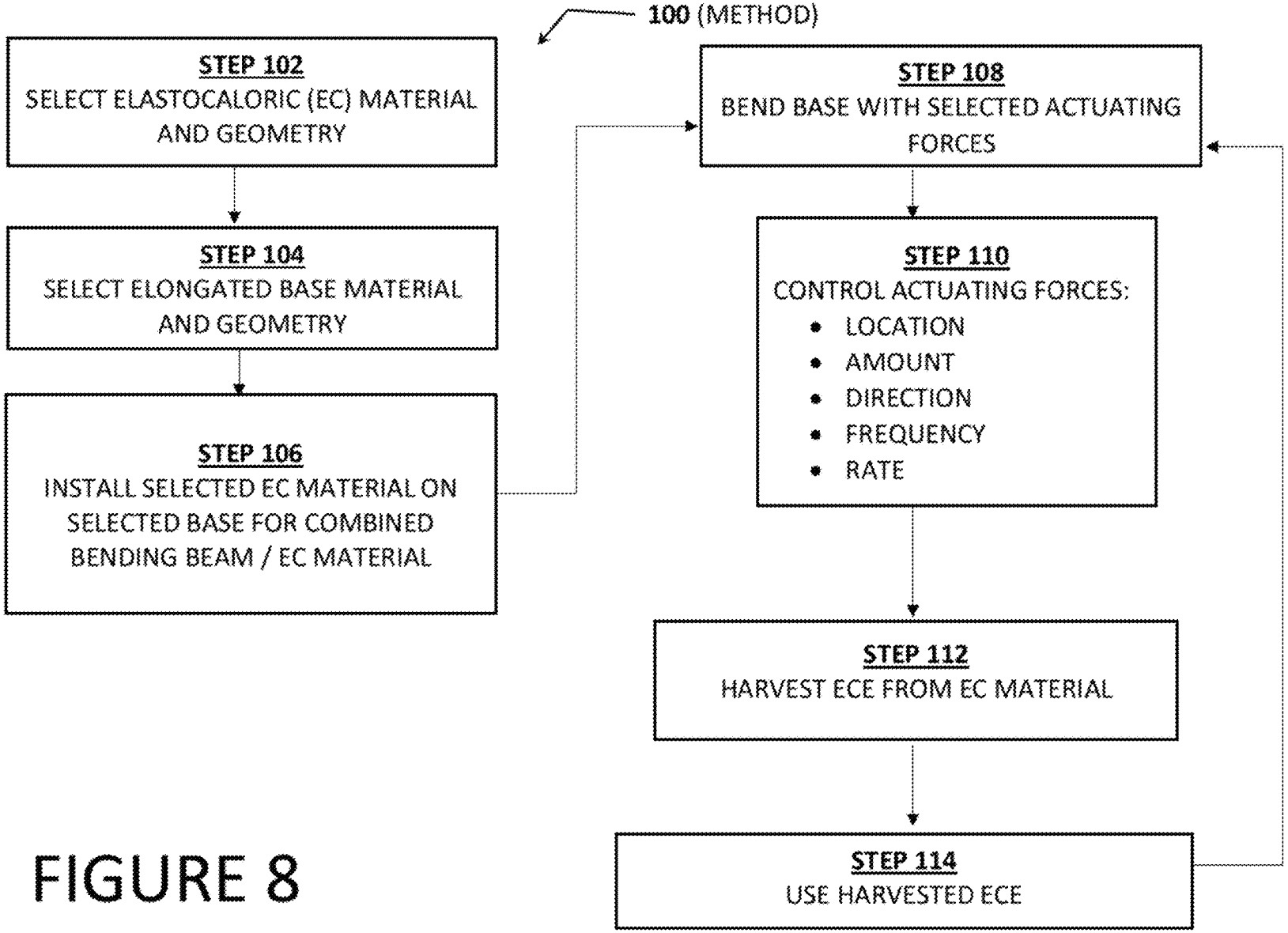
FIG. 8 is a flow chart of a method according to embodiments of the invention.

The materials, mountings, and control of actuating forces can take a variety of different forms. As indicated in FIG. 8, a designer would select the elastocaloric material and the base member and their form factors, as well as a mode of delivery of the actuating forces. Control of those forces can also include location, amount, direction, and rate of bending. Likewise can be frequency of repeat bending.

Harvesting of elastocaloric effect can take many forms. Likewise can use of the harvested effect. One example is for heating/cooling applications, including refrigeration. Non-limited examples are described at US Published Patent Application 2016/00844544A1 to University of Maryland (2016).

The combination of mounting the elastocaloric strip on a thicker, longer base, and then applying actuating forces to the base, promotes uniform stress (exclusively tensile or compressive) in the strip to increase the elastocaloric yield from the strip. It also deters damage or deformation of the strip, including over multiple cycles of subjecting to stress; either tensile or compressive. And a subtle but important benefit is that the amount of actuation forces to accomplish effective elastocaloric yield can be significantly less than at least similar yield from direct axial loading of such a strip. Furthermore, in some embodiments simply change of direction of actuating forces can determine tensile or compressive actuation of the same strip.

FIG. 6A illustrates a basic concept of embodiments of the present invention. In comparison to direct loading of EC material like in FIGS. 1-4, EC material 30 is coupled to a base material 20. Non-limiting examples are mechanically or chemical coupling (e.g. chemical bonding). Base material 20 can function as a bending beam. The composite 10 of those two components can be subjected to mechanically loading to elicit and harvest an elastocaloric effect ECE from EC material 30. Benefits of such a combination 10 relative to direct loading will be further discussed herein.

FIGS. 6B-D further illustrate that the composite 10 can take a variety of configurations and be mechanically loaded in a variety of ways. Insets in each of these Figures, as well as the diagrammatic of FIG. 7, further illustrate principles involved with these versions.

FIG. 8 illustrates a method 100 according to aspects of the invention. A designer selects an EC material and geometry (e.g. length, width, thickness, composition) (step 102). Likewise, base or bending beam selections are made (step 104). The composite device 10 is assembled by coupling the EC material 30 and the base 20 (step 106). Non-limiting examples are set forth herein. Composite device 10 is operatively installed relative an actuator (step 108), and the actuator controls bending of composite device 10 (step 110) to elicit an elastocaloric effect 22 (ECE), which is harvested (step 112) and used (step 114). Non-limiting examples of the same are set forth in detail herein.

Figure 9:
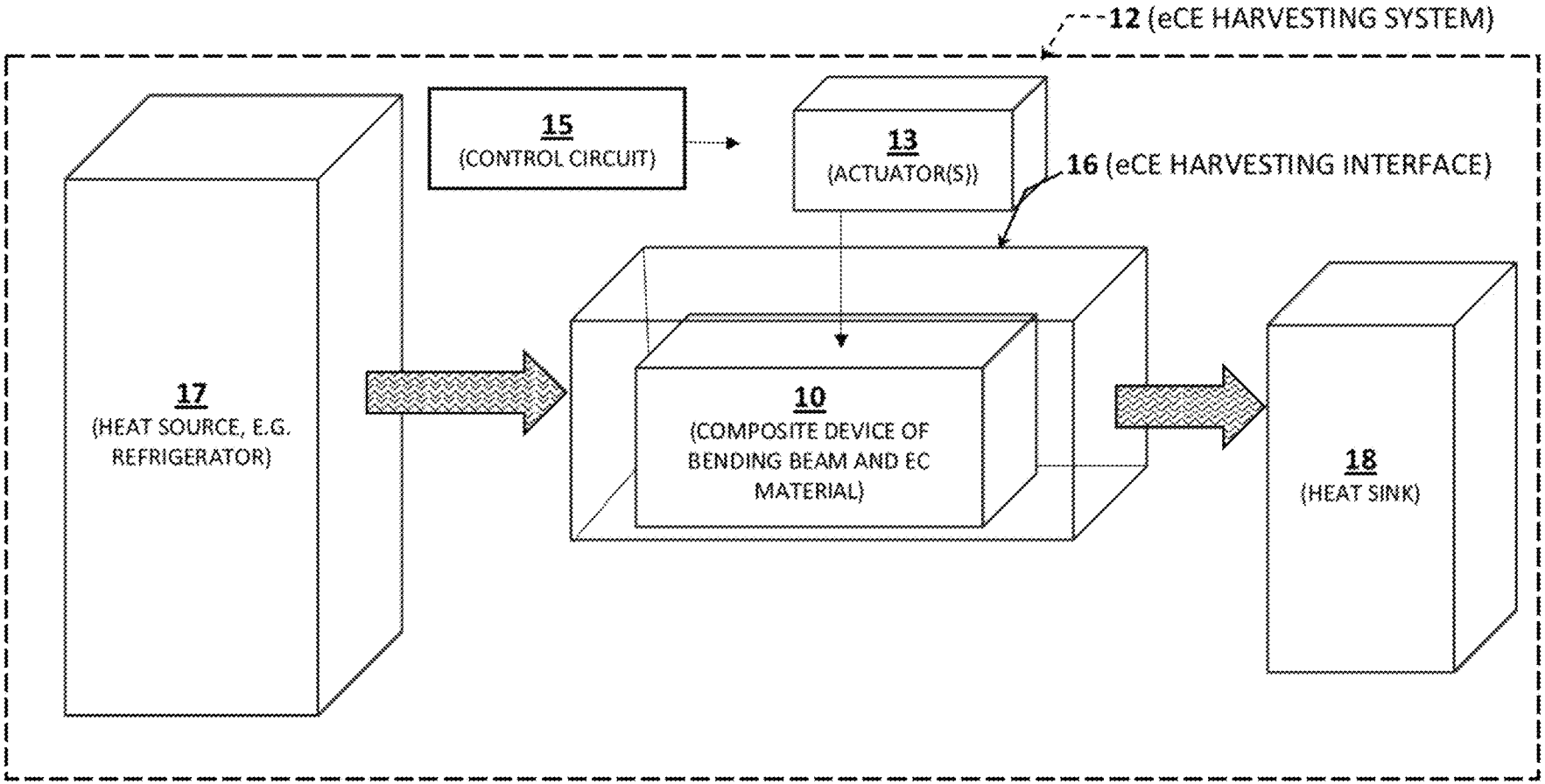
FIG. 9 is a diagram illustrating an overall system for harvesting elastocaloric effect (ECE) according to embodiments of the invention.

FIG. 9 diagrammatically illustrates an overall system 12 to accomplish method 100. One or more actuators 13 are operatively connected to one or more composite devices 10 in manner effective to bend device(s) 10 to elicit ECE. A control circuit 15 operates actuator(s) 13. Some type of ECE harvesting interface 16 is operatively installed relative device(s) 10. As is well-known to those skilled in this technical art, such ECE harvesting interfaces can take many forms and configurations. Non-limiting examples are discussed herein. In one example, the ECE harvesting can be put to a variety of uses and applications. One example is to transfer heat from a heat source 17 to a heat sink 18. One non-limiting example of a heat source is a refrigerator.

FIG. 10A illustrates diagrammatically how such heat from ECE harvesting can be harvested according to one specific embodiment according to the invention. FIG. 10B diagrammatically illustrates one example of how use of composite devices 10 (left curve—"bending actuation") can provide benefits over direct mechanical loading (right curve—"Direct actuation"). Further discussion is set forth herein.

In these descriptions the base or bending beam is sometimes described as having a length and width between opposite ends, and having a thickness between opposite faces. A neutral plane or axis is in the thickness between the opposite faces, spans, or sides of the beam. Opposite edges of the beam are on opposite lateral sides along that axis.

The opposite sides, spans, or faces are on opposite sides of the neutral plane of the beam. EC material can be applied or coupled to or at one or both of these bending faces, spans, or sides. Sometimes the faces, spans, or sides may be indicated as being "inner" or "outer" to differentiate them from each other, but this is in relative to each other and not necessarily to any particular direction in XYZ space. As will be appreciated by those skilled in the art, the terms faces, spans, sides, and the like refer to the sides of the bending beam on opposite sides of the neutral plane through the thickness of the beam.

C. Specific Example 1

As will be appreciated, the invention can be implemented in a variety of forms. With particular reference to appended FIGS. 11-23, the following specific example includes several non-limiting possible embodiments. It also includes proof-of-concept experimental results and data showing efficacy.

1. Introduction

This section is taken at least substantially verbatim from Agata Czernuszewicz, Lucas Griffith, Julie Slaughter, Vitalij Pecharsky, Low-force compressive and tensile actuation for elastocaloric heat pumps, Applied Materials Today 19 (2020) 100557, which is incorporated by reference herein in its entirety.

Nomenclature

- B width of the beam (m)
- c distance between neutral surface and outer fiber of the beam (m)
- $c_p$ specific heat at constant pressure (J $kg^{-1}$ $K^{-1}$)
- F force (N)
- H height of the beam (m)
- moment of inertia (N m)
- J heat flux (W $m^{-2}$)
- k thermal conductivity (W $m^{-1}$ $K^{-1}$)
- L length of the beam (m)
- $M_g$ bending moment (N m)
- Q heat (J)
- time (s)
- T temperature (K)
- $\Delta t$ time change (s)

ΔT temperature change (K)
V volume ($m^3$)
y distance from the neutral axis (m)
ε strain (%)
σ stress (MPa)
ρ density (kg $m^{-3}$)
PEEK Polyether Ether Ketone

2. Materials

A Ni—Ti superelastic alloy containing 50.6 to 51.0 at. % Nickel (henceforth NiTi) with the quoted austenite finish temperature around 290 K was purchased from Confluent. The material 30 was received in strips 0.2 mm thick by 4 mm wide and cut to 90 mm length. To increase fatigue life in tension, the edges of NiTi strips were surface treated by mechanical polishing. Differential scanning calorimetry traces of a sample extracted from a strip trained in tension are shown in FIG. 24. High-strength Polyether ether ketone (PEEK) was used as a beam base material 20.

3. Methodology

3.1. Concept

The idea of reducing force required to axially actuate the elastocaloric material is based on a bending beam concept. Applying the force, F, axially gives a uniform stress, $\sigma_{axial}$, over the entire length of the beam:

$$\sigma_{axial} = \frac{F}{BH}, \tag{1}$$

where B, H—width and height of the beam, respectively.

A straight rectangular beam 20 subjected to forces transverse to its axis deflects. The bending moment, $M_g$, causes tension on one side of the beam and compression on the other. The neutral surface 21 is a curved surface at distance, c, from the outer fiber of the beam, on which no change in length occurs, hence there is no tension or compression. Strain and stress in a deflected beam are described [19] as:

$$\varepsilon_{bending} = -\frac{y}{c}\varepsilon_{max} = -\frac{y}{c}\varepsilon_c, \text{ and} \tag{2}$$

$$\sigma_{bending} = -\frac{y}{c}\sigma_{max} = -\frac{y}{c}\sigma_c, \tag{3}$$

where $\varepsilon_{bending}$—strain in a bent beam, $\sigma_{bending}$—stress in a bent beam, y—distance from the neutral axis, $\varepsilon_c$, $\varepsilon_{max}$—strain at the outer fiber of the beam which is distance c from the neutral axis, and σ, $\sigma_{max}$—stress at the outer fiber. According to equations (2) and (3) the outer fibers of the beam experience the largest strain and stress.

When the beam 20 is subjected to four-point bending, the maximum stress and strain are constant over the section of the beam between loading points. If the loading span is ½ of the support span, stress in the beam between loading points can be calculated from [19]:

$$\sigma_{bending} = \frac{M_g y}{I_y} = \frac{F}{BH}\frac{3Ly}{2H^2} = \sigma_{axial}\frac{3Ly}{2H^2}, \tag{4}$$

where $I_y$—moment of inertia, L—length of the beam. Since the length is much larger than the height for a long, thin beam, bending stresses are much larger compared with axial loading for the same force as shown by the last term of (4).

In order to minimize the required force to achieve a given stress, NiTi strips and plastic beams were assembled as structures consisting of patches 30 of NiTi attached to the outer surface of the beam 20 and subjected to four-point bending. Structures 10 are designed to assure the neutral surface 21 is in the plastic beam 20, placing the elastocaloric material 30 entirely in either tension or compression. FIG. 11 shows a principle schematic of the proposed method for an elastocaloric material in compression.

Figure 12B:
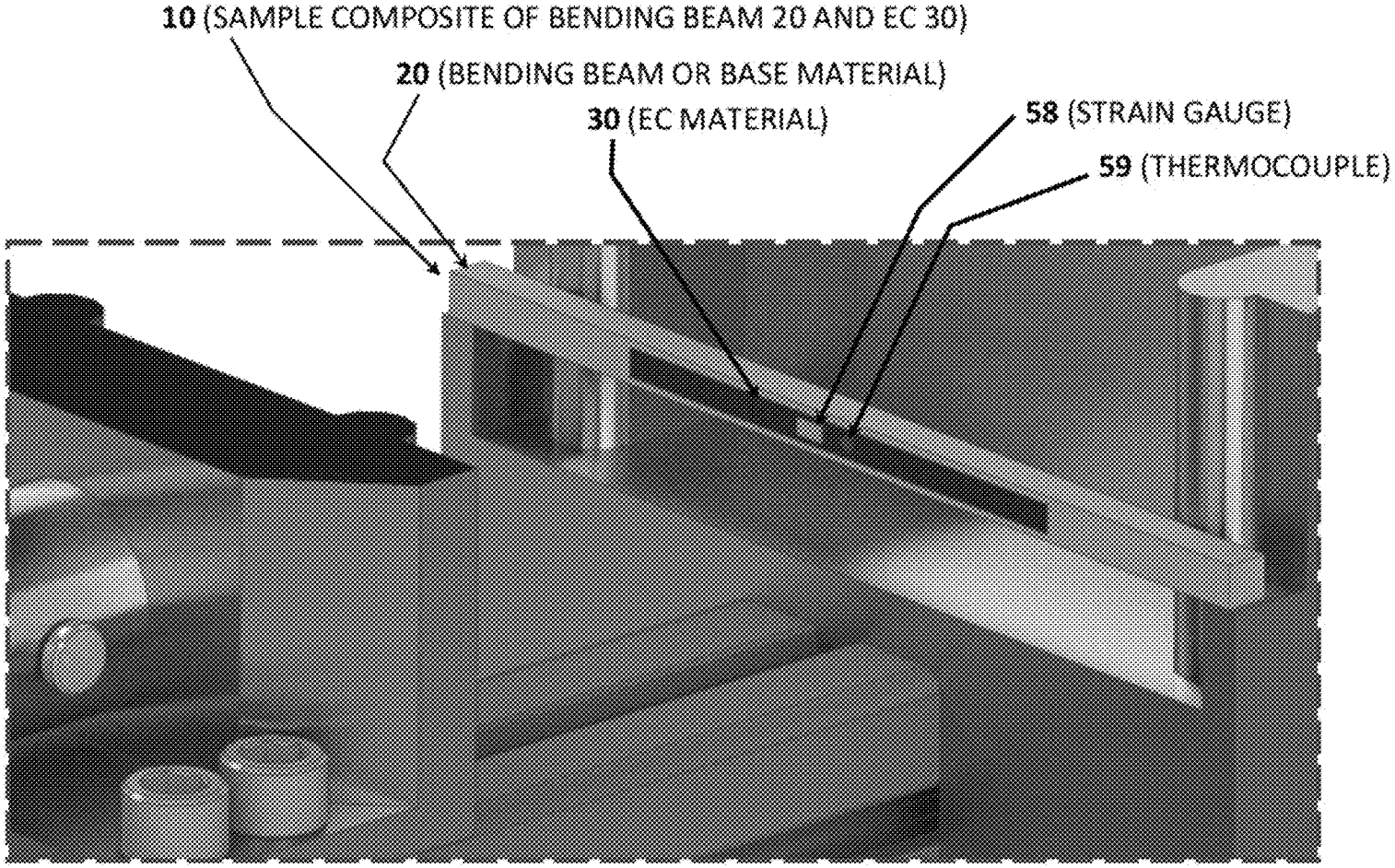

3.2 Test System A purpose-build test system enabled investigations of elastocaloric material performance under bending conditions. The main system components are: a linear actuator 51, load cell 52, and test fixtures 53, 54 as shown in FIG. 12. The four-point bending fixtures 53 have a fixed loading span of 60 mm, while the supporting span 54 is 120 mm. The system 50 is also equipped with tensile fixtures for direct tensile loading. The actuator 51 from Progressive Automations has a 3-phase brushless DC motor drive with 100% duty cycle, allowing cyclic tests, a built-in 10 kΩ potentiometer for position sensing, a load capacity of 667 N, a 305 mm displacement, and a maximum speed of 15 mm $s^{-1}$. The 60001 Vishay Sensortronics S-type load cell 52 has a 4448 N load range and can work in both compression and tension. The load cell 52 combined error is ±1.33 N and non-repeatability is ±0.44 N. Variability during static measurements agrees well with the combined error, however variability during dynamic measurements increases with rising (un)loading rates to a maximum of ±10 N.

The elastocaloric system 50 is controlled using Raspberry Pi 3 single board computer running Raspbian (not shown-see FIG. 9 control circuit 15). It is equipped with modules for force, position, strain, speed, and temperature measurements. Temperature is monitored using T-type thermocouples 59 with 0.08 mm wire diameter. Thermocouples are glued to the NiTi surface with high thermal conductivity epoxy to ensure a robust connection and fast response. Strain measurement (strain gauge 58) provides precision of 14με and accuracy of ±1.6%. Temperature measurement has accuracy of ±1 K with precision of 0.01 K. The accuracy of the position sensor is 0.05 mm with 0.01 mm precision and time delay of 0.1 s. Data logging is performed at all times during operation. Tests can be controlled with the force, position, or a combination of both. Thermocouple 59 and strain gauge 58 are attached to the top surface of the elastocaloric material 30 and are located near the middle between the loading pins (strain gauge used to measure strain in tension was placed in a similar fashion but was attached to a passive material as will be discussed in the next section). FIG. 12 also shows an enlarged view of a sample, including placement of the sensors. Characteristics of all components used to construct the experimental apparatus are provided in Supplementary table 1 below.

3.3 Strain Measurement

Strain gauges are the natural choice for strain measurements owing to their ease of application and low cost, assuming they can be effectively bonded to the NiTi 30 surface [20]. Uniaxial strain gauges SGT-1/350-TY11 from Omega and 1-LY11-0.6/120 from HBM of width 3.0 mm and 3.2 mm, respectively were bonded to the NiTi surface with adhesives Z 70 and X 60 from HBM. Sensors were arranged longitudinally and transversely which allows quarter or half-Wheatstone bridge circuit configuration (in half-bridge circuit configuration only the same type strain gauges were used). Initial validation of the system for axially loaded NiTi strip 30 showed a significant difference between strain measured with the position sensor and strain measured by a strain gauge mounted longitudinally (Supplementary FIG. 12). The strain gauge response starts to saturate around 1%, conspicuously coinciding with the strain value where the phase transition initiates, indicating that the sensors may impede the martensitic transition in areas they cover. An IR camera (FLIR A8303sc) captured temperature changes in NiTi strips during tensile loading at a room temperature of 296.7 K both without the strain gauge attached and on the side opposite the mounted strain gauge as shown in FIG. 13.

IR image of the bare sample (FIG. 13 at "b)") shows a relatively uniform temperature distribution across the sample as indicated by the color scale largely in the yellow to red range (also see FIG. 21). Minor non-uniformity in local temperature distribution seen as diagonal bands reflects locations of the Lüders-type bands where martensitic transition in NiTi 30 is initiated by stress [11]. For the sample 10 with the sensor mounted (Figure at "a)") a 4% strain change (as measured by the actuator position sensor) causes the change in temperature in the range from 7.65 to 17.25 K. Results show the lowest temperature changes where the strain gauge 58 is affixed to the strip 30, as indicated by the green area. Though the temperature change is expected to be somewhat lower because of heating of the strain gauge due to heat conduction, the difference in the temperature change is too large to be explained by this effect alone. Moreover the changes in the temperature in areas away from the sensor are notably higher than ΔT in the bare sample. Since adiabatic temperature change is proportional to strain, this confirms non-uniform strain distribution in the NiTi strip 30 with the strain gauge attached. It is likely that if the sample width is much larger than the width of the strain gauge envelope, the influence of the sensor is lower making it possible to measure the strain in a loaded sample as was done in [20]. However, for narrow samples used in this work, it is difficult to find sensors small enough to directly measure strain of the NiTi strips in tension.

To correctly measure strain in NiTi strips in tension (clamped only on ends) strain gauges were bonded to a passive material mounted side by side with the NiTi strip to ensure identical strains. For this purpose thin polycarbonate strips were chosen due to high yield point (above 2% strain). An additional benefit of using a passive material for measuring strain is that it thermally isolates the strain gauges, preventing any influence from elastocaloric effect on strain readings. The force required to stretch the polycarbonate strip itself was measured separately and subtracted from the NiTi measurements. Strains in excess of 2% were calculated from the position sensor for the directly loaded elastocaloric strips. In the bending mode strain was extrapolated from the superelastic slope and verified with the position sensor.

Samples where NiTi strips 30 were directly bonded to a plastic beam 20 and subjected to bending showed no saturation in strain, i.e. the measured strain increased linearly with the actuator position. In these samples, the stiffness of the plastic beam 20 dominates over the stiffness of the NiTi 30 and the sensor, and enables equal strain distribution along the loaded sample 10. Strain was measured directly on the NiTi strip in these samples.

4. Bending, Tensile Loading

4.1 Samples

Samples 10B used in a bending mode, where elastocaloric material 30 experiences only tensile stresses, consist of a strip of NiTi which is attached to a base beam 20 (PEEK) with a large cutout 26 as shown in FIG. 14. The cutout 26 reduces the beam 20 stiffness allowing the elastocaloric material 30 to dominate the overall stiffness. Moreover the slot 26 ensures bilateral access to the active material 30 which is favorable for heat transfer between the active material 30 and heat transfer medium in future refrigerator configurations.

The PEEK beam used as a base material 20 was 150 mm long, 27 mm wide, and 6.6 mm thick with a slot 26 of 50×27×4.6 mm. NiTi strips 30 were clamped to the beam 20 on the side with the cutout 26. This beam structure 10B ensures the 50 mm of NiTi strip 30 above the slot 26 is entirely in tension. Finite element modeling (FIG. 22) demonstrates that the stress and strain distribution in that part of the strip 30 is nearly homogenous (2% variation of strain over its thickness), and the neutral surface 21 is located in the plastic beam 20.

4.2 Results and Discussion

Before testing, NiTi materials were trained to stabilize their behaviors [11]. The NiTi strips 30 were subjected to 150 loading/unloading cycles between 0 and 500 N (which corresponds to 625 MPa) using a strain rate of 0.05 $s^{-1}$ at room temperature. The critical stress of the superelastic transition decreased from 480 MPa to 340 MPa after the training.

The elastocaloric effect in the trained samples 10B was first evaluated in direct tension. FIG. 15 shows measurements of temperature changes in axially loaded samples 10B for strains from 0.5% to 6% with a preload of 5 MPa, and strain rate of 0.05 $s^{-1}$. Because of the time delay 8 of the potentiometer used to evaluate the strain above 2%, the force-strain curves in FIG. 15C, and also in panel (c) of FIG. 16, are plotted only up to 2% strain.

The temperature change increases with the strain in a near-linear fashion and the elastocaloric effect is higher for loading than unloading. At 6% strain, the measured temperature changes were 22.5 K and 17.0 K for loading and unloading, respectively. The difference in the temperature changes between loading and unloading results from elastocaloric material hysteresis and increases with rising strain. The temperature change is approximately linear with force from 1% to 5% strain. Below and above these values the increase in the force is much larger than rise in ΔT, indicative of the superelastic transformation from 1% to 5% strain. Below 1% the elastic deformation in the austenite is visible and above 5% the elastic deformation in the martensite begins. The energy of hysteresis area amounts to 0.28, 1.65, and 2.89 $MJ/m^3$ for 1, 1.5, and 2% strain, respectively (FIG. 15C).

Trained NiTi strips 30 were attached to the plastic beam 20 of FIG. 14 and tested in a four-point bending configuration. Results shown in FIG. 16 were taken at a strain rate of 0.04 $s^{-1}$; the actuator velocity was held constant and the distance to achieve a given strain in bending mode is larger than for axial loading.

As seen in FIGS. 16A and B the forces to reach a given strain are less than half of those required for the axially loaded sample. For the highest strain of 5% the temperature change was 18.6 and 15.4 K for loading and unloading, respectively. The ΔT values agree with results for axial loading at the same strain. With the present beam 20 dimensions (see FIG. 14), larger deflection results in thermal contact between the NiTi strip 30 and the base material 20 in the middle of the cutout 26.

With our new approach to elastocaloric actuation, the required force decreases at the expense of increased displacement. While a low-force, high-displacement mechanism is a good match for the linear motor used in our experiments, this type of actuator may not be optimal for every application. The ability to tailor the required force and displacement profiles, on the other hand, opens up a wide design space that includes a variety of actuators and makes a large selection of variable-scale elastocaloric heat pump systems possible.

5. Bending, Compressive Loading

5.1 Samples

NiTi in tension suffers from fatigue at a low number of cycles which makes it desirable to operate the material in compression, however, thin strips of material buckle at very modest load for a given strip length. To overcome this limitation, we developed a composite beam 10A consisting of a base beam material 20 with a NiTi strip 30 bonded to it (shown in FIG. 17) allowing compressive stresses on the elastocaloric strip 30 without buckling. Because the NiTi 30 makes up a small portion of the beam 20, the neutral axis 21 is in the base beam 20 leaving the NiTi 30 in pure compression with little variation over its thickness (approximately 8% according to COMSOL Multiphysics® finite element modeling, FIG. 23). Using a four-point bend test configuration results in a large segment of the strip 30 with constant compressive stress.

The PEEK beam 20 used as a base material measured 150 mm long, 6.2 mm wide, and 6.2 mm thick. A NiTi strip 30 was glued to the top surface of the beam 20 using Loctite E-90FL epoxy. Before bonding, both surfaces were roughened with #80 grit abrasive paper and cleaned. The NiTi 30 was also coated with AC-130-2 sol-gel to improve adhesion [21]. This configuration obscures one strip surface, limiting the heat transfer from the NiTi 30. Direct contact between the base beam 20 and strips 30 also results in heat transferred to the plastic of beam 20 (see below), reducing the measured temperature change of the NiTi 30 compared to an unsupported strip in tension. This beam configuration 10A allowed the 60 mm of NiTi 30 between loading pins to be entirely in compression.

5.2 Results and Discussion

The NiTi strips used in compressive mode were not trained due to the difficulty of applying direct compression at high strains and bonding issues between the NiTi 30 and the PEEK 20. For strains above 1.5% samples typically failed at the joint after about 10 cycles on average, while at lower strains the bond withstands hundreds of cycles. After failure, the glue was routinely found to be entirely adhered to the NiTi 30 with none remaining on the PEEK 20 surface, suggesting that improving adhesion to PEEK 20 (or using a different base material with high surface energy) could substantially lengthen sample life. Such an advancement is necessary before this method of actuating elastocaloric materials can be applied in cooling devices.

Results are presented in FIG. 18. Experiments were performed at a strain rate of 0.02 $s^{-1}$; the actuator velocity was held constant and the distance to achieve a given strain in compression is twice that for tension. Stress-strain characteristics for the composite beam 10A for 1 and 1.5% strain show much lower hysteresis when compared with samples 10A subjected to tension loading. No superelastic regime was observed, which agrees with results from [8,12], where superelasticity appeared for higher applied strains. The largest temperature change of 4.1 K for loading and unloading was obtained for 1.6% strain, with higher strains resulting in immediate glue joint failure. Adiabatic temperature change was reversible which is consistent with a much narrower hysteresis compared to tension loading [8].

Because of the sample dimensions, force cannot be applied axially to the sample 10A without buckling to get a direct comparison between compression and bending. Results of the bending tests were used in conjunction with a COMSOL finite element model (FIG. 23) to estimate Young's modulus of the NiTi 30 and calculate the force required to directly compress the sample 10A. The calculated value of 480 N for 1% strain is in agreement with published data [18]. The forces in bending are reduced by approximately half compared to the estimates for direct compression, and the risk of buckling of the NiTi strips 30 is eliminated.

Selecting a low thermal conductivity material, such as PEEK, limits the amount of heat transferred to the beam 20, however, the direct contact does have an impact as revealed by the much faster return to room temperature compared to tensile-bending samples (FIG. 18D). The time to reduce the temperature by $\Delta T/2$ was 3.6 s for compression and 19.2 s for tension. Heat loss to PEEK can be estimated by comparing $\Delta T$ recorded in compression and tension. Assuming elastocaloric effects are the same in both cases [18], the difference in the two adiabatic temperature changes under 1% strain gives the heat lost to the PEEK, $Q_{lost}$, $$Q_{lost}=Q_{tension}-Q_{compression}=\rho V c_p(\Delta T_{tension}-\Delta T_{compression})\approx 0.22\ \text{J}, \quad (5)$$

where $Q_{tension}$ and $Q_{compression}$—heats generated in tension and compression; $\rho$, V, $c_p$—density, volume, and specific heat of NiTi at constant pressure; $\Delta T_{tension}$ and $\Delta T_{compression}$—adiabatic temperature changes measured in tension and compression. To estimate the heat loss, $\rho$=6500 kg $m^{-3}$, V=48 $mm^3$, and $c_p$=837 J $kg^{-1}$ $K^{-1}$ were used.

Heat transfer between PEEK and NiTi can also be estimated considering the response of a semi-infinite medium to a linear ramp in temperature following Carslaw and Jager [22], where heat flux into the PEEK is proportional to the square root of the product of the heat capacity, thermal conductivity, and density (also see Supplementary information). For the 1% strain shown in FIG. 18, $Q_{lost}$ is about 0.21 J, which is within 5% of that determined from Eq. 5. Heat losses to the beam can be reduced by selecting base material with lower specific heat, and/or density, and/or thermal conductivity. Faster actuation and reduced contact area between the active material and the base will further reduce heat losses.

6. Conclusions

Arranging elastocaloric strips in composite structures and subjecting the structures to bending forces allows application of nearly-uniform, purely-tensile or purely-compressive stresses over large segments of the NiTi strips while greatly reducing the force required to achieve a given strain. A 50% lower force demand translates into smaller and simpler actuators. Another highly important feature of the method is that thin strip samples can have high compression stresses applied without buckling, which is unreachable in direct loading. This result is very beneficial for construction of future elastocaloric systems, because the low fatigue life of materials subjected to tension limits their utility for practical devices. Strips also have much bigger surface to volume ratio compared to bulk materials which is important for efficient heat transfer. The proposed low-force and long-lifetime method of activating elastocaloric materials opens up new possibilities for construction of compact and efficient cooling and heating systems.

7. References for Section IV.C, Supra.

[1] Goetzler W, Zogg R, Young J, Johnson C. Energy Savings Potential and RD&D Opportunities for Non-Vapor-Compression HVAC Technologies. 2014.

[2] Kitanovski A, Tušek J, Tomc U, Plaznik U, Ožbolt M, Poredoš A. Magnetocaloric Energy Conversion. 2015. doi:10.1007/978-3-319-08741-2.

[3] Weiss P, Piccard A. Le phénomène magnétocalorique. J Phys Theor Appl 1917; 7:103-9.

[4] Lozano J A, Engelbrecht K, Bahl C R H, Nielsen K K, Eriksen D, Olsen U L, et al. Performance analysis of a rotary active magnetic refrigerator. Appl Energy 2013. doi:10.1016/j.apenergy.2013.05.039.

[5] Jacobs S, Auringer J, Boeder A, Chell J, Komorowski L, Leonard J, et al. The performance of a large-scale rotary magnetic refrigerator. Int. J. Refrig., 2014. doi:10.1016/j.ijrefrig.2013.09.025.

[6] Teyber R, Holladay J, Meinhardt K, Polikarpov E, Thomsen E, Cui J, et al. Performance investigation of a high-field active magnetic regenerator. Appl Energy 2019. doi:10.1016/j.apenergy.2018.12.012.

[7] Tušek J, Engelbrecht K, Eriksen D, Dall'Olio S, Tušek J, Pryds N. A regenerative elastocaloric heat pump. Nat Energy 2016. doi:10.1038/nenergy.2016.134.

[8] Cui J, Wu Y, Muehlbauer J, Hwang Y, Radermacher R, Fackler S, et al. Demonstration of high efficiency elastocaloric cooling with large AT using NiTi wires. Appl Phys Lett 13 2012; 101. doi: 10.1063/1.4746257.

[9] Qian S, Geng Y, Wang Y, Ling J, Hwang Y, Radermacher R, et al. A review of elastocaloric cooling: Materials, cycles and system integrations. Int J Refrig 2016. doi: 10.1016/j.ijrefrig.2015.12.001.

[10] Qian S, Wu Y, Ling J, Muehlbauer J, Hwang Y, Takeuchi I, et al. Design, developement and testing of a compressive thermoelastic cooling system. 24th IIR Int. Congr. Refrig., 2015. doi:10.18462/iir.icr.2015.0092.

[11] Tušek J, erovnik A, Čebron M, Brojan M, užek B, Engelbrecht K, et al. Elastocaloric effect vs fatigue life: Exploring the durability limits of Ni—Ti plates under pre-strain conditions for elastocaloric cooling. Acta Mater 2018. doi:10.1016/j.actamat.2018.03.032.

[12] Zhang K, Kang G, Sun Q. High fatigue life and cooling efficiency of NiTi shape memory alloy under cyclic compression. Scr Mater 2019. doi:10.1016/j.scriptamat.2018.09.012.

[13] Hou H, Finkel P, Staruch M, Cui J, Takeuchi I. Ultra-low-field magneto-elastocaloric cooling in a multiferroic composite device. Nat Commun 2018. doi: 10.1038/s41467-018-27 06626-y.

[14] Sharar D J, Radice J, Warzoha R, Hanrahan B, Chang B. First Demonstration of a Bending-Mode Elastocaloric Cooling "Loop." Proc. 17th Intersoc. Conf. Therm. Thermomechanical Phenom. Electron. Syst. ITherm 2018, 2018. doi: 10.1109/ITHERM.2018.8419513.

[15] Ossmer H, Wendler F, Gueltig M, Lambrecht F, Miyazaki S, Kohl M. Energy-efficient miniature-scale heat pumping based on shape memory alloys. Smart Mater Struct 2016. doi:10.1088/0964-1726/25/8/085037.

[16] Bruederlin F, Ossmer H, Wendler F, Miyazaki S, Kohl M. SMA foil-based elastocaloric cooling: From material behavior to device engineering. J Phys D Appl Phys 2017.doi: 10.1088/1361-6463/aa87a2.

[17] Kumar A, Chauhan A, Patel S, Novak N, Kumar R, Vaish R. Vibration induced refrigeration using ferroelectric materials. Sci Rep 2019. doi: 10.1038/s41598-019-40159—

[18] Wu Y, Ertekin E, Sehitoglu H. Elastocaloric cooling capacity of shape memory alloys —Role of deformation temperatures, mechanical cycling, stress hysteresis and inhomogeneity of transformation. Acta Mater 2017. doi: 10.1016/j.actamat.2017.06.012.

[19] Beer F P, Johnston R, Dewolf J, Mazurek D. Mechanics of Materials, McGraw-Hill. New York 1981.

[20] Prabhakaran R, Galloway T L. Strain measurement in a shape memory alloy with strain gauges. Strain 2005. doi:10.1111/j.1475-1305.2005.00228.x. 17

[21] Zimmerman T J, Blohowiak K Y, Dilligan M A, Calkins F T, Mabe J H. Adhesive bonding of hybrid actuated shape memory alloy-composite structures. SAMPE fall Tech. Conf., 2010, p. 1-13.

[22] Carslaw H S, Jaeger J C. Conduction of Heat in Solids, Oxford. Oxford Clarendon Press 2nd Ed 1959. doi: 10.1063/1.3057871.

8. Supplementary Information for Section IV.C.

Supplementary table 1 for Section IV.C. Technical characteristics of components used to construct experimental apparatus

| Component | Range | Accuracy |
|---|---|---|
| Load cell, Vishay Sensortronics 60001 | 0-4448N | Load cell combined error = ±1.33N<br>Non-repeatability = ±0.44N |
| Load cell module, SparkFun Electronics OpenScale | | Precision = $7 \times 10^{-4}$N<br>Calibrated accuracy = 0.0021N |
| Actuator with built-in 10 kΩ potentiometer, Progressive Automations PA-14P | 0-305 mm<br>0-667N | Accuracy of displacement measurement = 0.05 mm |
| Position module, Adafruit ADS1115 | | Precision = 0.01 mm |
| Strain gauge, Omega SGT-1/350-TY11 | 30000 με | Accuracy of gage factor = ±1% |
| Strain gauge, HBM 1-LY11-0.6/120 | 50000 με | Accuracy of gage factor = ±1.5% |
| Strain module, Adafruit ADS1115 | | Precision = 14 με<br>Accuracy = ±0.5% |
| Thermocouple T-type, Omega 5tc-tt-t-40-36 | 23-593K | Accuracy = ±1K |
| Thermocouple module, Adafruit MAX31856 | 218-400K | Precision = 0.0078K<br>Linearity correction error = ±0.07K |

Supplementary table 2 for Section IV.C. Material properties used in numerical analyses shown in Supplementary FIGS. 4 and 5

| Properties | NiTi | PEEK |
|---|---|---|
| Young's modulus for tension (GPa) | 34 | 3.6 |
| Young's modulus for compression (GPa) | 60 | 3.6 |
| Poisson ratio (–) | 0.33 | 0.37 |
| Density (kg $m^{-3}$) | 6500 | 1310 |

8.1 Heat Transfer Analysis in a Compression Beam

Heat transfer into PEEK can be estimated by considering the response of a semi-infinite medium to a linear ramp in temperature at the surface $\phi=\dot{d}t$, where $\dot{d}$ is the temperature ramp rate and t is the time. The response depends primarily on the thermal conductivity, k, density, ρ, and specific heat, $c_p$ of PEEK at constant pressure. Carslaw and Jager (Carslaw H. S. and Jager J., *Conduction of heat in solids*, Oxford Clarendon Press 2nd Ed 1959) give the temperature, T, distribution as a function of time and spatial position, x, in the PEEK as $$T = \dot{d}t\left[\operatorname{erfc}\left(\frac{x}{2\sqrt{\alpha t}}\right) - \frac{x}{\sqrt{\alpha t}}\left(\frac{\exp\left(-\frac{x^2}{2\sqrt{\alpha t}}\right)}{\sqrt{\pi}} - \frac{x}{2\sqrt{\alpha t}}\operatorname{erfc}\left(\frac{x}{2\sqrt{\alpha t}}\right)\right)\right], \tag{S1}$$

where erfc is the error function compliment and the thermal diffusivity $$\alpha = \frac{k}{\rho c_p}.$$

Tne heat flux, J, at the surface is then simply $$J = 2\dot{d}k\sqrt{\frac{t}{\pi\alpha}} = 2\dot{d}\sqrt{\frac{k\rho c_p t}{\pi}}. \tag{S2}$$

Integrating (S2) over the loading time provides the total heat flow into the PEEK beam during loading. For the 1% strain shown in FIG. 18D and k=0.25 (W $m^{-1}$ $K^{-1}$), ρ=1310 (kg $m^{-3}$), and $c_p$=1500 (J $kg^{-1}$ $K^{-1}$), heat transfer into PEEK is about 0.21 J, which is within 5% of the same determined from the difference in temperature changes recorded in tension and compression.

D. Specific Example 2

As will be appreciated, the invention can be implemented in a variety of forms. With particular reference to appended FIGS. 24-28, the following specific example includes several non-limiting possible embodiments. It also includes proof-of-concept experimental results and data showing efficacy.

This section is taken at least substantially verbatim from a manuscript by Agata Czernuszewicz, Lucas Griffith, Alexander Scott, Julie Slaughter, Vitalij Pecharsky entitled Unlocking large compressive strains in thin active elastocaloric layers.

Elastocaloric cooling attracts broad interest and rapidly growing attention due to its potential for high efficiency and low environmental impact. While it is common knowledge that triggering reversible entropy and temperature changes with stress applied in compression prevents rapid failures of materials, realizing this regime in elastocaloric systems is highly challenging because nearly all geometries suited for efficient heat transfer are prone to buckling even under modest loads. This work describes a composite 10D, where an active NiTi layer 30 is embedded into a polymer support structure 20 such that the elastocaloric material 30 is entirely in compression when the assembly 10D is subjected to bending. The active layer 30 achieves 8.1 K temperature change at 2.5% compressive strain without buckling. After 10,000 cycles at 2% compressive strain, the composite maintains mechanical integrity without degradation of the elastocaloric effect. The results show that NiTi and, potentially, other elastocalorically active materials in geometries previously thought impossible can be successfully implemented in regenerative cooling systems operating in compression.

1. Introduction

With population and per capita income continuing to grow worldwide, the ever-increasing needs for space and industrial cooling and food refrigeration are major drivers behind the escalating energy demand and subsequent steady rise of the average Earth temperature. Energy consumption for space cooling and refrigeration in the United States alone reached 7.3 EJ in 2014 (roughly 20% of the total primary energy consumed that year),[1] and this number was growing daily before economic activity contracted in the U.S. and globally as a result of the 2020 pandemic. High energy consumption will rebound in due course and concerns over potentially irreversible climate changes will return, hence addressing these major challenges sooner rather than later is critically important. Citations in superscript refer to the References cited at the end of this Section IV.D.

The ubiquitous cooling devices in use today are based on vapor-compression technology. Vapor-compression systems are near their efficiency limits, so increasing demand for cooling will lead to higher electricity needs, accelerating global climate changes, as power generation from burning fossil fuels is responsible for nearly three-fourths of human-caused carbon dioxide emissions.[2] Billions of units in service and new vapor-compression devices also directly contribute to climate change when volatile liquid refrigerants leak into the atmosphere because the most widely used refrigerants, hydrofluorocarbons (HFCs), have high global warming potentials.[3] Affordable, energy efficient, and environmentally benign cooling is indeed essential for the future of our planet and life on Earth as we know it.

One emerging approach to cooling-elastocaloric refrigeration-promises higher energy efficiency than vapor compression and, as importantly, is much safer for the environment. Elastocaloric materials change their temperature in response to mechanical loading and unloading. The principle is similar to the century-old method we rely upon today, but instead of using volatile chemicals, elastocaloric heat pumps employ solid working bodies, eliminating the possibility of refrigerants escaping into the atmosphere. Heat pumping based on elastocaloric phenomenon has a potential to be up to 50% more energy efficient compared to vapor compression[1] and can feasibly be realized with compact devices at reasonable cost.[4]

Elastocaloric effect can be actuated with either tensile or compressive loading of solids that exhibit stress-induced crystallographic phase transformations. Tensile stresses are easy to apply to geometrical shapes favorable for heat transfer, such as wires, strips, plates, or ribbons, yet materials in tension suffer from severely limited fatigue life.[5] Repetitive tensile loading initiates and opens cracks that propagate and lead to premature fracture of materials, which is one of the major challenges for the future of the elastocaloric refrigeration.[6-8] Actuation of elastocaloric effects by compression vastly extends the life of thermally active solids,[9,10] however, it is most readily achieved in geometries that are inadequate for fast and efficient heat transfer.

To the best of our knowledge only two elastocaloric system demonstrations operating in compression exist. The very first reported device[11] (S. Qian, Y. Wu, J. Ling, J. Muehlbauer, Y. Hwang, I. Takeuchi, R. Radermacher, and G. L. M. Hall, in 24*th IIR Int. Congr. Refrig.* (2015), incorporated by reference herein as background information) has two beds consisting of NiTi tubes that are compressed using a motor driven screw-jack. By arranging the elastocaloric material beds in parallel, the energy released during unloading of one bed can be recovered and used to load the other if both beds are initially pre-stressed. The system employs 117 g of NiTi, operates at rather low frequency of 0.05 Hz, achieves 1.5 K temperature lift, and delivers cooling power of 38 W. The other described device[12] (S. Qian, Y. Geng, Y. Wang, J. Muehlbauer, J. Ling, Y. Hwang, R. Radermacher, and I. Takeuchi, Sci. Technol. Built Environ. 22, 500 (2016), incorporated by reference herein as background information) employs four beds with 19. NiTi tubes each and total mass of 201 g of NiTi per bed, organized in hexagonal cross-sectional structures. Potential for buckling is minimized by an external rigid holder providing additional support. The inner and outer diameters of the tubes are 3.76 and 4.72 mm, respectively. The beds are arranged symmetrically for work recovery and compressed intermittently by a hydraulic actuator. System coefficient of performance, defined as a ratio of the cooling capacity to overall power consumption, of 11.0 and temperature lift of 24.6 K are estimated with a dynamic model. Experimental data describing performance of the device have not been published. The tubes used in both systems, as well as other hollow shapes, can be compressed to strains much higher than those achievable in plates or strips, however, only with very precise, very uniform loading fixtures and tightly controlled bed dimensions. Even a minor inaccuracy in the geometry of the materials and/or loading fixtures will cause buckling of the tubes and lead to failure. The high tolerances quickly drive up the cost, presenting a hard to overcome barrier for such appliances to penetrate consumer market.

Recently, we demonstrated how the feature size can be reduced compared to what has been achieved in the past[9,10,13] by attaching a thin elastocalorically active layer to a support structure.[14] (see also Section IV.C supra). Subjecting such structure to bending moments puts the elastocaloric layer(s) entirely in compression or tension, depending on the loading direction. An additional advantage of the proposed method is a reduction in the force necessary to activate elastocaloric effect compared to direct axial loading which allows for compact and efficient elastocaloric system design.[4] A major impediment in this approach is weak adhesion between the elastocaloric layer and the base material which may lead to delamination and early failure. Elastocaloric materials chemically bonded to the base beam demonstrate over 4 K temperature change under 1.6% compressive strain, but fail after less than 10 loading cycles due to the joint rupture which makes them unusable for practical application.

This work describes a novel fatigue-resistant method of creating elastocaloric material—polymer base composites capable to actuate the elastocaloric component entirely in compression, thus enabling high compressive strains and functional elastocaloric effects in geometries like thin plates, strips, ribbons, or wires, out of reach in the past. As opposed to being chemically bonded to the surface of the polymer base, a NiTi layer 30 in the form of a thin strip is encapsulated by melting the polymer 20 around the strip 30, while leaving an open window 73 with elastocaloric material 30 exposed for effective heat transfer. These composites 10D, prepared using both Polyether Ether Ketone (PEEK) base 20 and NiTi strips 30 from the same batches as in[14] are subjected to bending moments as described in that reference. The maximum temperature change of 8.1 K is observed for 2.5% compressive strain. Endurance experiments show that composites 10D withstand 10,000 cycles, and likely beyond, without any noticeable mechanical degradation. A stable +5.7 K temperature change (−4.5 K for the unloading) under 2% strain is more than sufficient for cooling applications employing an active regenerative cycle similar to that used in sister magnetocaloric regenerative heat pump systems.[15] The results show a feasible way to use thin layers of elastocaloric solids in refrigeration devices operating in compressive mode, exploiting advantages of both long fatigue life provided by compressive stresses and fast heat transfer due to small-size features. The proposed method of fabricating components and activating elastocaloric materials in compression proves the high potential of compression actuation for safe and affordable energy-saving cooling devices of the future.

2. Flexible Composites

Composite samples 10D are created by surrounding a NiTi strip 30 with two pieces of PEEK: a beam 20 and frame 72. The beam 20 is 6.2 mm wide, 6 mm thick, and 150 mm long and the frame 72 is 0.38 mm thick with the same length and width as the beam 20. The frame 72 has a window 73 with dimensions 2 mm×50 mm that provides access to the elastocaloric material 30 for heat transfer. NiTi strips 30 are 0.2 mm thick (i.e., 2.4 times thinner than the walls of the tubes in[12]), 4 mm wide, and 135 mm long. Properties of materials are the same as in Ref.[14]

Before bonding, all components are cleaned and degreased, PEEK is additionally dried out. To dry PEEK, the material is placed for 1 h in a pre-heated to 393 K oven. NiTi strips 30 are sandwiched between the beam 20 and the frame 72 and then mounted in the groove 71 of an aluminum jig 70 with the frame 72 facing the bottom of the jig 70. The groove 71 length and width are the same as the PEEK beam's 20 dimension with a height of 4.5 mm. The jig 70 both aligns the components and restricts their movement during the melting process. Two pins are placed inside the jig's groove 71 near its ends, which protrude through complementary holes in the NiTi strip 30 and PEEK frame 72, preventing the elastocaloric material 30 from twisting while the polymer melts. Additionally, the bottom of the jig's groove 71 has a boss 75 with the same length and width as the PEEK window 73 and the height of 0.2 mm, which keeps the NiTi 30 surface exposed. A lid [not shown] attached with 12 screws provides uniform load to the components while a hot plate heats the assembly from the bottom. The jig 70 is heated up to 593 K and held at this temperature for 20 minutes. During this process, the frame 72 and the beam 20 fuse, yielding a uniform, permanent connection between all components. After the melting, the jig 70 is cooled down with the hot plate to room temperature and the PEEK-NiTi composite 10D is released. The final dimensions of the composites 10D are 150×6.2×6.2 $mm^3$. FIG. 2 24A-D show a model of the jig 70, composite assembly process, and a photo of a finished material 10D.

3. Results and Discussion

Samples 10D are subjected to four-point bending using the test system described in[14] with loading and supporting spans of 60 and 120 mm, respectively. Making the NiTi strip 30 longer than the supporting span so there is no stress applied near the ends of the strip 30 eliminates shear stresses that can cause mechanical failure. All tests are performed at room temperature with the strain load rate of about 0.02 $s^{-1}$. After loading/unloading steps samples 10D are held at constant load until NiTi 30 returns to the ambient temperature.

3.1 Maximum Strain and Temperature Change

The maximum strain composite beams 10D can withstand is evaluated by applying successively larger strains to newly assembled, untrained samples and measuring the resulting temperature change as shown in FIGS. 25A-C. Strain is measured with strain gauges (SGT-1/350-TY11, Omega) attached to the NiTi surface, while temperature is recorded with T-type thermocouples bonded to the NiTi surface with high thermal conductivity epoxy. Tests are repeated on 3 identically assembled beams 10D. Using a newly assembled composite beam 10D allows verifying the reproducibility of the assembly method while also establishing the maximum sample performance in the absence of any fatigue.

The maximum observed temperature change of NiTi 30 under compression is 8.1 K at 2.5% strain. No mechanical failure occurs and the temperature change increases almost linearly. Increasing the strain further is restricted by the test stand and strain measurement capabilities, therefore tests under larger loads are not performed. Owing to heat transfer to the base 20, the recorded temperature changes are lower by ca 30% compared to the free-standing strip under direct loading.[14] For cyclic operation, the periodicity of the temperature changes at the interface between the PEEK 20 and the NiTi 30 limits both the volume and the thermal mass of the polymer participating in the heat transfer.

Compared to results reported,[14] the temperature changes are higher at the same strains and the areas between the loading and unloading curves, which represent unrecoverable energy upon cycling, are larger. Because both PEEK and NiTi are from the same batch and with the same properties as before, the heating and melting process are likely responsible for these differences. To verify this assumption, the mechanical properties of PEEK are tested before and after the melting and the thermal properties of NiTi are checked before and after subjecting it to the same thermal cycle as is used for embedding it in the PEEK, i.e., heating the strip to 593 K, holding at this temperature for 20 minutes, and cooling to room temperature. The results show no measurable differences in polymer properties, however, thermal characteristics of NiTi do change. Differential Scanning calorimetry (DSC) reveals sharpening of the transition and the austenite stabilization temperature shifts from 302 to 322 K, which is in agreement with Pelton et al.[17] Cycling in the temperature range closer to the beginning of the transition is known to result in wider hysteresis as shown in Pelton et al.[17] and Wu et al.,[9] while the sharper transition is the reason for the higher measured temperature change associated with loading to certain strains.

3.2 Cyclic Testing

In order to test cyclic behavior two randomly selected composite beam 10D samples are subjected to 10,000 loading cycles at 2% strain which corresponds to almost 7 K temperature change in the freshly assembled composites. As large body of research in magnetocaloric systems indicate,[18-20] this temperature variation is sufficient for achieving useful temperature spans and sufficient cooling powers while operating in the active regenerator heat pumping cycle.[15] None of the samples failed during cyclic tests reaching runout at $10^4$ cycles. FIG. 26 shows force-strain behavior for the 1st, 1,000th and 10,000th cycle. The large cyclic strains quickly break the strain gauges, so a new gauge is attached to record each curve. Results show no noticeable fatigue in mechanical behavior of samples between 1st and 10,000th loading cycles.

FIGS. 27A-C show surface temperatures for selected loading and unloading cycles. Measurements are taken with a FLIR A8303sc Infrared (IR) camera using the factory calibration for the range from 283 to 363 K. Over the temperature range considered, differences in emissivity between the black body used for calibration and the sample are negligible as demonstrated by the excellent (within 0.2 K) agreement of temperature changes recorded during the first cycle with the IR camera, shown in FIG. 27A-C, and those measured with thermocouples, shown in FIGS. 25A-C. The temperature change is calculated by averaging the area defined by the full width of NiTi strip (4 mm) and distance between loading pins (60 mm) which corresponds to about 2000 pixels. The full width of the strip is considered due to similar temperature changes of the exposed surface and surface covered by PEEK film as visible in FIG. 4. This observation is beneficial for the construction of elastocaloric systems, because it shows that even the elastocaloric material covered by the polymer film is still usable for heat generation/absorption process albeit with increased heat transfer resistance.

The temperature change stabilizes with the NiTi training process. The first cycle achieves +6.6 K and −5.4 K temperature change for loading and unloading, respectively. Over the first 1,000 cycles the temperature changes decrease by approximately 0.9 K due to training[21] and then hold steady. The temperature distribution across the sample does not change with the training process in compression as is observed for elastocaloric materials utilized in tension.[22]

4. Conclusions

Compression of elastocaloric materials is extended beyond bulk, heat-transfer-resistant samples and rigid hollow geometries like tubes that require precise alignment. Fabricating composites and subjecting their elastocalorically active layer to compressive stresses shows that achieving high strains and temperature changes is possible even in geometries like strips. The stable mechanical and thermal response after $10^4$ cycles is a promise of durable solutions that can be employed in elastocaloric cooling systems. To further benefit from the proposed idea and to enhance energy harvesting from the elastocaloric materials, demonstrating cycle life several orders of magnitude higher than the chosen runout at $10^4$ cycles, as well as providing access to the obscured surface are both important and should be the next steps in advancing robust, compact, and efficient regenerator designs.

5. References for Section IV.D. Supra

[1]W. Goetzler, R. Zogg, J. Young, and C. Johnson, *Energy Savings Potential and RD&D Opportunities for Non-Vapor-Compression HVAC Technologies* (2014).

[2]U.S. Department of Energy. Fossil https://www.energy.gov/science-innovation/energy-sources/fossil (accessed 2020-05-06).

[3]W. Goetzler, T. Sutherland, M. Rassi, and J. Burgos, DOE Off. Energy Effic. Renew. Energy (2014).

[4]J. Slaughter, A. Czernuszewicz, L. Griffith, and V. Pecharsky, J. Appl. Phys. 127, 194501 (2020).

[5]J. Tušek, K. Engelbrecht, D. Eriksen, S. Dall'Olio, J. Tušek, and N. Pryds, Nat. Energy 1, (2016).

[6]K. Engelbrecht, J. Phys. Energy 1, 021001 (2019).

[7]P Kabirifar, A. erovnik, . Ahčin, L. Porenta, M. Brojan, and J. Tušek, Stroj. Vestnik/Journal Mech. Eng. 65, 615 (2019).

[8]J. Frenzel, G. Eggeler, E. Quandt, S. Seelecke, and M. Kohl, MRS Bull. 43, 280 (2018).

[9]Y. Wu, E. Ertekin, and H. Sehitoglu, Acta Mater. 135, 158 (2017).

[10]K. Zhang, G. Kang, and Q. Sun, Scr. Mater. 159, 62 (2019).

[11]S. Qian, Y. Wu, J. Ling, J. Muehlbauer, Y. Hwang, I. Takeuchi, R. Radermacher, and G. L. M. Hall, in 24*th IIR Int. Congr. Refrig.* (2015).

[12]S. Qian, Y. Geng, Y. Wang, J. Muehlbauer, J. Ling, Y. Hwang, R. Radermacher, and I. Takeuchi, Sci. Technol. Built Environ. 22, 500 (2016).

[13]J. Chen, K. Zhang, Q. Kan, H. Yin, and Q. Sun, Appl. Phys. Lett. 115, 093902 (2019).

[14]A. Czernuszewicz, L. Griffith, J. Slaughter, and V. Pecharsky, Appl. Mater. Today 19, (2020).

[15]J. A. Barclay and W. A. Steyert, (1982).

[16]K. L. Engelbrecht, G. F. Nellis, and S. A. Klein, J. Heat Transfer 128, 1060 (2006).

[17]A. R. Pelton, J. DiCello, and S. Miyazaki, Minim. Invasive Ther. Allied Technol. 9, 107 (2000).

[18]A. Kitanovski, Adv. Energy Mater. 10, 1903741 (2020).

[19]A. Greco, C. Aprea, A. Maiorino, and C. Masselli, Int. J. Refrig. 106, 66 (2019).

[20]L. Griffith, A. Czernuszewicz, J. Slaughter, and V. Pecharsky, Energy Convers. Manag. 199, 111948 (2019).

[21]J. Tušek, A. erovnik, M. Čebron, M. Brojan, B. užek, K. Engelbrecht, and A. Cadelli, Acta Mater. 150, 295 (2018).

[22]P. Sittner, Y. Liu, and V. Novak, J. Mech. Phys. Solids 53, 1719 (2005).

[21]J. Tušek, A. erovnik, M. Čebron, M. Brojan, B. užek, K. Engelbrecht, and A. Cadelli, Acta Mater. 150, 295 (2018).

[22]P. Sittner, Y. Liu, and V. Novak, J. Mech. Phys. Solids 53, 1719 (2005).

FIG. 28 diagrammatically illustrates use of composite structure 10D in an ECE harvesting system 12, similar to that shown in FIG. 9. As will be appreciated, one or more devices 10D can be used and actuated in a coordinated manner for a given application.

E. Options and Alternatives

As mentioned, the invention can take many forms and embodiments. Additional examples follow.

1. Cantilever Beam

With particular references to FIGS. 29-34, several examples of a composite base and strip (or strips) in a composite cantilevered arrangement 10C will be shown. A thin elastocaloric strip is mounted at or on the fixed end of the beam. An actuating force is applied at the opposite beam end. Because the thin strip is at the margin of the beam, relative low force at the free end concentrates stresses at the fixed/pinned end. As a result substantial tensile or compressive strain can be created in the strip (dependent on whether the bending is away from or towards the strip side of the beam). Further discussion follows.

2. Stresses in a Cantilever Beam (FIGS. 29A and B)

Larger stresses can be induced by bending a beam 20 with the same force as by applying uniaxial stresses.

Applying the force axially gives a uniform stress over the entire length of the beam 20:

$$\sigma_{axial} = \frac{F}{tb}$$

Applying the force transverse to the thickness results in large stresses at the "fixed" end of a cantilever beam 20:

$$\sigma_{bending} = \frac{My}{I} = \frac{F}{tb}\frac{6L}{t} = \sigma_{axial}\frac{6L}{t}$$

Since L>>t for a long, thin beam bending stresses are much larger for the same force. The upper surface is in tension for the force direction shown. The lower surface is in compression.

3. Composite Beam (Cantilever Arrangement) (FIG. 30)

By making a portion of the beam out of elastocaloric materials, the stresses can be either all in tension or all in compression.

The example 10E shown has all tension for the upper elastocaloric material and all compression for the lower portion.

By making the active EC material much shorter than the beam 20 length, the stresses do not vary greatly over the length of the elastocaloric material.

4. Key Design Variables for Embodiments of Composite Structure 10

As will be appreciated by those skilled in this technical art, designers can take into consideration a variety of factors in design of a composite structure 10 and its integration into an assembly and system to use its ECE. Non-limiting examples follow:

- Geometry (length, width, and thickness) of the substrate material (inactive beam). It will be appreciated that examples herein include beams of on the order of 150 mm long and 6 mm in width and thickness, but that these can vary up or down according to design or need.
- Material of the inactive beam (mismatch of Young's modulus between the beam and elastocaloric material). It will be appreciated that examples herein include polymers and polymer composites, including PEEK, but others are possible including some with similar characteristics but higher surface energy (e.g. aluminium). Any metals, or even active materials as mentioned above (electrostrictors or magnetostrictors), could be used.
- Geometry (length, width, and thickness) of the elastocaloric material. It will be appreciated that examples herein include strips of much greater width and length than thickness, but that these can vary up or down according to design or need. Non-limiting examples include a fraction of mm thick, several mm wide, and tens of mm long (e.g. ~100 mm).
- Material of the elastocaloric member(s). It will be appreciated that examples herein include shape-memory effect metals and alloys, including NiTi. Published Patent Application US 2016/00844544A1 to University of Maryland (2016), incorporated by reference herein gives other non-limited examples. Examples of EC materials, whether in strips, bulk, flakes, powder, or other forms are known to those skilled in the art. See, e.g., Hou H. et al., Fatigue-resistant high performance elastocaloric material made by additive manufacturing, Science, 29 Nov. 2019: 1116-1121 (describes additive manufacturing of EC in powder or flake form).

Location of the elastocaloric material. It will be appreciated that examples herein include elastocaloric members pinned over a cut-out along a beam, bonded along the side of a beam, at or extending from an end of a beam. Variations are possible. The manner of mounting can vary.

Bending Actuation. It will be appreciated that examples herein include electromechanical actuators that can apply linear forces to a beam to bend it. Some examples are in the context of four-point bending, which requires two supporting points to hold the beam and mounted elastocaloric member(s) and two loading points on the opposite side of the beam. Such four-point bending is well-known and can be implemented in a variety of ways according to need or desire of the designer. Some examples are in the form of a cantilevered beam where actuating force can be applied transverse to the beam axis at its free end. Variations are possible. Any combination of fixed, free, pinned, or other boundary conditions that, when subjected to loading forces or moments, causes bending in the beam are possible. Another example would have the actuator in the form of an electrostrictive or magnetostrictive plate embedded in the beam located at a distance from the neutral axis so that when a field is applied, the entire beam, including elastocaloric material, bends in response because of the differential strain between the actuator and passive layers (commonly called a bi-morph or uni-morph beam for piezoelectric actuators).

Actuation control. Examples of digitally-programmable controllers that can be configured to output instructions to the actuator(s) to apply and release actuating forces that produce a desired and effective elastocaloric effect. A few non-limiting examples are discussed herein. As can be appreciated, the instructions will depend on the design selections of the beam, elastocaloric material, and the application that will use the elastocaloric effect. In the example of an application to produce cooling of an enclosed space, such as refrigeration or air conditioning, a cyclical regime for application and release of actuating forces tuned to the components and desired cooling results can be derived by the designer. US Published Patent Application 2016/00844544A1 to University of Maryland (2016) gives some examples for illustration (see also Sharar D J, Radice J, Warzoha R, Hanrahan B, Chang B. First Demonstration of a Bending-Mode Elastocaloric Cooling "Loop." Proc. 17th Intersoc. Conf. Therm. Thermomechanical Phenom. Electron. Syst. ITherm 2018, 2018. doi: 10.1109/ITHERM.2018.8419513, incorporated by reference herein).

All of these variables can be used to optimize the design (maximize stresses, minimize stress variation, minimize force, etc.)

5. Alternating Force (See Again FIG. 30)

For composite structure 10E, force can go from positive to negative direction.

Slowly varying-quasi-static motion of the beam.

Dynamic (varying quickly)-vibration of the beam below, at, or above resonance.

Stresses can alternate between any combination of tension, compression, and zero stress.

Figure 31A:
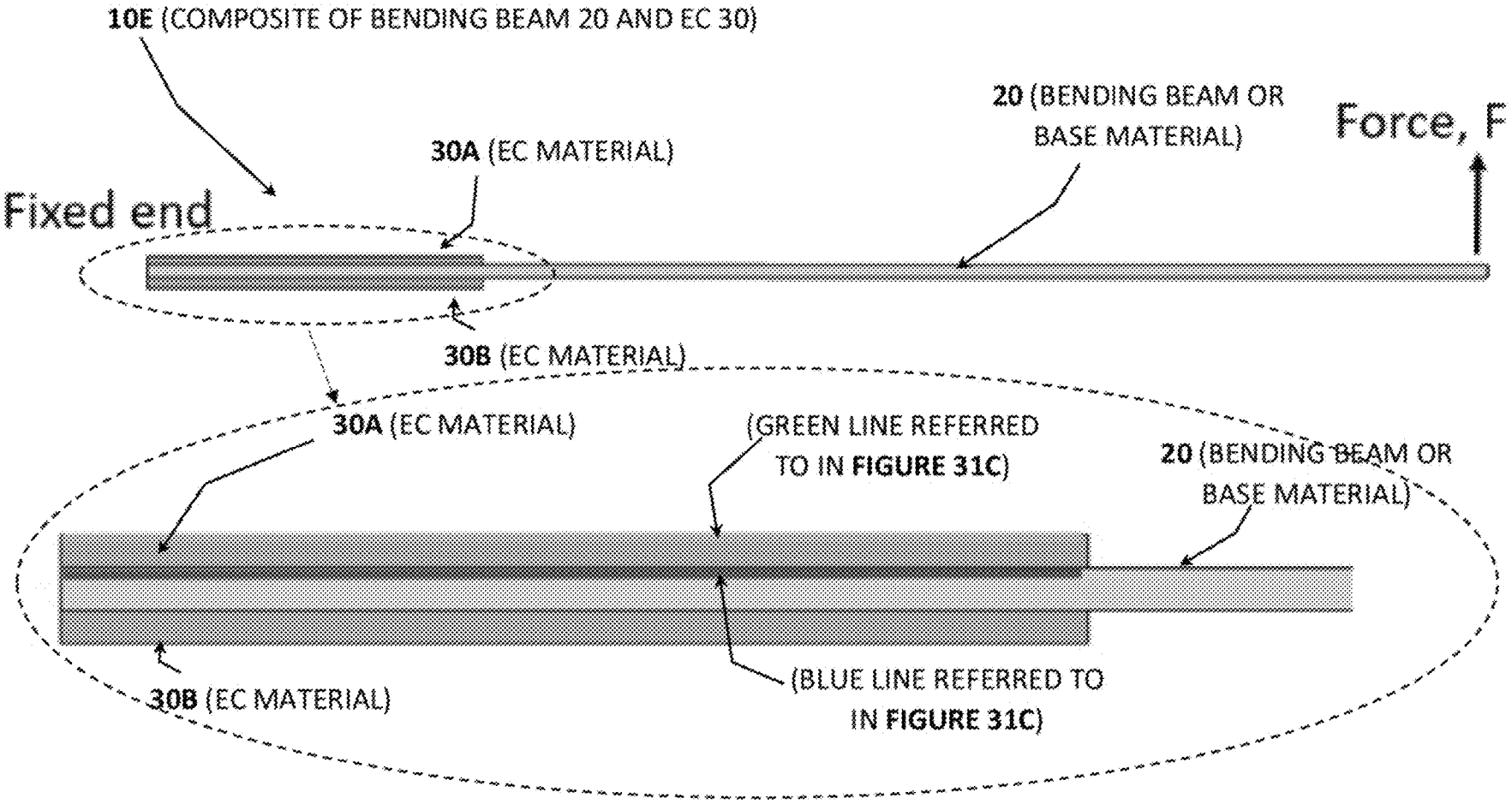
Figure 31B:
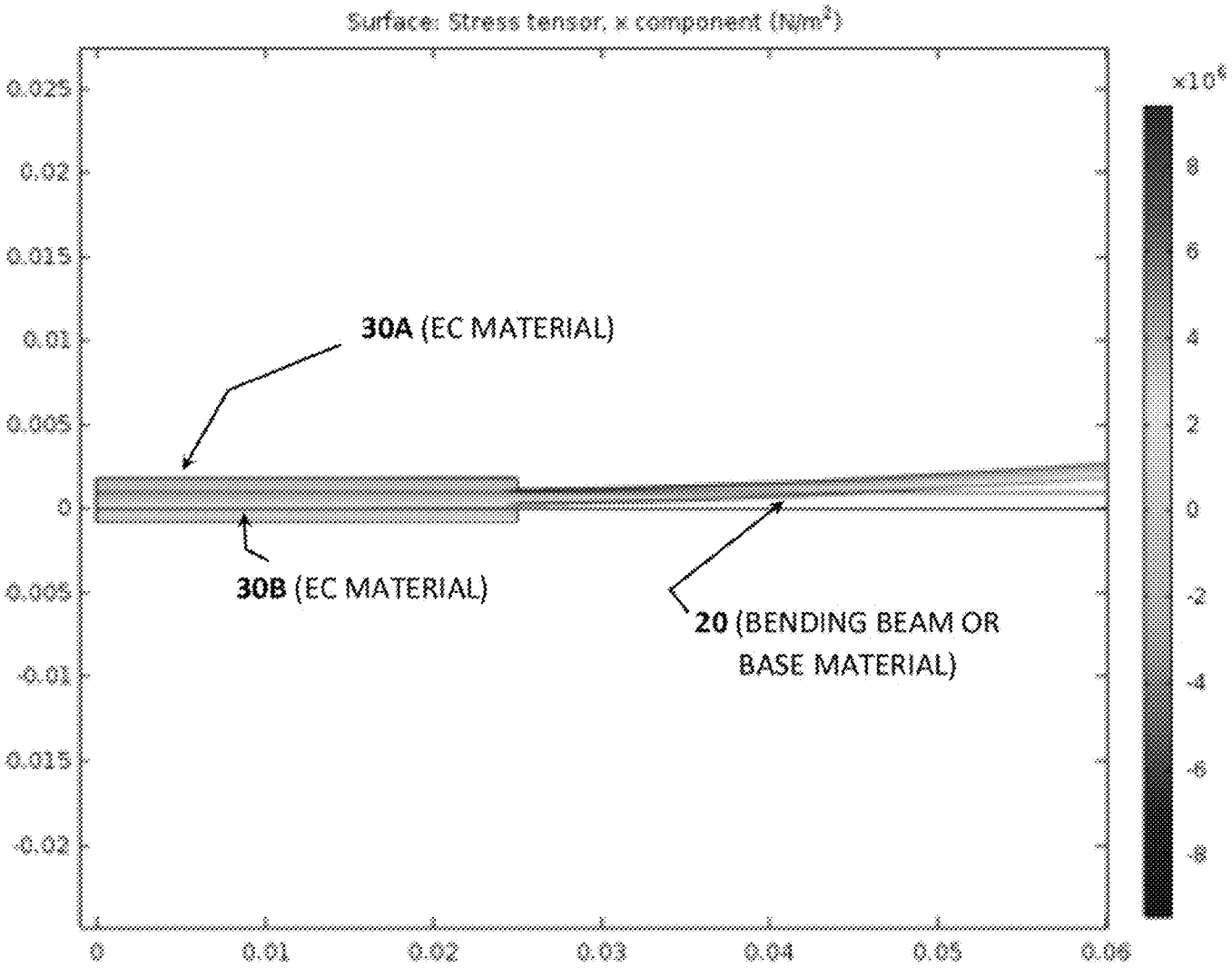
Figure 31C:
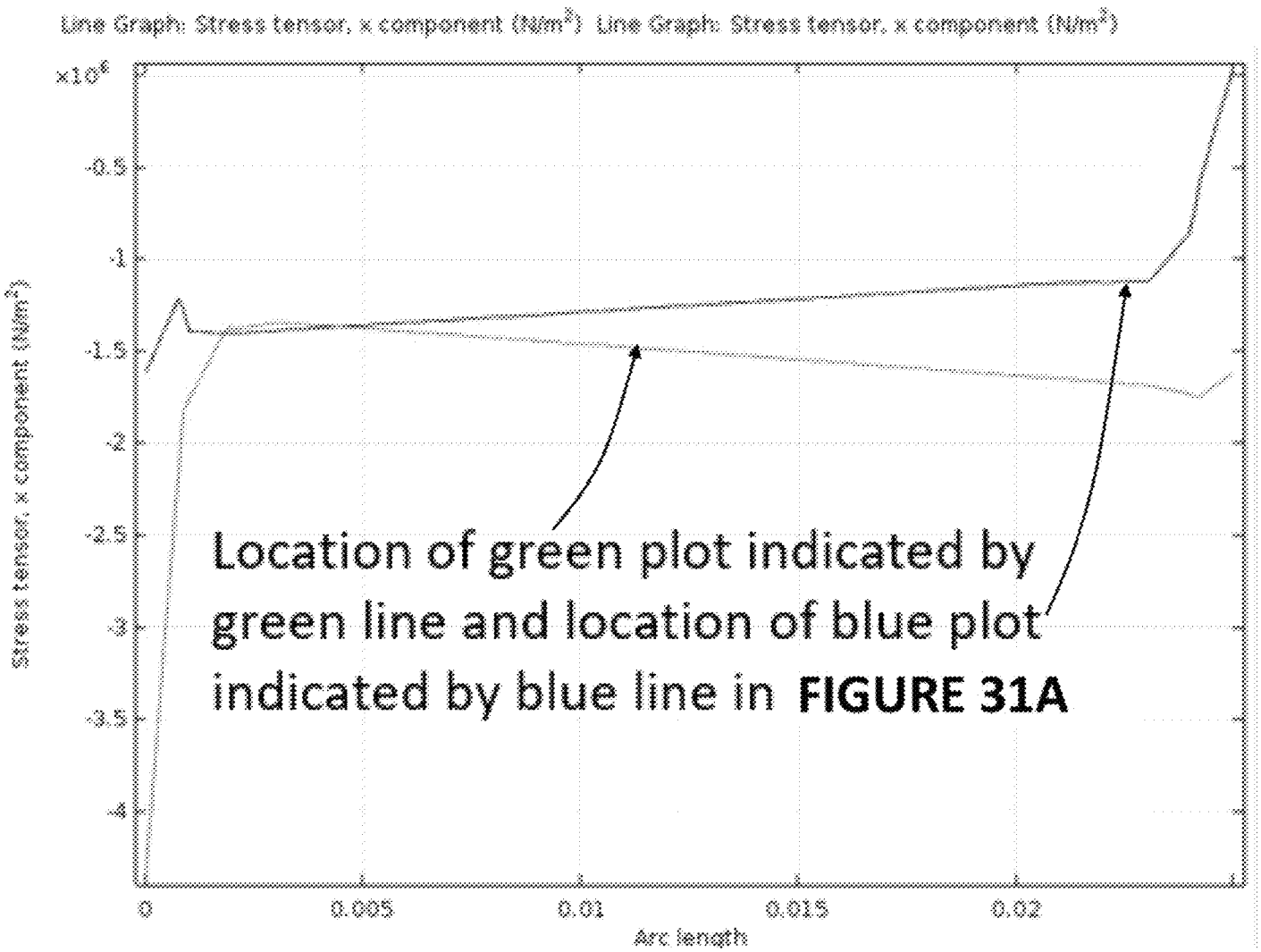

6. Example Beam #1 (FIGS. 31A-C)

Elastocaloric patches 30A and B on the beam 20 to form a composite device 10E (FIG. 31A) can be made as follows:

Elastocaloric material 30A and B (blue, NiTi, E=20e9 Pa, t=0.8 mm, L=25 mm, b=50 mm)

Passive material 20 (gray, Titanium, E=110e9 Pa, t=1 mm, L=100 mm, b=50 mm)

F=1 N

Stresses are roughly equal to 1.5 MPa per N of input force, 400 N provides 600 MPa stress Note stress concentration on the substrate 20 near the end of the elastocaloric material 30.

Performance data for composite structure 10E is shown at FIGS. 31B-C.

7. Example Beam #2 (Figure S32A-C)

Portion of the substrate replaced with elastocaloric patches to form a composite device 10F (FIG. 32A) can be made as follows:

Elastocaloric material 30A and B (blue, NiTi, E=20e9 Pa, t=0.8 mm, L=25 mm, b=50 mm)

Passive material 30 (gray, Titanium, E=110e9 Pa, t=2.6 mm, L=100 mm, b=50 mm)

F=1N

Figure 32A:
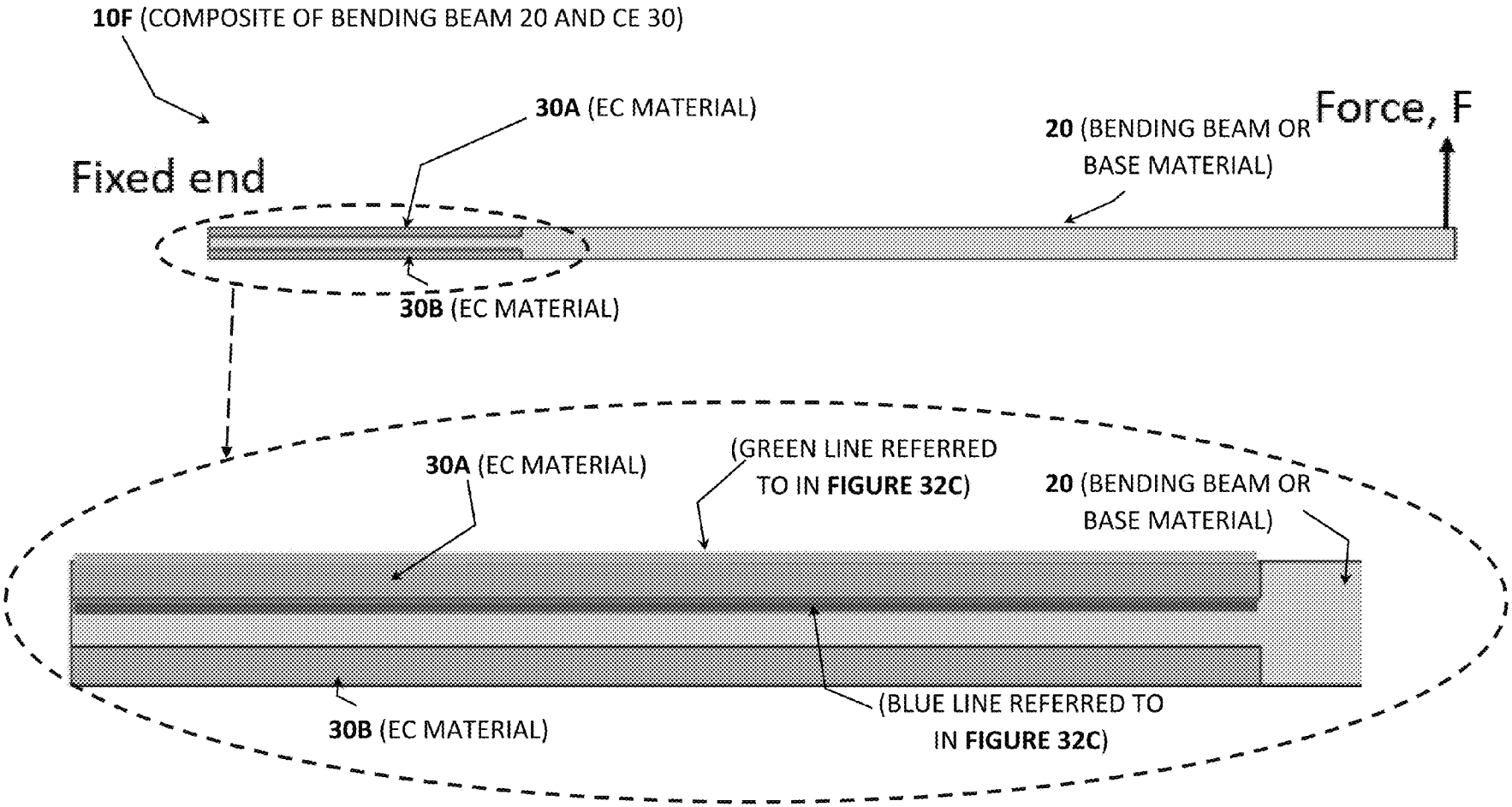
Figure 32B:
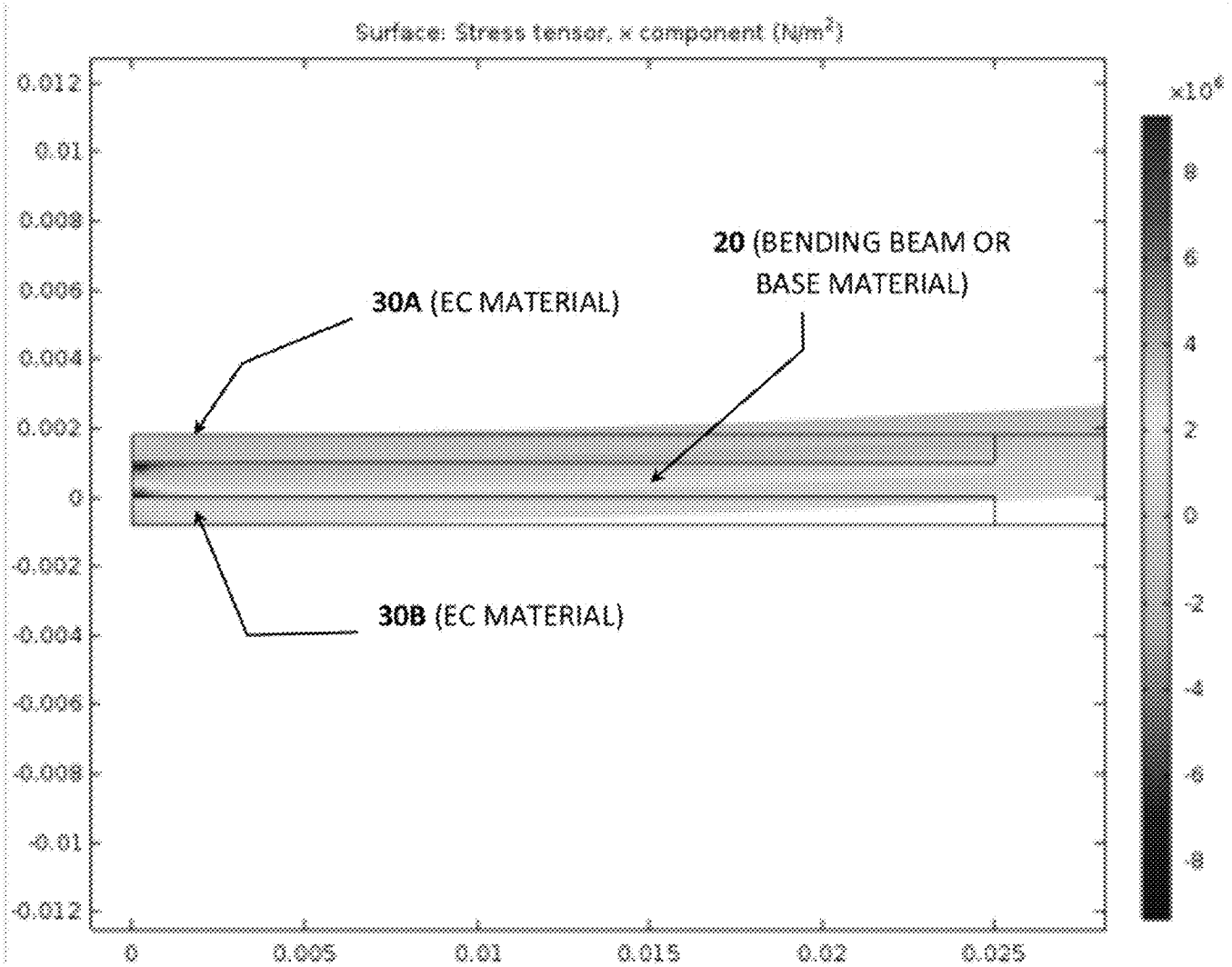
Figure 32C:
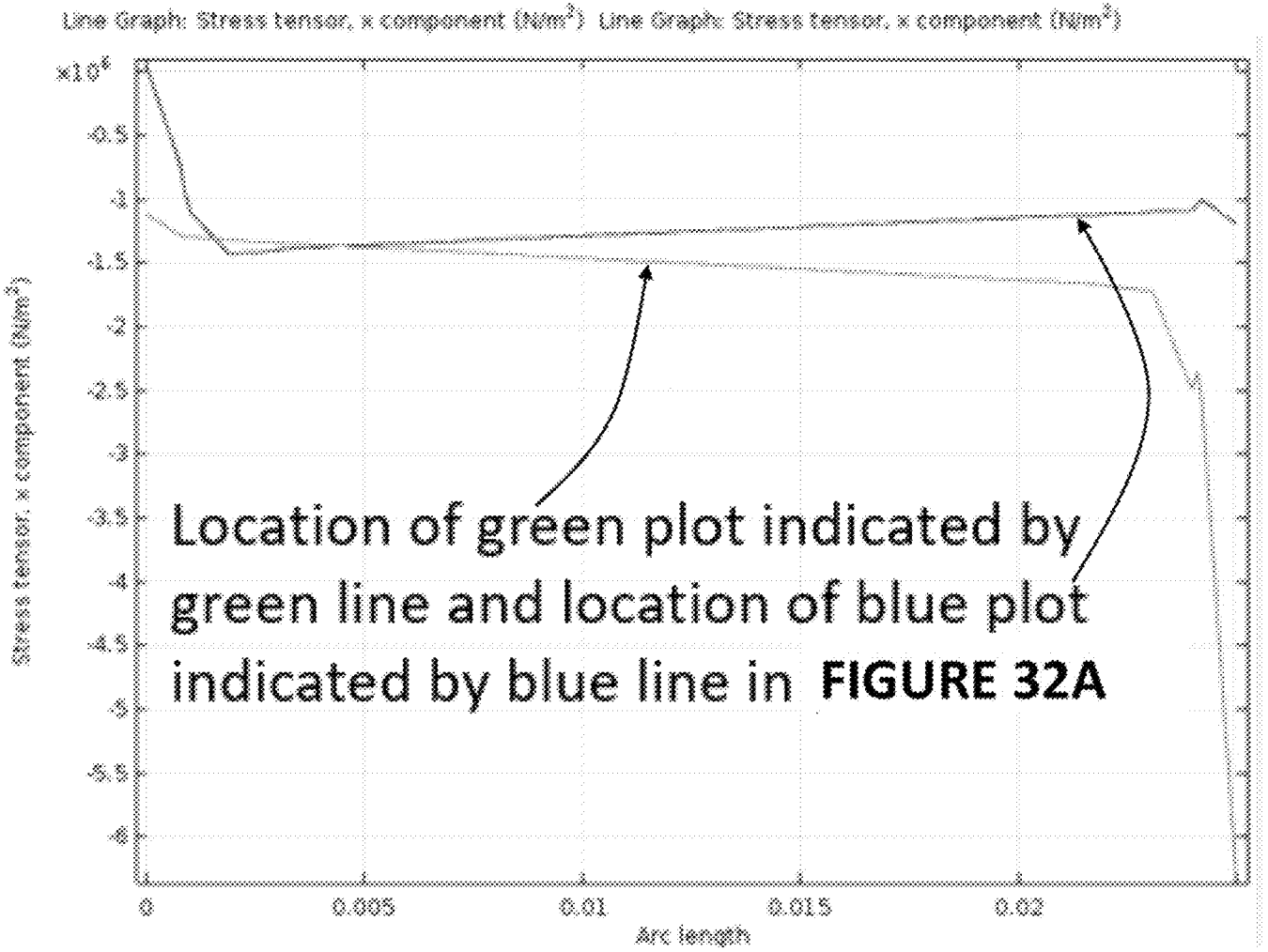

Stresses are roughly equal to 1.5 MPa per N of input force, 400 N provides 600 MPa stress Note that the stress concentration on the substrate near the end of the elastocaloric material is no longer there for this option Performance data for composite structure 10F is shown at FIGS. 32B-C.

8. Example Beam #3 (FIG. 33A-C)

Portion of the substrate 20 replaced with elastocaloric patches to form a composite device 10G (FIG. 33A) can be made as follows:

Elastocaloric material 30A, B (blue, NiTi, E=20e9 Pa, t=0.8 mm, L=25 mm, b=50 mm)

Passive material 20 (gray, Titanium, E=110e9 Pa, t=2.6 mm, L=100 mm, b=50 mm)

F=1N

Stresses are roughly equal to 1.5 MPa per N of input force, 400 N provides 600 MPa stress.

Stresses are much less uniform for this arrangement, but it may provide benefits for heat transfer.

Performance data for composite structure 10F is shown at FIGS. 32B-C.

9. Regenerator Concept (FIGS. 34-36)

As will be appreciated by those skilled in this technical art, a variety of ways to use the ECE generated by embodiments according to the invention can vary according to designer need or desire. A few non-limiting concepts or examples are diagrammatically illustrated in FIGS. 34-36 in a variety of composite structures 10H, 10I, or 10J. General principles include:

Fluid can flow along the width, b of the beam with fluid connections in the clamped portion of the beam 20.

Fluid can flow external to the beam 20 in direct contact with the elastocaloric materials 30A, B. See, e.g., FIG. 34A.

Fluid can flow internal to the beam 20 in direct contact with the elastocaloric materials 30A,B. See, e.g., FIGS. 35 and 36.

As the beam moves vertically, it can make/break contact with heat exchanges resulting in an effective passive thermal diode.

Other examples of design options are as follows with respect to FIGS. 34-36:

Use the clamped region of the beam to flow water in and out of the region covered by the elastocaloric patch.

Or replace a portion of the beam with the patches and have cooling fluid in direct contract with the elastocaloric material.

Temperature gradient across the beam width, w, in both cases.

Alternatively, the beam motion can be used to contact alternative hot and cold heat sinks to make an effective thermal diode. (See, e.g., Kitanovski, A, et al., Magnetocaloric Energy Conversion, From Theory to Applications, CH6, Section 6.63) Springer International Publishing (2015), incorporated by reference herein. See FIGS. 37A and B.

Apply a force and move beam upward.

Makes contact with hot heat exchanger when $\sigma=\sigma_{max}$

Can rapidly transfer heat to the hot and cold sinks.

10. Integrated Actuation (FIGS. 37A-B)

Differential strain between different parts of the beam causes bending (similar to a thermally actuated bimetallic switch)-many piezo and thin-film bender actuators are available (bi-morph, uni-morph, beams and plates)

One portion of the beam can be a bender actuator with another portion being elastocaloric material to form a composite device 10K (FIG. 37A).

Differential strain between the bender and the elastocaloric material causes bending and high stresses in the elastocaloric material (FIG. 37B).

This integrates the actuator with the beam, so an external source of force is not needed.

11. Piezo Beam (FIGS. 38A-C)

Other examples of a piezoelectric-based beam are as follows:

Piezo bimorph bends because of differential strain in two layers of a PZT (or other electrostrictive) beam.

One side expands while the other contracts resulting in bending (or one side expands/contracts in response to applied electric field while the other does not).

A thin layer of EC material is applied to one or both sides of the bimorph.

Or one side of the PZT layer is replaced with elastocaloric material.

This concept integrates the actuator with the beam to make a much more compact elastocaloric device.

12. Other Possible Geometries and Composites 11.1 Beams with Other End Conditions Actuating forces or bending moments can be applied to beams with any combination of clamped, free, pinned, or other boundary conditions to cause bending stresses in the beam.

11.2 Plates

The geometry of the base material can also be in the form of a plate where the length and width dimensions are similar in extent. The elastocaloric material can be continuous or in smaller pieces than the width and length of the base. All boundary conditions appropriate for beams can also be used for plates. These boundary conditions can be applied in any direction in the plane of the plate and will restrict motion transverse to the plane of the plate in the regions of the boundary conditions. Actuating forces and bending moments are applied to the plate to cause bending stresses in the plate.

13. Other Bending Geometry

Structures other than flat beams or plates can be envisioned including curved beams, curved plates, closed rings or structures (example in FIG. 39) with elastocaloric material attached to all or part of the surface(s) of the bending structures.

14. Methods to Apply Stresses to Elastocaloric Materials:

Attach patches of suitable elastocaloric (EC) material to a cantilever beam. Apply a force at the end. (FIGS. 32-37).

The EC patch is either in tension (top of beam as shown with the force) or compression (bottom of beam as shown)

Changing force causes changing stress in the EC patch.

Can be operated at resonance of the beam ($F=F_0 \sin \omega t$ where $\omega$=bending resonance of the beam).

Can be operated in a slowly varying way.

Each EC patch can be alternated between +/−stress by applying +/−F or they can remain always + or − by applying a force between 0 and F (see FIG. 32B).

Forces are much lower acting on the beam to achieve the same stress as direct tension or compression:

Direct:

$$\sigma_D = \frac{F}{A},$$

where A=d*t where d is width and t is thickness of the beam

Bending:

$$\sigma_B = \frac{F \times L \times t/2}{\frac{1}{12} d t^3} \text{ where}$$

$$L \text{ is length of the beam} = \left(\frac{F}{A}\right)\frac{6L}{t} \text{ since } L \gg t$$

$\sigma_B >> \sigma_D$ for the same force.

15. Piezo Plate

The "beam" can also be in the form of a piezo bender plate (see FIG. 39). EC material can be added to the plate and stretched/compressed with the PZT. The substrate can also be replaced by EC material.

The plate (circular or rectangular) provides more flexibility for the design with boundary conditions and possibilities for regeneration.

F. Specific Example 3

As will be appreciated, the invention can be implemented in a variety of forms. With particular reference to appended FIGS. 40-50, the following specific example includes several non-limiting possible embodiments. It also includes proof-of-concept experimental results and data showing efficacy. It also provides examples of how the device can be implemented in heating and cooling applications.

This section is taken at least substantially verbatim from Slaughter, J., Czernuszewicz, A., Griffith, L., and Pecharsky, V., COMPACT AND EFFICIENT ELASTOCALORIC HEAT PUMPS—IS THERE A PATH FORWARD? J Appl. Phys. 127, 194501 (2020), which is incorporated by reference herein in its entirety.

ABSTRACT

Elastocaloric cooling holds promise for energy-efficient heat pumping near room temperature with low environmental impact. Its adoption is, however, impeded by disproportionally large sizes of actuators compared with the active material volume. Taking magnetocaloric cooling as the baseline, the value of no more than 10:1 actuator volume to active material volume should lead to both size- and cost-effective solutions that may potentially be competitive with vapor-compression devices. With the goal to establish performance metrics that can lead to informed actuator selection for specific regenerator requirements, we analyze a wide range of elastocaloric materials and actuator technologies to find the best matches. We find that actuation with magnetic shape memory alloys meets all requirements; however, this technology is currently in early developmental stages and such actuators are not widely commercially available. Another promising and easily accessible option is standard rotary electric motors in combination with rotary-to-linear transduction mechanisms. A theoretical analysis of two case studies of elastocaloric systems using rotary electric motors with a Scotch yoke mechanism demonstrates the usefulness of our approach. Actuator requirements are based on two different regenerator configurations: one starting from zero strain without any mechanical energy recovery and another with 2% pre-strain and mechanical energy recovery to reduce the power and torque required from the motor. Our results indicate that the 10:1 target actuator to active material volume ratio can be met and feasibly lowered further, demonstrating that the proposed method for selecting actuators makes compact and efficient elastocaloric systems possible.

1. Introduction

By 2050, global energy use for space cooling is projected to increase threefold[1] due to emerging economies, income rise, and population growth resulting in significant increases in economic and environmental impacts. Caloric cooling, more specifically elastocaloric (eC, also known as thermoelastic) cooling, has been identified as one of the most promising non-vapor-compression technologies with a high potential to improve efficiency and eliminate greenhouse gas emissions.[2] Although the technology shows great promise, there are no known commercial elastocaloric cooling systems.

Several research-scale devices for both single-stage cooling[3-5] and active elastocaloric regeneration[6] were demonstrated; however, they are far from achieving the performance and size parameters needed to be competitive with vapor-compression systems. Citations in superscript in this Section IV. F. pertain to the list of References at the end of this Section IV. F.

While research and development of elastocaloric (eC) heat pump systems is on the rise, elastocaloric cooling has not yet reached the level of maturity of competing caloric technologies such as magnetocaloric (MC) cooling. Learning from 20+ years of MC development[7,8] and its main barriers to commercial adoption[9] can help rapidly advance eC technology. Many promising MC systems have been demonstrated;[10] however, the technology has not been widely adopted largely due to the high cost of producing magnetic fields. Unlike MC systems where permanent magnet arrays or coils are the only practical choices to produce magnetic fields that control magnetocaloric effects, there is a wide range of actuators available to apply stresses to control strains and elastocaloric effects.

The majority of demonstration systems that have achieved measurable cooling power employ hydraulic actuators[11] and linear motors.[5,6] In all of these cases, the actuators are hundreds of times larger than the amount of active material.[12] For comparison, in MC systems, the ratios of permanent magnet volume to active regenerator volume are on the order of 10:1 or less. A similar target value for elastocaloric systems, less than 10:1 actuator volume to active material volume, is needed in order for these systems to be competitive in size with vapor-compression systems.

Qian et al.[3] considered piezoelectric, linear motor, screw jack, hydraulic, and pneumatic actuators for elastocaloric systems, however, without detailed analysis of actuator selection. Shape memory alloy (SMA) actuation of elastocaloric materials has the potential to achieve a small actuator to active material volume,[12] but this approach uses thermal energy, is slow, and is therefore unsuitable for most cooling applications. Considering the wide array of actuator technologies available, establishing reliable methods to match actuator capabilities with requirements of active elastocaloric regenerators is needed for compact cooling solutions.

In this work, we identify metrics that can be used to select actuators for eC systems for best performance by evaluating a broad range of actuator technologies using established methods.[13] For specific elastocaloric materials, we evaluate possible actuator technologies on the basis of energy density and power density. We further show the potential for compact, inexpensive actuators in two case studies of regenerative elastocaloric systems.

2. Methods

A. Elastocaloric Materials

The most widely used eC materials are nearly stoichiometric nickel-titanium (NiTi) alloys, commonly known as Nitinol, due to their large eC effect and commercial availability. Near-adiabatic temperature changes of 23 K have been reported for applied tensile stresses of 570 MPa and strains of 6%.[14] NiTi alloys do have draw-backs such as large hysteresis and fatigue-related failure.[15,16] To address fatigue in NiTi, operating with pre-strain and a relatively low oscillating strain has been proposed.[15] Other known elastocaloric materials, the majority of which are not commercially avail-able, are mostly variations of nickel-based and copper-based alloys, magnetic shape memory alloys (MSMAs), man-made and natural polymers, and ferroelectric ceramics. Selected eC materials and their achievable actuation stresses and strains are listed in Table I along with their reported adiabatic temperature changes including two cases of NiTi materials with pre-strain. Strain energy density of a linear elastic material is half of the product of stress and strain,[17] and we use this as a first-pass estimate of the energy density required to actuate the materials.

B. Actuation Performance Metrics

From the wide array of actuation technologies available, we list the technologies deemed most appropriate for elastocaloric actuation in Table II.[3,13] Actuator types include both direct actuation of active materials (e.g., piezoelectrics, magnetostrictives, SMAs, and ferromagnetic SMAs) and conventional actuators (e.g., hydraulic, pneumatic, and electromagnetic). Evaluating the inherent stress and strain of actuators and actuator materials provides insights into selecting the best technology to use. We apply the technology-independent metrics for actuators and actuator selection suggested by Huber and Fleck[13] to the case of elastocaloric systems. For a linear actuation material, the maximum mechanical energy density is calculated as one quarter of the product of maximum stress and strain,[13,35]

$$E_{max}=\tfrac{1}{4}\sigma\varepsilon \quad (1)$$

While considering the full load curve, including nonlinearities, would be more accurate, the simplicity of this method makes it attractive as a first approximation in comparing active material requirements with actuation capabilities. It is applicable to low-frequency actuation and provides an order-of-magnitude evaluation tool for matching actuator technologies to key parameters of elastocaloric materials collected in Table I.

At the full-actuator level, the actuator energy density, $E_{a,max}$, describes the maximum force it can provide, $F_{max}$, and its maximum travel, $x_{max}$, making it a better system-level metric, $$E_{a,max} = \frac{1}{4}\frac{F_{max}x_{max}}{V}, \tag{2}$$

where V is the volume of the actuator. For some active materials, actuator size is strongly application dependent; these technologies were evaluated based on the energy density of the actuating material [Eq. (1)] where indicated in Table II (see FIG. 49B).

The maximum actuator energy per unit volume provides an accurate measure of the size of the actuator needed to meet requirements of direct actuation for low-frequency elastocaloric heat pump operation. Practically, however, actuators commonly operate indirectly at the system level; working through, e.g., gearboxes and lever arms. For these cases, considering the frequency of operation, f, allows matching the power density of the actuator, $P_{a,max}$, to the requirements of a given eC system, $$P_{a,max}=fE_{a,max} \tag{3}$$

Because power density is proportional to frequency for the regime of interest, this opens up a range of possible actuation technologies, provided the power can be shifted efficiently from high to low frequency.

3. Results And Discussion

A. Actuator Evaluation

FIG. 40 shows the stress-strain capabilities of many common actuation materials and actuators along with the requirements for several elastocaloric materials; our focus is on Ni-based alloys and NiTi with pre-strain because of their commercial availability and large eC effect. Lines of constant energy density are provided on the plot as an indicator of the volume ratio of active material required to actuate elastocaloric material. The Ni-based eC materials fall largely along the 10 MJ/m$^3$ line; actuators and active materials in the 1-10 MJ/m$^3$ range fall within the 10:1 target range. Interestingly, thermally actuated NiTi (shape memory effect) pro-vides a very close match to the energy density requirements of elastocaloric (superelastic) NiTi.[12] The only other technology that meets or exceeds the energy density requirements is hydraulics albeit with a lower stress and higher strain. Magnetic shape memory alloys (MSMAs) overlap a small portion of the actuation requirements for NiTi with pre-strain and pneumatics fall within the 10:1 energy density range. Based purely on stress and strain requirements, SMAs and MSMAs would result in the most compact actuators for Ni-based alloys and NiTi with pre-strain, respectively. Although hydraulics are in the same range of energy density as elastocaloric materials, they would require force amplification and stroke de-amplification to meet the requirements because of their low stress and large strain. Without this, hydraulic actuators need to be oversized to meet the force requirements as done eslewhere.[11] FIG. 1 does not account for power, efficiency, or cost of the actuator; so it only provides part of the information needed in actuator selection. It is promising, however, that there are multiple actuator technologies in the target 10:1 volume range.

When designing an energy-efficient eC heat pump system, efficiency of the actuator will be critical to the overall system efficiency. Thus, we can safely exclude technologies with efficiencies less than 50% in Table I (see FIG. 49A) from further consideration, leaving piezo-electrics, magnetostrictives, magnetic SMAs (MSMA), solenoids, moving coils, and linear motors. These higher efficiency technologies are evaluated on the basis of frequency and power density to match the requirements of elastocaloric materials.

Evaluating actuators based on power provides another dimension in actuator selection (FIG. 41). While piezoelectric and magnetostrictive actuators have higher power density than required for most eC materials, they tend to have very high operating frequencies. There are some methods to frequency-shift their opera-tion;[40,41] however, this comes at the expense of low efficiency and complex controls. Linear motors, solenoids, and moving coil actuators suffer from low power density in the frequency range of inter-est. MSMAs are a good match in power density and frequency. The power density is calculated only at the material level; however, actuators based on MSMAs are not widely available because they are not a mature technology.

In the power density plot, we add a new category of actuators, rotary electric motors. While rotary motors cannot directly actuate elastocaloric regenerators, their rotary motion can be converted to linear reciprocating motion using any number of mechanisms such as slider-cranks or Scotch yokes.[42] Motors are ubiquitous and inexpensive, and their frequency of operation is easily changed with gears at reasonable efficiencies making them a good choice of actuators for eC applications.

B. Case Studies—Rotary Motor Actuation

We look at theoretical design cases for elastocaloric cooling, including the regenerator configuration that drives requirements for actuation. For case 1, an actuator is based on a DC electric rotary motor with a rotary-to-linear oscillation mechanism sized to operate the regenerator. Case 2 uses the same actuation method but includes improved regenerator design to reduce the actuation requirements.

The eC regenerator, in particular, the amount and configuration of eC material (plates, wires, etc.) and their arrangement, directly influences the force and displacement requirements of the actuator. For both studies, we assume a regenerator with 20.7 g of NiTi material in the form of 20 plates with active length of 75 mm, width of 10 mm, and thickness of 200 μm attached to a polyether ether ketone (PEEK) base structure. With a target operating frequency of 1 Hz, the rotational speed of the motor is 60 rpm for both cases. In case 1, the target strain for the plates is about 0%-1%, requiring approximately 0-325 MPa tensile stress applied along the active length, normal to the direction of motion as illustrated by the minor loop depicted with filled green circles in FIG. 40. Under these conditions, approximately ±3.5 K temperature changes are achieved for loading and unloading, respectively.[14]

We use a unique bending configuration as described by Czernuszewicz et al. 14 to match the requirements of the regenerator with a rotary motor (FIG. 43). Using Young's modulus of 32.5 GPa estimated from the data of FIG. 42 for the minor 0%-1% loop, we employed a two-dimensional finite element model in Comsol R to assess the force and displacement of the structure when operated as a cantilever with the fixed region and forced portion as shown in FIG. 43 (more details are provided in the supplementary material). For case 1, we estimate the target force and displacement requirements to be 2423 N and 13 mm, respectively. These force and dis-placement requirements are highly dependent on the base structure material and geometry. NiTi geometry, and boundary conditions, and can be readily matched to an actuator.

Actuation forces and displacements required by the regenerator are supplied by a rotary motor driving a Scotch yoke mechanism to convert rotary to oscillating linear motion schematically illustrated in FIG. 43: this mechanism was selected because of its compact nature and its ability to be readily adapted for different requirements.[43] The estimated average torque needed from the motor is 15.9 Nm and an average estimated power of 100 W. We selected a readily available brushless DC motor with a 223:1 gear-head (Portescap, 22ECT82 Ultra EC with R22HT planetary gearbox). As shown in FIG. 43 and Table III (FIG. 49C), the actuator volume to active material volume ratio for case 1 is 15.7:1 which is a significant improvement over hydraulics.[11]

The case 2 design employs two design concepts to further reduce the actuator to active material volume ratio. The regenerator structure discussed above can readily be used in a push-pull configuration (two regenerators acting in opposite directions) for mechanical energy recovery[44] and to provide an offset strain for the eC material,[15] both of which can drastically reduce the force and strain requirements to achieve the same temperature change. During assembly of the regenerator, both sets of strips are assembled in tension with a specific pre-strain so that, at either end of the range of motion, releasing tension on one side (lowering its temperature) can partially supply the stress for applying tension on the other side (increasing its temperature). For the case 2 design, the actuator only needs to supply the alternating stress and strain and not the total stress and strain. With a target mean strain of 2%, an alternating strain of ±0.5% results in approximately ±3.5 K temperature change,[14] which requires ±93 MPa stress because the material is operating as shown by the corresponding minor loop (red circles in FIG. 42). This minor loop is entirely in the superelastic regions illustrated by the larger stress-strain loop (black circles in FIG. 42)

This modified regenerator configuration for case 2 shown in FIG. 45 has NiTi strips on both sides of a PEEK support for a symmetric structure with energy recovery and offset strain. It has the same number and geometry of NiTi strips as in case 1. Using the case 2 regenerator geometry, stress/strain targets, and Young's modulus of 19.1 GPa estimated from the data depicted in FIG. 42, we calculate the target force and displacement requirements to be 585 N and 14 mm, respectively, using finite element analysis with the structure operated as a cantilever (refer to the supplementary material for details). The estimated average torque needed from the motor is 4.0 Nm with an average estimated power of 25 W. We selected a readily available 34 W brushless DC motor with a 204:1 gearhead as an option that can provide the torque and speed needed for actuation (Portescap, 22ECT35 Ultra EC with R22HT planetary gearbox). As listed in Table III (FIG. 49C), the motor volume to active material volume for case 2 is 9.7:1, which meets our target size of 10:1 (FIG. 45).

If the Scotch yoke mechanism is balanced properly to minimize torque[43] (i.e., operating at a mechanical resonance), the motor power and size can be reduced even further for the same regenerator assembly. The motor can also be used to provide additional functions such as pumping heat transfer fluid and operating fans. These additional functions should not add significantly to the overall motor requirements and will help ensure that the motor operates at its peak efficiency.[38]

4. Conclusions

We demonstrate two methods that can be employed to match actuation technologies with elastocaloric regenerators, namely, the energy density based on stress and strain and the power density that further takes into account operating frequency. The energy density method is appropriate for selecting actuator technologies to directly strain elastocaloric materials. Shape memory actuators match the stress, strain, and energy density requirements; however, low efficiency and slow response time eliminate them as a viable option. While hydraulics and pneumatics are close to the energy density requirements, they do not meet the stress and strain, thus requiring force amplification. Actuation with magnetic shape memory alloys matches the strain and is within a factor of 10 for stress, providing an interesting option for directly driving elastocaloric materials.

Using power density and frequency as selection criteria allows for actuation methods that do not directly strain the elastocaloric material but, rather, act through some transduction mechanism. For this second analysis, we did not consider technologies with efficiencies less than 50%, thus eliminating hydraulics, pneumatics, and shape memory actuators. Some technologies, such as piezoelectrics and magnetostrictives, have very high power densities only at high operating frequencies. We show that rotary motors with rotary-to-linear mechanisms are promising as actuators in select regenerator configurations because they are ubiquitous, efficient, and extremely flexible; frequency of operation is readily shifted using gears or belts/pulleys and rotary-to-linear converters provide the necessary oscillating motion.

Actuators based on magnetic shape memory materials meet the stress, strain, energy density, power density, and frequency ranges for elastocaloric applications and warrant future exploration as a long-term solution. While a system based on a magnetic shape memory actuator has the potential to be much simpler than the design cases considered in this work, their technical immaturity and lack of commercial availability are a hindrance to their immediate widespread use in elastocaloric cooling technologies.

Electric rotary motors fall within the target range for power density, thus providing a promising path forward for effective actuation of elastocaloric regenerators. We presented two theoretical design cases with off-the-shelf electric rotary motors and a Scotch yoke to convert rotary to linear motion driving a regenerator in a unique bending configuration. Without energy recovery, an actuator to active material volume can be as low as 15.7:1, which is an improvement over hydraulic actuators. Modifying the regenerator geometry to include energy recovery and pre-strain reduces the power requirements, lowers the ratio of actuator to material volume to 9.7:1, and demonstrates a feasible path forward to compact and efficient elastocaloric heat pumps.

5. References for Section IV. F.

[1]B. Dean, J. Dulac, T. Morgan, and U. Remme, *The Future of Cooling* (IEA, 2018).

[2]W. Goetzler, R. Zogg, J. Young, and C. Johnson, *Energy Savings Potential and RD&D Opportunities for Non-Vapor-Compression HVAC Technologies* (U.S. Department of Energy, Office of Energy Efficiency and Renewable Energy, Building Technologies Office, 2014).

[3]S. Qian, Y. Geng, Y. Wang, J. Ling, Y. Hwang, R. Radermacher, I. Takeuchi, and J. Cui, Int. J. Refrig. 64, 1 (2016).

[4]F. Bruederlin, H. Ossmer, F. Wendler, S. Miyazaki, and M. Kohl, J. Phys. D Appl. Phys. 50, (2017).

[5]M. Schmidt, A. Schütze, and S. Seelecke, Int. J. Refrig. 54, 88 (2015).

[6]J. Tušek, K. Engelbrecht, D. Eriksen, S. Dall'Olio, J. Tušek, and N. Pryds, Nat. Energy 1, (2016).

[7]C. Zimm, A. Jastrab, A. Sternberg, V. Pecharsky, K. Gschneidner, M. Osborne, and I. Anderson, *Advances in Cryogenic Engineering* (Springer US, 1998), pp. 1759-1766.

[8]C. Zimm, A. Boeder, B. Mueller, K. Rule, and S. L. Russek, MRS Bull. 43, 274 (2018).

[9]D. Eriksen, K. Engelbrecht, C. R. Haffenden Bahl, and R. Bjørk, Sci. Technol. Built Environ. 22, 527 (2016). 8

[10]A. Greco, C. Aprea, A. Maiorino, and C. Masselli, Int. J. Refrig. 106, 66 (2019).

[11]S. Qian, Y. Geng, Y. Wang, J. Muehlbauer, J. Ling, Y. Hwang, R. Radermacher, and I. Takeuchi, Sci. Technol. Built Environ. 22, 500 (2016).

[12]S. Qian, Y. Wang, L. Yuan, and J. Yu, Energy 182, 881 (2019).

[13]M. F. A. J. E. Huber and N. A. Fleck, Proc. R. Soc. Lond. A 453, 2185 (1997).

[14]A. Czernuszewicz, L. Griffith, J. Slaughter, and V. Pecharsky, Appl. Mater. Today 19, 100557 (2020).

[15]J. Tušek, A. erovnik, M. Čebron, M. Brojan, B. užek, K. Engelbrecht, and A. Cadelli, Acta Mater. 150, 295 (2018).

[16]K. Zhang, G. Kang, and Q. Sun, Scr. Mater. 159, 62 (2019).

[17]F. Beer and R. Johnston, *Mechanics of Materials,* 2nd ed. (McGraw-Hill, Inc., 1992).

[18]J. Cui, Y. Wu, J. Muehlbauer, Y. Hwang, R. Radermacher, S. Fackler, M. Wuttig, and I. Takeuchi, Appl. Phys. Lett. 101, 073904 (2012).

[19]C. Bechtold, C. Chluba, R. Lima de Miranda, and E. Quandt, Appl. Phys. Lett. 101, 091903 (2012).

[20]Y. W. Daoyong Cong, W. Xiong, A. Planes, Y. Ren, L. Mañosa, P. Cao, Z. Nie, X. Sun, Z. Yang, and X. Hong, Phys. Rev. Lett. 122, 255703 (2019).

[21]Y. J. Huang, Q. D. Hu, N. M. Bruno, J.-H. Chen, I. Karaman, J. H. Ross, and J. G. Li, Scr. Mater. 105, 42 (2015). 27

[22]B. Lu, P. Zhang, Y. Xu, W. Sun, and J. Liu, Mater. Lett. 148, 110 (2015).

[23]R. Millán-Solsona, E. Stern-Taulats, E. Vives, A. Planes, J. Sharma, A. K. Nayak, K. G. Suresh, and L. Mañosa, Appl. Phys. Lett. 105, 241901 (2014).

[24]Y. Li, W. Sun, D. Zhao, H. Xu, and J. Liu, Scr. Mater. 130, 278 (2017).

[25]G. J. Pataky, E. Ertekin, and H. Sehitoglu, Acta Mater. 96, 420 (2015).

[26]F. Xiao, M. Jin, J. Liu, and X. Jin, Acta Mater. 96, 292 (2015).

[27]A. Shen, D. Zhao, W. Sun, J. Liu, and C. Li, Scr. Mater. 127, 1 (2017).

[28]S. Qian, Y. Geng, Y. Wang, T. E. Pillsbury, Y. Hada, Y. Yamaguchi, K. Fujimoto, Y. Hwang, R. Radermacher, J. Cui, Y. Yuki, K. Toyotake, and I. Takeuchi, Philos. Trans. R. Soc. A Math. Phys. Eng. Sci. 374, 20150309 (2016).

[29]L. Mañosa, S. Jarque-Farnos, E. Vives, and A. Planes, Appl. Phys. Lett. 103, 211904 (2013).

[30]F. Xiao, T. Fukuda, and T. Kakeshita, Appl. Phys. Lett. 102, 161914 (2013).

[31]Y. Liu, I. C. Infante, X. Lou, L. Bellaiche, J. F. Scott, and B. Dkhil, Adv. Mater. 26, 6132 (2014).

[32]S. Patel, A. Chauhan, and R. Vaish, Appl. Phys. Lett. 107, 042902 (2015).

[33]A. Chauhan, S. Patel, and R. Vaish, Acta Mater. 89, 384 (2015).

[34]Z. Xie, G. Sebald, and D. Guyomar, Appl. Phys. Lett. 108, 041901 (2016).

[35]J. Sirohi and I. Chopra, J. Intell. Mater. Syst. Struct. 14, 135 (2003).

[36]H. E. Karaca, I. Karaman, B. Basaran, Y. Ren, Y. I. Chumlyakov, and H. J. Maier, Adv. Funct. Mater. 19, 983 (2009).

[37]L. J. Love, E. Lanke, and P. Alles, Estimating the Impact (*Energy, Emissions and Economics*) *of the U.S. Fluid Power Industry* (Oak Ridge National Laboratory, 2012).

[38]G. A. McCoy and J. G. Douglass, *Premium Efficiency Motor Selection and Application Guide a Handbook for Industry* (U.S. Department of Energy, Office of Energy Efficiency and Renewable Energy, Advanced Manufacturing Office, 2014). 22

[39]Portescap Motor, See https://www.portescap.com/products/brushless-dc-motor/22ect35-ultra-ec-slotless-brushless-dc-motor for information about motors and gearheads used in examples.

[40]T. Hemsel, M. Mracek, J. Twiefel, and P. Vasiljev, Ultrasonics 44, e591 (2006).

[41]T. Ueno, Z. G. Zhang, and T. Higuchi, Adv. Robot. 24, 1423 (2010).

[42]M. Pramoth Kumar, K. Akash, and M. Venkatesan, IOP Conf. Ser. Mater. Sci. Eng. 149, 012221 (2016).

[43]V. Arakelian, J.-P. Le Baron, and M. Mkrtchyan, Proc. Inst. Mech. Eng. Part K J. Multi-Body Dyn. 230, 379 (2016).

[44]S. Qian, J. Ling, Y. Hwang, R. Radermacher, and I. Takeuchi, Int. J. Refrig. 56, 65 (2015). 2

[45]F. Auricchio and R. L. Taylor, Comput. Methods Appl. Mech. Eng. 143, 175 (1997).

[46]H. Hou, P. Finkel, M. Staruch, J. Cui, and I. Takeuchi, Nat. Commun. 9, 4075 (2018).

6. Supplementary Material for Section IV. F.

Supplementary material relates to finite element analysis of the regenerator structure discussed in this Section.

A. Finite Element Models, Case 1

For finite element analysis we used Comsol Multiphysics, Structural Mechanics, static model, 2D plane strain model, with included geometric nonlinearities in solver. We compared 2D models against a full 3D model and the results were within 8% with expected discrepancies due to spaces between the plates (1 mm) in the 3D model which are not accounted for in the 2D model. 2D model results are presented in the figures and tables (see FIGS. 46-48 and 50A-C).

B. Finite Element Models, Case 2

Comsol Multiphysics, Structural Mechanics, static model, 2D plane strain model, included an initial strain of 2% in the NiTi plates. The modulus for Case 2 is lower than Case 1 because the NiTi material is operating in its superelastic region as shown in FIG. 42 discussed above.

What is claimed is:

1. A method of producing and harvesting an elastocaloric effect from an elastocaloric material for heating or cooling applications that add or subtract heat to or from another system comprising:

a. physically coupling a thinner and shorter strip or patch of elastocaloric material having a length and thickness to or along a portion of a thicker and longer elongated bendable base member to form a composite structure having a neutral plane inside and along the elongated base member with the thinner and shorter strip or patch spaced from the neutral plane, the base member having a thermal conductivity that limits amount of heat transferred from the strip or patch to the base member to increase addition or subtraction of heat from the another system, the strip or patch having at least a portion of one side at least partially exposed along the elongated base member for harvesting elastocaloric effect to the another system;

b. subjecting the composite structure to directly applied actuating forces or moments to induce bending moments in the thicker and longer elongated base member to, in turn, create stresses in the thinner and shorter strip or patch along the elongated base member because of its offset from the neutral plane during bending of the elongated base member; and c. controlling the bending moments in the elongated base member with the actuating forces or moments on the elongated base member to promote purely or predominantly uniform and exclusive tensile and/or purely or predominantly uniform and exclusive compressive stresses in the thinner and shorter strip or patch of elastocaloric material with lower actuating forces and increase displacement compared to axially tensioning or compressing to generate an elastocaloric effect response from the elastocaloric material of the composite structure, and harvesting from the at least partially exposed portion of the elastocaloric material elastocaloric effect to add or subtract heat for use in the heating or cooling application for the other system.

2. The method of claim 1 wherein:

a. the elongated base member comprises a bending beam with opposite ends and opposite sides comprising inner and outer spans along the neutral plane;

b. the actuating forces comprise four-point bending with two load points located along the inner span, and two load points located along the outer span so that applying equal and opposite forces to the inner span and outer span load points bends the composite structure, creating tensile strain at the outer span of the elongated base member and in the strip or patch of elastocaloric material.

3. The method of claim 2 wherein:

a. the bending beam has a cut-out on the outer span of the bending beam for access to the portion of one side at least partially exposed along the elongated base member;

b. the strip or patch of elastocaloric material is mounted across the cut-out; and c. the actuating forces are applied such that largely uniform tensile stress is imposed in the strip or patch of elastocaloric material in the region of the cut-out.

4. The method of claim 1 wherein:

a. the elongated base member comprises a bending beam with opposite ends and opposite sides comprising inner and outer spans along a longitudinal axis;

b. the actuating forces comprise three-point or four-point bending with two points located along the outer span, and one or two points located along the inner span so that applying equal and opposite forces to the inner span and outer span load points bends the composite structure, creating compressive stress at the side of the inner span of the elongated base member and in the strip or patch of elastocaloric material.

5. The method of claim 4 wherein:

a. the elastocaloric material is adhered to an inner space of the elongated base; and b. the actuating forces are applied such that largely uniform compressive stress is imposed in the strip or patch of elastocaloric material.

6. The method of claim 1 wherein:

a. the elongated base member comprises a bending beam with opposite fixed and free ends and opposite sides comprising inner and outer spans along a longitudinal axis, wherein the bending beam is cantilevered from the fixed end to the free end, the bending beam further comprising mounting surfaces on one or both of the inner and outer spans of the bending beam at or near the fixed end;

b. the strip or patch of elastocaloric material comprises one or more elastocaloric layers wherein said strip or patch of elastocaloric material is mounted to at least one of the mounting surfaces of the bending beam and stress is imposed in the strip or patch of elastocaloric material when the bending beam bends;

c. the actuating forces are at or near the free end of the bending beam so that the whole bending beam bends and stress is imposed on the one or more elastocaloric layers of the strip or patch of elastocaloric material on one or more of the inner and outer spans.

7. The method of claim 6 wherein said strip or patch of elastocaloric material is mounted to both of the mounting surfaces of the bending beam and stress is imposed in the strip or patch of elastocaloric material when the bending beam bends.

8. The method of claim 1 wherein:

a. the elongated base member comprises one or more layers, each of the one or more layers comprising a piezoelectric or electrostrictive material;

b. the actuating force comprises bending of the one or more piezoelectric or electrostrictive material upon application of an electric field based on differential strain (i) between the one or more piezoelectric or electrostrictive layers and the strip or patch of elastocaloric layer or (ii) if the piezoelectric or electrostrictive material comprises two or more layers, between the two or more layers of piezoelectric or electrostrictive layers, which also bends the elastocaloric material to induce elastocaloric effect in the strip or patch of elastocaloric material in one of predominantly compression or predominantly tension mode.

9. The method of claim 1 wherein:

a. the strip or patch of elastocaloric material is in the form of a strip, layer, layer of particles, layer of flakes, layer of fibers, or layer of wires and comprises:

i. a metallic alloy that exhibits superelasticity;

ii. a metallic alloy that exhibits stress-induced caloric effect;

iii. an inorganic compound that exhibits stress-induced caloric effect;

iv. an organic compound that exhibits stress-induced caloric effect; or v. a polymer, natural or synthetic, that exhibits stress-induced caloric effect; and b. the elongated base member is in the form of a bending beam comprising a layer or a plurality of layers, and further comprises:

i. a plastic;

ii. a carbon fiber material;

iii. a glass fiber material;

iv. a composite material;

v. a metal;

vi. a shape memory alloy;

vii. a low thermal conductive material to reduce heat transferred to the bending beam;

viii. a piezoelectric or electrostrictive material; or ix. any combination of the above materials; and c. the strip or patch of elastocaloric material is physically coupled, at least at two points, to the bending beam by:

i. clamping, ii. adhesion, iii. insertion, iv. implantation, v. embedment, or vi. joining.

10. The method of claim 1 wherein:

a. the actuating forces are a fraction of forces required to induce an equivalent elastocaloric effect compared to creating compression or tension in the length of the strip or patch of elastocaloric material by axial loading, and the actuating forces are controlled as to one or more of:

i. amount;

ii. direction;

iii. length of time of application;

iv. rate of application;

v. frequency of application; and vi. location of loading and/or supporting points.

11. The method of claim 1 wherein the controlling of actuation comprises controlling one or more of:

i. amount of the actuating forces;

ii. direction of the actuating forces;

iii. rate of the actuating forces;

iv. length of time of application of the actuating forces; and v. frequency of application of the actuating forces; and further comprising operatively connecting an interface to harvest the elastocaloric effect from the strip or patch of elastocaloric material and make the harvested elastocaloric effect available in the heating or cooling application.

12. The method of claim 11 wherein the heating or cooling application comprises:

a. a heat pump application.

13. The method of claim 12 wherein the heat pump application comprises a regenerative heat exchange system wherein coordination of the application of the actuating forces with a fluid flow achieves regenerative heat exchange to create the heat pump.

14. The method of claim 1 wherein:

a. the elongated base member comprises a bending beam with opposite fixed and free ends and opposite sides, wherein the bending beam is cantilevered from the fixed end to the free end, the bending beam further comprising mounting surfaces on one or both opposite sides of the bending beam at or near the fixed end;

b. the actuating forces are transverse to and at or near the free end of the bending beam so that the whole bending beam bends and stress is imposed on the opposite sides of the bending beam, and c. said strip or patch of elastocaloric material is mounted to at least one of the mounting surfaces of the bending beam and stress is imposed in the strip or patch of elastocaloric material when the bending beam bends.

15. The method of claim 14 wherein said strip or patch of elastocaloric material is mounted to both of the mounting surfaces of the bending beam and stress is imposed in the strip or patch of elastocaloric material when the bending beam bends.

16. The method of claim 1 wherein:

a. the strip or patch of elastocaloric material is in the form of a strip, layer, layer of particles, layer of flakes, layer of fibers, or layer of wires and comprises:

i. a metallic alloy that exhibits superelasticity;

ii. a metallic alloy that exhibits stress-induced caloric effect;

iii. an inorganic compound that exhibits stress-induced caloric effect;

iv. an organic compound that exhibits stress-induced caloric effect; or v. a polymer, natural or synthetic, that exhibits stress-induced caloric effect; and b. the base member is in the form of a bending beam, a layer, or a plurality of layers and comprises:

i. a plastic;

ii. a carbon fiber material;

iii. a glass fiber material;

iv. a composite material;

v. a metal;

vi. a shape memory alloy;

vii. a low thermal conductive material to reduce heat transferred to bending beam;

viii. a piezoelectric or electrostrictive material; or ix. any combination of the above materials; and c. the elastocaloric material is physically coupled, at least at two points, to the base member by:

i. clamping, ii. adhesion, iii. insertion, iv. implantation, v. embedment, or vi. joining.

17. The method of claim 1 wherein the elastocaloric effect response from the strip or patch of elastocaloric material of the composite structure is operatively connected to at least one of:

a. a heat sink; and b. a heat exchanger.

18. The method of claim 17 wherein the heat sink is in proximity to the strip or patch of elastocaloric material.

19. The method of claim 18 wherein the actuating forces move the strip or patch of elastocaloric material into thermal contact with the heat sink.

20. The method of claim 18 wherein the heat exchanger comprises a regenerative heat exchanger.

21. The method of claim 20 wherein the regenerative heat exchanger comprises fluid conduits that cycle a heat transferring fluid at or near the strip or patch of elastocaloric material and between cold and hot fluid reservoirs correlated with strain induced in the strip or patch of elastocaloric material to develop a temperature gradient along the strip or patch of elastocaloric material higher than adiabatic temperature change of the strip or patch of elastocaloric material.

22. The method of claim 17 wherein the heat exchanger is configured as a solid-state heat pump in combination with a refrigeration unit.

23. The method of claim 22 wherein the refrigeration unit comprises a residential or commercial refrigerator, freezer, refrigerator freezer, water chiller, fluid chiller, heat pump, or air conditioner.

24. The method of claim 1 further comprising physically coupling the strip or patch of elastocaloric material to the elongated base member by:

a. encapsulating the strip or patch of elastocaloric material in the elongated base member except for an opening in the elongated base member to the exposed portion of the strip or patch of elastocaloric material.

25. The method of claim 24 wherein the step of encapsulating comprises:

a. selecting a meltable polymer composite material for the elongated base member; and b. melting the polymer composite material around the strip or patch of elastocaloric material except for the opening.

26. The method of claim 25 wherein:

a. the strip or patch of elastocaloric material comprises NiTi; and b. the meltable polymer composite material comprises PEEK.

* * * * *